US010743694B2

(12) United States Patent
Raphael et al.

(10) Patent No.: US 10,743,694 B2
(45) Date of Patent: Aug. 18, 2020

(54) PACKAGE RECEIVING LOCKER

(71) Applicant: Securum Capsa, Inc., Los Angeles, CA (US)

(72) Inventors: Carlos Raphael, Los Angeles, CA (US); Jason Scott Altman, Los Angeles, CA (US); Jeff Harlan, Corona, CA (US)

(73) Assignee: Securum Capsa, Inc., Los Angeles, CA (US)

( * ) Notice: Subject to any disclaimer, the term of this patent is extended or adjusted under 35 U.S.C. 154(b) by 0 days.

(21) Appl. No.: 16/414,634

(22) Filed: May 16, 2019

(65) Prior Publication Data

US 2019/0350398 A1 Nov. 21, 2019

Related U.S. Application Data

(60) Provisional application No. 62/796,805, filed on Jan. 25, 2019, provisional application No. 62/673,070, filed on May 17, 2018.

(51) Int. Cl.
*A47G 29/14* (2006.01)

(52) U.S. Cl.
CPC ..... *A47G 29/141* (2013.01); *A47G 2029/144* (2013.01); *A47G 2029/145* (2013.01); *A47G 2029/149* (2013.01)

(58) Field of Classification Search
CPC .. A47G 29/141; A47G 29/16; A47G 29/1216; A47G 29/12; A47G 29/1214;
(Continued)

(56) References Cited

U.S. PATENT DOCUMENTS 1,256,112 A 2/1918 Clawson
1,673,769 A * 6/1928 Graham ..... G07C 13/02 220/6
(Continued)

FOREIGN PATENT DOCUMENTS

CN 2016179120 U 5/2017
EP 1396595 B1 3/2004
(Continued)

OTHER PUBLICATIONS

Cottner SmartBox See: http://www.cottnertechnologies.com (last visited on May 11, 2019).
(Continued)

*Primary Examiner* — William L Miller
(74) *Attorney, Agent, or Firm* — Eric Kelly

(57) ABSTRACT

Package-receiving-lockers (PRLs) may have a collapsible-locker portion and door-attachment-structure. PRLs may exist in a substantially collapsed configuration for storing the given PRL or for otherwise minimizing a footprint of the given PRL; and these PRLs may exist in a substantially deployed (expanded) configuration for acting as a secure object storage location. Regardless of configuration (deployed or collapsed), PRLs may be removably attached to side-hinged-doors with the door-attachment-structure, in such a way so as not to impair operation of the given door. The PRLs may have various electronics for facilitating access (e.g., locking and unlocking the collapsible-locker), delivery confirmation, and mitigating theft. These electronics, along with specialized software, may allow an intended recipient (e.g., a buyer), a shipper/delivery person (or shipping/deliver robot), and/or a seller/vendor to access the PRL in a controlled and documented manner. At least some of these electronics may be in wireless communications with other electronic devices.

68 Claims, 107 Drawing Sheets

(58) Field of Classification Search
CPC ..... A47G 2029/144; A47G 2029/145; A47G 2029/148; A47G 2029/149; B65D 7/26
USPC ..... 232/19, 17, 45, 34–36, 38, 39, 1 E; 220/6, 476
See application file for complete search history.

(56) References Cited

U.S. PATENT DOCUMENTS 1,915,980 A * 6/1933 Craft ..... A47G 29/12 232/19
2,098,469 A 3/1936 Smith
2,229,646 A * 1/1941 Firestone ..... A47G 29/1223 220/6
2,379,202 A 2/1944 Wagner
2,456,479 A * 12/1948 Antil ..... A47G 29/14 220/476
3,644,011 A 2/1972 MacDonald
3,814,220 A 6/1974 Brody
4,035,964 A 7/1977 Robinson
4,066,208 A 1/1978 Jones
4,091,950 A 5/1978 Craven
4,494,690 A 1/1985 Dupuis
4,579,401 A 4/1986 Mears
4,657,249 A 4/1987 Offutt
4,735,330 A 4/1988 Hoss
4,735,331 A 4/1988 Keenan
4,746,062 A 5/1988 Bartylla
4,901,912 A 2/1990 Pinard
4,944,422 A 7/1990 Aurness
5,150,834 A 9/1992 Bourke
5,161,709 A 11/1992 Destreich
5,253,763 A * 10/1993 Kirkley ..... B65D 19/16 206/600
D345,847 S 4/1994 Schuchard
5,299,704 A 4/1994 Thorby
5,433,375 A 7/1995 Warrick
5,544,619 A 8/1996 Braun
5,549,073 A 8/1996 Askins
5,624,071 A * 4/1997 Sosan ..... A47G 29/20 232/1 B
6,138,910 A 10/2000 Madruga
6,155,715 A * 12/2000 Lake ..... A47G 29/20 150/102
6,192,834 B1 2/2001 Kolozsvari
6,426,699 B1 * 7/2002 Porter ..... A47F 10/00 221/2
6,690,997 B2 2/2004 Rivalto
D487,347 S 3/2004 Felsenthal
6,719,195 B2 4/2004 Farentinos
7,004,344 B2 2/2006 Fulton
7,090,622 B2 8/2006 Hetrick
7,243,674 B2 7/2007 Devine
7,337,944 B2 3/2008 Devar
7,526,934 B2 5/2009 Conforti
7,657,466 B2 2/2010 Klingenberg
7,815,112 B2 10/2010 Volpe
7,891,034 B2 2/2011 Smith
7,988,035 B2 8/2011 Cox
D644,814 S * 9/2011 Clarke ..... D99/33
8,222,993 B2 7/2012 Bliding
8,334,765 B2 12/2012 Weinstein
8,413,831 B2 4/2013 Nolan
D707,472 S 6/2014 Wehner
D707,473 S 6/2014 Wehner
8,783,461 B2 7/2014 Hill
8,840,075 B2 9/2014 Dalebout
9,007,171 B2 4/2015 Yang
9,106,271 B2 8/2015 Metivier
9,211,025 B1 12/2015 Elhawwashy
9,364,112 B2 * 6/2016 Sundaresan ..... A47G 29/124
9,469,476 B1 10/2016 Ashoori
9,514,585 B2 12/2016 Ahearn
9,530,262 B2 12/2016 Johnson
9,530,295 B2 12/2016 Johnson
9,596,952 B2 * 3/2017 Mencel ..... A47G 29/20
9,619,955 B2 4/2017 Eichenblatt
9,624,695 B1 4/2017 Cheng
9,665,846 B2 5/2017 Gillen
9,679,429 B2 6/2017 Duncan
9,685,015 B2 6/2017 Johnson
9,685,018 B2 6/2017 Johnson
9,691,198 B2 6/2017 Cheng
9,741,186 B1 8/2017 Lemke
9,842,446 B2 12/2017 Vecchiotti
9,852,561 B2 12/2017 Dumas
9,861,221 B2 * 1/2018 Jiang ..... G06Q 10/0833
9,926,108 B2 * 3/2018 Wiley ..... B65D 33/00
9,965,934 B2 5/2018 Siminoff
10,083,561 B2 * 9/2018 Sundaresan ..... E05B 73/0011
10,143,321 B2 * 12/2018 Hippert ..... A47G 29/20
10,299,617 B1 * 5/2019 Castellanos ..... A47G 29/141
10,321,780 B1 * 6/2019 James ..... A47G 29/16
10,362,889 B2 7/2019 Dehner
2001/0040422 A1 * 11/2001 Gramlich ..... A47G 29/141 312/234
2002/0147919 A1 10/2002 Gentry
2002/0162883 A1 11/2002 Arvonio
2002/0178074 A1 11/2002 Bloom
2003/0006275 A1 * 1/2003 Gray ..... A47G 29/14 232/19
2004/0181570 A1 9/2004 Kaneko
2004/0256449 A1 * 12/2004 Stagnaro ..... A47G 29/12 232/28
2008/0004995 A1 1/2008 Klingenberg
2008/0236765 A1 10/2008 Sager
2009/0050072 A1 2/2009 Moser
2011/0284707 A1 11/2011 Adams
2012/0269461 A1 * 10/2012 Proctor ..... A47G 29/20 383/64
2013/0056998 A1 3/2013 Chincarini
2013/0284800 A1 10/2013 Gillen
2014/0190081 A1 7/2014 Wanjohi
2014/0258168 A1 9/2014 Crawford
2015/0120015 A1 4/2015 Fadell
2015/0186840 A1 7/2015 Torres
2016/0033966 A1 2/2016 Farris
2016/0051073 A1 * 2/2016 Heinz ..... A47G 29/141 232/39
2016/0068306 A1 * 3/2016 Heinz ..... B65D 21/086 220/560.01
2016/0309939 A1 10/2016 Mencel
2016/0331171 A1 * 11/2016 Jiang ..... G06Q 10/0833
2016/0374494 A1 12/2016 Geng
2017/0127868 A1 * 5/2017 Adewuyi ..... A47G 29/141
2017/0188737 A1 7/2017 Hippert
2018/0070753 A1 * 3/2018 Eveloff ..... H04W 12/08
2018/0082554 A1 3/2018 Siminoff
2018/0114420 A1 4/2018 Siminoff
2018/0114421 A1 4/2018 Siminoff
2018/0174413 A1 6/2018 Siminoff
2018/0228310 A1 * 8/2018 Enobakhare ..... A47G 29/1207
2018/0233010 A1 8/2018 Modestine
2018/0261060 A1 9/2018 Siminoff
2018/0268674 A1 9/2018 Siminoff
2019/0000255 A1 1/2019 Dehner

FOREIGN PATENT DOCUMENTS

EP 2835078 B1 2/2015
WO WO2001008078 A1 2/2001
WO WO2015100390 A1 7/2015
WO WO2016109838 A1 7/2016

OTHER PUBLICATIONS

Porch Pod See: https://www.theporchpod.com (last visited on Feb. 4, 2019).
eDor See: https://www.edordelivery.com/ (last visited on May 11, 2019).
Parcelhome.com See https://www.parcelhome.com (last visited on May 11, 2019).

(56) References Cited

OTHER PUBLICATIONS

DynoSafe See: http://dynosafe.com/ (last visited on May 14, 2019).
Landport See https://www.thelandport.com (last visited on May 14, 2019).
ElephantTrunk See: https://www.amazon.com/Architectural-Mailboxes-6950B-elephantrunk-Locking/dp/B0796K9692/ref=sr_1_3?keywords=elephant+trunk+mailbox&qid=1557877877&s=gateway&sr=8-3 (last visited on May 14, 2019).
BrizeBox See: www.brizebox.com (last visited on May 11, 2019).
BoxLock See: https://www.getboxlock.com (last visited on May 14, 2019).
Dropsak See: http://www.dropsak.com (last visited on May 11, 2019).
Package Guardian See: https://www.amazon.com/Package-Guardian-Anti-Theft-Home-Deliveries/dp/B076VVW4JR/ref=sr_1_2?keywords=package+guardian&qid=1557878448&s=gateway&sr=8-2 (last visited on May 14, 2019).
Package Panther See: https://www.amazon.com/Package-Panther-Protection-Fully-Lined-Instruction/dp/B075PXWNQU/ref=sr 1_1?keywords=package=panther&qid=1557878496&s=gateway&sr=8-1 (last visited on May 14, 2019).
The Original Porch Pirate Bag See: https://www.amazon.com/Original-Porch-Pirate-Bag-Shipping/dp/B01MF9W2l1/ref=pd_sbs_60_12?_encoding=UTF8&pd_rd_i=B01MF9W2l1&pd_rd_r=R42EH1F81NWYKZFC3RVK&pd_rd_w=XVjSo&pd_rd_wg=Lluim&,psc=1&refRID=R42EH1F81NWYKZFC3RVK (last visited on Dec. 29, 2017).
Collapsible crate See: https://www.officedepot.com/a/products/612392/Storex-Collapsible-File-Storage-Crate-14/ (last visited on May 11, 2019).
Folding cart See: https://www.officedepot.com/a/products/987304/Office-Depot-Brand-Mobile-Folding-Cart/ (last visited on May 11, 2019).
Folding cart See: https://www.officedepot.com/a/products/142842/Fusion-Cargo-Cart-41-H-x/ (last visited on May 11, 2019).
Amazon Locker See: https://www.amazon.com/b?ie=UTF8&node=6442600011 (last visited on May 14, 2019).
Package Guard See: https://www.amazon.com/Package-Guard-Sensor-Guaranteed-Protection/dp/B077915FYH/ref=pd_sbs_236_6?_encoding=UTF8&pd_rd_i=B077915FYH&pd_rd_r=8ARE7JGTSYRDEV37BA4N&pd_rd_w=zu6Ej&pd_rd_wg=zkN7h&psc=1&refRID=8ARE7JGTSYRDEV37BA4N (last visited on Dec. 29, 2017).
RTS Parcel Dropbox See: https://www.hayneedle.com/product/rtshomeaccentsparcelwirxdropbox.cfm?source=pla&kwid=Mailboxes%20newskus&tid=RTS105-1&adtype=pla&kw=&Isft=adtype:pla&gclid=EAlalQobChMl6fjNtoCp2AIVIshkCh1C3QKiEAQYFSABEgL9OPD_BwE (last visited on Dec. 29, 2017).
Mail Boss Locking Security Drop box See: https://www.officedepot.com/a/products/691082/Mail-Boss-Locking-Security-Drop-Box/?cm_mmc=Pla-_-Google-_-Mailing_Packing_Shipping-_-691082-VQ6-51194742236-VQ16-c-VQ17-pla-VQ18-online-VQ19-691082-VQ20-101647056356-VQ21--VQ22-624117016-VQ27-10575817556&mrkgc1=1104&mrkgadid=3115174695&rkg_id=h-10bf4f1e8739a8f00825dbc73e6637e3_t-151411.
QualArc Selma Locking Mail and Parcel Box See: http://www.bellacor.com/productdetail/qualarc-wf-pb018-selma-locking-mail-and-parcel-box-black-with-stainless-steel-1825962.htm?partid=googlePLA-DataFeed-Mlailboxes-1825962&kpid=1825962&k_id=735p873338&utm_source=google&utm_medium=cpc&utm_campaign=shopping%20_%20decor&utm_term=&utm_content=outdoor%20_%20mailboxes&kclickid=6a3897bf-.
Amazon Key See: http://www.amazon.com/key (last visited on May 14, 2019).
Ring (various products and services) See: https://ring.com/ (last visited on May 14, 2019).

* cited by examiner

PACKAGE RECEIVING LOCKER

PRIORITY NOTICE

The present application claims priority under 35 U.S.C. § 119(e) to U.S. Provisional Patent Application Ser. No. 62/673,070 filed on May 17, 2018, the disclosure of which is incorporated herein by reference in its entirety.

The present application claims priority under 35 U.S.C. § 119(e) to U.S. Provisional Patent Application Ser. No. 62/796,805 filed on Jan. 25, 2019, the disclosure of which is incorporated herein by reference in its entirety.

CROSS REFERENCE TO RELATED PATENT APPLICATIONS

The present application makes no reference to any other related filed patent applications.

STATEMENT REGARDING FEDERAL SPONSORSHIP

No part of this invention was a result of any federally sponsored research.

TECHNICAL FIELD OF THE INVENTION

The present invention relates in general to collapsible lockers and more specifically to collapsible lockers that may be attached to or located proximate to a door; and/or wherein such door mountable collapsible lockers may have various electronics components rendering the door mountable collapsible locker as a smart locker serving as a secure drop-off repository or as a secure pick-up repository.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Circa 2018, with the continued growth in shipments and deliveries of objects to residences and businesses, has been the parallel growth of the problem of "porch piracy"; wherein thieves, i.e., the "pirates" steal such objects delivered to the homes and businesses, typically because the given delivered object was dropped off by a carrier/shipper/delivery person in an unsecured manner.

The obvious solution of having a person to receive the delivery at the drop-off location (e.g., home or work) is simply not practical for many situations. One may be preoccupied at a time of delivery, being away (unavailable) from the drop-off site at a time of delivery, for a variety of reasons such as, being at work when delivery is expected at home or vice versa, being out of town, being on vacation, being indisposed (e.g., in the shower), etc.

Solutions other than having a person receive the delivery at the drop-off location generally have some form of enclosure at the drop-off location to receive the delivery into. To date these enclosure solutions have various other problems.

One such enclosure solution has been to install a bank of fixed and permanent lockers at a given drop-off location, i.e., various locker concierges, such as, but not limited to Amazon Locker. While this solution may be effective at the porch piracy problem, assuming the carrier/shipper complies and utilizes the bank of fixed and permanent lockers, this solution has a variety of other problems. In addition to the problem that such a bank of fixed and permanent lockers is very expensive to deploy, install, maintain, and use; there is the need for physical construction at the site for installing this bank of fixed and permanent lockers, which may include tying into an electrical power supply and communicating with network technologies. Construction means there must be sufficient physical space to accommodate installation of the given bank of fixed and permanent lockers; there must be local government approval (i.e., permits); installation requires expensive licensed contractors (e.g., electricians); there must be a sufficient budget to pay for the bank of fixed and permanent lockers as well as their construction and their subsequent maintenance; construction takes a significant amount of planning and time to implement; and there must an owner of the site to receive this installation who is willing and capable to undertake the project. Tenants and lessees, i.e., non-owners, would need permission from their given owner to make such construction modifications. This solution is likely not doable for a vast majority of single family residences, small businesses, tenants, and lessees because of such problems.

Another solution to the porch piracy problem has been to install effectively a pass-through specifically for deliveries at a given single family residence building or business building. Structurally, a pass-through may be very similar to a doggie door; and thus, have problems associated with doggie doors; e.g., that the pass-through may provide undesirable access to an interior of the building. This pass-through solution also has the same problems as the above bank of fixed and permanent lockers, such as, all the problems that go along with construction and retrofitting/modifying an existing building to have the pass-through.

Another solution to the porch piracy problem has been to replace an existing exterior access door with a new door with built in (integral) pass-through for deliveries. A disadvantage to this solution is the need to replace an existing exterior door. For example, tenants and lessees may not have permission to make a door replacement on the building they may be renting/leasing. Another problem, this solution may still require skilled crafts people (professional installers) to perform the replacement and installation. Also, the newly installed replacement door with pass-through may create problems with using the door as intended as an entry door for humans. For example, some expandable accordion pass-through structures may render a door effectively inoperable when expanded. And the newly installed replacement door with pass-through may be aesthetically unattractive, which may be a serious problem where the look of buildings is governed by local laws, CC&Rs, an HOA, and/or the like.

Another solution to the porch piracy problem has been to utilize a container/locker that is physically mounted to a porch/patio area outside of an exterior door. A fundamental problem with this approach is that the porch must have sufficient free space to accommodate a permanently mounted container/locker; and then once mounted, the porch is effectively now smaller due to the container/locker now permanently taking up some footprint of the porch/patio. Additionally, because there is mounting going on, professional installation may be necessary, which as noted above, is an additional undesirable cost. Additionally, if the permanently mounted container/locker does not match the existing décor, there may be compliance problems with local laws, CC&Rs, HOAs, and/or the like.

Another solution to the porch piracy problem has been to utilize a free-standing (non-mounted) container/locker on the porch/patio or proximate to the exterior access door. Regardless of sophistication of the container/locker lock, a fundamental problem with this solution is that the thief/pirate may simply just steal the entire free-standing container/locker because the free-standing container/locker is not anchored to the real estate/property/building/porch/patio.

Additionally, the currently used containers/lockers (whether free standing or permanently anchored to the porch/patio) have also been non-collapsible; that is, these containers/lockers only have a fully expanded/deployed configuration, which may always undesirably occupy some large footprint because they cannot be collapsed into a smaller footprint.

Another solution to the porch piracy problem has been to attach a package receiving bag, that has a lockable access opening, to an exterior access door (such as a front door). These bags are flexible/pliable, being made from fabric. These bags are attached to the given door via a strap. These bags have several problems. First, because the bag is flexible/pliable, it is easy to tell if the bag is empty or has package(s) in it; thus, a thief/pirate will have a positive visual indicator as to which bags should be attacked, i.e., the bags that look to have package(s) in them are targets for attack; whereas, with an opaque locker, the thief/pirate has no idea if there are any packages within. Secondly, these bags often hang from the top of the door, via their strap, which increases the bags visibility, compounding the first problem; but also because of hanging from the top of the door, the bag is considerably high off the ground making access to the bag difficult for both carriers/shippers and for the intended recipient, which may be compounded when the intended recipient is elderly, weak, and/or short. Additionally, due to the nature of being a bag versus a locker, the bag has the impression of being less strong and more flimsy, which may cause would be purchasers to look for an alternative solution that appears to be more secure.

Another solution to the porch piracy problem has been granting access to an interior of the building to the carrier/shipper when the owner, tenant, or lessees is not present. A fundamental concern with this solution, is that many owners, tenants, and lessees do not want (or cannot have) unsupervised strangers entering their respective buildings.

Another solution to the porch piracy problems has been to locate a "smart" scale on the porch/patio, designed to receive a package; and if the received package is then removed in an undesirable fashion (e.g., stolen) the reduction in weight on the scale may generate an alarm. This solution at best can only deter not prevent theft.

There is a need in the art for a solution to the porch piracy problem, but that does not have the problems of the existing porch piracy problems, some of which have been noted above.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe package-receiving-lockers (PRLs) with a collapsible-locker and with door-attachment-structure. These PRLs may exist in a substantially (mostly) collapsed configuration for storing the given PRL or for otherwise minimizing a footprint of the given PRL; and these PRLs may exist in a substantially (fully) deployed (expanded) configuration for acting as an object storage location that is secure (as drop-off location for receiving packages or as a pick-up location for outgoing shipments to be picked up by a given carrier/shipper). Regardless of configuration (deployed or collapsed), PRLs may be removably (or permanently, in some embodiments) attached to doors with the door-attachment-structure, and in some embodiments, in such a way so as not to impair operation of the given door. The PRLs may have various electronics for facilitating access (e.g., locking and unlocking the collapsible-locker), delivery confirmation, and mitigating theft. These electronics, along with specialized software, may allow an intended recipient (e.g., a buyer), a shipper/delivery person (or shipping/deliver robot), and/or a seller/vendor to access the PRL in a controlled, efficient, consistent, and documented manner. At least some of these electronics may be in wireless communications with other electronic devices. These PRLs may also be known as "SBLs" for smart-box-lockers.

It is an objective of the present invention to provide an affordable and cost-effective solution to the problem of "porch piracy."

It is an objective of the present invention to provide a substantially enclosed storage location (e.g., a given package-receiving-locker) that is secure (e.g., lockable) that may be removably attached to a given door.

It is another objective of the present invention to provide the given package-receiving-locker that may be removably attached to the given door so that the package-receiving-locker may not be removed from the door when the door is closed.

It is another objective of the present invention to provide the given package-receiving-locker that may be removably attached to the given door in a manner that does not substantially impair operation of that door, i.e., the door may be locked, opened, or closed normally, with the given package-receiving-locker still removably attached to that given door.

It is another objective of the present invention to provide the given package-receiving-locker that may have door-attachment-structure for the removable attachment to the given door.

It is another objective of the present invention to provide the given package-receiving-locker with door-attachment-structure for the removable attachment to the given door, wherein the door-attachment-structure may not harm the door.

It is another objective of the present invention to provide the given package-receiving-locker with door-attachment-structure for the removable attachment to the given door, wherein removably attaching the door-attachment-structure to the door is simple and does not require professional installation to accomplish.

It is another objective of the present invention to provide the given package-receiving-locker with door-attachment-structure for the removable attachment to the given door, wherein removably attaching the door-attachment-structure to the door is simple and does not require separate tools, screws, bolts, or nails to accomplish.

It is another objective of the present invention to provide the given package-receiving-locker that may be attached to the door closer to a hinge-side of the door than to a non-hinge-side of the door, as this may facilitate normal operation of the door.

It is another objective of the present invention to provide the given package-receiving-locker that may be attached to the door at or proximate to a bottom of the door.

It is another objective of the present invention to provide the given package-receiving-locker that may be attached to the door at or proximate to the bottom of the door so as to be closer to the ground than a middle of the door, with respect to a vertical direction, to make use of the package-receiving-locker easy for those who may be weak and/or short.

It is another objective of the present invention to provide the given package-receiving-locker that may be attached to the door at or proximate to a bottom half of the door, but without touching the ground, so as to be closer to the ground than a middle of the door, with respect to a vertical direction, to make use of the package-receiving-locker easy for those who may be weak and/or short.

It is another objective of the present invention to provide a given package-receiving-locker that may have a locker portion that is collapsible, designated as a collapsible-locker, wherein this may facilitate storage of the given package-receiving-locker when not in use; and/or generally to reduce the footprint of the given package-receiving-locker.

It is another objective of the present invention to provide a given package-receiving-locker that may exist in two configurations, a substantially (fully) deployed (expanded) configuration and a substantially collapsed configuration; wherein the substantially deployed configuration may be for using the collapsible-locker a secure storage location; wherein the substantially collapsed configuration may be for storing the package-receiving-locker or minimizing the footprint of the given package-receiving-locker. Collapsibility may also render the given package-receiving-locker readily movable (mobile) and may be easily transported to different location, different use locations, and/or different storage locations.

It is another objective of the present invention to provide a given package-receiving-locker that may be lockable in its substantially deployed configuration, to control access to the interior of the given package-receiving-locker.

It is another objective of the present invention to provide a given package-receiving-locker that may be lockable in its substantially collapsed configuration, to facilitate transport and mobility of the given package-receiving-locker while in this configuration.

It is another objective of the present invention to provide a given package-receiving-locker as a secure drop-off location that may be used to receive packages from carriers/shippers/delivery people (or carrier/shipper/delivery robots).

It is another objective of the present invention to provide a given package-receiving-locker as a secure pickup location that may be used to hold packages until pickup from carriers/shippers/delivery people (or carrier/shipper/delivery robots).

It is another objective of the present invention to provide a given package-receiving-locker wherein exteriorly visible panels and/or walls of the package-receiving-locker may be substantially opaque (not transparent, not see-through, not translucent), so that from the outside of the package-receiving-locker one may not know by looking at the package-receiving-locker if the package-receiving-locker has one or more objects inside.

It is another objective of the present invention to provide a given package-receiving-locker that may have various electronics for facilitating access to the collapsible-locker (e.g., locking and unlocking the collapsible-locker), delivery confirmation, pickup confirmation, and/or for mitigating theft.

It is another objective of the present invention to provide a given package-receiving-locker that may have various electronics, such as, but not limited to, electronic lock(s), motion sensor(s) (exterior and interior), accelerometer, GPS, interiorly oriented camera(s), exteriorly oriented camera(s), radar, sonar, pressure sensors, temperature sensors, scale(s), and/or the like, for facilitating access to the collapsible-locker (e.g., locking and unlocking the collapsible-locker), delivery confirmation, pickup confirmation, and/or for mitigating theft.

It is another objective of the present invention to provide a given package-receiving-locker that may have various electronics and utilize specialized software that may allow an intended recipient of a package (e.g., a buyer), a carrier/shipper/delivery person (or carrier/shipping/deliver robot), and/or a seller/vendor to access (unlock and/or lock) the PRL in a controlled, easy, consistent, and documented manner.

It is yet another objective of the present invention provide a given package-receiving-locker that may have various electronics, wherein at least some of these electronics of the given package-receiving-locker may be in wireless communications with other electronic devices (such as, smartphones and the like of various users of the package-receiving-locker).

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 3A may be an opposing view as compared to FIG. 2A, where both views may be showing the same package-receiving-locker in the same substantially collapsed configuration.

FIG. 18 and FIG. 19 may be reverse processes of each other.

(FIG. 22C and FIG. 22B may be opposing views.)

(FIG. 22F and FIG. 22E may be opposing views.)

(FIG. 23C and FIG. 23B may be opposing views.)

(FIG. 24C and FIG. 24B may be opposing views.)

(FIG. 26C and FIG. 26B may be opposing views.)

(FIG. 27C and FIG. 27B may be opposing views.)

(FIG. 28C and FIG. 28B may be opposing views.)

(FIG. 31D and FIG. 31C) may be opposing views.)

Figure 22A:
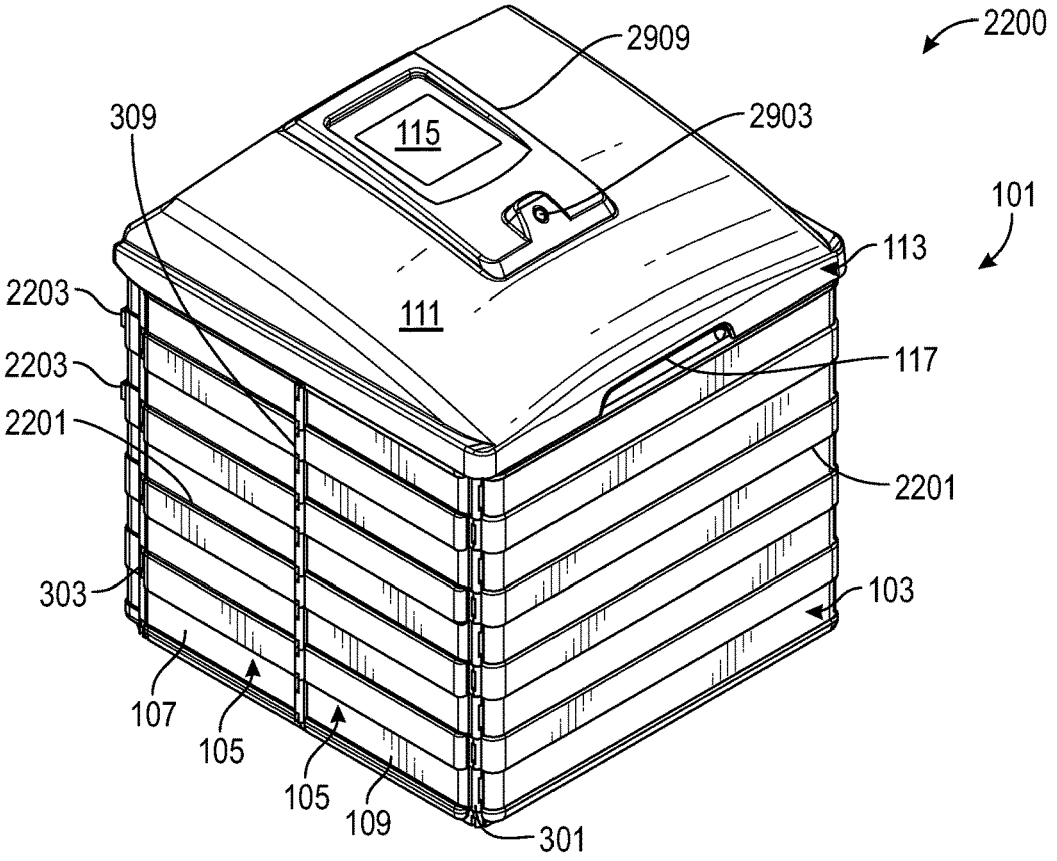
FIG. 22A may depict a front, left, top, perspective (isometric) view of a substantially (or fully) deployed package-receiving-locker.
Figure 33A:
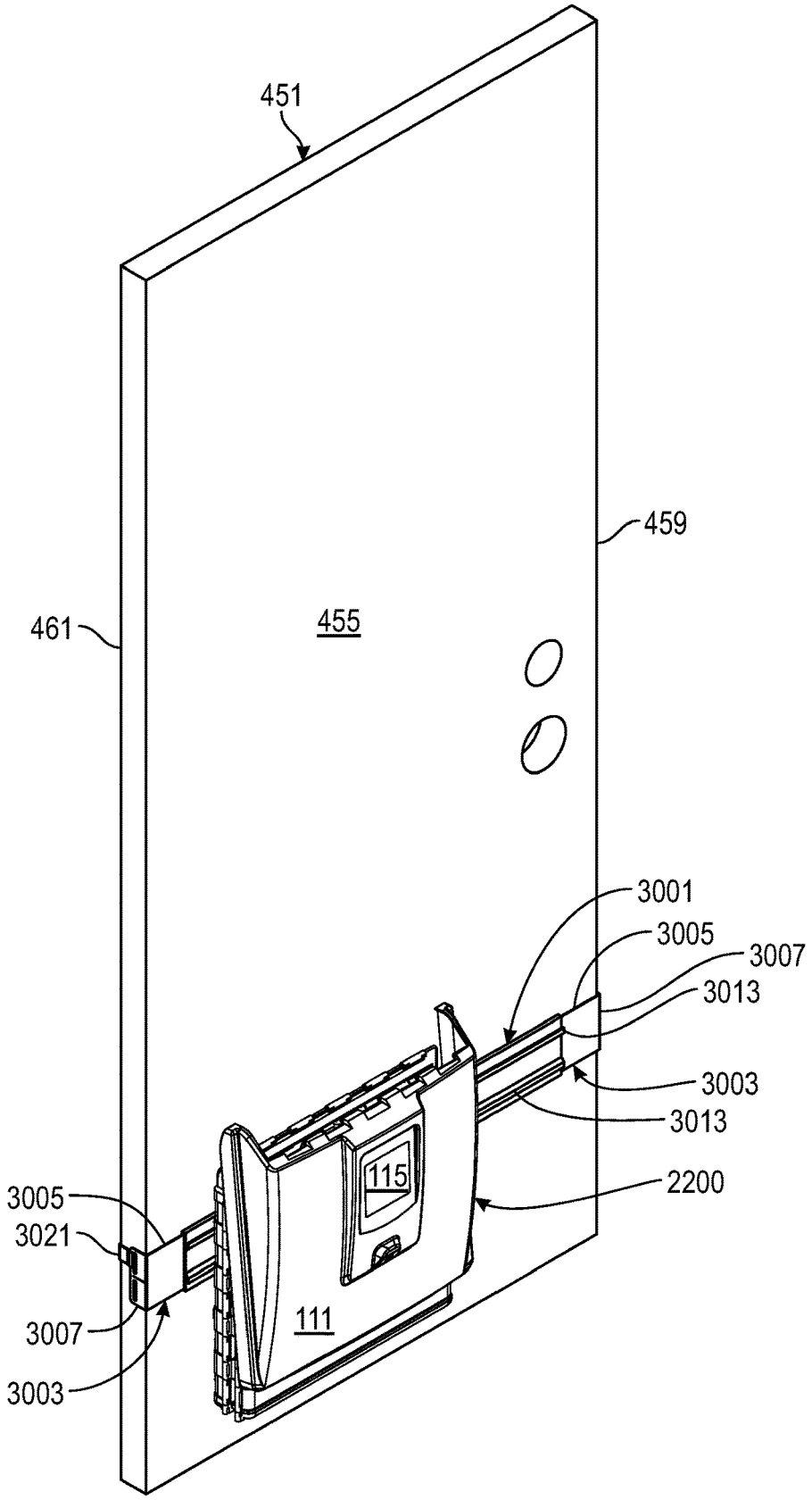

FIG. 33A may depict the door-attachment-structure attached to the door and wherein the door-attachment-structure may be attached to the package-receiving-locker of FIG. 22A (shown in its collapsed configuration), shown from a perspective view.

Figure 33B:
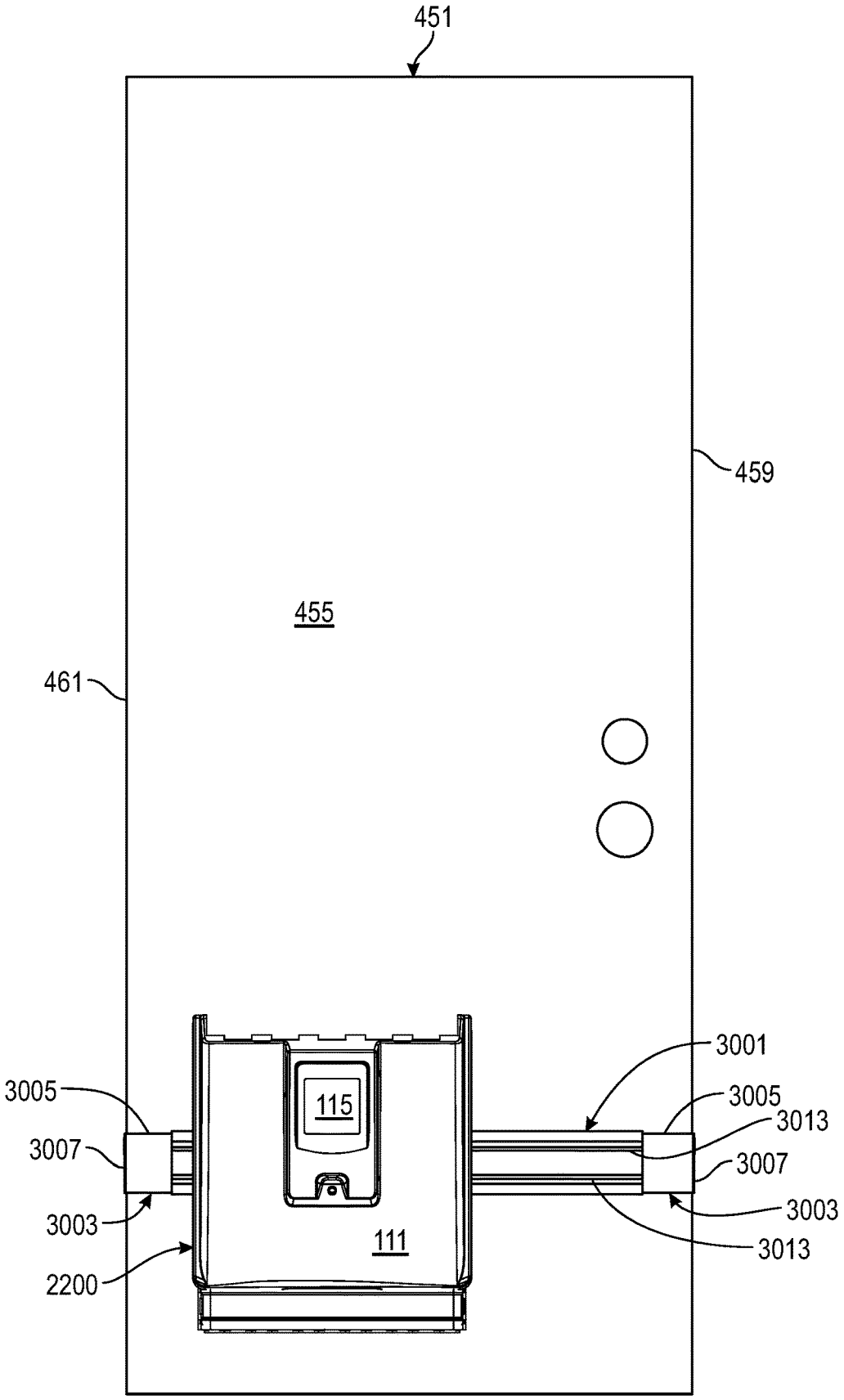

FIG. 33B may depict the door-attachment-structure attached to the door (e.g., showing a front/outside of the door) and wherein the door-attachment-structure may be attached to the package-receiving-locker of FIG. 22A, shown from a front view.

Figure 33C:
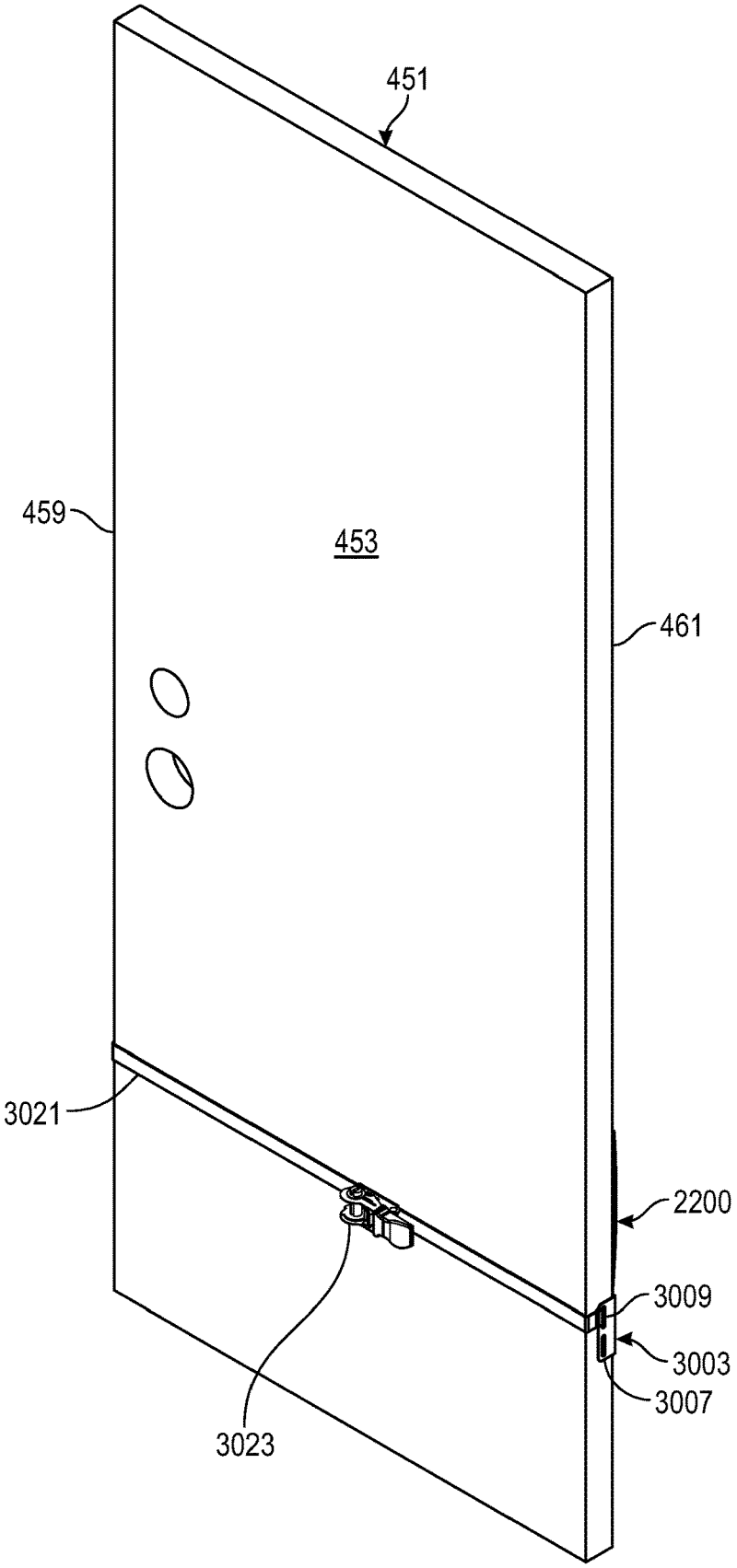

FIG. 33C may depict the door-attachment-structure attached to the door (e.g., showing the rear/inside of the door) and wherein the door-attachment-structure may be attached to the package-receiving-locker of FIG. 22A, shown from another perspective view.

Figure 33D:
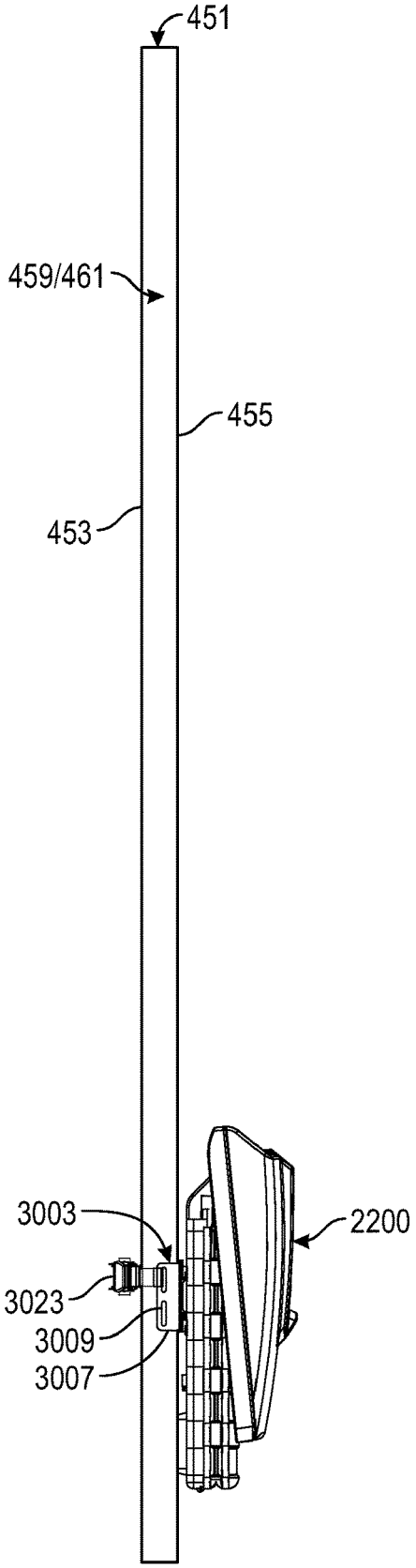

FIG. 33D may depict the door-attachment-structure attached to the door (e.g., showing a front/outside of the door) and wherein the door-attachment-structure may be attached to the package-receiving-locker of FIG. 22A, shown from a side view.

Figure 34A:
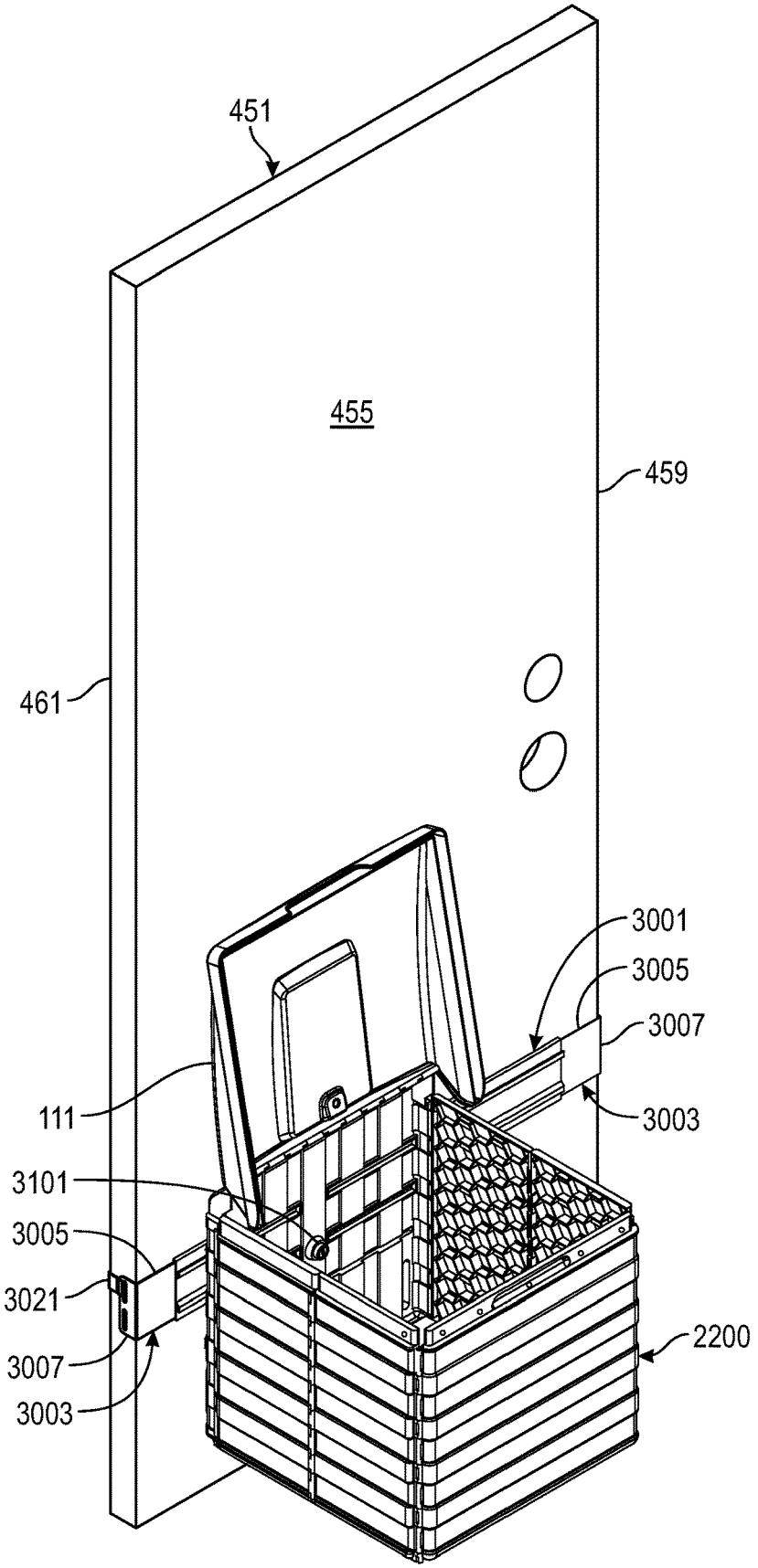

FIG. 34A may depict the door-attachment-structure attached to the door and wherein the door-attachment-structure may be attached to the package-receiving-locker of FIG. 22A (shown in its fully deployed configuration), shown from a perspective view.

Figure 34B:
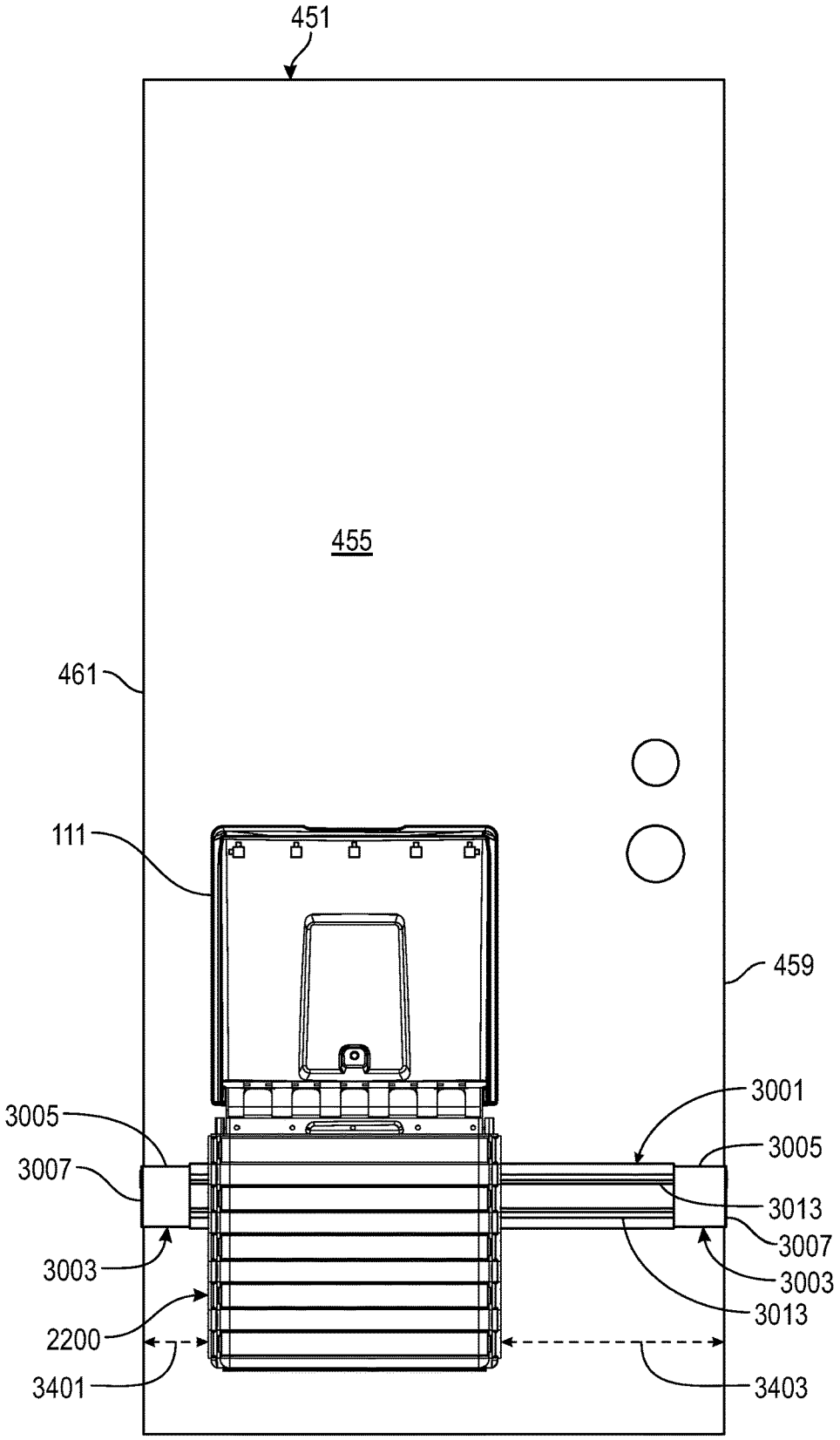

FIG. 34B may depict the door-attachment-structure attached to the door (e.g., showing a front/outside of the door) and wherein the door-attachment-structure may be attached to the package-receiving-locker of FIG. 22A, shown from a front view.

Figure 34C:
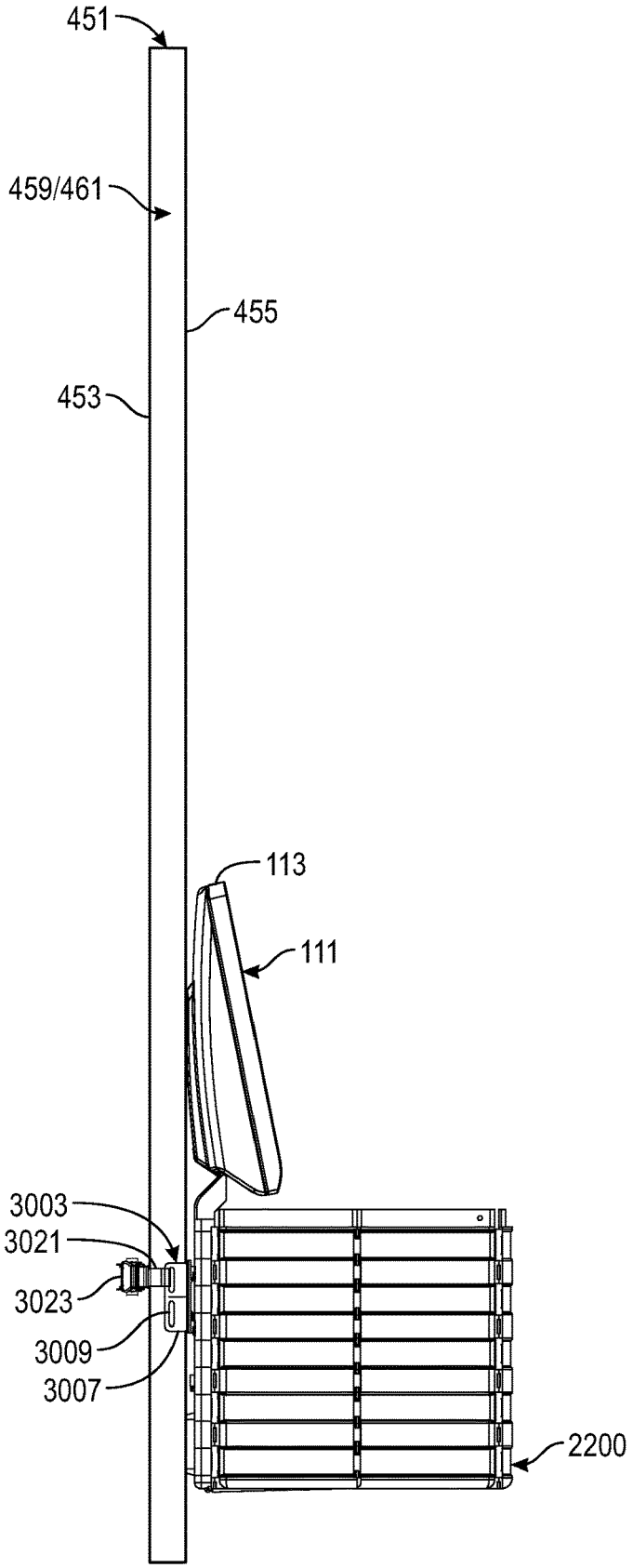

FIG. 34C may depict the door-attachment-structure attached to the door (e.g., showing the rear/inside of the door) and wherein the door-attachment-structure may be attached to the package-receiving-locker of FIG. 22A, shown from a side view.

Figure 35A:
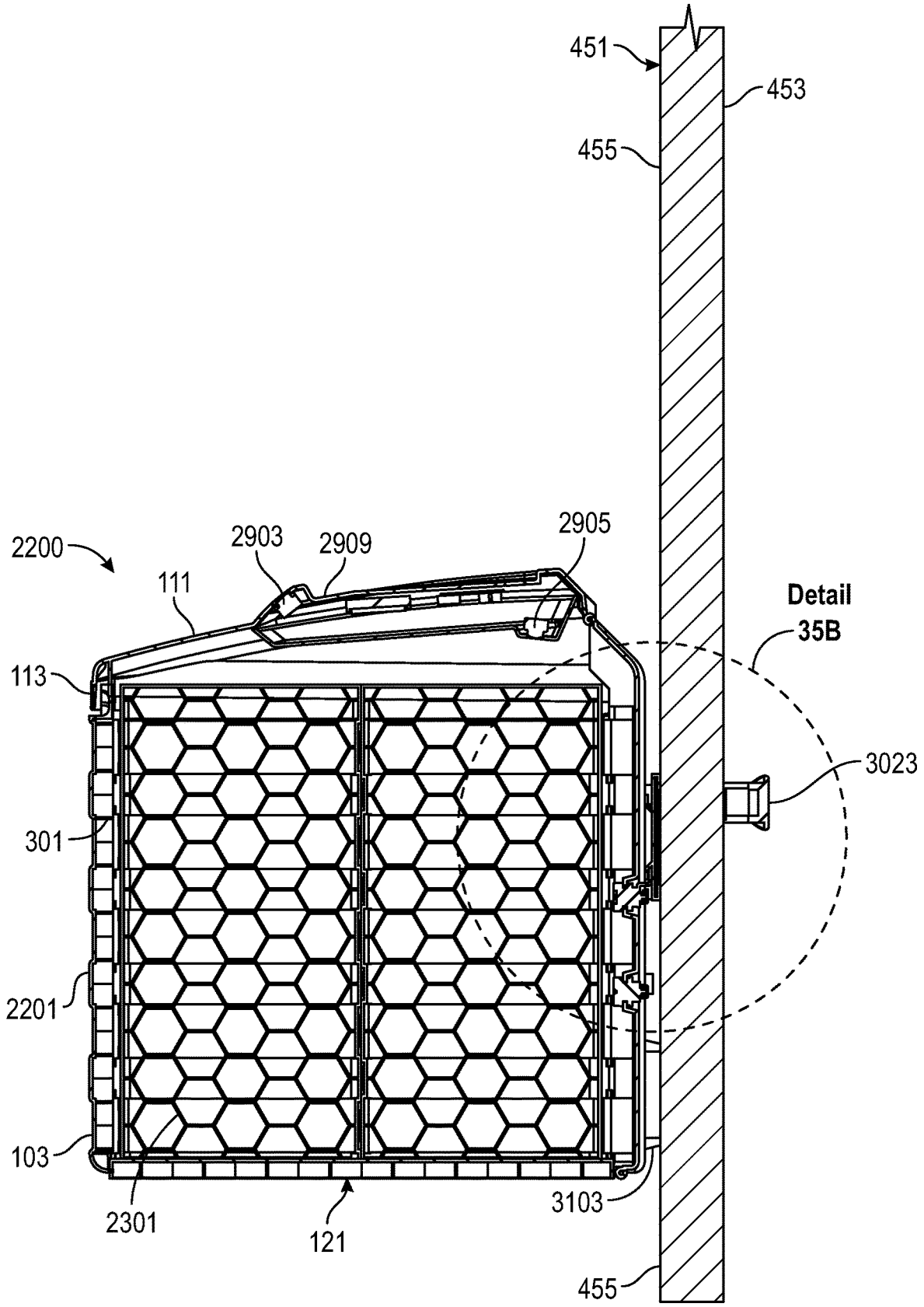

FIG. 35A may depict a cross-sectional view through the package-receiving-locker of FIG. 22A when the package-receive-locker may be attached to the door using the door-attachment-structure. FIG. 35A may similar to cross-sectional view FIG. 25B, except that in FIG. 35A both the door-attachment-structure and the door may also be shown. FIG. 35A may also depict a detail region denoted as Detail 35B.

Figure 35B:
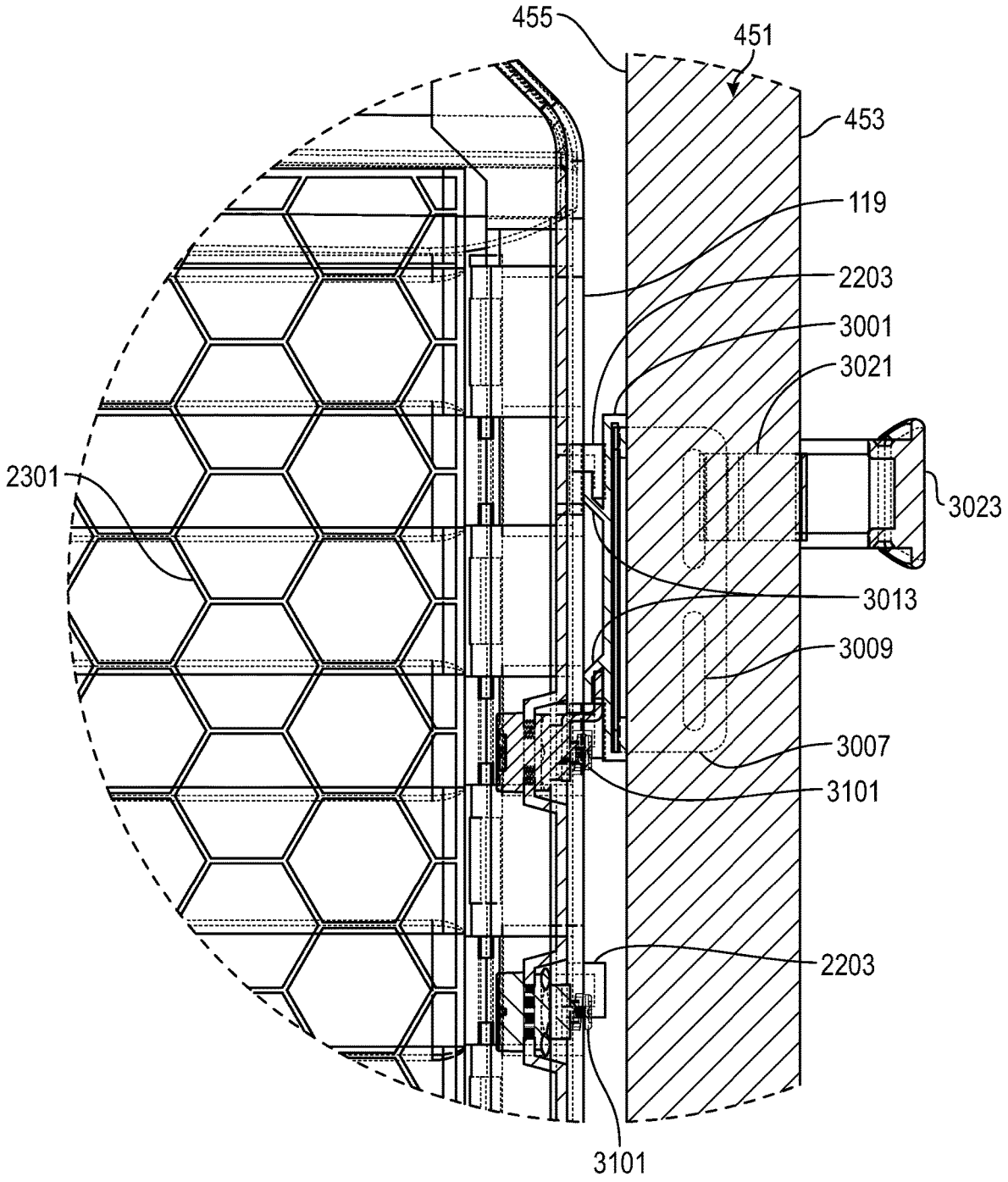

FIG. 35B may be an enlarged view of Detail 35B.

Figure 36A:
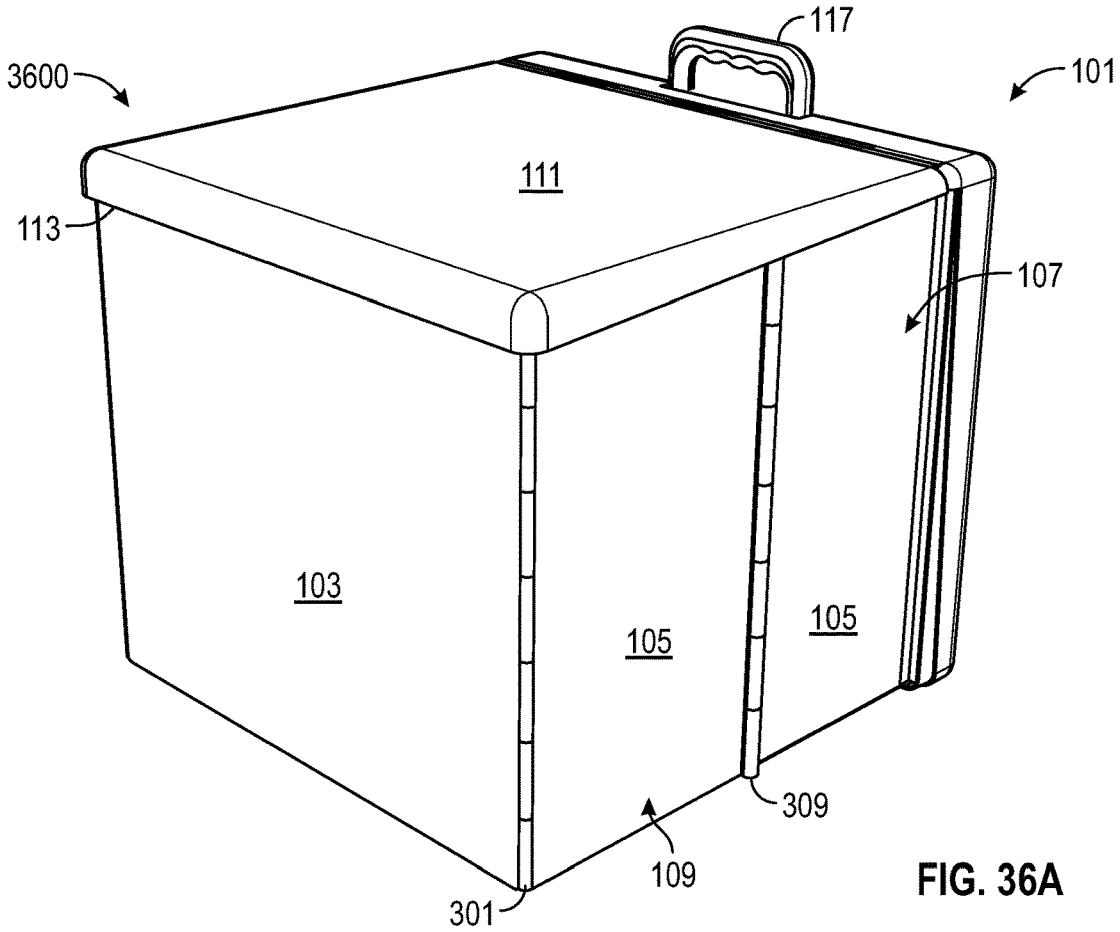

FIG. 36A may depict a front, right, top, perspective (isometric) view of a package-receiving-locker, shown in the fully deployed configuration.

Figure 36B:
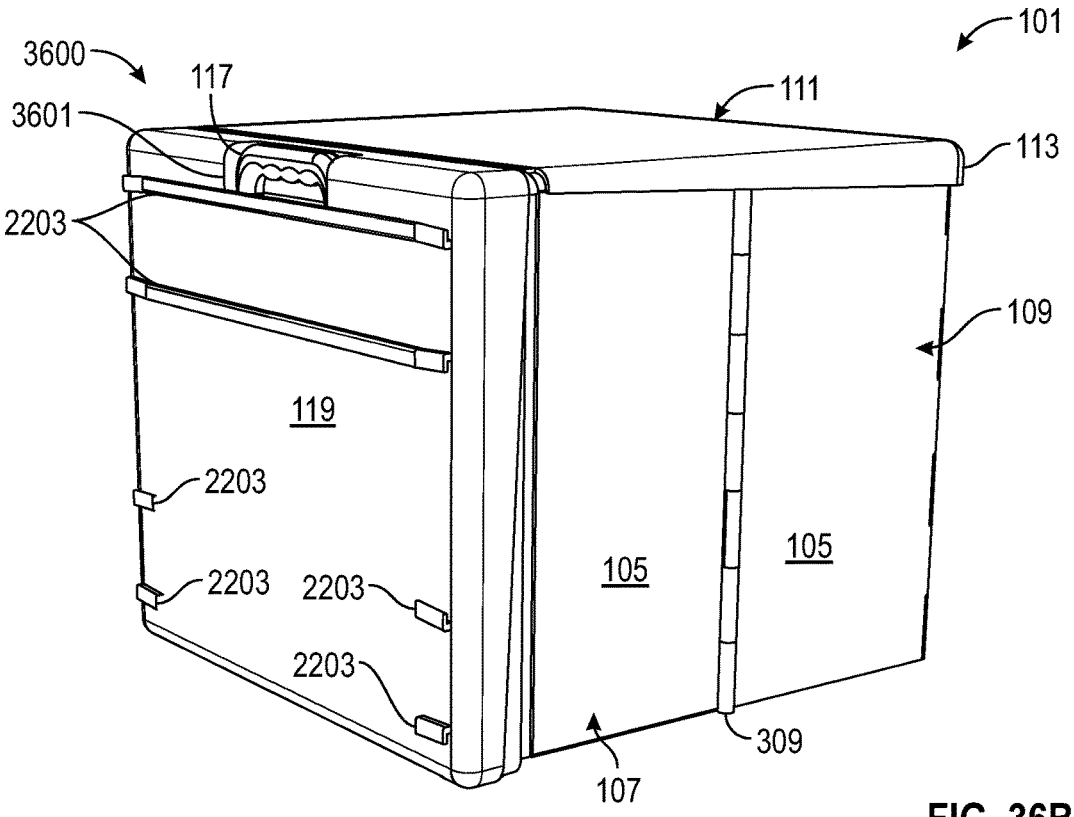

FIG. 36B may a rear, left, top, perspective (isometric) view of the package-receiving-locker of FIG. 36A.

Figure 36C:
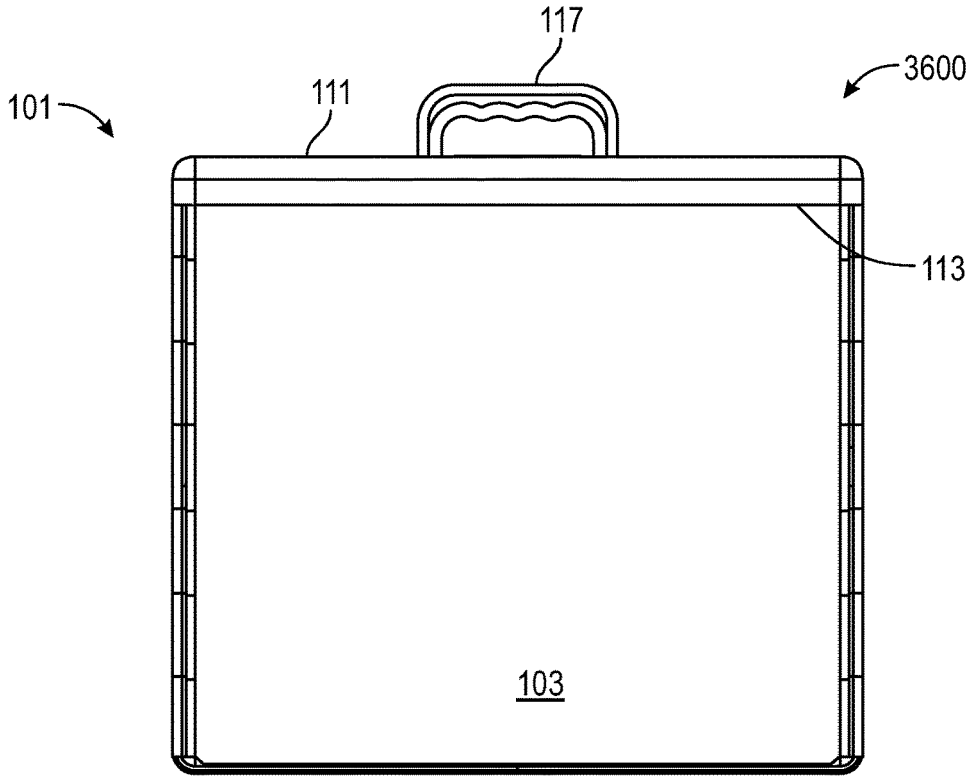

FIG. 36C may depict a front view of the package-receiving-locker of FIG. 36A.

Figure 36D:
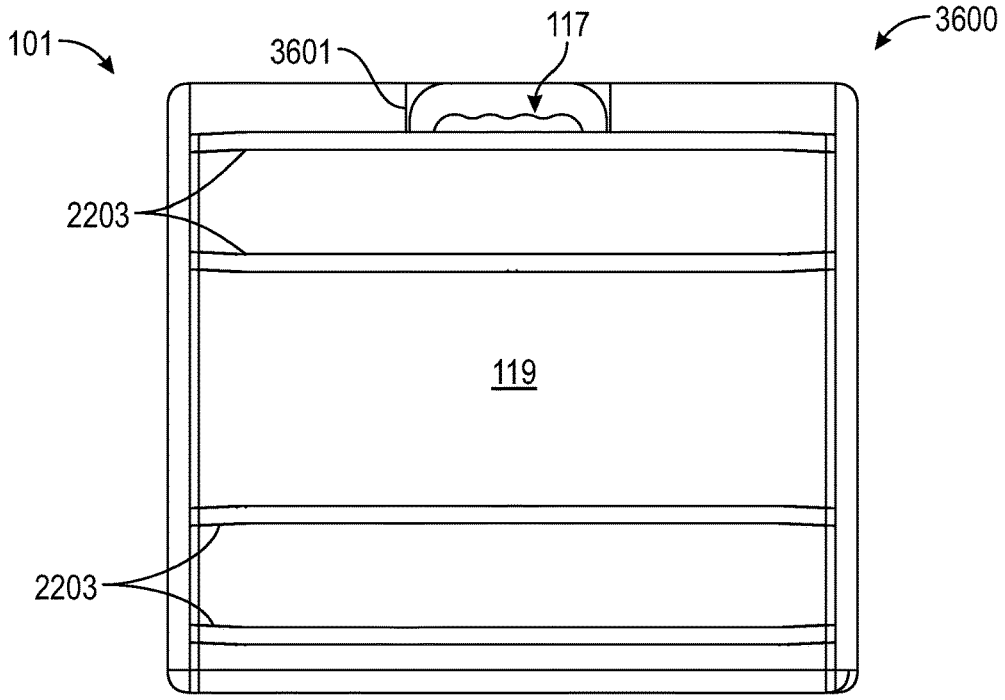

FIG. 36D may depict a rear (back) view of the package-receiving-locker of FIG. 36A. (FIG. 36D and FIG. 36C) may be opposing views.)

Figure 36E:
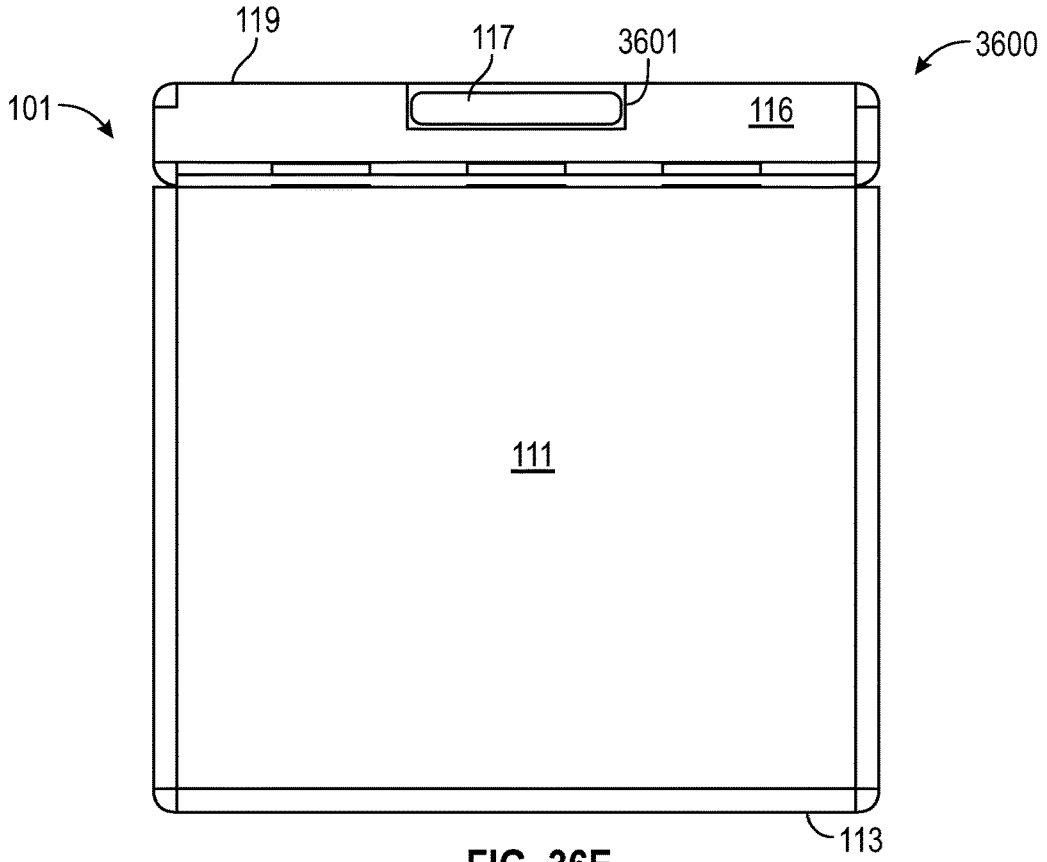

FIG. 36E may depict a top view of the package-receiving-locker of FIG. 36A.

Figure 36F:
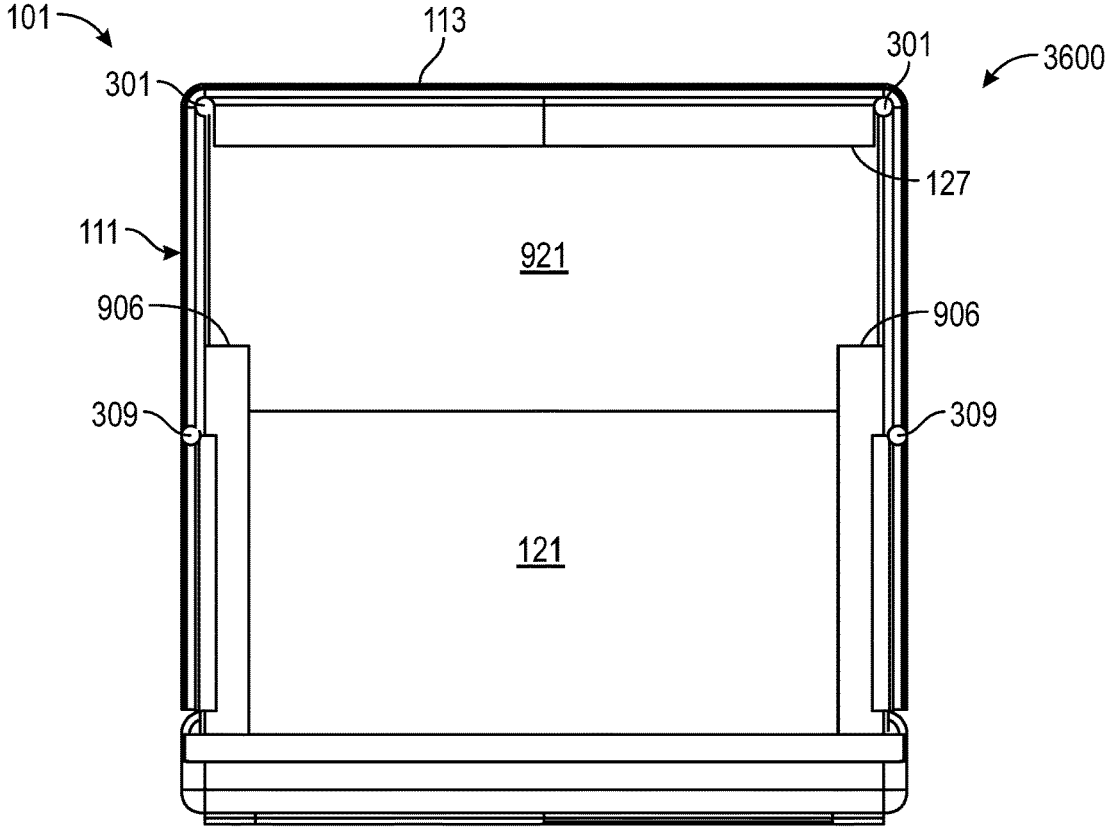

FIG. 36F may depict a bottom view of the package-receiving-locker of FIG. 36A. (FIG. 36F and FIG. 36E) may be opposing views.)

Figure 36G:
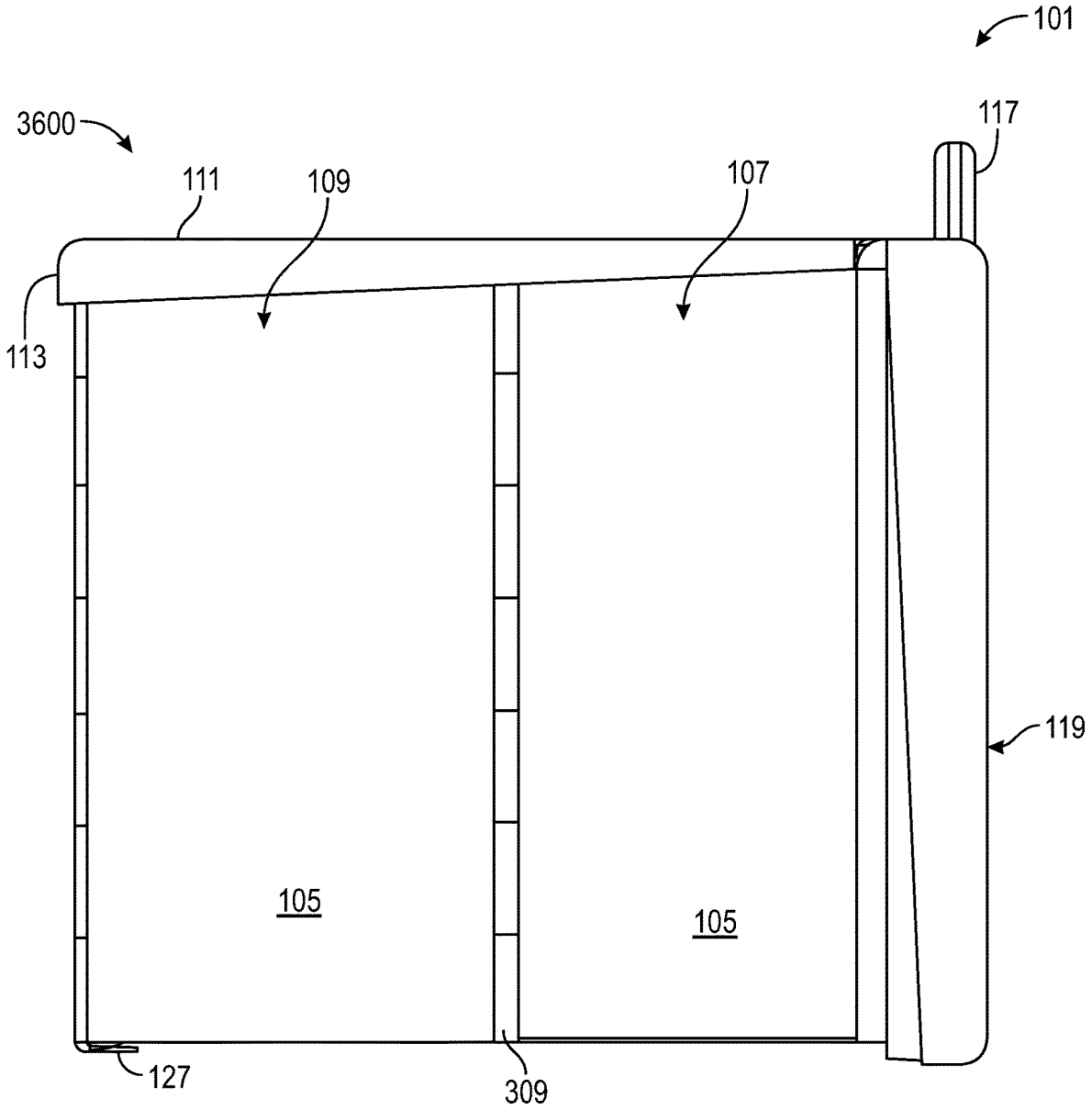

FIG. 36G may depict a side view (left or right) of the package-receiving-locker of FIG. 36A. (Side views may be substantially similar or identical.)

Figure 37:
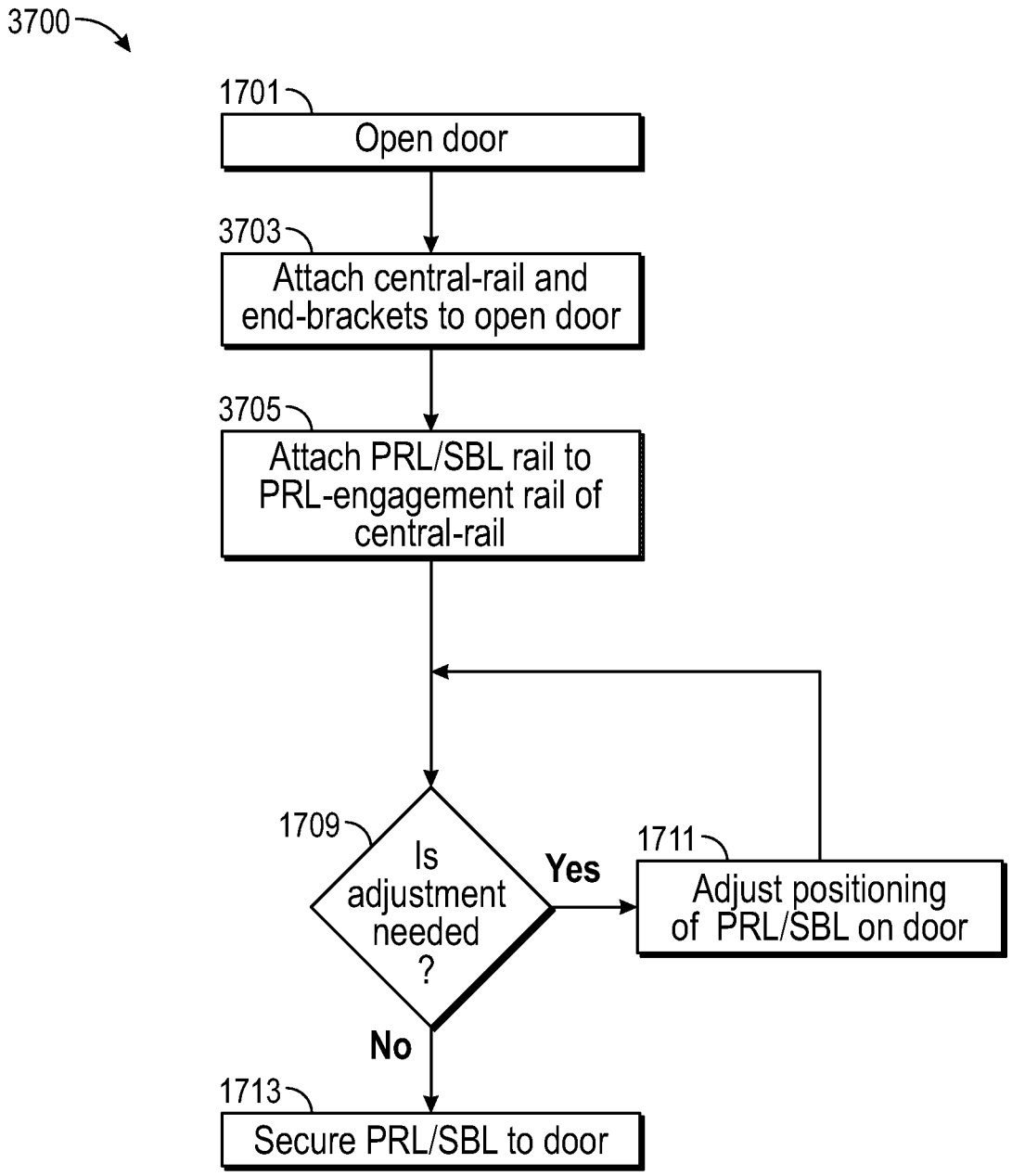

FIG. 37 may be a flow diagram showing at least some steps of how a given package-receiving-locker may be removably attached to a given door.

REFERENCE NUMERAL SCHEDULE

100 package-receiving-locker 100
101 collapsible-locker 101
103 front-wall 103
105 side-wall 105
107 side-wall-panel-closer-to-rear-wall 107
109 side-wall-panel-closer-to-front-wall 109
111 lid 111
113 lid-overhang 113
115 exterior-interface 115
116 top-panel 116
117 handle 117
119 rear-wall 119
121 floor 121
123 floor-hole 123
125 logo-display-region 125
127 floor-support 127
151 door-attachment-structure 151
153 bottom-door-bracket 153
155 adjustment-screw 155
157 pivoting J-hook 157
159 sliding J-hook 159
161 J-hook-receiver 161
163 J-hook-attachment-hardware 163
165 J-hook-slot 165
301 front-side-hinge 301
303 rear-side-hinge 303
305 lid-hinge 305
307 top-rear-hinge 307
309 side-hinge 309
311 bolt 311
313 housing 313
315 bolt-receiver 315
321 opening-to-interior 321
401 curve-away 401
403 receiving-gap 403
405 protective-covering 405
407 protective-covering 407
451 door 451
453 door-inside 453
455 door-outside 455
457 door-bottom 457
459 non-hinge-side 459
461 hinge-side 461
603 front-wall-interior 603
605 side-wall-interior 605
607 bottom-hinge 607
615 interface-housing 615
619 rear-wall-interior 619
621 kickstand 621
623 kickstand-housing 623
625 kickstand-housing-receiver 625
627 spring 627
629 pin 629
711 lid-interior 711
900 package-receiving-locker 900
905 side-panel 905
906 ledge 906
921 distal-floor 921
922 joiner 922
923 bottom-panel 923
951 input 951
1005 side-panel-hole 1005
1006 lock 1006
1022 pull 1022
1024 anchor 1024
1026 bracket 1026
1115 bolt-receiver 1115
1301 kickstand-assembly 1301
1311 landing 1311
1315 step-top 1315
1401 non-hinge-side-wall 1401
1403 hinge-side-wall 1403
1405 too-close-locker 1405
1407 too-wide-locker 1407
1409 too-deep-locker 1409
1500 computing-device 1500
1501 Processors 1501
1503 Memory 1503
1505 I/O for External Communications 1505
1507 I/O Means 1507
1509 power-supply 1509
1511 GPS-module 1511
1601 first-user-computing-device 1601
1603 second-user-computing-device 1603
1605 Server 1605
1607 Admin-Device 1607
1609 internet/network/WAN/LAN 1609
1700 method of attaching PRL/SBL to door 1700
1701 step of opening door 1701
1703 step of attaching bottom-door-bracket to bottom of open door 1703
1705 step of attaching first J-hook to side of open door 1705
1707 step of attaching second J-hook to side of open door 1707
1709 step of determining if positional adjustment needed 1709
1711 step of adjusting positioning of PRL/SBL on door 1711
1713 step of securing PRL/SBL to door 1713
1800 method of deploying PRL/SBL 1800
1801 step of unlocking lock 1801
1803 step of opening lid 1803
1805 step of extending front-wall away from rear-wall 1805
1807 step of placing floor 1807
1809 step of closing lid 1809
1900 method of collapsing PRL/SBL 1900
1901 step of unlocking lock 1901
1903 step of opening lid 1903
1905 step of placing floor towards rear-wall 1905
1907 step of pushing sides towards each other and pushing front-wall to rear-wall 1907
1909 step of closing lid 1909
2000 method of receiving object 2000
2001 step of generating temp-access-code 2001
2003 step of sending temp-access-code 2003
2005 step of receiving temp-access-code 2005
2007 step of determining if temp-access-code valid 2007
2008 step of sending access denied message 2008
2009 step of unlocking lock of PRL/SBL 2009
2011 step of receiving object inside of PRL/SBL 2011
2013 step of documenting object receival 2013
2015 step of sending evidence of object receival 2015
2017 step of receiving master-unlock-command 2017
2019 step of determining if master-unlock-command valid 2019
2020 step of sending access denied message 2020

2021 step of removing object from inside of PRL/SBL 2021
2023 step of documenting object removal 2023
2025 step of sending evidence of object removal 2025
2100 method of returning package 2100
2101 step of receiving package into PRL/SBL 2101
2200 package-receiving-locker 2200
2201 exterior-rib 2201
2203 rail 2203
2205 hole 2205
2301 interior-rib 2301
2501 pocket 2501
2901 PCB 2901
2903 exterior-camera 2903
2905 interior-camera 2905
2907 electronics cover 2907
2909 exterior-electronics-cover 2909
3000 door-attachment-structure 3000
3001 central-rail 3001
3003 end-bracket 3003
3005 insertable-portion 3005
3007 door-thickness-engagement-portion 3007
3009 aperture 3009
3011 end-bracket-receiving-slot 3011
3013 PRL-engagement-rails 3013
3021 strap 3021
3023 cam-ratchet 3023
3101 cam-lock 3101
3103 back-support 3103
3401 distance from SBL to hinge-side 3401
3403 distance from SBL to non-hinge-side 3403
3600 package-receiving-locker 3600
3601 handle-pocket 3601
3700 method of attaching PRL/SBL to door 3700
3703 step of attaching central-rail and end-brackets to open door 3703
3705 step of attaching PRL/SBL rail to PRL-engagement rail 3705

DETAILED DESCRIPTION OF THE INVENTION

Note "PRL" as used herein may refer to "package-receiving-locker" as package-receiving-locker 100 or package-receiving-locker 900.

Note "SBL" as used herein may refer to "smart-box-locker" and may refer to package-receiving-locker 100 or package-receiving-locker 900. That is, "PRL" and "SBL" may be used interchangeably.

Note "PRL," "package-receiving-locker," "package-receiving-locker 100," and "package-receiving-locker 900" should not be construed as being only applicable to packages. For example, and without limiting the scope of the present invention, "PRL," "package-receiving-locker," "SBL," "smart-box-locker," "package-receiving-locker 100," and "package-receiving-locker 900" may removably hold, store, and/or store one or more: objects, packages, parcels, mail, boxes, containers, articles, documents, bags, sacks, pouches, consumer goods, electronic devices, clothing, food, beverages, and/or the like.

Note "PRL," "package-receiving-locker," "package-receiving-locker 100," and "package-receiving-locker 900" should not be construed as being only applicable to "receiving." For example, and without limiting the scope of the present invention, "PRL," "package-receiving-locker," "SBL," "smart-box-locker," "package-receiving-locker 100," and "package-receiving-locker 900" may be used as a secure drop-off location for receiving shipments; as a secure pick-up location for outgoing shipments; as a secure storage location; and/or the like.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1A through FIG. 1H may show a package-receiving-locker 100 in a substantially deployed configuration from various views. In some embodiments, package-receiving-locker 100 may exist in four configurations. FIG. 1A through FIG. 1H may show package-receiving-locker 100 in one of these four configurations, the substantially (fully) deployed configuration for a collapsible-locker 101 subassembly of the given package-receiving-locker 100, i.e., with its various walls unfolded into a fully expanded (deployed) configuration. These walls may be collectively denoted as the at least one wall; and in some embodiments, the at least one wall may be rigid, firm, and/or not generally flexible, i.e., not like an elastomer or not like a fabric. In some embodiments, collapsible-locker 101 may also exist in a substantially collapsed configuration. This substantially collapsed configuration may be shown in FIG. 2A through FIG. 2G. In some embodiments, package-receiving-locker 100 may also be removably attached to a given door or not. Thus, these four configurations may be: fully deployed; substantially (fully) collapsed; removably attached to the given door; or not attached to the given door. In some embodiments, when collapsible-locker 101 may be deployed or collapsed, package-receiving-locker 100 may be removably attached to the given door or not. Note herein, collapsible-locker 101 may be also be denoted as collapsible-container 101, i.e., these two terms may be used interchangeably herein.

Figure 1A:
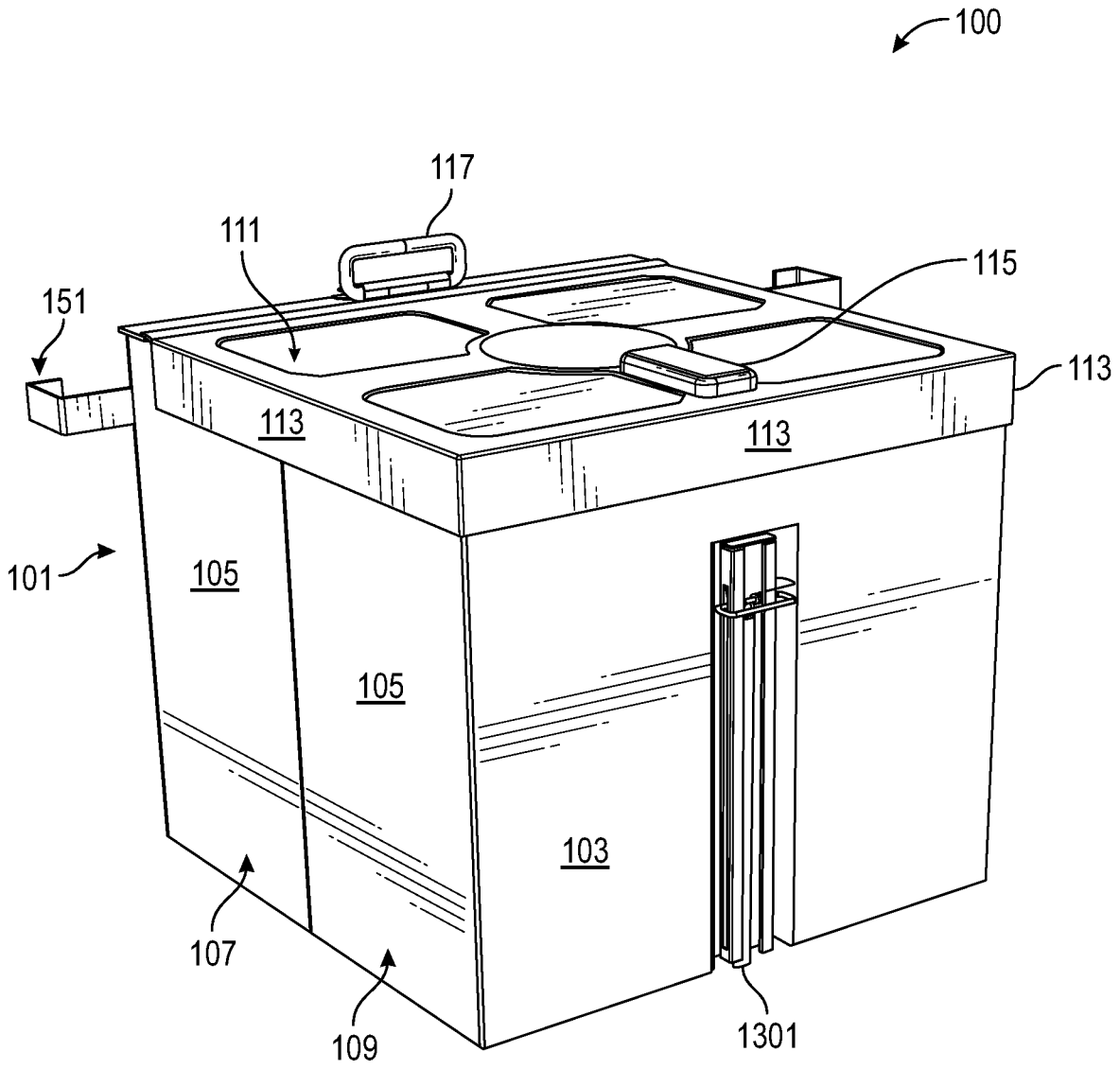
FIG. 1A may depict a front, left, top, perspective (isometric) view of a substantially (or fully) deployed package-receiving-locker.

FIG. 1A may depict a front, left, top, perspective (isometric) view of a deployed package-receiving-locker 100. In some embodiments, package-receiving-locker 100 may comprise a collapsible-locker 101 and door-attachment-structure 151. In some embodiments, collapsible-locker 101 when in its fully deployed configuration may be for the removable and/or temporary storage of at least one package in a locked, safe, and/or secure manner. In some embodiments, door-attachment-structure 151 may be physical geometry, structures, components, and/or hardware for removably attaching package-receiving-locker 100 to a given door. In some embodiments, at least portions of collapsible-locker 101 may be in communication with at least portions of door-attachment-structure 151. In some embodiments, the at least portions of collapsible-locker 101 may be physically contacting the at least portions of door-attachment-structure 151. In some embodiments, the at least portions of collapsible-locker 101 may be physically attached to the at least portions of door-attachment-structure 151. In some embodiments, the at least portions of collapsible-locker 101 may be physically removably attached to the at least portions of door-attachment-structure 151.

Continuing discussing FIG. 1A, in some embodiments, collapsible-locker 101, when fully deployed, may securely enclose a volume that may be substantially a void space when empty for the removable and/or temporary storage of at least one package (object) in a locked, safe, and/or secure manner. In some embodiments, collapsible-locker 101 may be formed from side-walls, a floor, and an openable/closable lid. In some embodiments, these side-walls may be substantially vertical when collapsible-locker 101 may be deployed and when door-attachment-structure 151 may be removably attached to the given door, i.e., in a same way that this given door may be substantially vertical. In some embodiments, these side-walls may be a front-wall 103, two opposing side-walls 105, and a rear-wall 119 (note rear-wall 119 may not be shown in FIG. 1A, but may be shown in FIG. 1B) that may be opposing front-wall 103. In some embodiments, this lid may be lid 111. In some embodiments, this floor may be floor 121 (note floor 121 may not be shown in FIG. 1A, but may be shown in FIG. 1D). In some embodiments, the at least one wall of a given collapsible-container 101 may be front-wall 103, the two opposing side-walls 105, the rear-wall 119, lid 111, and floor 121. In some embodiments, front-wall 103, the two opposing side-walls 105, rear-wall 119, and floor 121, when collapsible-locker 101 may be fully deployed, may define, circumscribe, enclose and/or bound the volume for receiving the at least one package (object). This volume may be denoted as the main interior volume and when the package (or object for temporary storage) may not be within this main interior volume, then this main interior volume may be mostly/substantially void space; i.e., the interior of the collapsible-container 101 may be mostly (substantially) hollow, when the collapsible-container 101 may be in its substantially (fully) expanded (deployed) configuration. In some embodiment, this volume may be closed and/or sealed by lid 111 (at least one lid 111), which may substantially cover an opening to this volume when lid 111 may be closed. In some embodiments, this opening may be an only opening, that may be denoted as the single main opening for accessing the main interior volume of the given collapsible-locker 101, wherein the object (package) enters and leaves the given collapsible-locker 101 via this single main opening.

In some embodiments, access to the single main opening may be controlled by the at least one lid 111. In some embodiments, the at least one lid 111 may be hingedly attached to the at least one wall (e.g., rear-wall 119). In some embodiments, the at least one lid 111 may exist in two operational configurations, a closed configuration and a substantially open configuration, respectively. In some embodiments, when the at least one lid 111 may be in its closed configuration, the at least one lid 111 may be lockable to prevent unintended access to the single main opening.

Continuing discussing FIG. 1A, in some embodiments, the two opposing side-walls 105 may be disposed away from each other by about a width of front-wall 103 and/or a width of rear-wall 119. In some embodiments, front-wall 103 may be disposed opposite away from rear-wall 119 by about a width of the two opposing-side-walls 105. In some embodiments, the width of the two opposing side-walls 105 and the widths of front-wall 103 and of rear-wall 119 may be substantially similar, in which case 101 may be shaped substantially as a cube when fully expanded (deployed).

Continuing discussing FIG. 1A, in some embodiments, each side-wall 105 selected from the two opposing side-walls 105 may be attached to: rear-wall 119 and to front-wall 103. In some embodiments, each side-wall 105 selected from the two opposing side-walls 105 may be pivotally (hingedly) attached to: rear-wall 119 and to front-wall 103. In some embodiments, such pivot attachment may be accomplished by use of one or more hinges attached to the two adjacent wall members.

Continuing discussing FIG. 1A, in some embodiments, front-wall 103 may be attached to each side-wall 105 selected from the two opposing side-walls 105. In some embodiments, front-wall 103 may be pivotally (hingedly) attached to each side-wall 105 selected from the two opposing side-walls 105. In some embodiments, such pivot attachment may be accomplished by use of one or more hinges attached to the two adjacent wall members.

Continuing discussing FIG. 1A, in some embodiments, each side-wall 105 selected from the two opposing side-walls 105 may be comprised of two panels, a side-wall-panel-closer-to-rear-wall 107 and side-wall-panel-closer-to-front-wall 109. In some embodiments, side-wall-panel-closer-to-rear-wall 107 plus side-wall-panel-closer-to-front-wall 109 may together form a given side-wall 105 selected from the two opposing side-walls 105. In some embodiments, side-wall-panel-closer-to-rear-wall 107 may be about half of side-wall 105. In some embodiments, side-wall-panel-closer-to-front-wall 109 may be about half of side-wall 105. In some embodiments, as its name implies, side-wall-panel-closer-to-rear-wall 107 may be located closer to rear-wall 119 than to front-wall 103. In some embodiments, as its name implies, side-wall-panel-closer-to-front-wall 109 may be located closer to front-wall 103 than to rear-wall 119. In some embodiments, side-wall-panel-closer-to-rear-wall 107 may be attached to side-wall-panel-closer-to-front-wall 109 (e.g., by a vertically arranged hinge). In some embodiments, side-wall-panel-closer-to-rear-wall 107 may be attached to rear-wall 119 along one of side-wall-panel-closer-to-rear-wall's 107 edges and disposed opposite may be attached to side-wall-panel-closer-to-front-wall 109. In some embodiments, side-wall-panel-closer-to-front-wall 109 may be attached to front-wall 103 along one of side-wall-panel-closer-to-front-wall's 109 edges and disposed opposite may be attached to side-wall-panel-closer-to-rear-wall 107.

Continuing discussing FIG. 1A, in some embodiments, lid 111 may comprise a lid-overhang 113. In some embodiments, around non-hinged sides (edges and/or periphery) of lid 111 may be lid-overhang 113. In some embodiments, when lid 111 may be closed, as shown in FIG. 1A, lid-overhang 113 may overlap at least some of the top portions of the two opposing side-walls 105. In some embodiments, when lid 111 may be closed, lid-overhang 113 may overlap the top portions of front-wall 103. In some embodiments, lid-overhang 113 may make tampering and/or forcing lid 111 open when locked more difficult. In some embodiments, lid-overhang 113 may protect any contents of package-receiving-locker 100. In some embodiments, lid-overhang 113 may protect any contents of package-receiving-locker 100 from environmental problems, such as, but not limited to, sun light, wind, water, rain, sleet, hail, snow, ice, and/or the like. In some embodiments, 113 may be a length of material that may extend downwards (extending downwards in a fixed and predetermined length) from non-hinged periphery of lid 111.

Continuing discussing FIG. 1A, in some embodiments, on a top of lid 111 may comprise an exterior-interface 115. In some embodiments, exterior-interface 115 may be how a given user may be able to interact with package-receiving-locker 100. In some embodiments, exterior-interface 115 may be how a given user may be able to unlock lid 111. In some embodiments, exterior interface 115 may be how a given user may be able to lock lid 111. In some embodiments, exterior-interface 115 may be means by which a user may exteriorly interact with locking or unlocking lid 111. In some embodiments, exterior-interface 115 may be means by which a user may exteriorly interact with opening or closing lid 111. In some embodiments, exterior-interface 115 may comprise various input/output (I/O) means. In some embodiments, exterior-interface 115 may comprise various accesscontrols, such as one or more of: a user-interface, a graphical-user-interface, a touchscreen, a keypad, a fingerprint scanner, a button, a lever, a switch, a slide, a dial, a knob, a camera, a RFID/NFC reader (scanner), a microphone, a speaker, a light, a buzzer, a port (for communication and/or electrical power transmission), a handle, a pull, and/or the like.

Continuing discussing FIG. 1A, in some embodiments, on a top of collapsible-locker 101 may have one or more handle(s) 117. In some embodiments, a given handle 117 may be configured for lifting package-receiving-locker 100. In some embodiments, a given handle 117 may be configured for lifting package-receiving-locker 100 when collapsible-locker 101 may not be holding any packages. In some embodiments, a given handle 117 may be configured to break upon receiving load (e.g., force or torque) of at least a predetermined level. In some embodiments, handle 117 may be located on a top of lid 111. In some embodiments, handle 117 may be located on a top of top-panel 116.

In some embodiments, handle 117 may be a slot and/or indenture into top-panel 116, lid 111, front-wall 103, rear-wall 119, and/or side-walls 105.

In some embodiments, there may be no such handle 117.

Figure 1B:
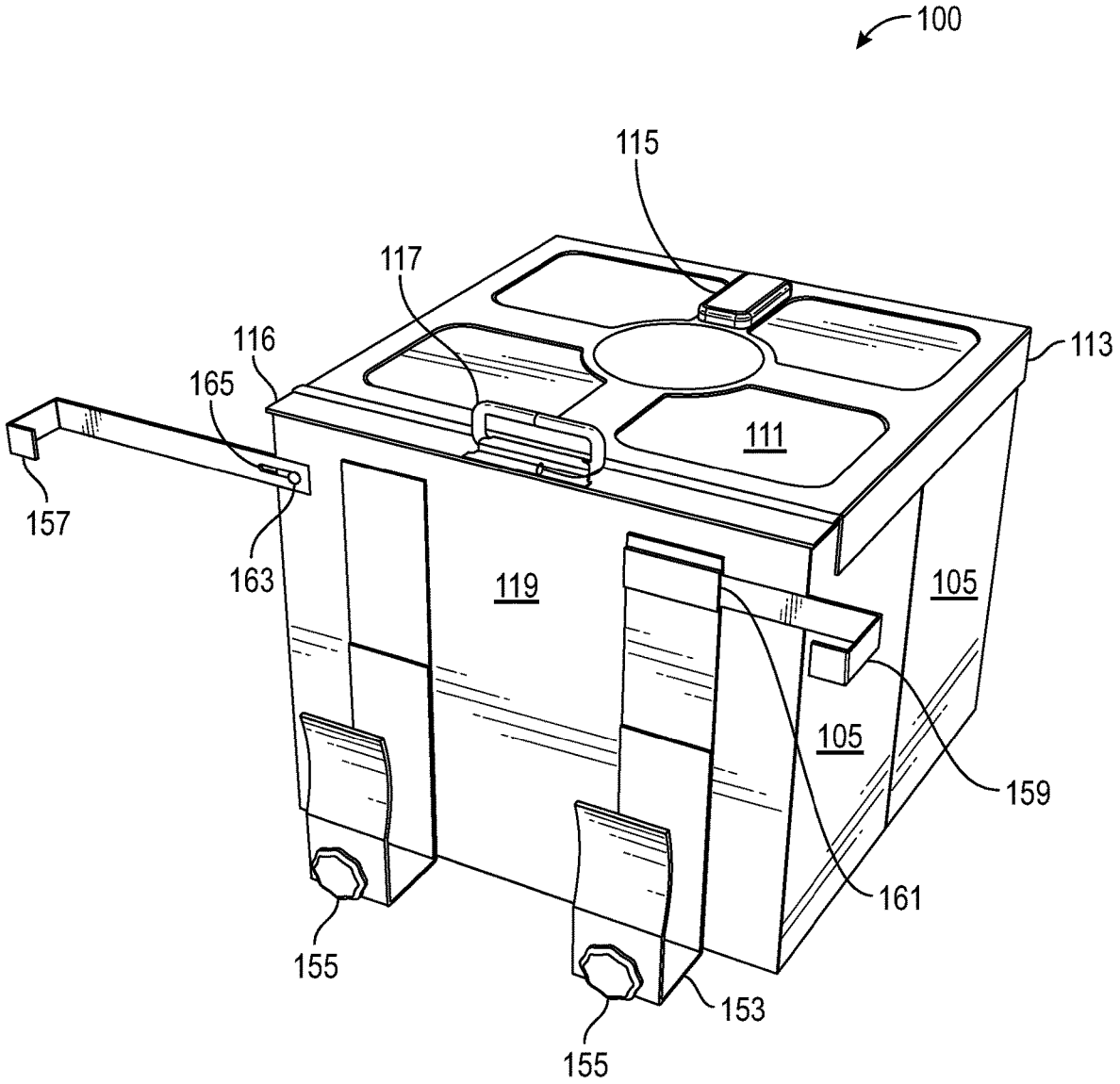
FIG. 1B may depict a rear, left, top, perspective view of the deployed package-receiving-locker from FIG. 1A.

FIG. 1B may depict a rear, left, top, perspective view of the deployed package-receiving-locker 100 from FIG. 1A. In some embodiments, rear-wall 119 may be attached to each side-wall 105 selected from the two opposing side-walls 105. In some embodiments, rear-wall 119 may be pivotally (hingedly) attached to each side-wall 105 selected from the two opposing side-walls 105. In some embodiments, such pivot attachment may be accomplished by use of one or more hinges attached to the two adjacent wall members.

Continuing discussing FIG. 1B, in some embodiments, collapsible-locker 101 may comprise top-panel 116. In some embodiments, top-panel 116 may an elongate member, that may be substantially planar. In some embodiments, top-panel 116 may be located on a top of collapsible-locker 101, towards rear-wall 119. In some embodiments, along one length top-panel 116 may be fixedly attached to rear-wall top-panel 116; and on an opposing length top-panel 116 may be attached to lid 111. In some embodiments, along one length top-panel 116 may be fixedly attached to rear-wall top-panel 116; and on an opposing length top-panel 116 may be pivotally (hingedly) attached to lid 111. In some embodiments, handle 117 may be attached to a top of top-panel 116.

Continuing discussing FIG. 1B, in some embodiments, door-attachment-structure(s) 151 may be attached to rear-wall 119. In some embodiments, door-attachment-structure(s) 151 may comprise two distinct regions, a lower or bottom region and an upper region, wherein each such region may be for a different kind of removable attachment to the given door. In some embodiments, door-attachment-structure(s) 151 may comprise bottom-door-bracket(s) 153 and two opposing J-hooks 157/159. In some embodiments, the lower or the bottom region may have the bottom-door-bracket(s) 153. In some embodiments, the upper region may have the two opposing J-hooks 157/159.

Continuing discussing FIG. 1B, in some embodiments, bottom-door-bracket(s) 153 may be configured to removably attach to a bottom of the given door. In some embodiments, bottom-door-bracket(s) 153 may be one or more brackets, sized to generally fit a width of a variety of doors, particularly exterior doors for accessing a given structure (such as a residence, home, office, business, building, etc.). In some embodiments, bottom-door-bracket(s) 153 may further comprise one or more adjustment-screws 155, which upon tightening may apply pressure against the bottom of the door that may be received within the brackets of bottom-door-bracket(s) 153. In some embodiments, adjustment-screws 155 may pass orthogonally through exterior portions of bottom-door-bracket(s) 153 that may be disposed away from rear-wall 119. In some embodiments, surfaces of bottom-door-bracket(s) 153 and/or surfaces of adjustment-screws 155 which may physically contact the given door, may be padded and/or cushioned to minimize any damage to the bottom of the door. In some embodiments, such padding and/or cushioning may be accomplished by use of rubber, silicone, elastomers, combinations thereof, and/or the like. In some embodiments, use of door-attachment-structure 151 (or door-attachment-structure 3000) may not harm door 451.

Continuing discussing FIG. 1B, in some embodiments, the two opposing J-hooks 157/159, as their name implies, may be located so as to be substantially disposed opposite from each other. In some embodiments, the two opposing J-hooks 157/159, as their name implies, may be shaped as hooks, wherein the hook portion substantially resembles the letter "J" when viewed from a side. In some embodiments, each of the two J-hooks 157/159 may be substantially an elongate member, that may be substantially planar, that may be configured and/or bent to resemble the letter "J" when viewed from the side. In some embodiments, the two opposing J-hooks 157/159 may be configured, sized, and/or shaped to removably grip the two opposing sides of the given door that is being removably attached to. In some embodiments, reference numeral "157" may refer to pivoting J-hook 157. In some embodiments, pivoting J-hook 157 may removably grip the non-hinge-side 459 of the given door 451 (see e.g., FIG. 5E). In some embodiments, reference numeral "159" may refer to sliding J-hook 159. In some embodiments, sliding J-hook 159 may removably grip the hinge-side 461 of the given door 451 (see e.g., FIG. 5E).

Continuing discussing FIG. 1B, in some embodiments, one or both of the two opposing J-hooks 157/159 may be adjustable to accommodate doors of different widths. In some embodiments, one or both of the two opposing J-hooks 157/159 may be slidingly adjustable to accommodate doors of different widths. In some embodiments, one or both of the two opposing J-hooks 157/159 may be slidingly attached to or proximate to rear-wall 119 via J-hook-receiver 161. In some embodiments, J-hook-receiver 161 may receive at least some of the substantially elongate and planar portion of one or both of the two opposing J-hooks 157/159. In some embodiments, sliding J-hook 159 may be slidingly adjustable to accommodate doors of different widths. In some embodiments, sliding J-hook 159 may be slidingly attached to or proximate to rear-wall 119 via J-hook-receiver 161. In some embodiments, J-hook-receiver 161 may receive at least some of the substantially elongate and planar portion of hinge-side J-hook 159.

Continuing discussing FIG. 1B, in some embodiments, one or both of the two opposing J-hooks 157/159 may be adjustable to accommodate the process of removably attaching door-attachment-structure(s) 151 to the given door. In some embodiments, one or both of the two opposing J-hooks 157/159 may be pivotally adjustable to accommodate the process of removably attaching door-attachment-structure(s) 151 to the given door. In some embodiments, one or both of the two opposing J-hooks 157/159 may be pivotally attached to or proximate to rear-wall 119 via J-hook-attachment-hardware 163. In some embodiments, J-hook-attachment-hardware 163 may be a pin, screw, bolt, rivet, and/or the like. In some embodiments, J-hook-attachment-hardware 163 may pass through a portion of the given J-hook 157/159 that may be substantially distal from the hook end. In some embodiments, the distal portion of the given J-hook 157/159 may comprise a slot, running a long its length, termed J-hook-slot 165. In some embodiments, J-hook-attachment-hardware 163 may pass through J-hook-slot 165. Thus in some embodiments, not only may the given J-hook 157/159 be pivotally attached to rear-wall 119, but because of J-hook-slot 165, there may be some linear adjustment capacity as well.

In some embodiments, door-attachment-structure 151 may comprise bottom-door-bracket(s) 153, but not the two opposing J-hooks 157/159. In some embodiments, door-attachment-structure 151 may comprise the two opposing J-hooks 157/159, but not the bottom-door-bracket(s) 153.

Figure 1C:
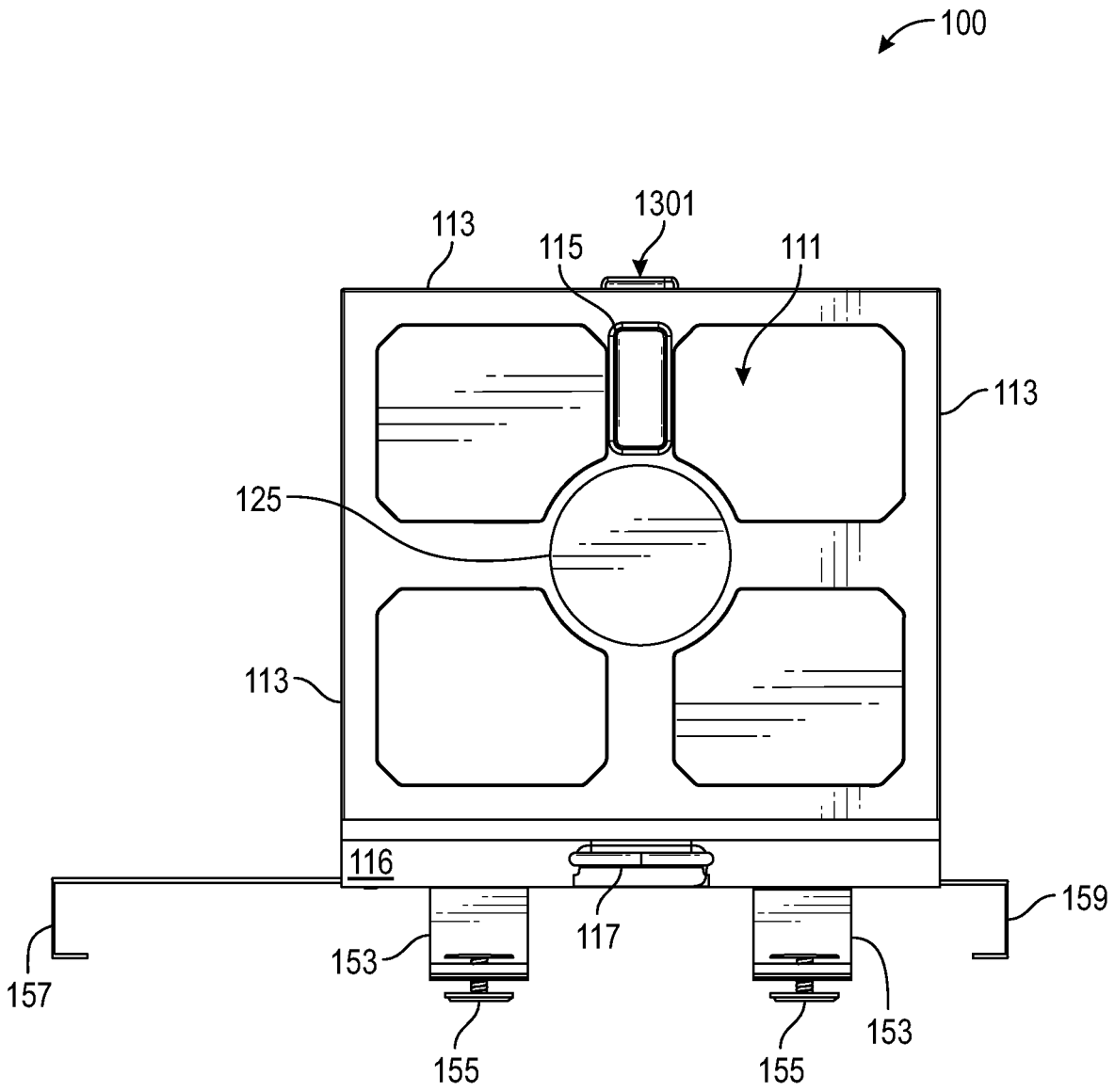
FIG. 1C may depict a top view of the deployed package-receiving-locker from FIG. 1A.

FIG. 1C may depict a top view of the deployed package-receiving-locker 100 from FIG. 1A. In some embodiments, collapsible-locker 101 may comprise logo-display-region 125. In some embodiments, on an exterior of collapsible-locker 101 may be one or more logo-display-region 125. In some embodiments, a top of lid 111 may have logo-display-region 125. In some embodiments, logo-display-region 125 may be located on sides and/or the front of collapsible-locker 101. In some embodiments, logo-display-region 125 may be a region where a logo and/or a trademark may be displayed.

Figure 1D:
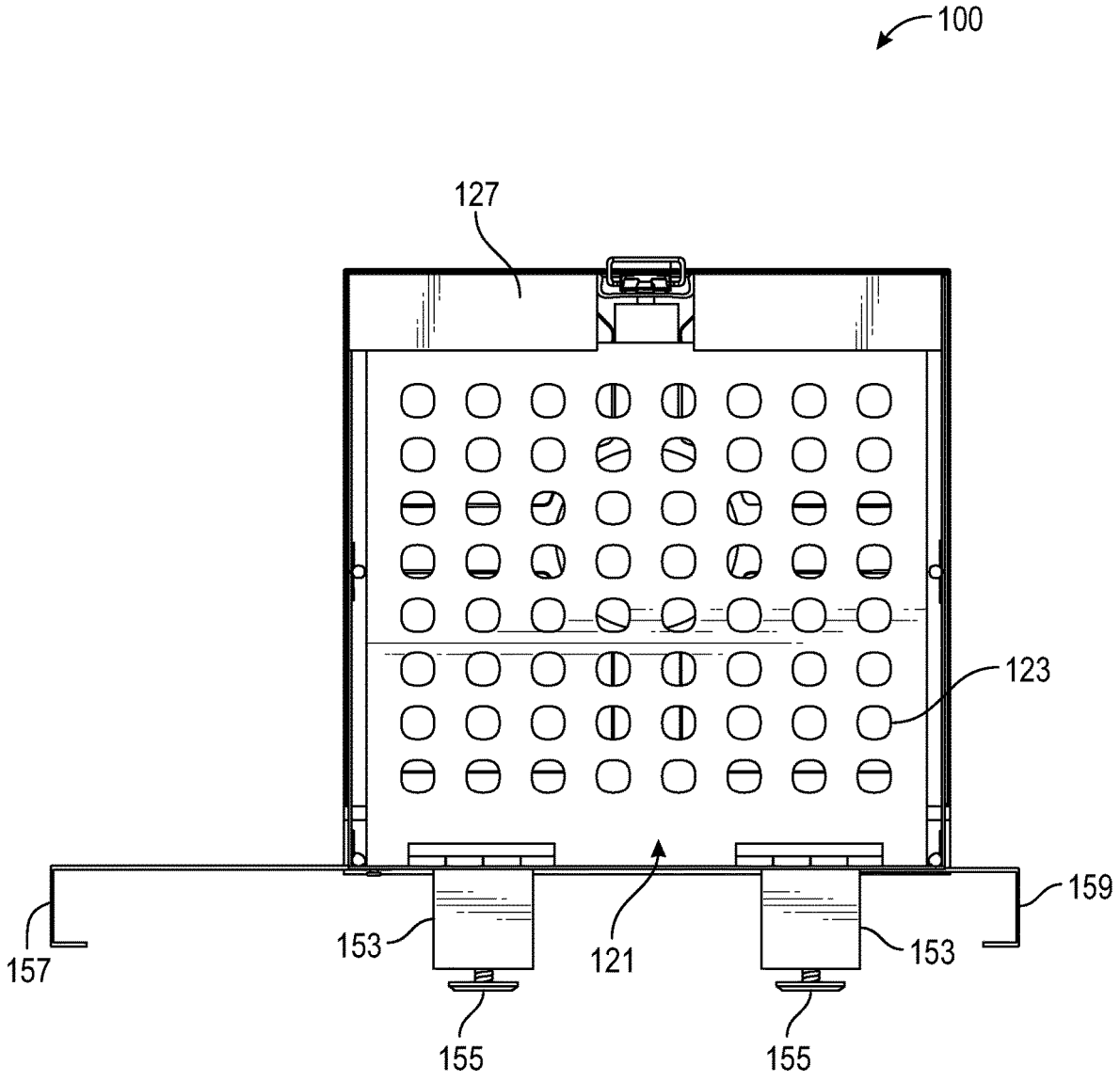
FIG. 1D may depict a bottom view of the deployed package-receiving-locker from FIG. 1A.

FIG. 1D may depict a bottom view of the deployed package-receiving-locker 100 from FIG. 1A. Floor 121 may be shown in FIG. 1D. In some embodiments, floor 121 may be the floor of collapsible-locker 101. In some embodiments, floor 121 may have at least one hole, termed, floor-hole 123. In some embodiments, floor 121 may have one or more floor-hole(s) 123. In some embodiments, floor 121 may have a plurality of floor-holes 123. In some embodiments, such floor-hole(s) 123 may be sized and/or shaped to reduce weight of package-receiving-locker 100, while still maintaining structural integrity of floor 121.

Continuing discussing FIG. 1D, collapsible-locker 101 may comprise floor-support 127. In some embodiments, floor-support 127 may be a shelf, brace, and/or a support for catching and/or supporting floor 121. In some embodiments, floor-support 127 may be an extension of front-wall 103, that may bend towards the bottom of collapsible-locker 101.

Figure 1E:
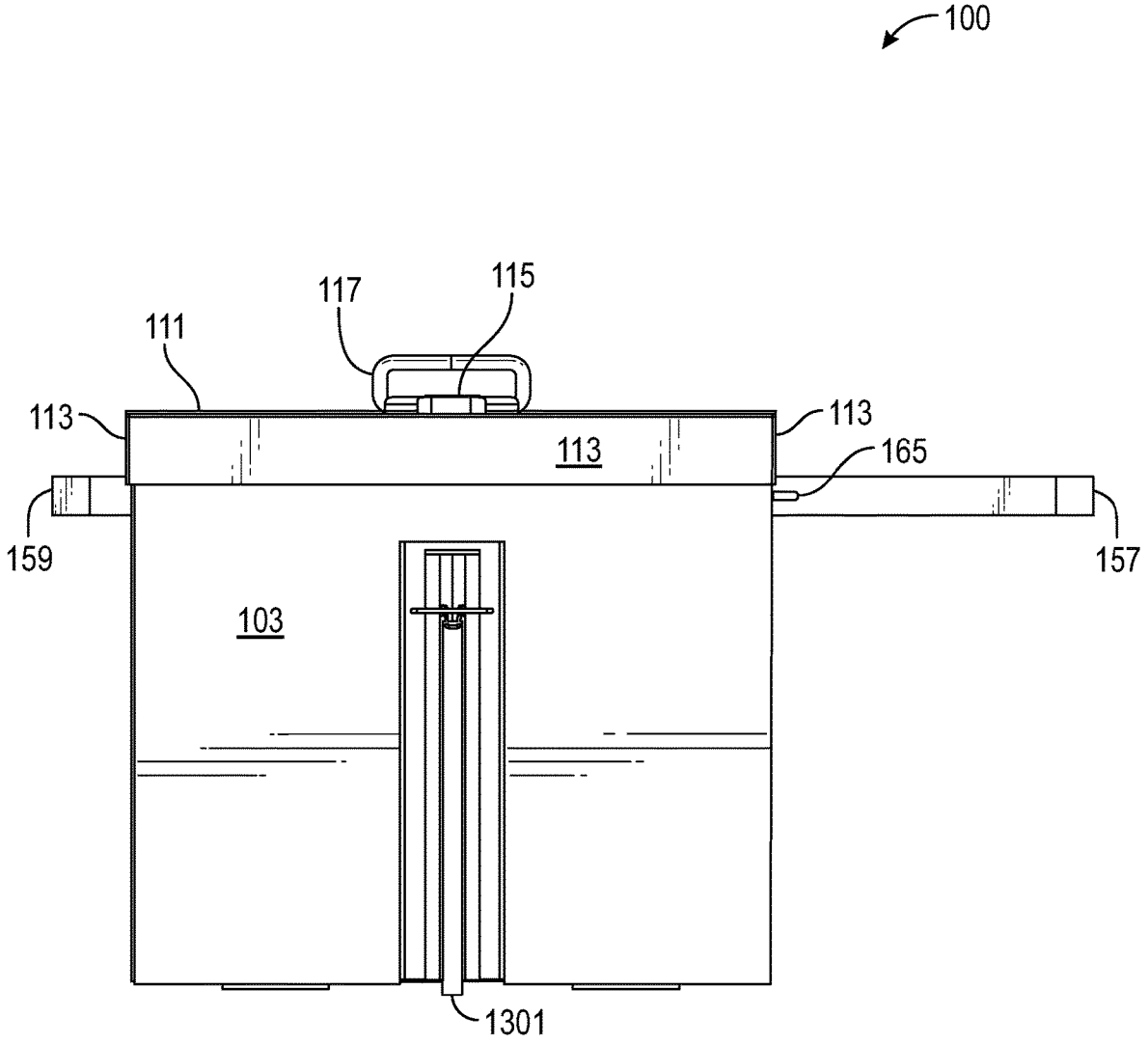
FIG. 1E may depict a front view of the deployed package-receiving-locker from FIG. 1A.
Figure 1F:
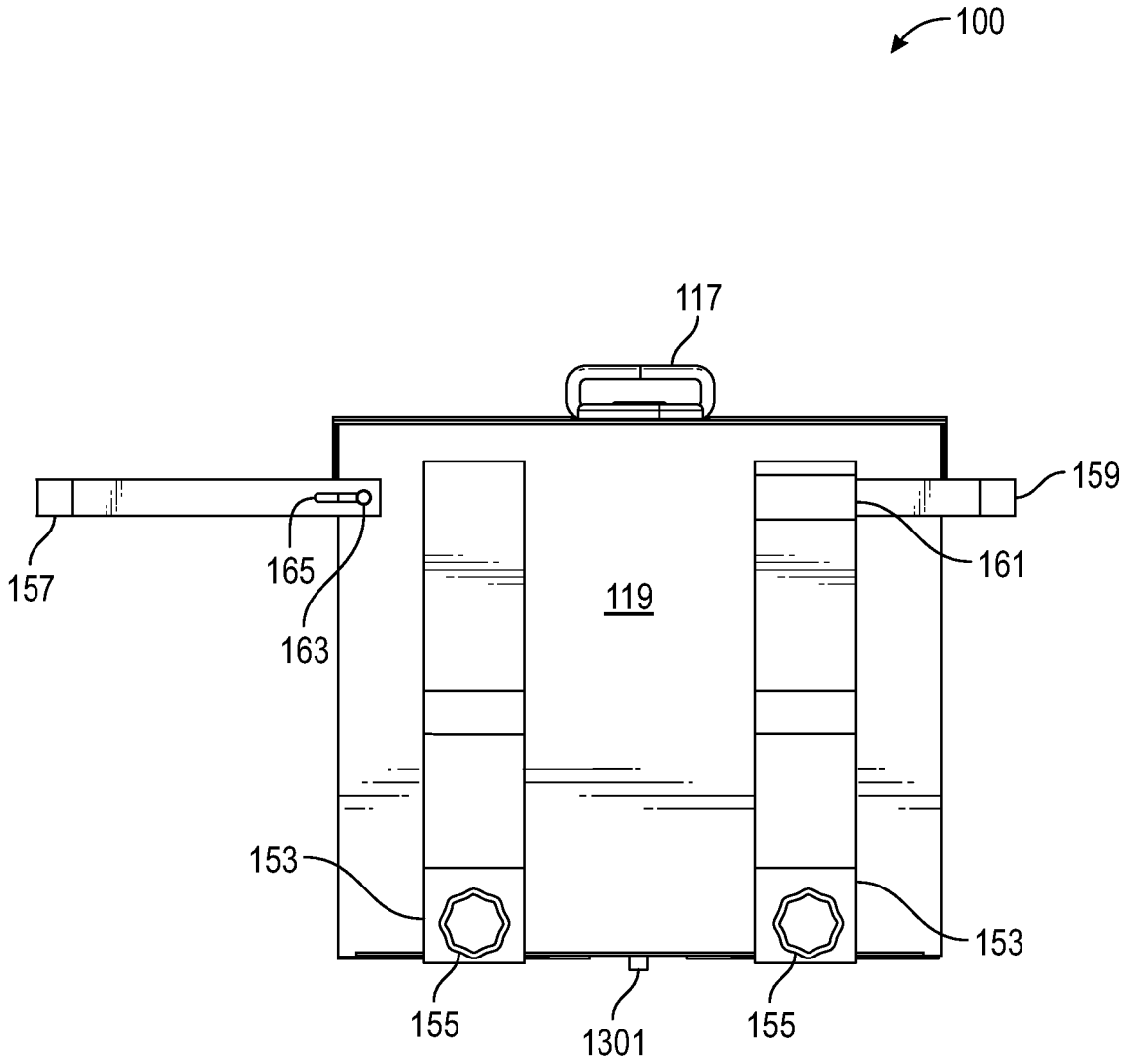
FIG. 1F may depict a rear view of the deployed package-receiving-locker from FIG. 1A.
Figure 1G:
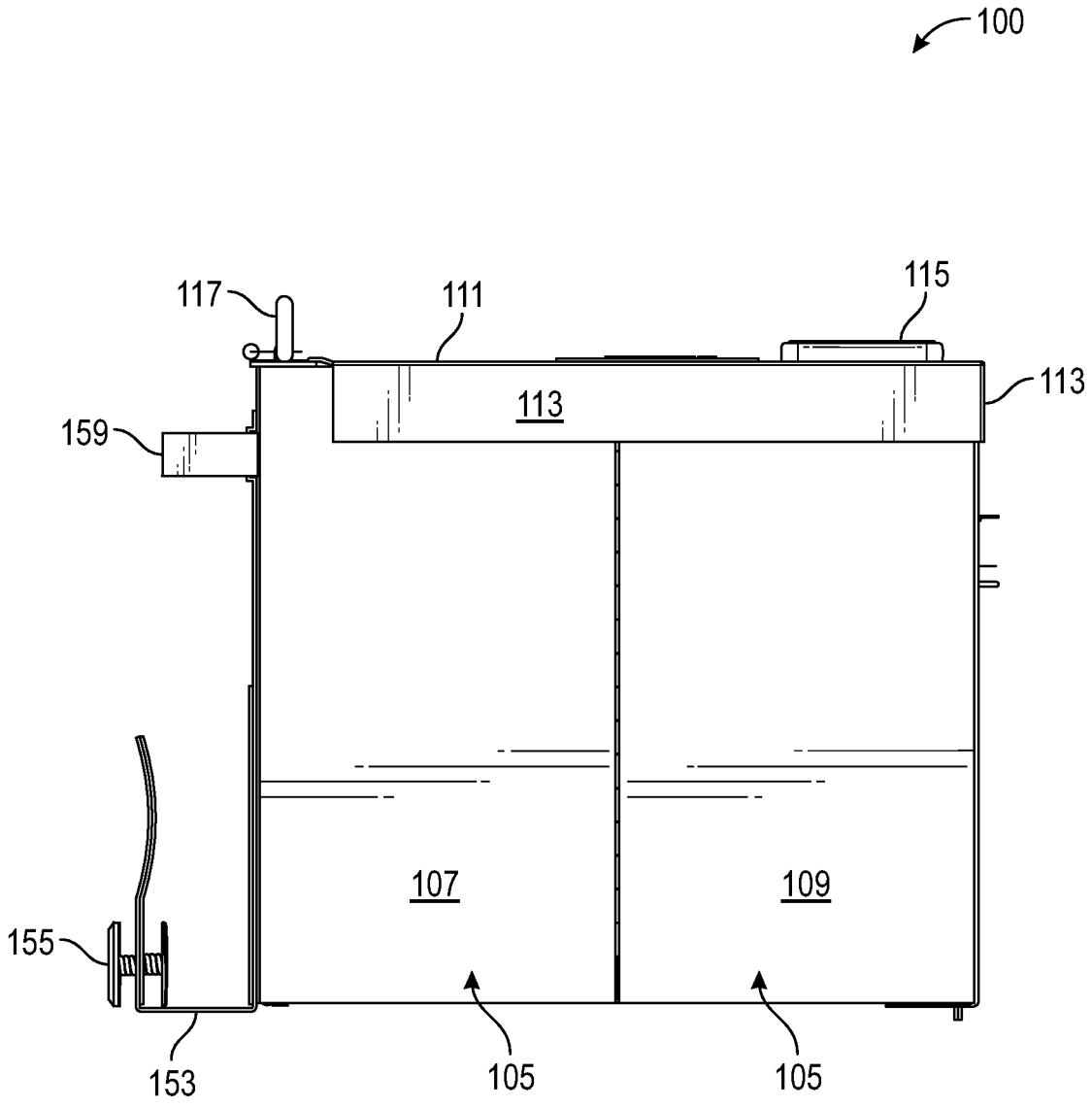
FIG. 1G may depict a left-side view of the deployed package-receiving-locker from FIG. 1A.
Figure 1H:
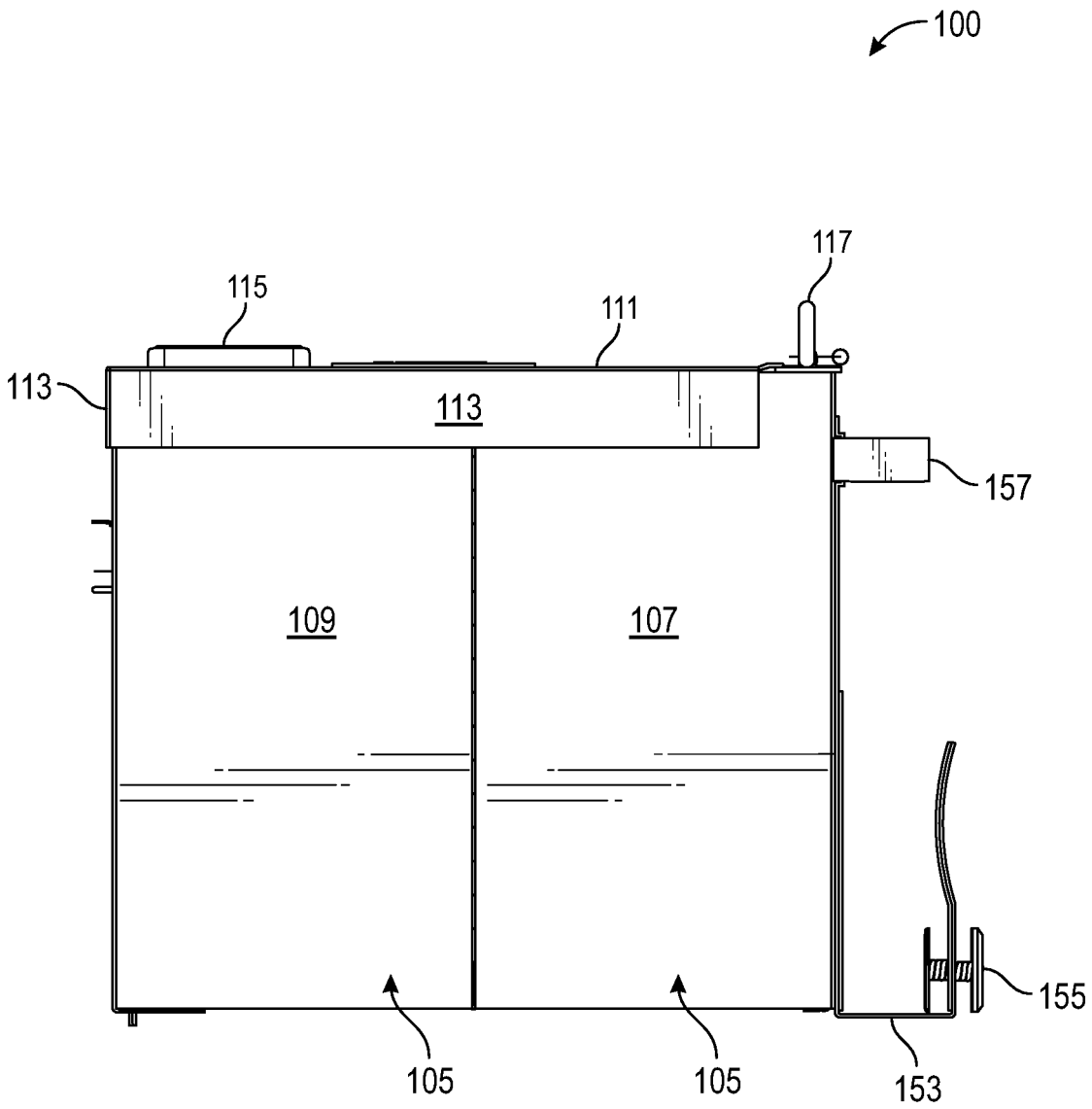
FIG. 1H may depict a right-side view of the deployed package-receiving-locker from FIG. 1A.

FIG. 1E may depict a front view of the deployed package-receiving-locker 100 from FIG. 1A. FIG. 1F may depict a rear view of the deployed package-receiving-locker 100 from FIG. 1A. FIG. 1G may depict a left-side view of the deployed package-receiving-locker 100 from FIG. 1A. FIG. 1H may depict a right-side view of the deployed package-receiving-locker 100 from FIG. 1A.

FIG. 2A through FIG. 2G may show the package-receiving-locker 100 in a substantially collapsed configuration. In some embodiments, when package-receiving-locker 100 may be in this substantially collapsed configuration, side-walls 105, floor 121, and front-wall 103 may be disposed between lid 111 and rear-wall 119. In some embodiments, when package-receiving-locker 100 may be in this substantially collapsed configuration, side-walls 105, floor 121, and front-wall 103 may be sandwiched between lid 111 and rear-wall 119. This substantially collapsed configuration may facilitate storage of package-receiving-locker 100, when package-receiving-locker 100 may not be in use. For example, and without limiting the scope of the present invention, this substantially collapsed configuration (when not attached to a given door 451) may facilitate (temporary) storage of package-receiving-locker 100 (and of package-receiving-locker 100/900/2200/3600) under beds and/or behind doors, or other furniture, and generally out of the way.

Figure 2A:
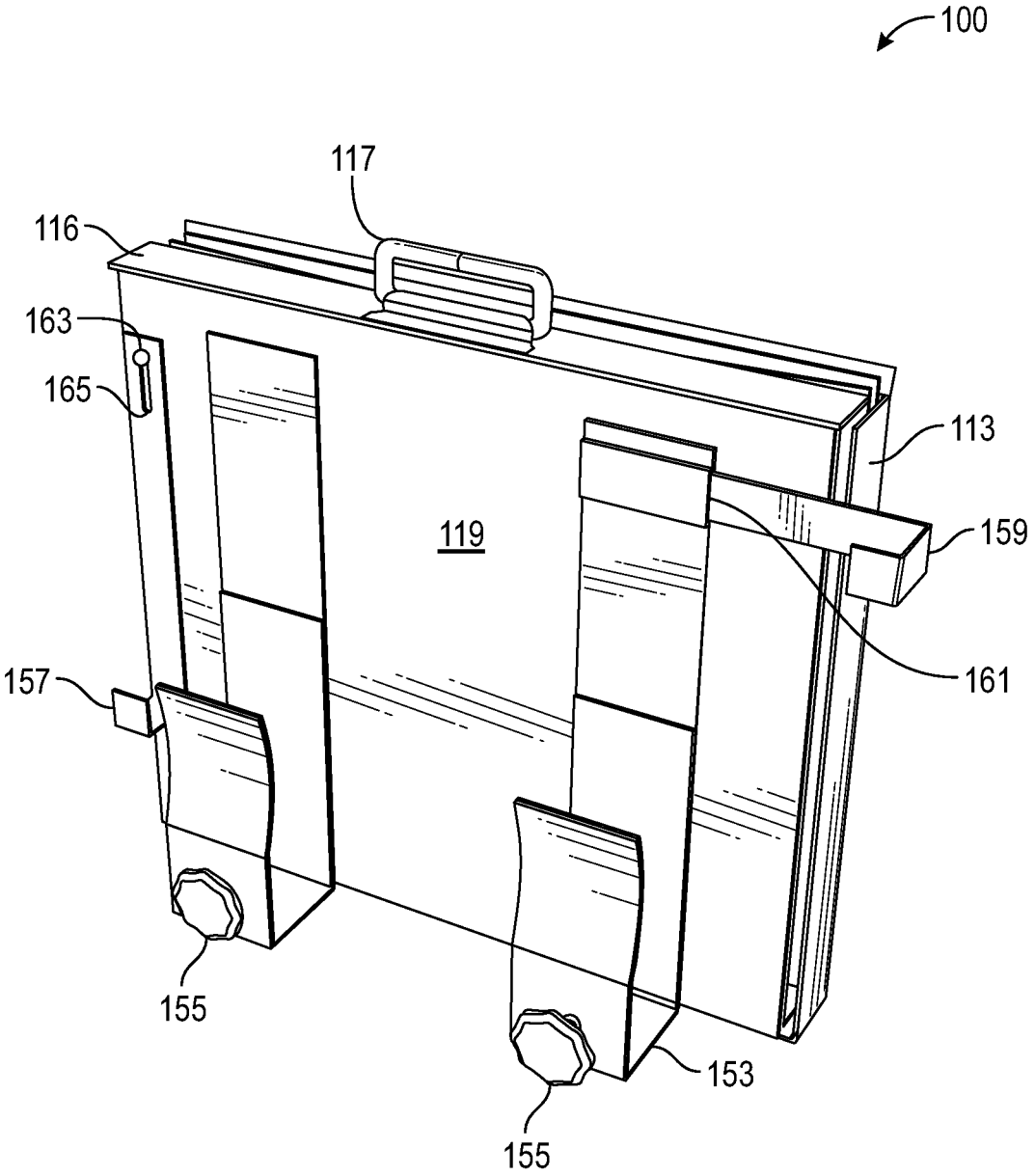
FIG. 2A may depict a rear, left, top, perspective view of the package-receiving-locker from FIG. 1A, but now shown in a substantially (or fully) collapsed configuration.
Figure 2B:
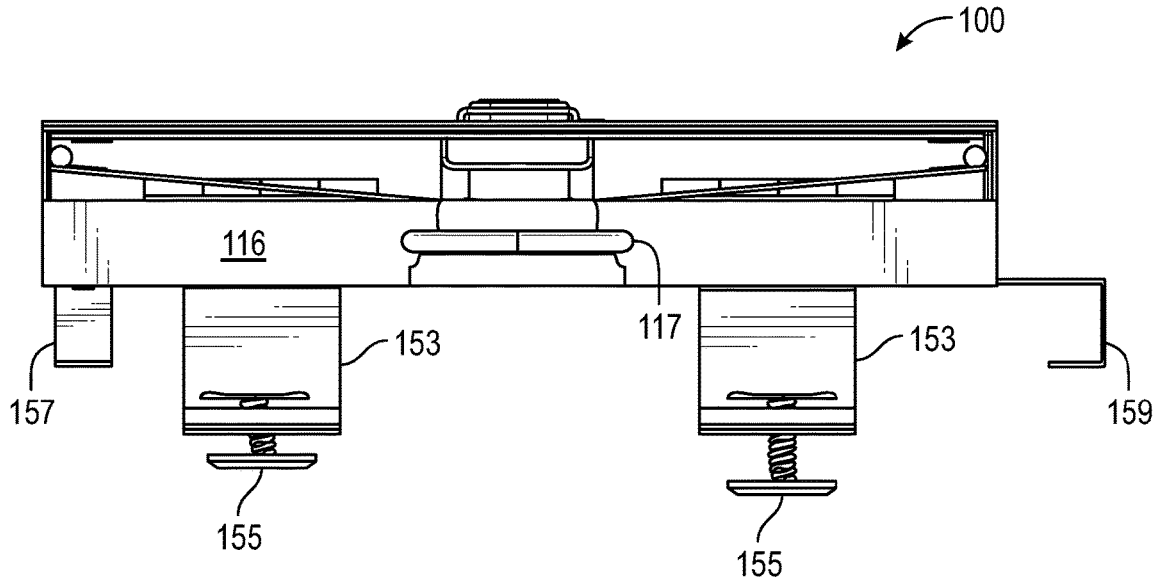
FIG. 2B may depict a top view of the substantially collapsed package-receiving-locker from FIG. 2A.
Figure 2C:
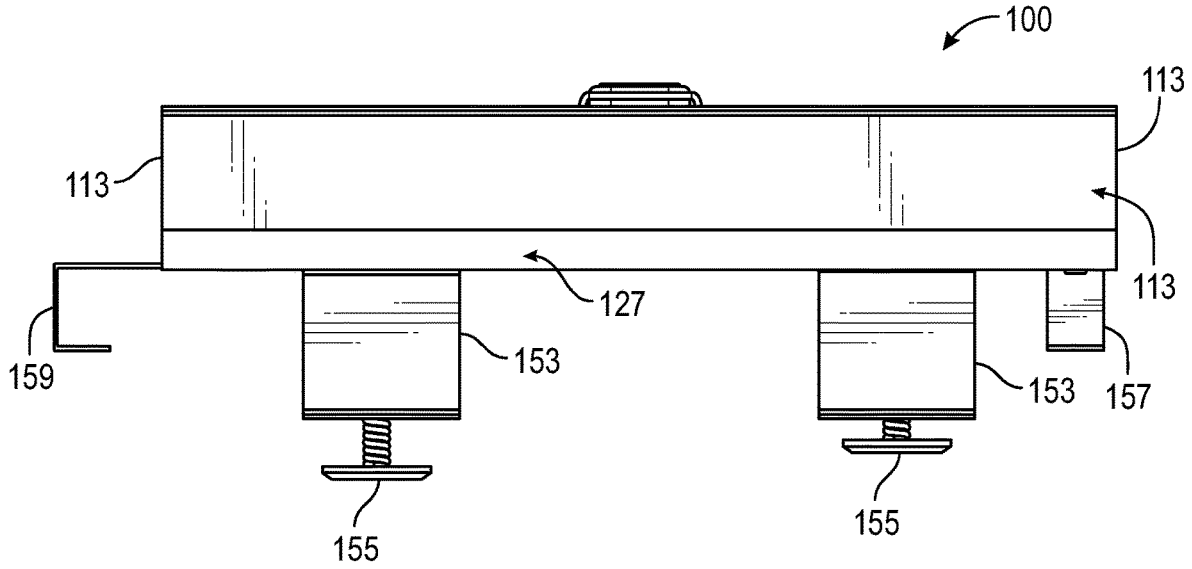
FIG. 2C may depict a bottom view of the substantially collapsed package-receiving-locker from FIG. 2A.
Figure 2D:
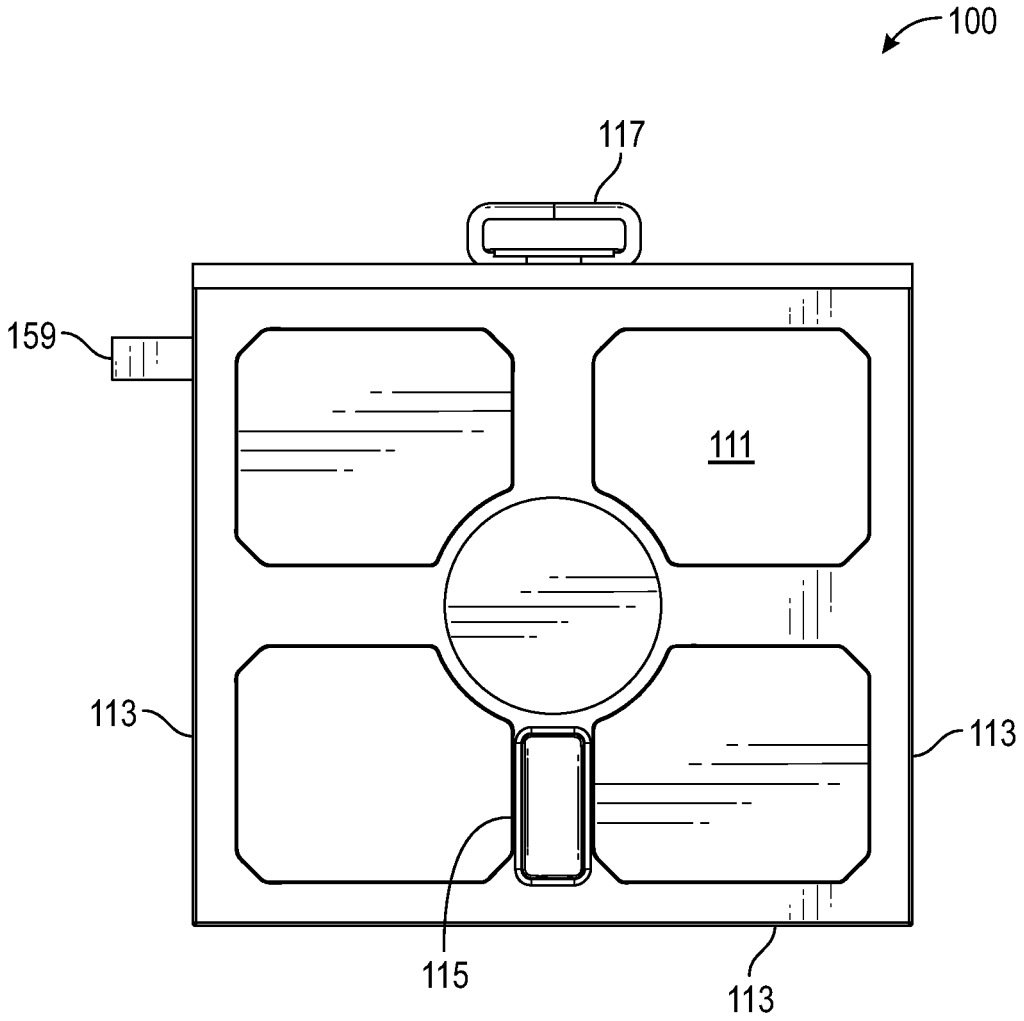
FIG. 2D may depict a front view of the substantially collapsed package-receiving-locker from FIG. 2A.
Figure 2E:
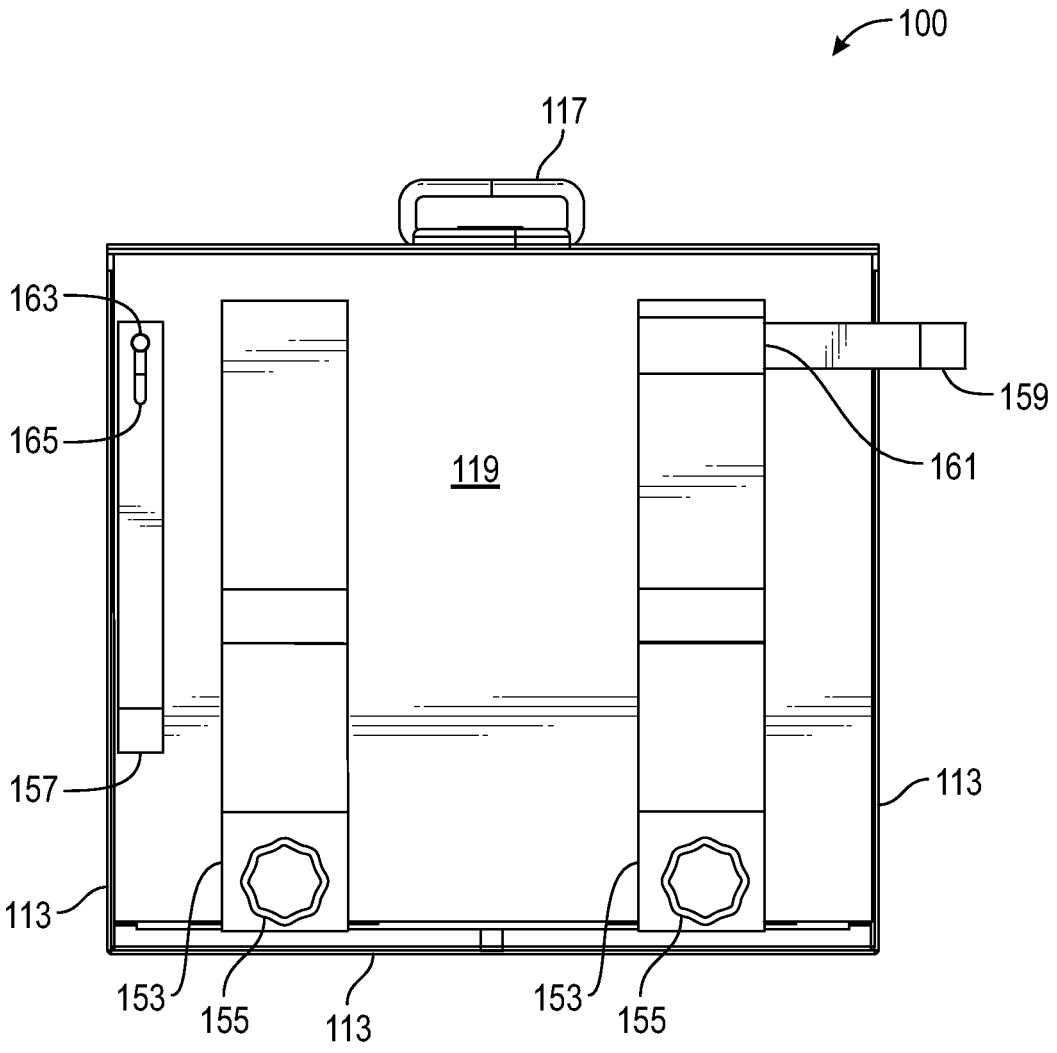
FIG. 2E may depict a rear view of the substantially collapsed package-receiving-locker from FIG. 2A.
Figure 2F:
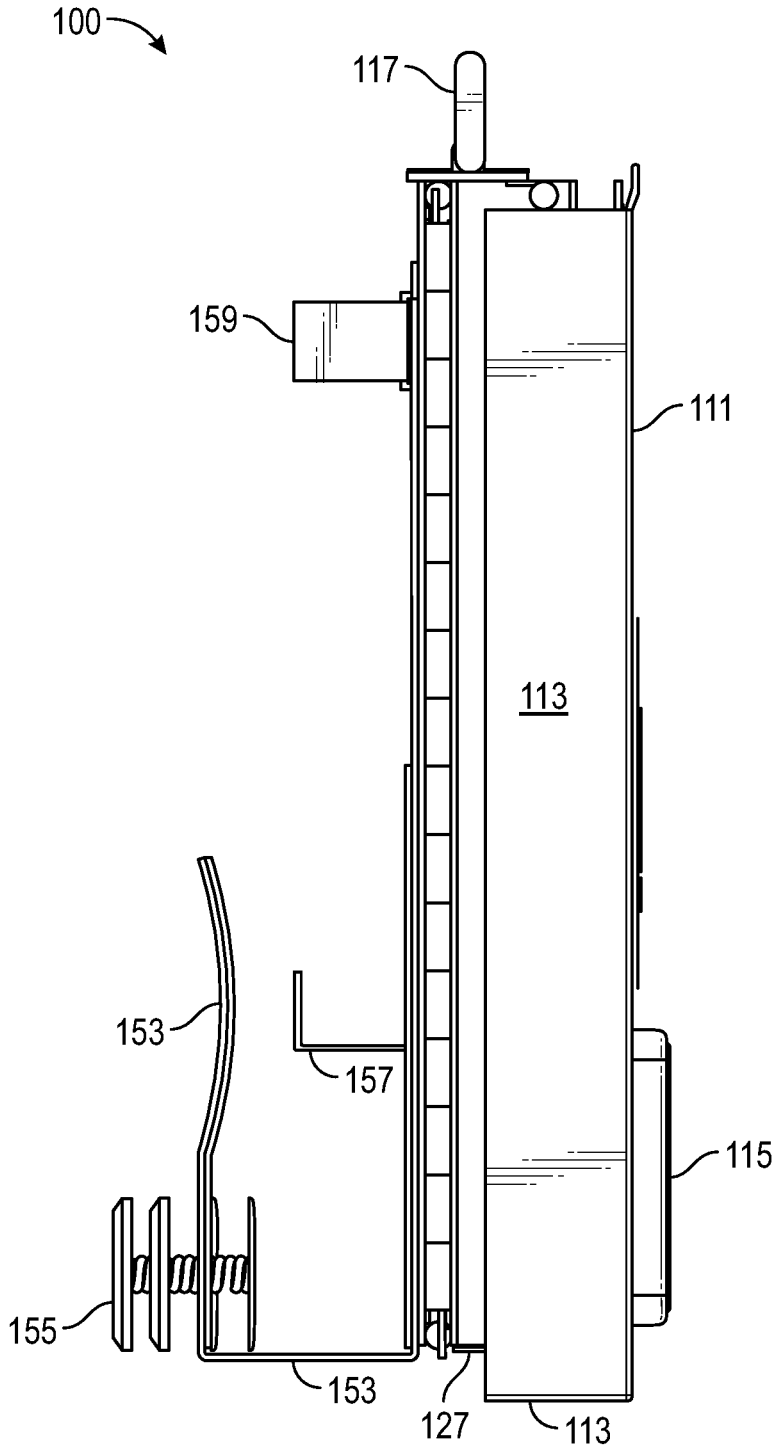
FIG. 2F may depict a left-side view of the substantially collapsed package-receiving-locker from FIG. 2A.
Figure 2G:
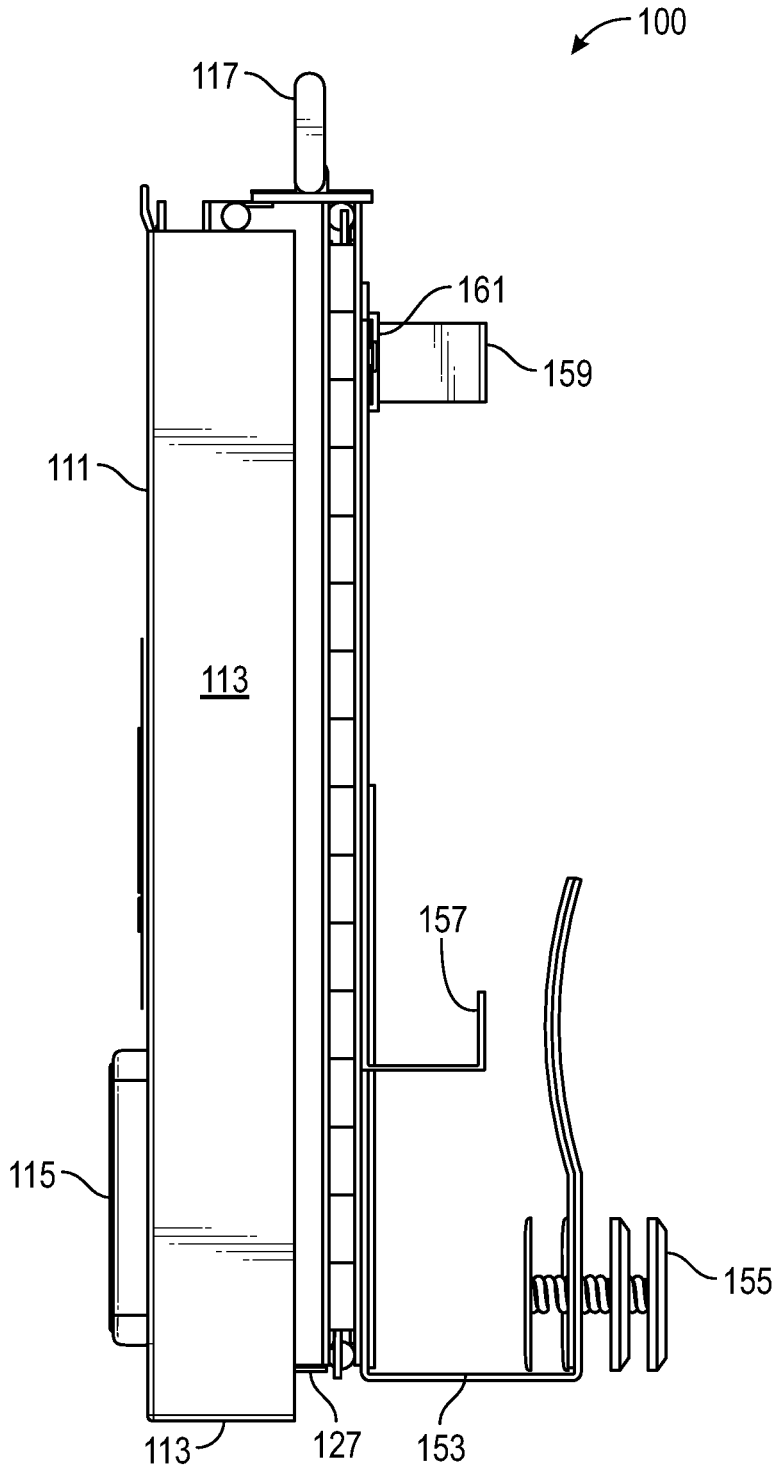
FIG. 2G may depict a right-side view of the substantially collapsed package-receiving-locker from FIG. 2A.

FIG. 2A may depict a rear, left, top, perspective view of the package-receiving-locker 100 from FIG. 1A, but now shown in the substantially collapsed configuration. In some embodiments, a length of the extension of lid-overhang 113 may be substantially similar to the width of top-panel 116. FIG. 2B may depict a top view of the substantially collapsed package-receiving-locker 100 from FIG. 2A. FIG. 2C may depict a bottom view of the substantially collapsed package-receiving-locker 100 from FIG. 2A. FIG. 2D may depict a front view of the substantially collapsed package-receiving-locker 100 from FIG. 2A. FIG. 2E may depict a rear view of the substantially collapsed package-receiving-locker 100 from FIG. 2A. FIG. 2F may depict a left-side view of the substantially collapsed package-receiving-locker 100 from FIG. 2A. FIG. 2G may depict a right-side view of the substantially collapsed package-receiving-locker 100 from FIG. 2A.

Figure 3A:
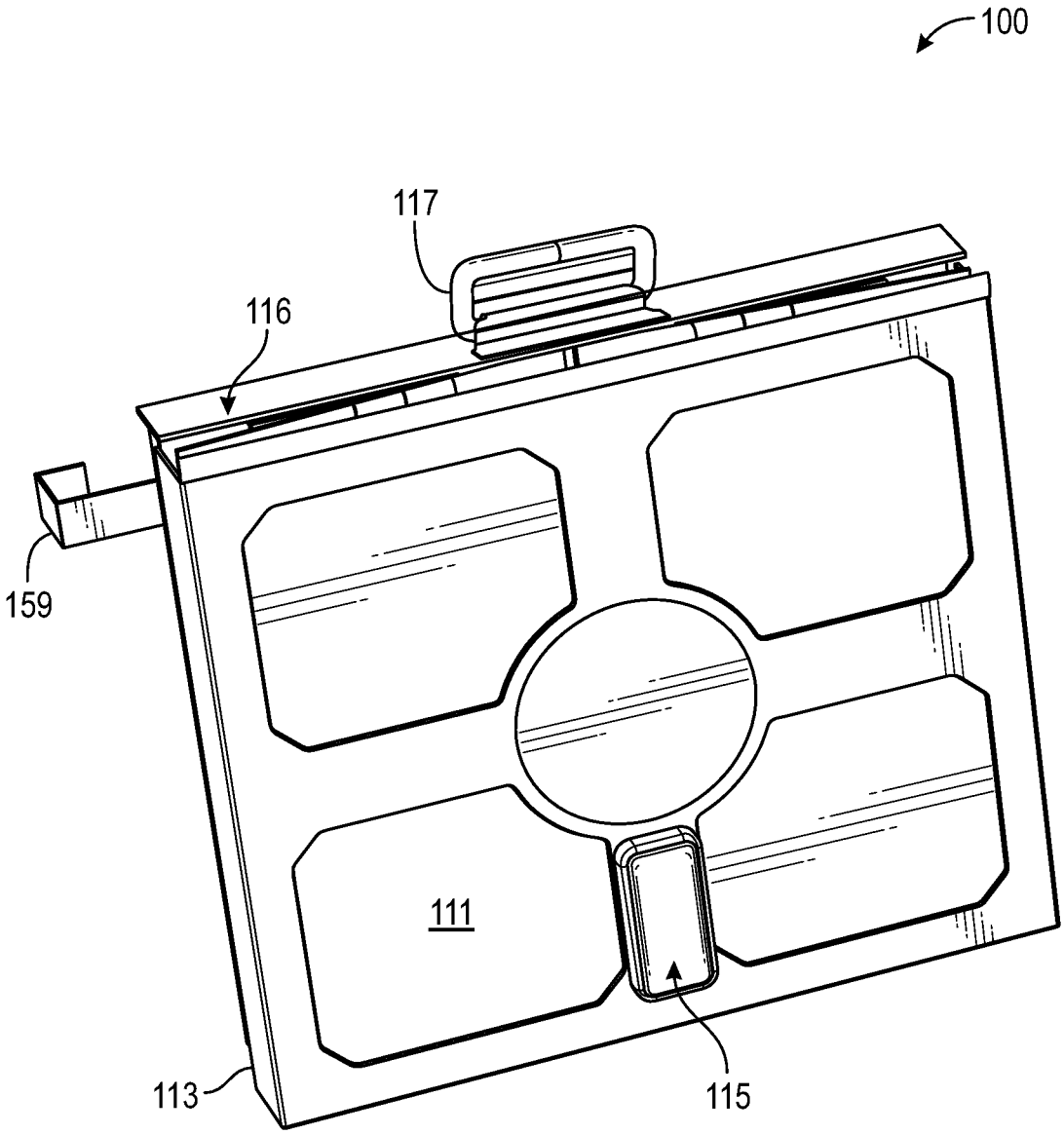
FIG. 3A may depict a front, left, top, perspective view of the substantially collapsed package-receiving-locker from FIG. 2A.
Figure 3B:
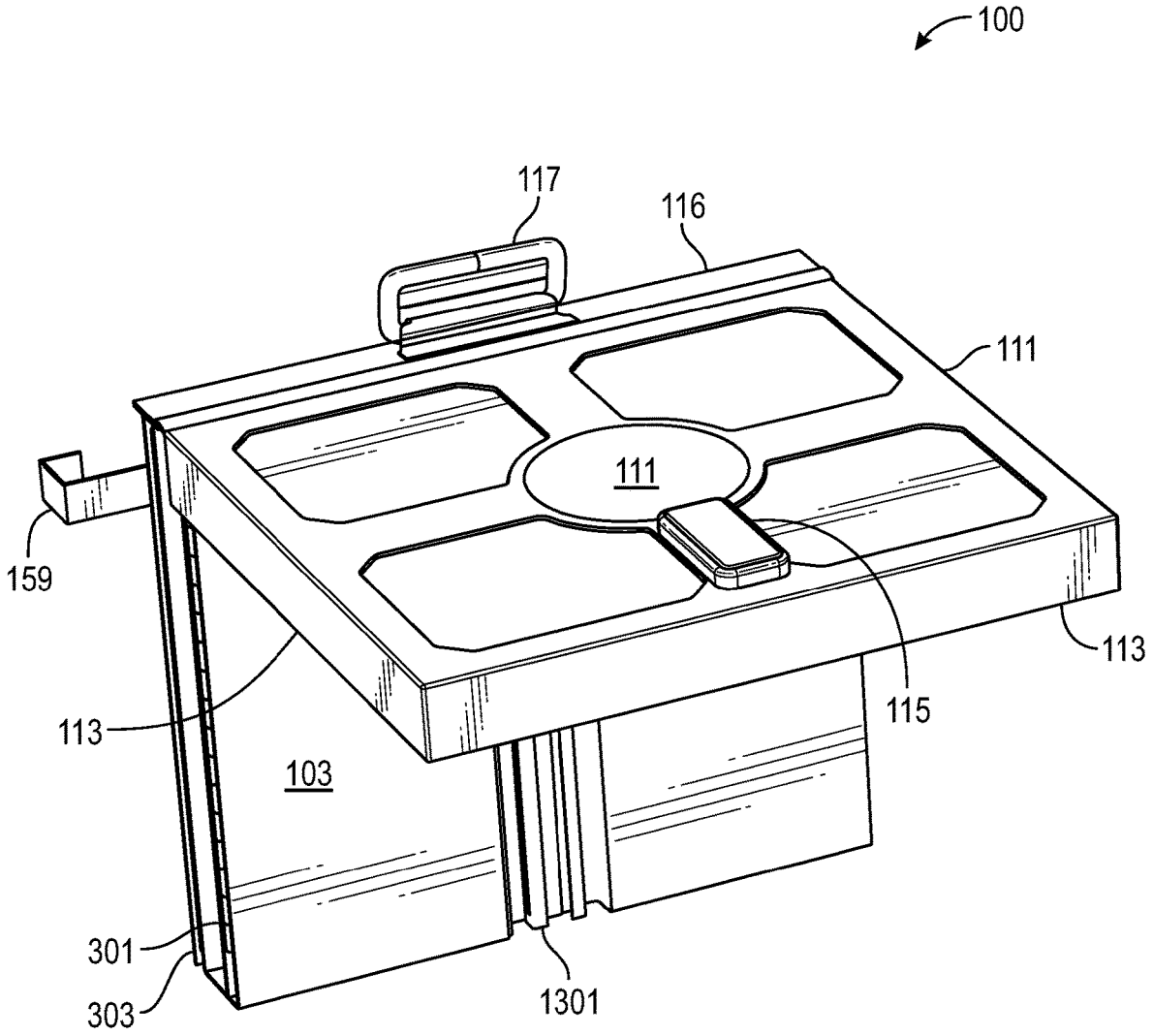
FIG. 3B may depict a lid of the package-receiving-locker being lifted up in preparation for deployment.
Figure 3C:
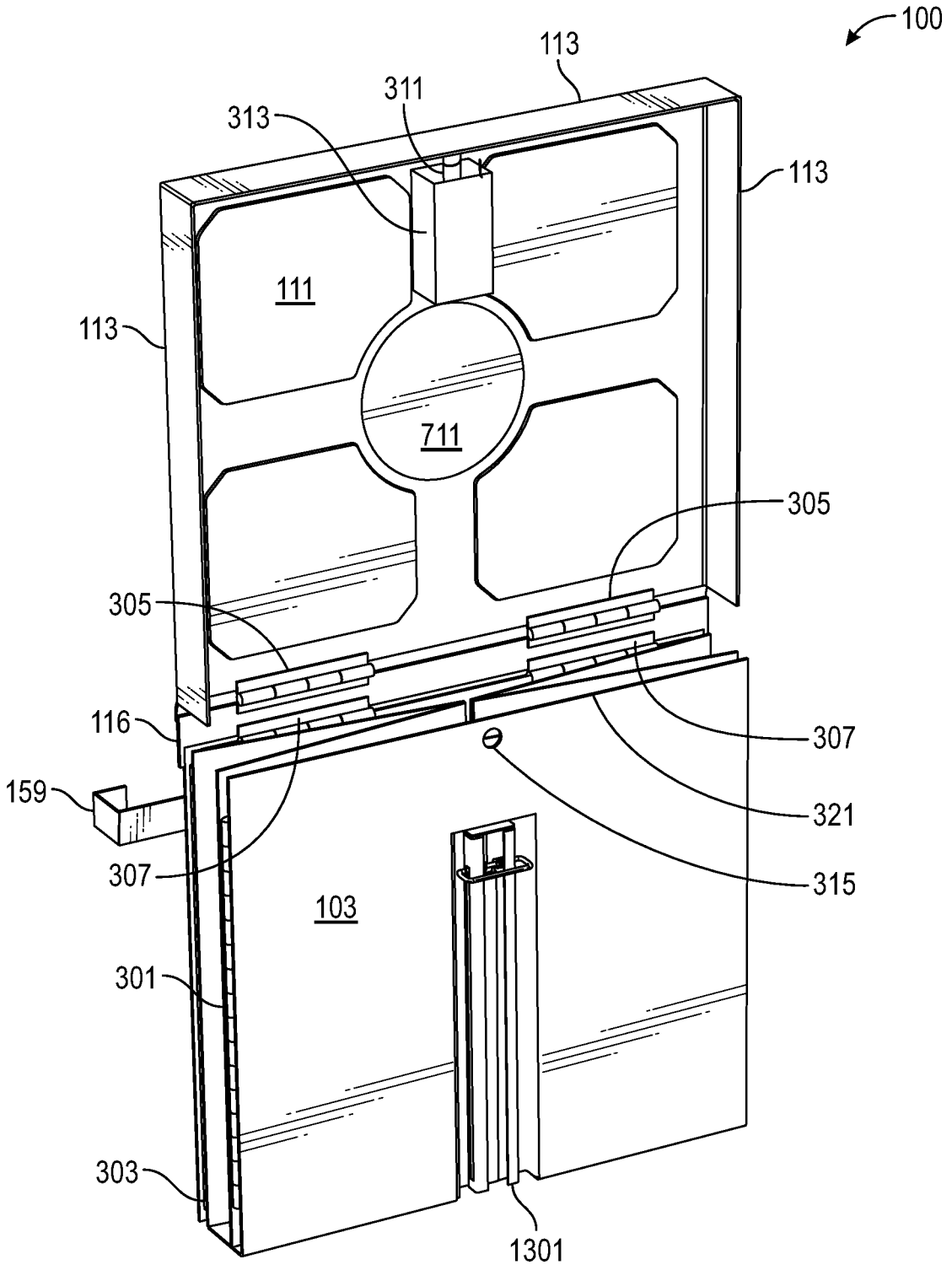
FIG. 3C may depict the lid of the package-receiving-locker in a further lifted up position as compared against FIG. 3B.
Figure 3D:
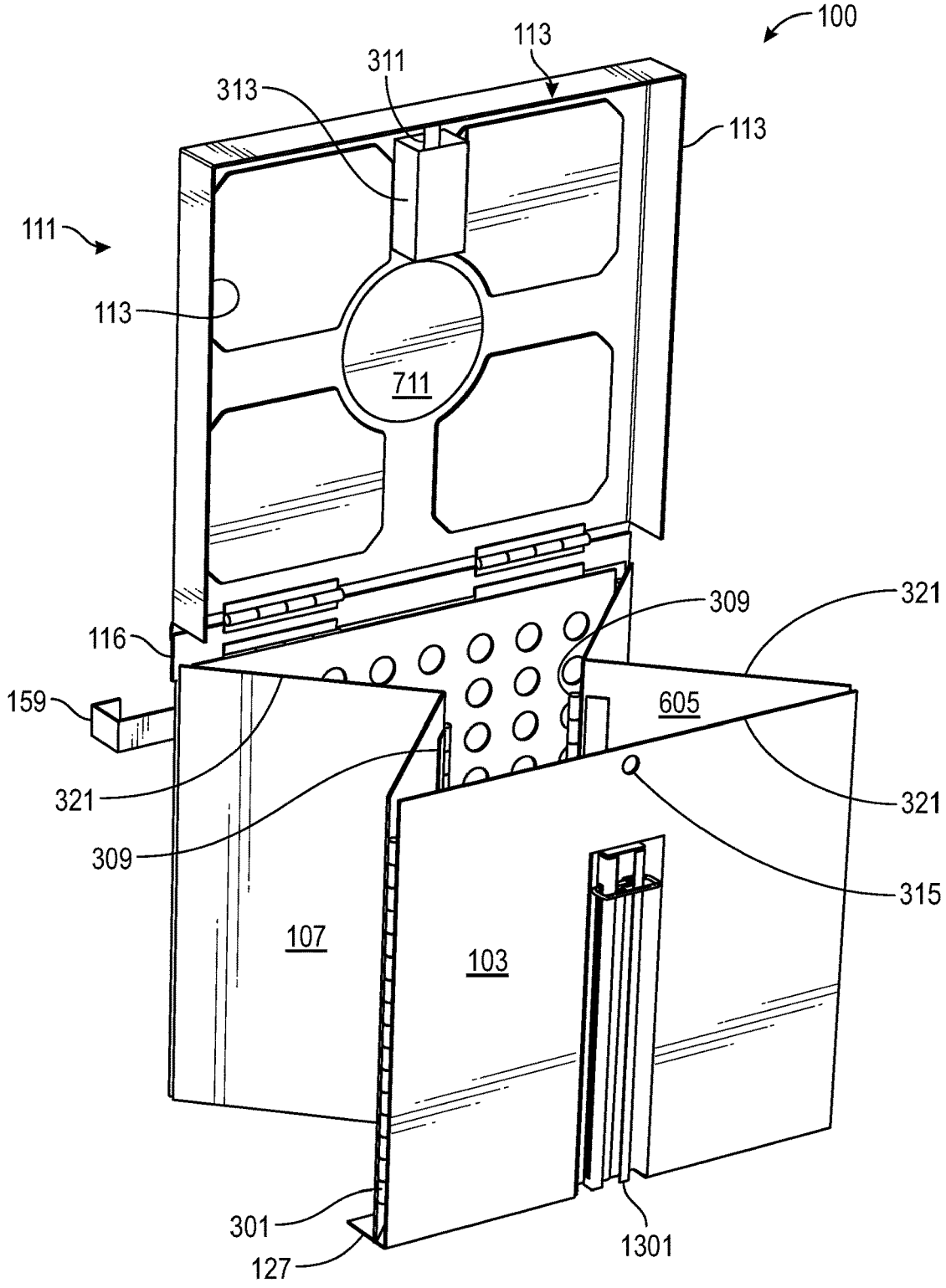
FIG. 3D may show a front-wall and the two opposing side-walls being pulled out away from a rear-wall from a collapsible-locker of the package-receiving-locker.
Figure 3E:
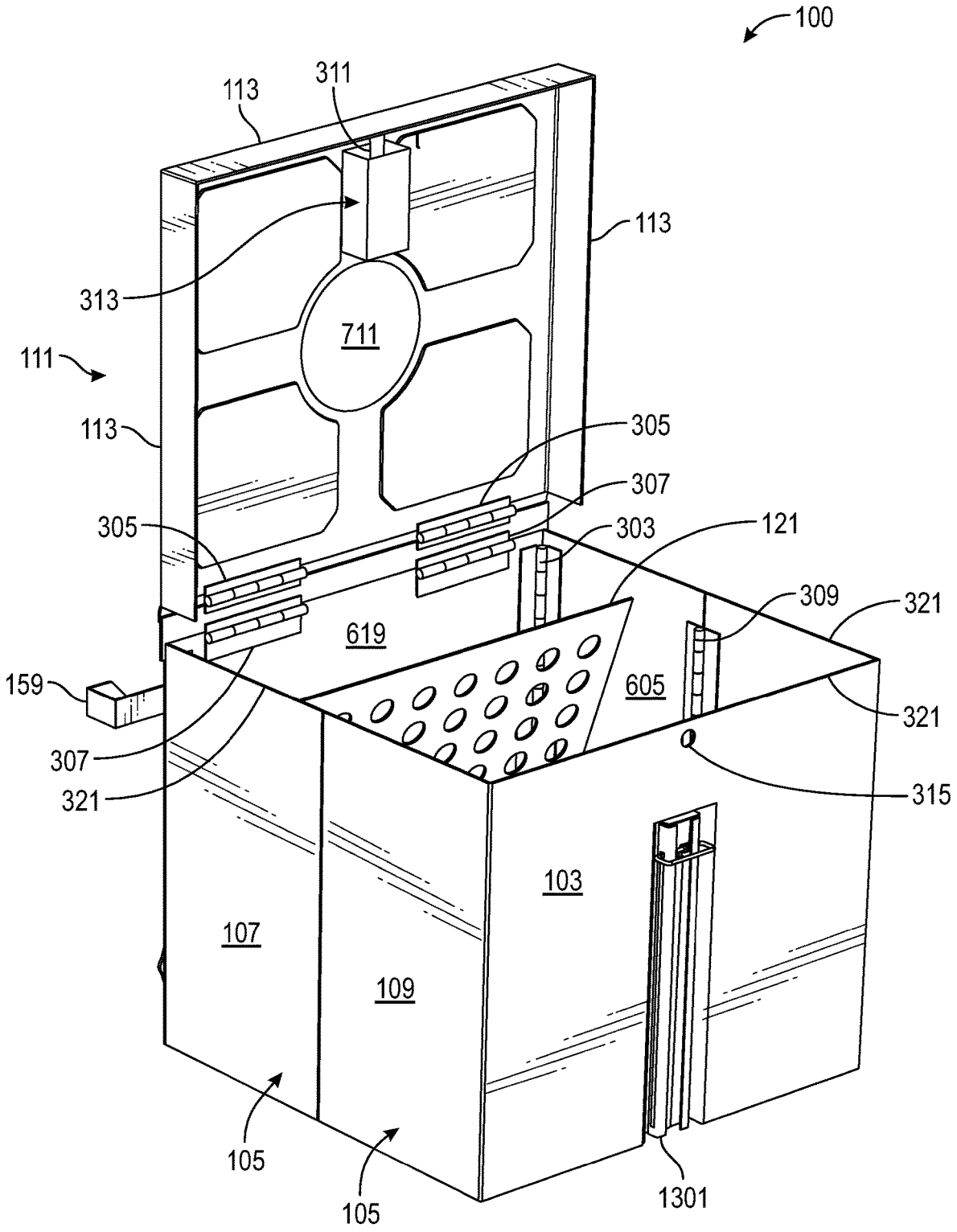
FIG. 3E may show the front-wall and the two opposing side-walls fully pulled out away from the rear-wall of the collapsible-locker; and with a floor being allowed to pivot downwards and drop into place, being supported by a floor-support.
Figure 3F:
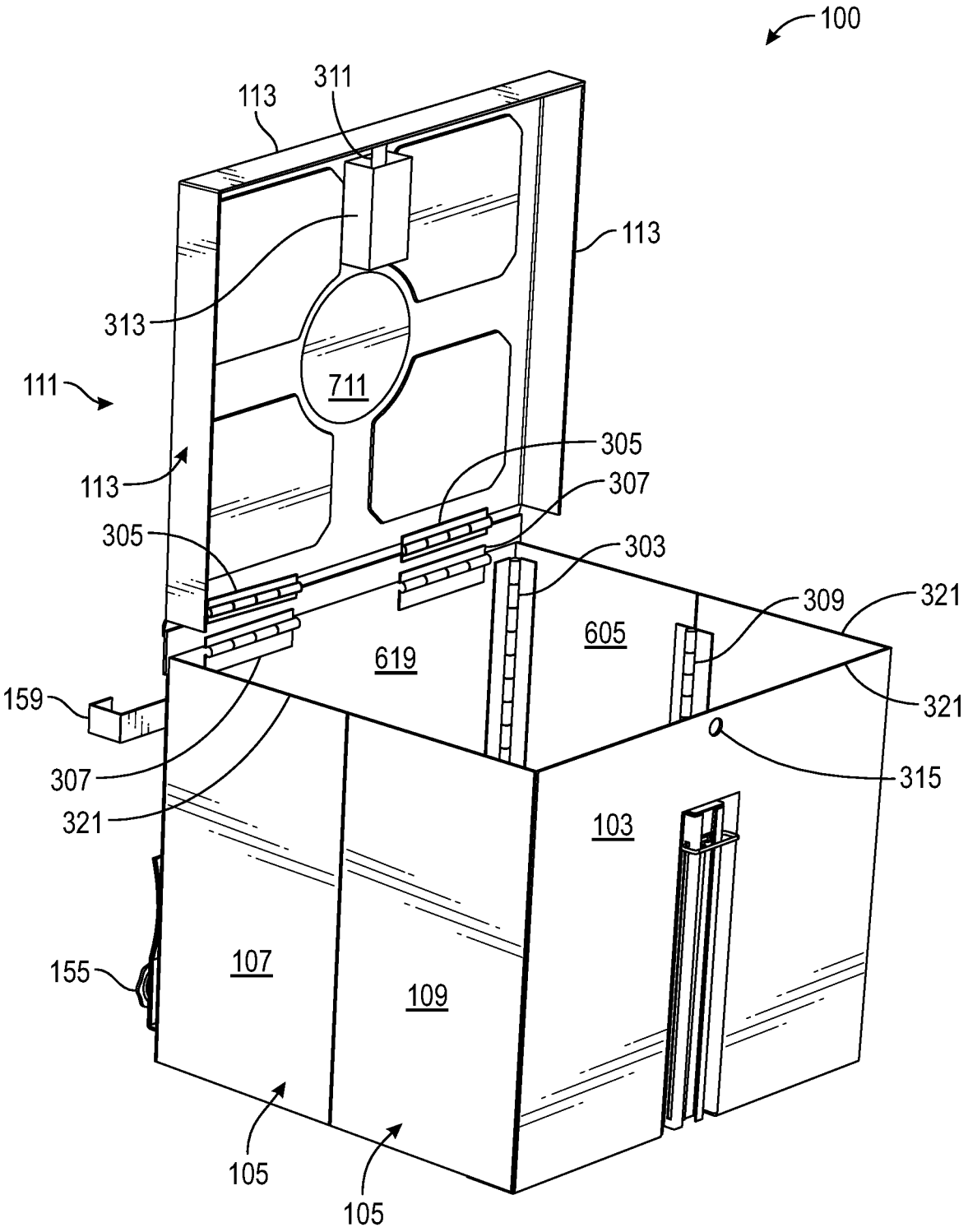
FIG. 3F may show the collapsible-locker (of the package-receiving-locker) in its fully deployed configuration, shown from a front, left, top, perspective view, with the lid open.

FIG. 3A through FIG. 3F may show the package-receiving-locker 100 in a process of being deployed from the substantially collapsed configuration to the substantially deployed configuration. FIG. 3A may depict a front, left, top, perspective view of the substantially collapsed package-receiving-locker 100 from FIG. 2A. FIG. 3A may be an opposing view as compared to FIG. 2A, where both views may be showing the same package-receiving-locker 100 in the same substantially collapsed configuration. FIG. 3B may depict lid 111 of the package-receiving-locker 100 being lifted up in preparation for deployment. FIG. 3C may depict lid 111 of the package-receiving-locker 100 in a further lifted up position as compared against FIG. 3B. FIG. 3D may show front-wall 103 and the two opposing side-walls 105 being pulled out away from rear-wall 119 from a collapsible-locker 101. FIG. 3E may show front-wall 103 and the two opposing side-walls 105 fully pulled out away from rear-wall 119 from the collapsible-locker 101; and with floor 121 being allowed to pivot (e.g., via hinges) downwards and into place, being supported by floor-support 127. FIG. 3F may show the collapsible-locker 101 in its fully deployed configuration, shown from a front, left, top, perspective view, with the lid 111 open. Note, in FIG. 3F, an upper right portion of lid 111 may be shown cut off (i.e., missing) from the drawing figure.

In FIG. 3B a portion of one of two front-side-hinges 301 may be seen. In some embodiments, collapsible-locker 101 may comprise two oppositely disposed front-side-hinges 301. In some embodiments, front-wall 103 may be pivotally (hingedly) attached to each side-wall 105 (e.g., side-wall-panel-closer-to-front-wall 109) via a front-side-hinge 301. In some embodiments, each front-side-hinge 301 may be located internally of collapsible-locker 101. In some embodiments, each front-side-hinge 301 may be a hinge that is substantially elongate. In some embodiments, portions of this same front-side-hinge 301 may also be seen in FIG. 3C and in FIG. 3D.

In FIG. 3B a small portion of one of two rear-side-hinges 303 may be seen. In some embodiments, collapsible-locker 101 may comprise two oppositely disposed rear-side-hinges 303. In some embodiments, rear-wall 119 may be pivotally (hingedly) attached to each side-wall 105 (e.g., side-wall-panel-closer-to-rear-wall 107) via a rear-side-hinge 303. In some embodiments, each rear-side-hinge 303 may be located internally of collapsible-locker 101. In some embodiments, each rear-side-hinge 303 may be a hinge that is substantially elongate. In some embodiments, portions of this same rear-side-hinge 303 may also be seen in FIG. 3C. FIG. 3E and FIG. 3F may show the other rear-side-hinge 303 located within the storage volume of collapsible-locker 101.

FIG. 3C may show a portion of bolt 311, housing 313, and bolt-receiver 315. In some embodiments, collapsible-locker 101 may comprise bolt 311, housing 313, and bolt-receiver 315. In some embodiments, bolt-receiver 315 may be a hole in front-wall 103 for receiving a distal terminal end of bolt 311. In some embodiments, when the distal terminal end of bolt 311 may be inserted into bolt-receiver 315, the package-receiving-locker 100 may be locked, with lid 111 secured to front-wall 103 (or with lid 111 secured to a side-wall 105). In some embodiments, at least portions of bolt 311 may be housed within housing 313. In some embodiments, housing 313 may be attached to an underside of lid 111. In some embodiments, housing 313 may house electronics. In some embodiments, bolt 311 may be driven closed or open via a solenoid, a servo motor, worm drive, a linear motor, magnets, and/or the like; and the driver may be controlled by computing-device 1500 of the given package-receiving-locker. In some embodiments, bolt 311 may be substantially constructed from one or more: metals and/or metal alloys; non-ferrous metal(s); carbon fiber; plastic(s) (with or without fillers, such as, but not limited to, glass fibers); composites; ceramics; laminates; combinations thereof; and/or the like. In some embodiments, bolt 311, housing 313, and bolt-receiver 315 may also be seen in FIG. 3D, FIG. 3E, and/or FIG. 3F.

FIG. 3C may show lid-hinges 305. In some embodiments, collapsible-locker 101 may comprise one or more lid-hinges 305. In some embodiments, lid 111 may be pivotally (hingedly) attached to top-panel 116 via one or more lid-hinges 305. In some embodiments, lid-hinges 305 may be located within collapsible-locker 101. In some embodiments, lid-hinge 305 may be a hinge that is substantially elongate. In some embodiments, lid-hinge 305 may be a torque hinge and/or a friction hinge, such that lid 111 may stay open when opened and when lid 111 may under its own load weight. This may prevent finger pinching problems of lid 111 closing unintentionally upon a user's fingers. Lid-hinges 305 may also be shown in FIG. 3D, FIG. 3E, and FIG. 3F.

FIG. 3D may show opening-to-interior 321. In some embodiments, when collapsible-locker 101 may be in its deployed configuration, disposed away from floor 121, may be opening-to-interior 321 located at the top edges (top lips) of front-wall 103, side-walls 105, and rear-wall 119. In some embodiments, when collapsible-locker 101 may be in its deployed configuration, and when lid 111 may be open, then at least portions of opening-to-interior 321 may be exteriorly visible. In some embodiments, when collapsible-locker 101 may be in its deployed configuration, and when lid 111 may be open, opening-to-interior 321 may provide access to an interior of collapsible-locker 101. In some embodiments, when collapsible-locker 101 may be in its deployed configuration, and when lid 111 may be open, opening-to-interior 321 may provide access to the interior void volume (space) of collapsible-locker 101. In some embodiments, this interior void volume of collapsible-locker 101 may be used to removably store and/or house various objects, such as, but not limited to packages, parcels, mail, boxes, containers, articles, documents, bags, sacks, pouches, consumer goods, electronic devices, clothing, food, beverages, and/or the like.

FIG. 3E may show top-rear-hinges 307. In some embodiments, collapsible-locker 101 may comprise one or more top-rear-hinge(s) 307. In some embodiments, top-panel 116 may be pivotally (hingedly) attached to rear-wall 119 via one or more top-rear-hinge 307. In some embodiments, top-rear-hinges 307 may be located within collapsible-locker 101. In some embodiments, top-rear-hinge 307 may be a hinge that is substantially elongate. In some embodiments, top-rear-hinge 307 may be a torque hinge and/or a friction hinge, such that lid 111 may stay open when opened and when lid 111 and top-panel 116 may under their own load weight, including the weight of their hinges. This may prevent finger pinching problems of lid 111 closing unintentionally upon a user's fingers. Top-rear-hinges 307 may also be shown in FIG. FIG. 3F. FIG. 3C and FIG. 3D may show top portions of top-rear-hinges 307.

In FIG. 3D portions of side-hinges 309 may be seen. In some embodiments, collapsible-locker 101 may comprise two oppositely disposed side-hinges 309. In some embodiments, side-wall-panel-closer-to-rear-wall 107 may be pivotally (hingedly) attached to side-wall-panel-closer-to-front-wall 109 via a side-hinge 309. In some embodiments, each side-hinge 309 may be located internally of collapsible-locker 101. In some embodiments, each side-hinge 309 may be a hinge that is substantially elongate. FIG. 3E and FIG. 3F may also show portions of side-hinges 309.

Figure 4A:
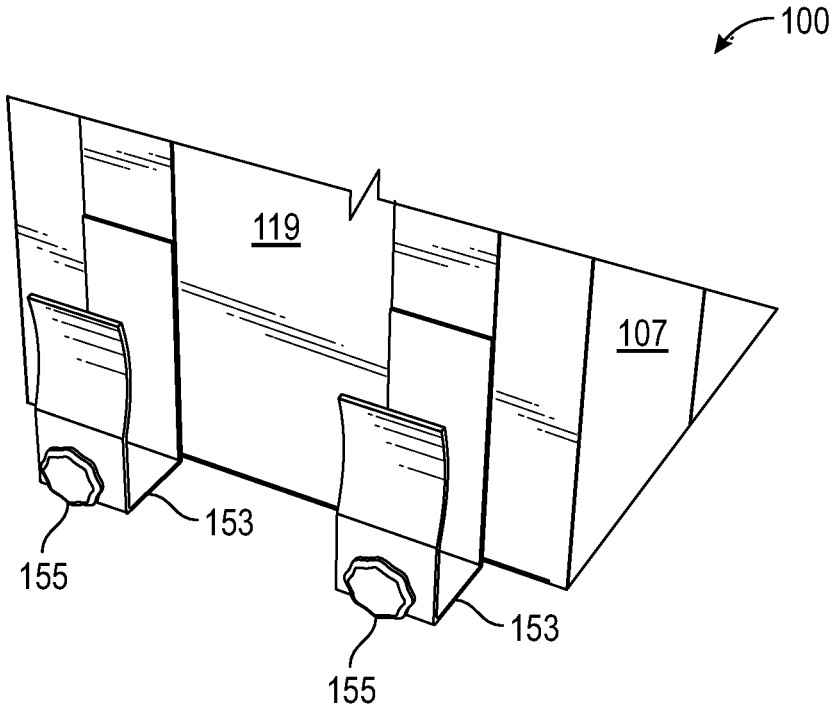
FIG. 4A may show a bottom-door-bracket (of the package-receiving-locker) from a partial rear perspective view.
Figure 4B:
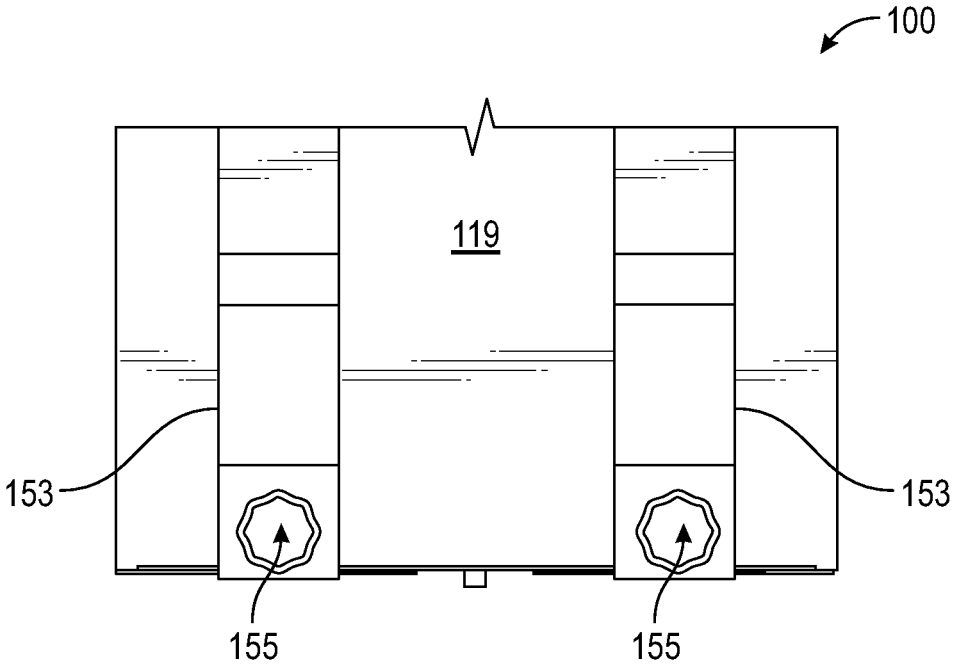
FIG. 4B may show the bottom-door-bracket from a partial rear view.
Figure 4C:
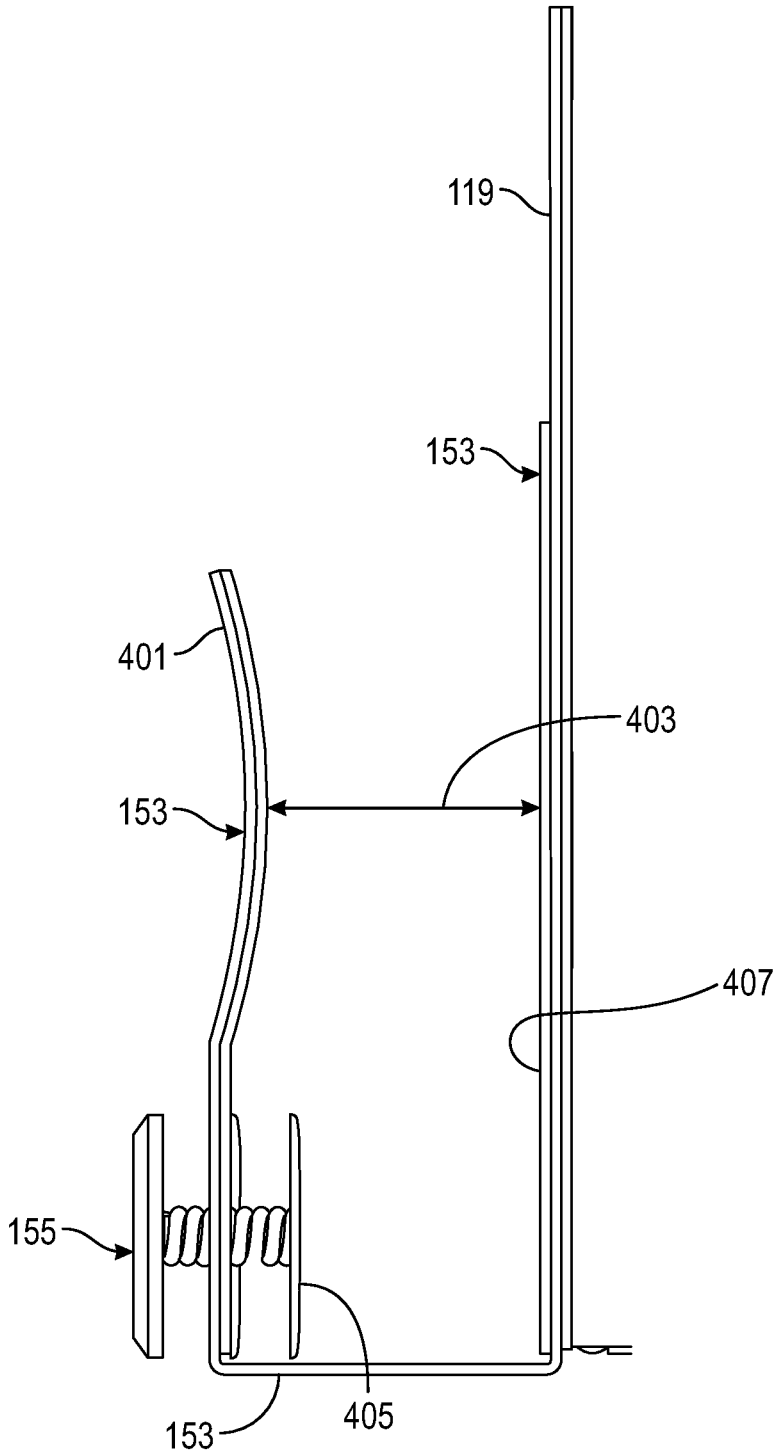
FIG. 4C may show the bottom-door-bracket from a partial side-view.
Figure 4D:
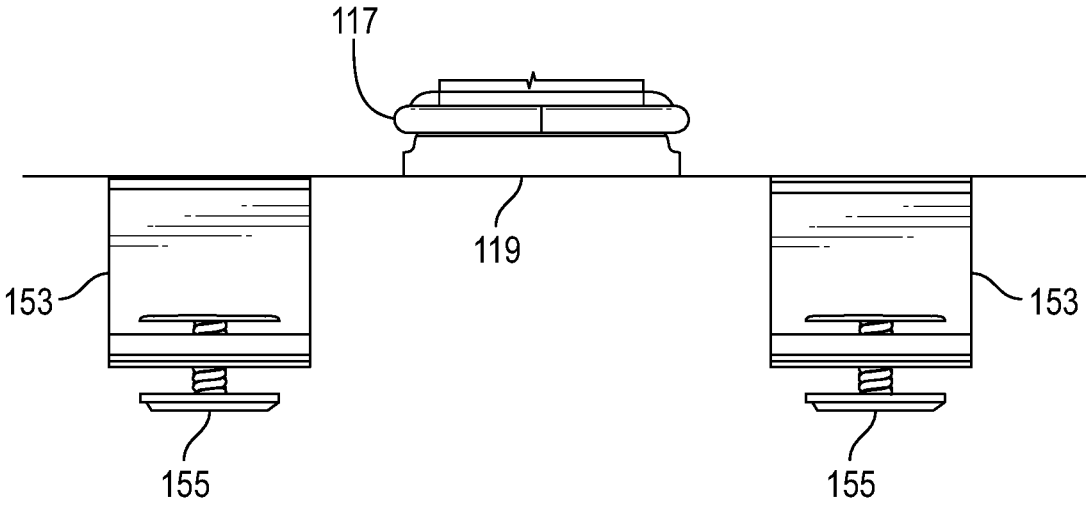
FIG. 4D may show the bottom-door-bracket from a partial top view.
Figure 4E:
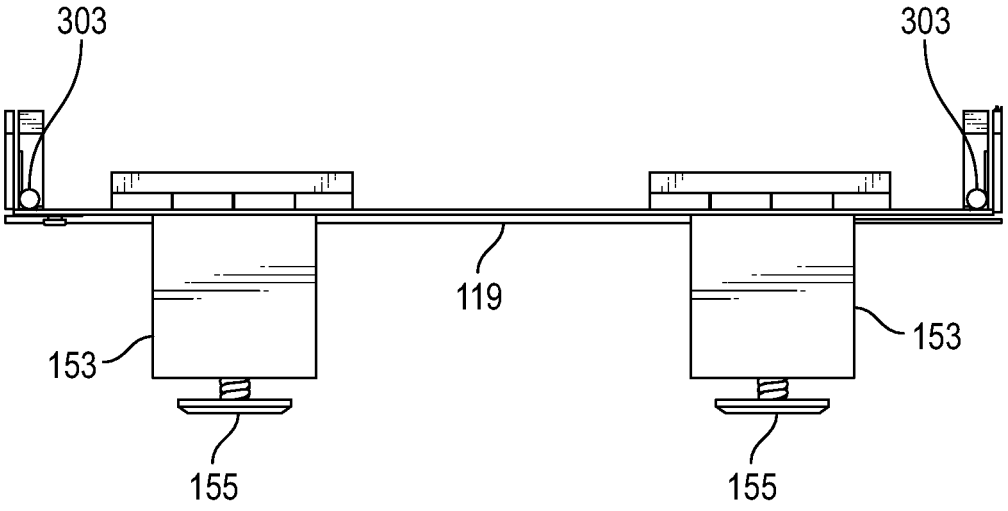
FIG. 4E may show the bottom-door-bracket from a partial bottom view.
Figure 4F:
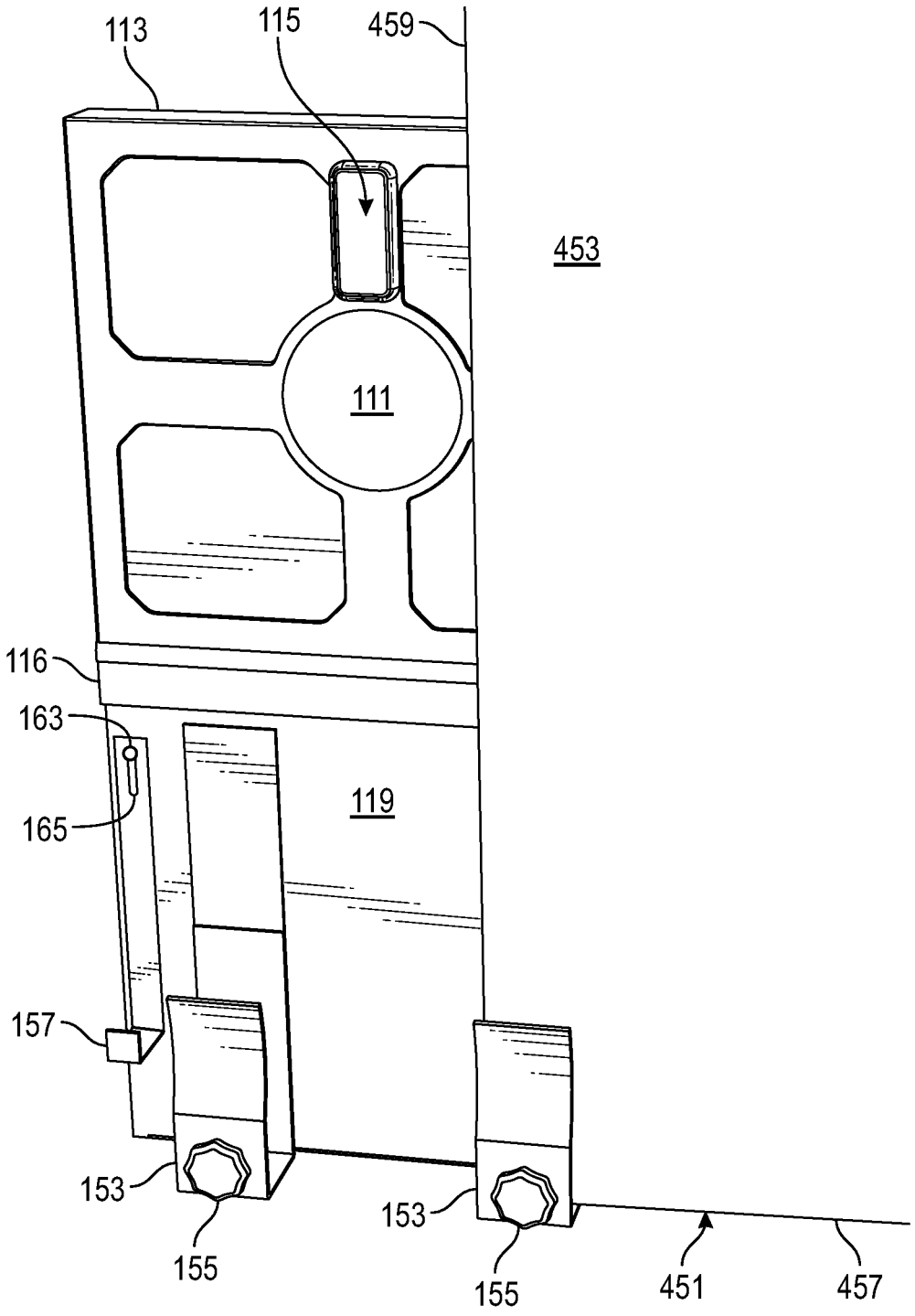
FIG. 4F may show the bottom-door-bracket in a process of being slid onto a door, shown from a rear perspective view.
Figure 4G:
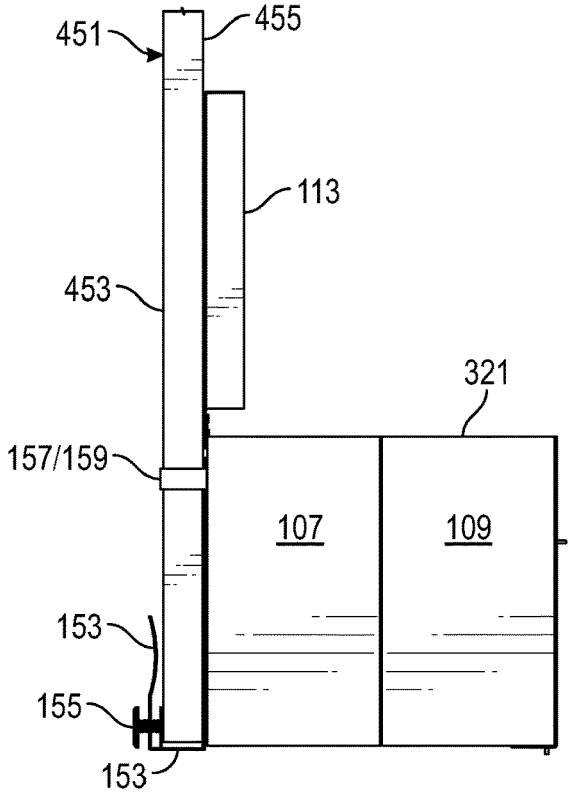
FIG. 4G may show the bottom-door-bracket removably mounted (attached) to the door, shown from a side-view.
Figure 4H:
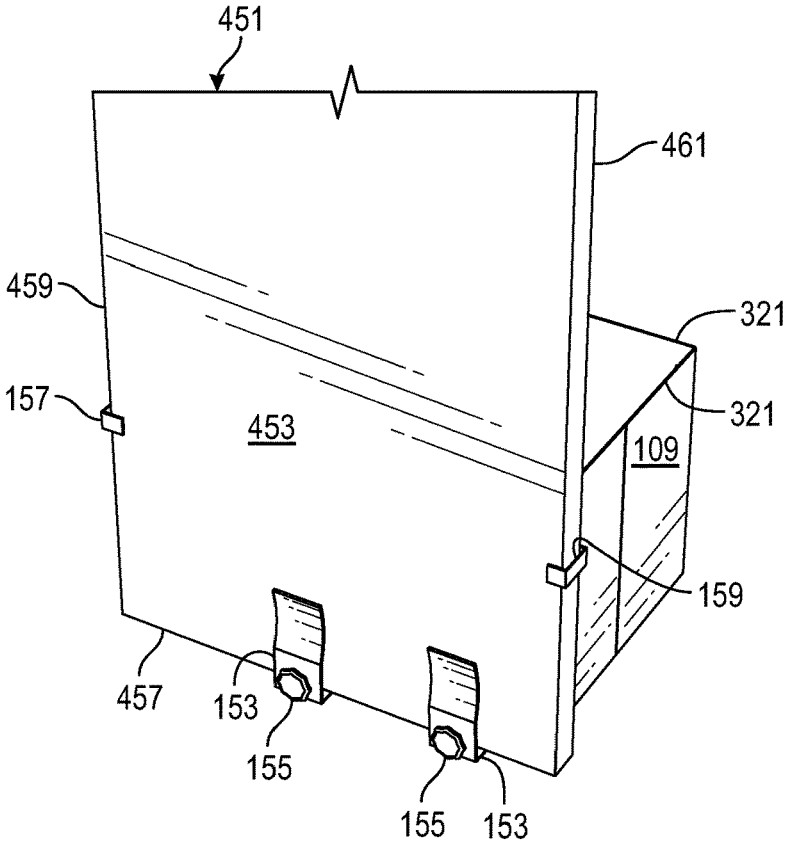
FIG. 4H may show the bottom-door-bracket removably mounted (attached) to the door, shown from a partial rear perspective view.

FIG. 4A through FIG. 4H may show and focus on a bottom rear portion of the package-receiving-locker 100, specifically a bottom portion of the door-attachment-structures 151, bottom-door-bracket 153. FIG. 4A may show bottom-door-bracket 153 from a partial rear perspective view. FIG. 4B may show bottom-door-bracket 153 from a partial rear view. FIG. 4C may show bottom-door-bracket 153 from a partial side-view. FIG. 4D may show bottom-door-bracket 153 from a partial top view. FIG. 4E may show bottom-door-bracket 153 from a partial bottom view. FIG. 4F may show bottom-door-bracket 153 in a process of being slid onto a door 451, shown from a rear perspective view. FIG. 4G may show bottom-door-bracket 153 removably mounted (attached) to the door 451, shown from a side-view. FIG. 4H may show bottom-door-bracket 153 removably mounted (attached) to the door 451, shown from a partial rear perspective view.

In some embodiments, bottom-door-bracket(s) 153 may be configured to removably attach to a door-bottom 457 of door 451. See e.g., FIG. 4F, FIG. 4G, and FIG. 4H. In some embodiments, bottom-door-bracket(s) 153 may be one or more brackets, sized to generally fit a width of a variety of doors 451, particularly exterior doors 451 for accessing a given structure (such as a residence, home, office, business, building, etc.). In some embodiments, bottom-door-bracket(s) 153 may further comprise one or more adjustment-screws 155, which upon tightening may apply pressure against the bottom of the door 451 that may be received within the brackets of bottom-door-bracket(s) 153. In some embodiments, adjustment-screws 155 may pass orthogonally through exterior portions of bottom-door-bracket(s) 153 that may be disposed away from rear-wall 119. See e.g., FIG. 4A, FIG. 4B, FIG. 4C, FIG. 4D, FIG. 4E, FIG. 4F, FIG. 4G, and FIG. 4H.

In some embodiments, door 451 may be swinging hinged door. In some embodiments, door 451 may be swinging side-hinged-door. In some embodiments, door 451 may be a door for accessing a given structure (such as a residence, home, office, business, building, etc.). In some embodiments, door 451 may be exterior door, an access door, and/or an entry door. In some embodiments, door 451 have predetermined and fixed length, width, and thickness. In some embodiments, a width of door 451 may be selected from 24 inches to 42 inches, plus or minus one inch. For example, in the United States, many such exterior doors have a width of 36 inches, 32 inches, or 30 inches; however, other predetermined widths may be applicable. As a hinged door, door 451 may have a non-hinge-side 459 and opposite its hinge-side 461. As an exterior door, door 451 may have two opposing major surfaces (that may be largely planar/flat), a door-inside 453 and opposite a door-outside 455. Door-inside 453 may face the inside (interior) of the given building when door 451 may be closed. Door-outside 455 may face the outside (exterior) of the given building when door 451 may be closed. At least portions of door 451 may be shown in FIG. 4F, FIG. 4H, FIG. 5C through FIG. 5F, FIG. 12A through FIG. 12C, FIG. 13A, FIG. 14A through FIG. 14E, and FIG. 32A through FIG. 35B.

In some embodiments, bottom-door-bracket(s) 153 may form a void space of a separation-gap 403, wherein a distance of separation-gap 403 may be configured to removably receive a width of door 451. In some embodiments, separation-gap 403 may be formed in (from) opposing regions of bottom-door-bracket 153. In some embodiments, bottom-door-bracket 153 may terminate in a curve-away 401 region, that may curve away from a region of bottom-door-bracket 153 that may be attached to or part of rear-wall 119. In some embodiments, this curve-away 401 may facilitate easier loading of the width and the bottom of door 451 into bottom-door-bracket 153. In some embodiments, this curve-away 401 may facilitate a clamping function of bottom-door-bracket 153 against the width and the bottom of door 451, because before curve-away 401 may be portion of bottom-door-bracket 153 that curves back towards bottom-door-bracket 153 that may be attached to or part of rear-wall 119. See e.g., FIG. 4C.

In some embodiments, surfaces of bottom-door-bracket(s) 153 and/or surfaces of adjustment-screws 155 which may physically contact the given door 451, may be padded and/or cushioned to minimize any damage to the bottom of door 451. In some embodiments, such padding and/or cushioning may be accomplished by use of rubber, silicone, elastomers, combinations thereof, and/or the like. See e.g., protective-covering 405 and protective-covering 407 in FIG. 4C. In some embodiments, protective-covering 405 may be on surfaces of adjustment-screws 155 that may contact exterior surfaces of door 451. In some embodiments, protective-covering 407 may be on surfaces of bottom-door-bracket 153 that may contact exterior surfaces of door 451. See e.g., FIG. 4C.

In some embodiments, when removably attaching (or detaching) package-receiving-locker 100 to door 451, package-receiving-locker 100 may be in the substantially collapsed configuration or in the substantially deployed configuration.

In some embodiments, when removably attaching package-receiving-locker 100 to door 451, door-bottom 457 may be slid on top of the bottoms of bottom-door-bracket 153 from a non-hinge-side 459 of door 451. See e.g., FIG. 4F. In some embodiments, when package-receiving-locker 100 may be removably attached to door 451, at least a portion of bottom-door-bracket 153, including adjustment-screw 155, may be located on an interior of the structure that door 451 may be permitting entry access to; and collapsible-locker 101 may be located exteriorly of this structure that door 451 may be permitting entry access to.

In some embodiments, when package-receiving-locker 100 may be removably attached to door 451, at least a portion of bottom-door-bracket 153, including adjustment-screw 155, may be located closer and proximate to door-inside 453 of door 451 than to door-outside 455 of door 451; and collapsible-locker 101 may be located closer and proximate to door-outside 455 of door 451 than to door-inside 453 of door 451. See e.g., FIG. 4G and FIG. 4H.

In some embodiments, when package-receiving-locker 100 may be removably attached to door 451, in a final intended location with respect to door 451, collapsible-locker 101 may be located closer to hinge-side 461 of door 451 than to non-hinge-side 459 of door 451. See e.g., FIG. 4H, FIG. 5E, and FIG. 5F. Such positioning of collapsible-locker 101 on door 451 may be important to preserve intended functionality of door 451, i.e., opening and closing of door 451, when package-receiving-locker 100 may be removably attached to door 451.

Figure 5A:
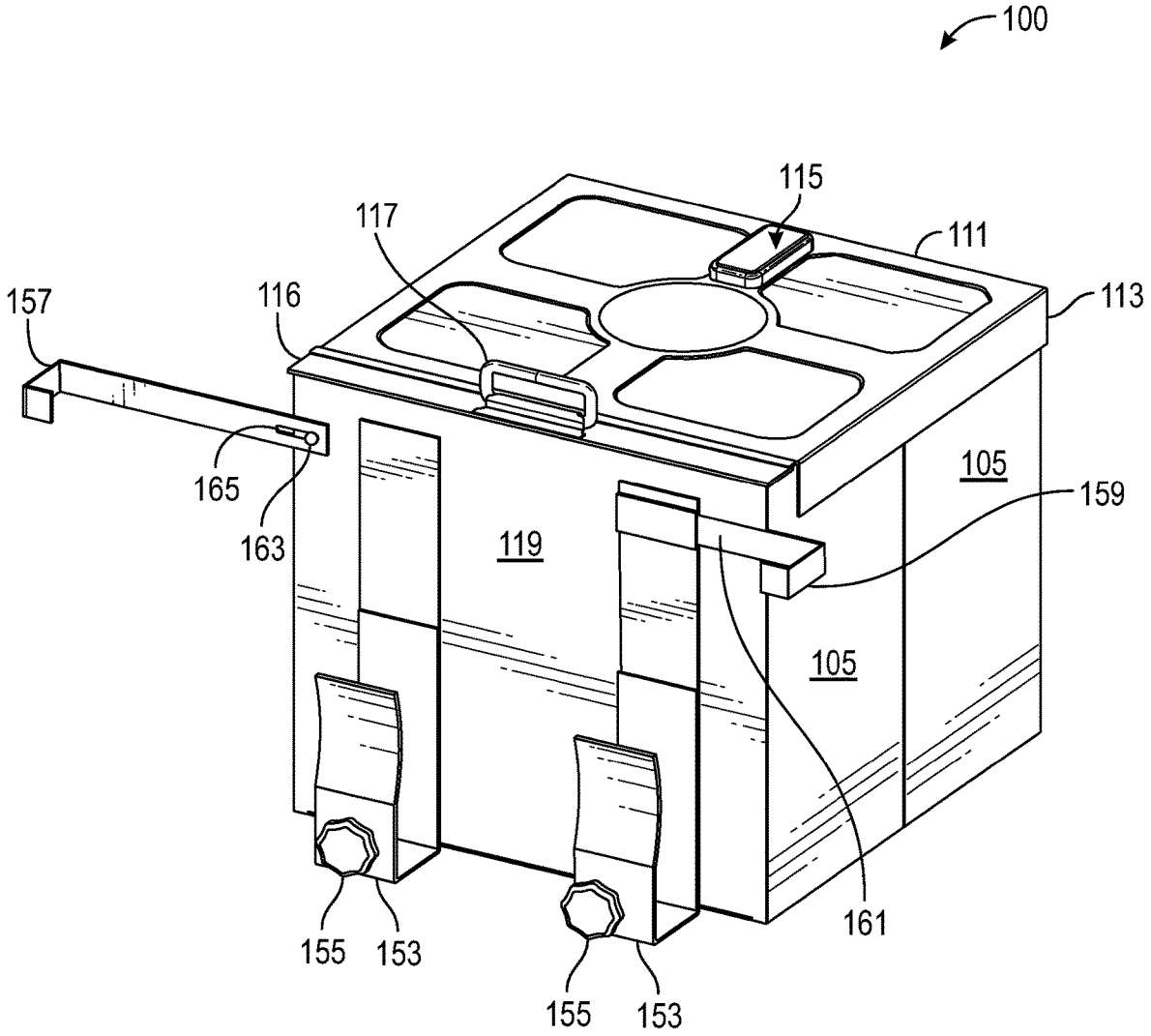
FIG. 5A may show the package-receiving-locker in its fully (or substantially) deployed configuration, from a rear perspective view showing two opposing J-hooks (of the package-receiving-locker) for removable attachment to the door.
Figure 5B:
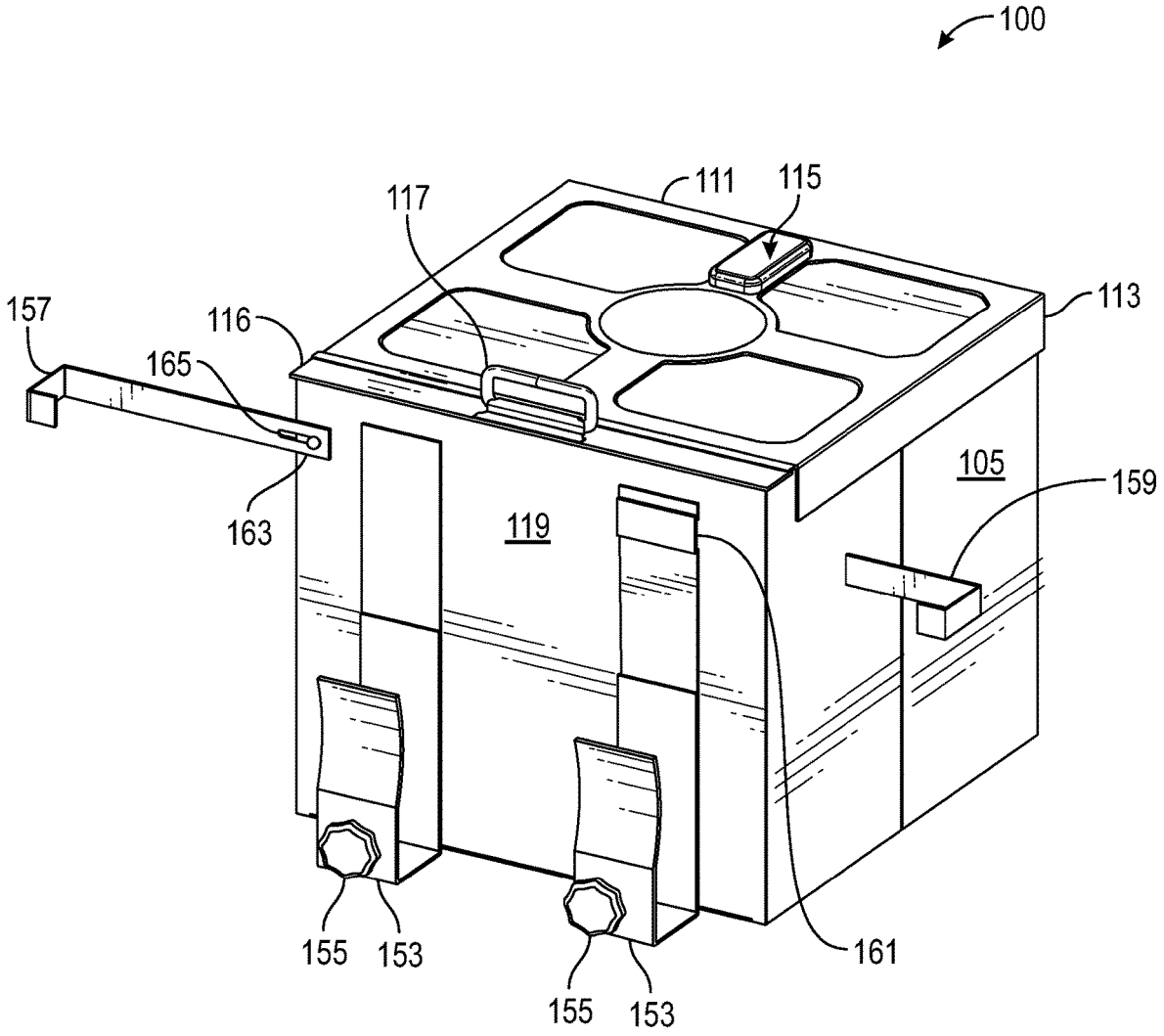
FIG. 5B may show the package-receiving-locker in its fully (or substantially) deployed configuration, from a rear perspective view showing the two opposing J-hooks.
Figure 5C:
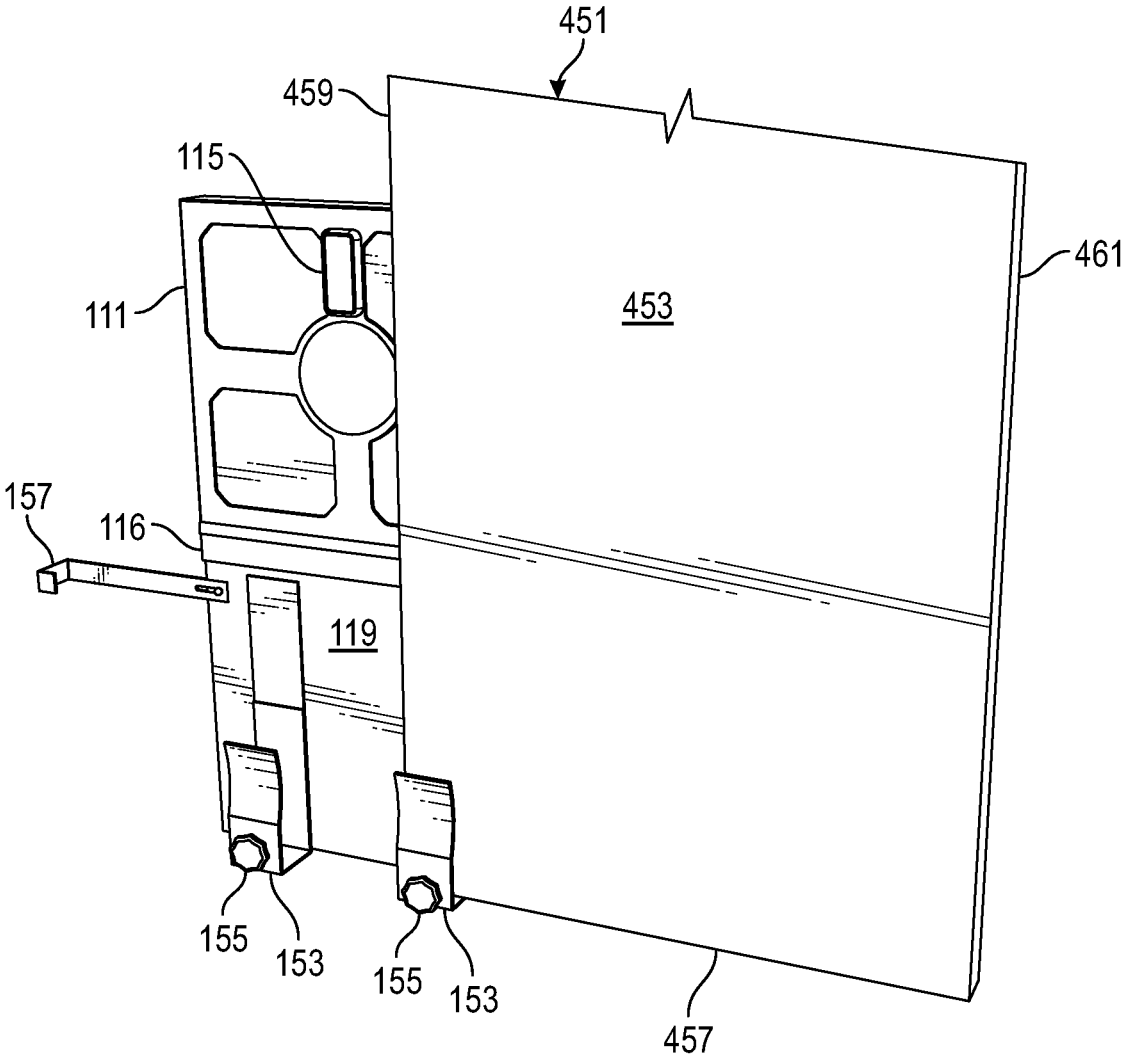
FIG. 5C may show the bottom-door-brackets in a process of being slid onto the door, shown from a rear perspective view.
Figure 5D:
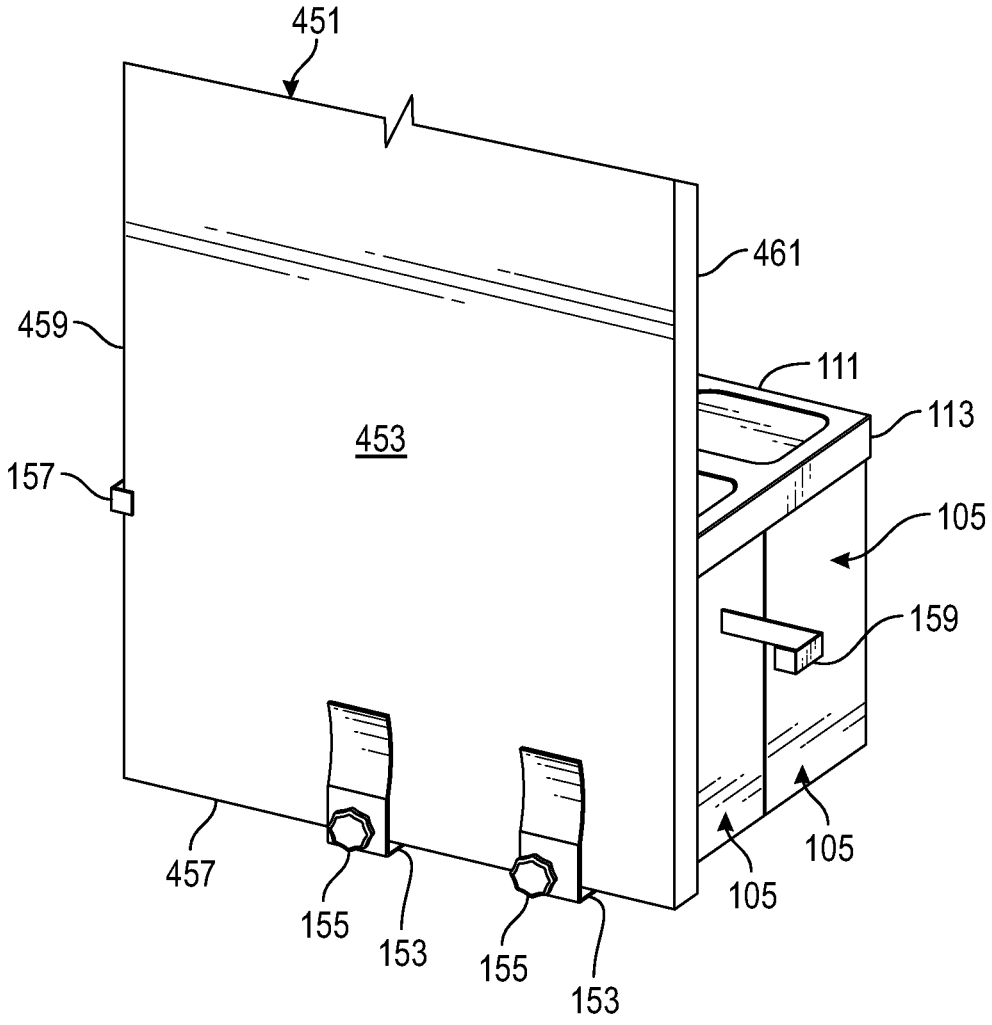
FIG. 5D may show a non-hinge-side of the door, removably captured (engaged) by a pivoting J-hook (of the package-receiving-locker), shown from a rear perspective view, showing door-inside.

FIG. 5A through FIG. 5F may show and focus on an upper rear portion of the package-receiving-locker 100, specifically an upper portion of the door-attachment-structures 151, two opposing J-hooks 157/159. FIG. 5A may show package-receiving-locker 100 in its fully deployed configuration, from a rear perspective view showing the two opposing J-hooks 157/159. FIG. 5B may show package-receiving-locker 100 in its fully deployed configuration, from a rear perspective view showing the two opposing J-hooks 157/159. In FIG. 5B, sliding J-hook 159 may be shown slid completely out of its J-hook receiver 161. FIG. 5C may show the bottom-door-brackets 153 in a process of being slid onto a door 451, shown from a rear perspective view. And once completely slid on, non-hinge-side 459 of door 451 may be removably engaged (captured) by pivoting J-hook 157. FIG. 5D may show non-hinge-side 459 of door 451, removably captured (engaged) by pivoting J-hook 157, shown from a rear perspective view, showing door-inside 453. FIG. 5D may show J-hook 159 slid completely out of its J-hook receiver 161, which in turn may then facilitate removably engaging (capturing) hinge-side 461 of door 451 with sliding hook 159 by sliding hook 159 being slid back into its J-hook receiver 161 until its hook portion removably engages (captures) hinge-side 461 of door 451.

Figure 5E:
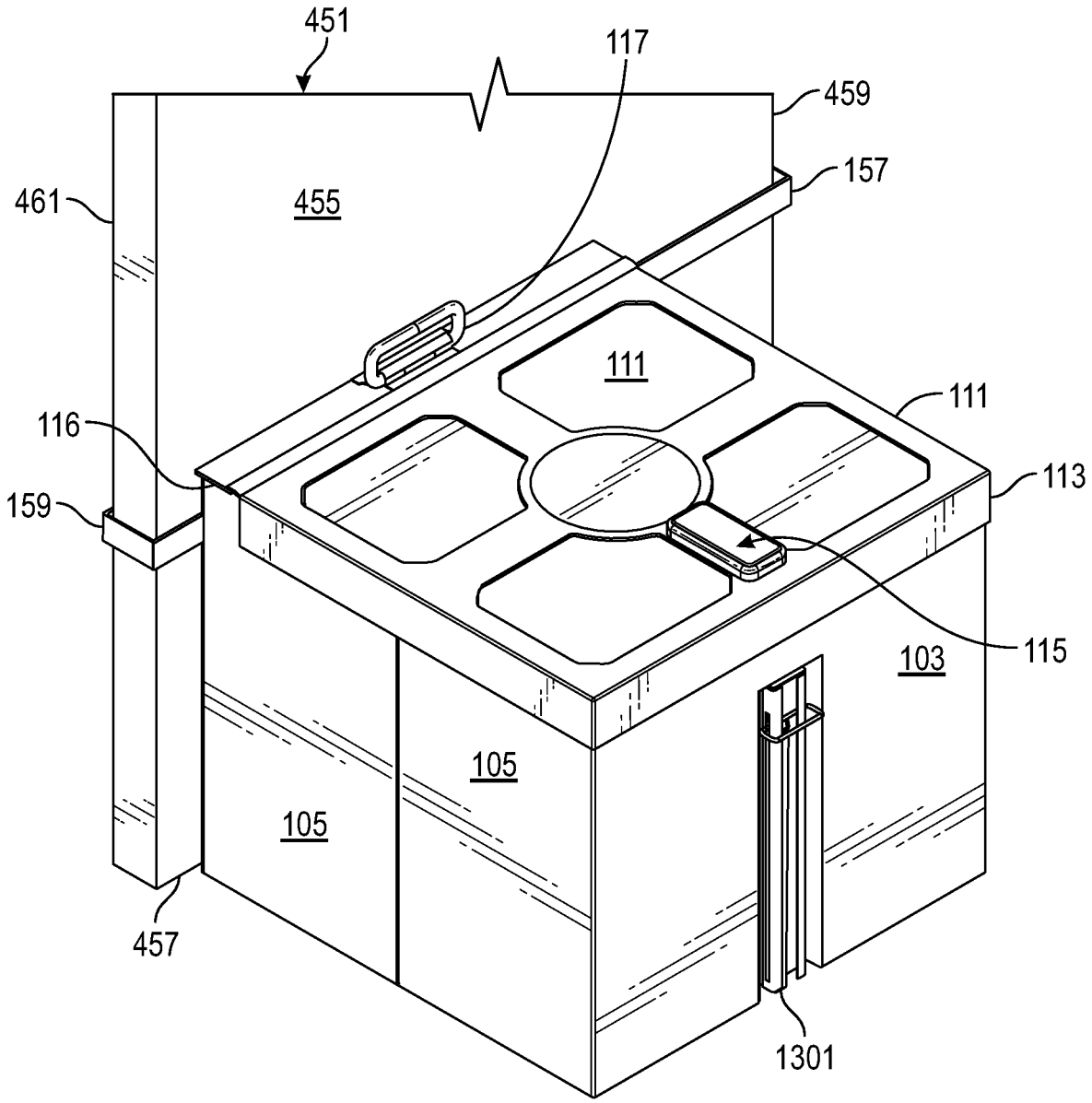
FIG. 5E may show both opposing sides of the door (e.g., a hinge-side and the non-hinge-side) being removably captured by the two opposing J-hooks (of the package-receiving-locker), shown from a front perspective view, showing door-outside.
Figure 5F:
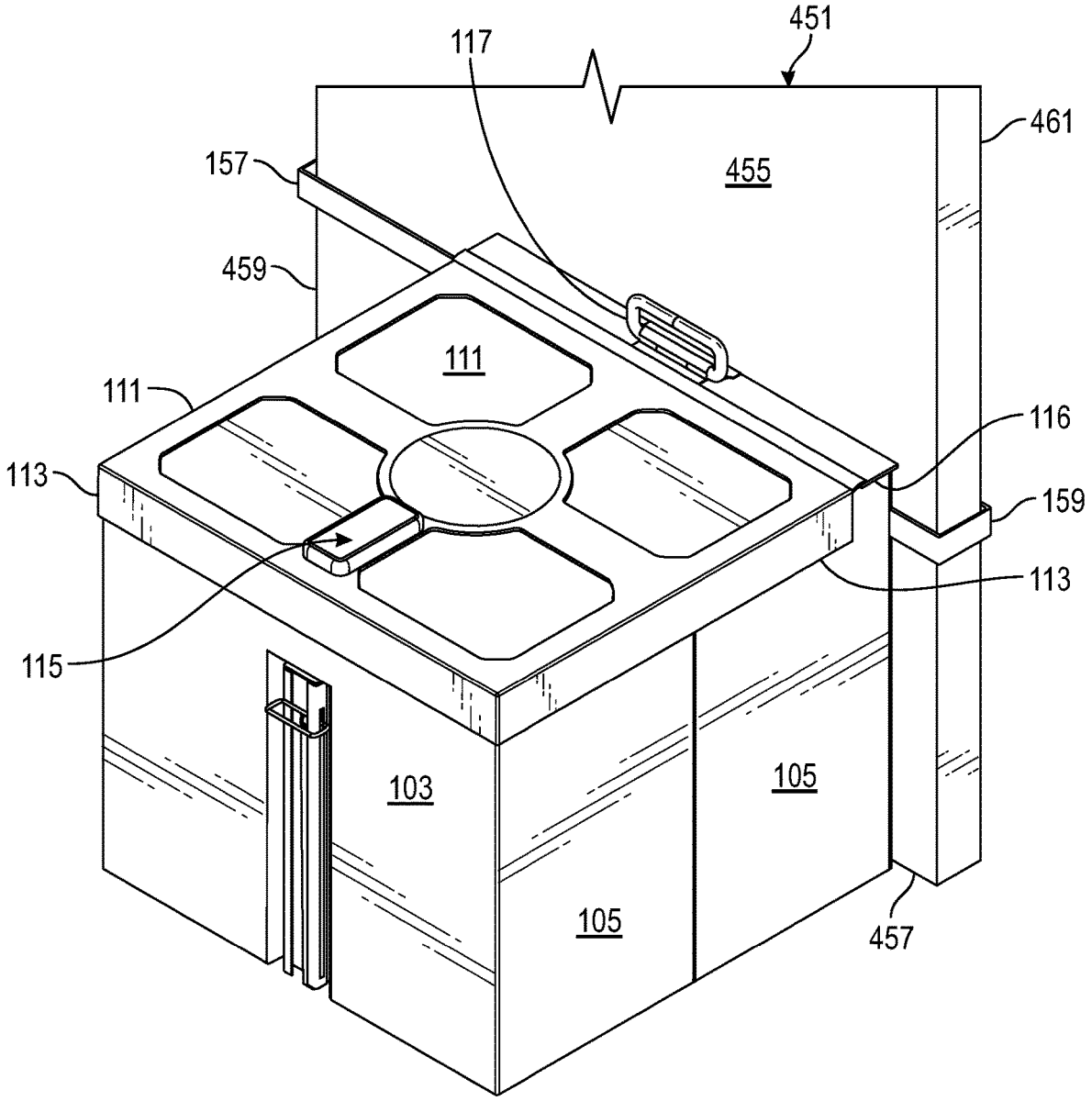
FIG. 5F may show both opposing sides of the door (e.g., the hinge-side and the non-hinge-side) being removably captured by the two opposing J-hooks, shown from a front perspective view, showing door-outside.

FIG. 5E and FIG. 5F may show both opposing sides of door 451 (hinge-side 461 and non-hinge-side 459) being removably captured by the two opposing J-hooks 159/157, shown from a front perspective view, showing door-outside 455. In some embodiments, sliding J-hook 159 may removably capture (engage) hinge-side 461 of door 451. In some embodiments, pivoting J-hook 157 may removably capture (engage) non-hinge-side 459 of door 451.

Note, FIG. 5E and FIG. 5F differ in that the shown door 451 in each of these two respective figures may have its hinge-side 461 and non-hinge-side 459 switched, i.e., on opposite sides. In some embodiments, pivoting J-hook 157 may be located on a left side of rear-wall 119; and sliding J-hook 159 may be located opposing, on a right side of rear-wall 119, see e.g., FIG. 5A. However, in other embodiments, this arrangement may be switched, with pivoting J-hook 157 located on the right side of rear-wall 119 and with sliding J-hook 159 located on the left side of rear-wall 119.

In some embodiments, both opposing J-hooks 157/159 may be sliding J-hooks. In some embodiments, both opposing J-hooks 157/159 may be pivoting J-hooks.

In some embodiments, with the above discussed door-attachment-structures 151, when door 451 may be closed, package-receiving-locker 100/900 may not be removed from door 451. In some embodiments, with the above discussed door-attachment-structures 151, when door 451 may be open, package-receiving-locker 100/900 may be removed from door 451.

Figure 6A:
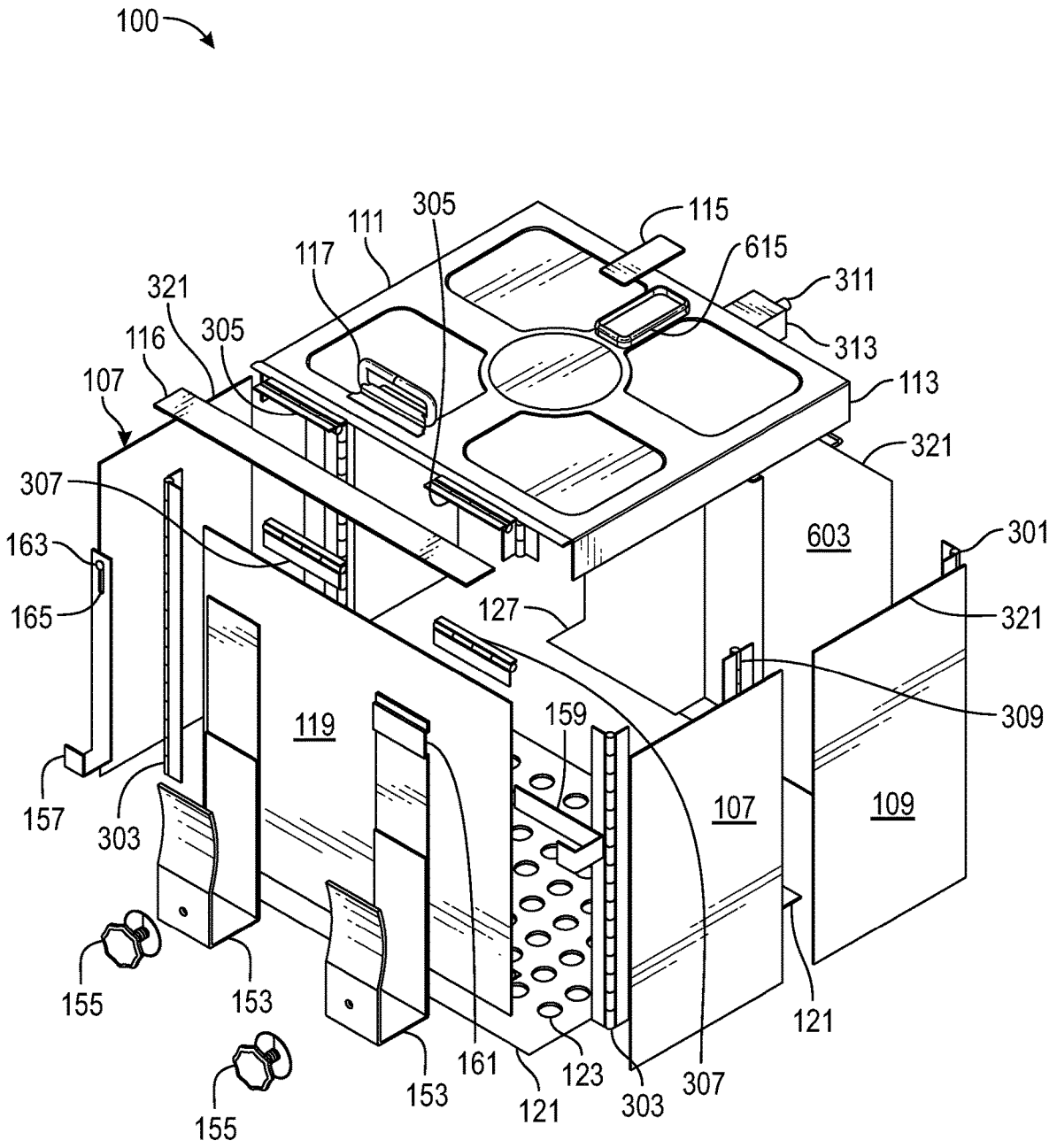
FIG. 6A may depict a rear perspective exploded view of the package-receiving-locker.
Figure 6B:
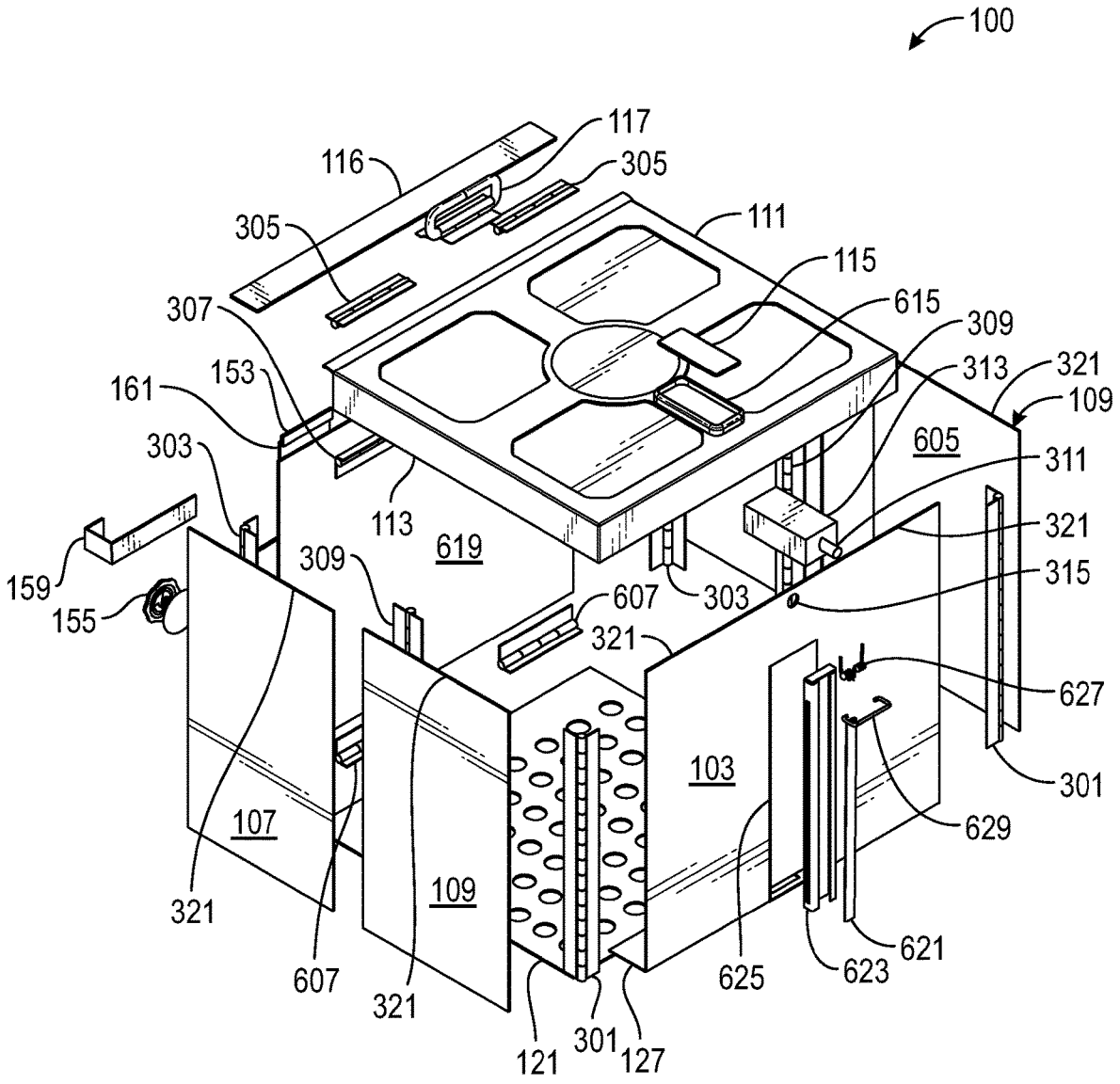
FIG. 6B may depict a front left perspective exploded view of the package-receiving-locker.

FIG. 6A and FIG. 6B may depict two perspective exploded views of the package-receiving-locker 100. FIG. 6A may depict a rear perspective exploded view of the package-receiving-locker 100. In FIG. 6A, front-wall-interior 603 may be partially seen. In some embodiments, front-wall-interior 603 may an interior facing surface of front-wall 103. FIG. 6B may depict a front left perspective exploded view of the package-receiving-locker 100. In FIG. 6B, side-wall-interior 605 may be partially seen. In some embodiments, side-wall-interior 605 may an interior facing surface of side-wall 105. In FIG. 6B, rear-wall-interior 619 may be partially seen. In some embodiments, rear-wall-interior 619 may an interior facing surface of rear-wall 119. FIG. 6B may show two bottom-hinges 607. In some embodiments, bottom-hinge(s) 607 may permit pivoting motion of floor 121 with respect to a bottom of rear-wall 119. In some embodiments, bottom-hinge(s) 607 may be attached to the bottom of rear-wall 119 and to floor 121. In some embodiments, collapsible-locker 101 may comprise one or more such bottom-hinges 607. FIG. 6B may show interface-housing 615. In some embodiments, a top of exterior-interface 115 may be attached to interface-housing 615. In some embodiments, interface-housing 615 may house electronics of exterior-interface 115. In some embodiments, collapsible-locker 101 may comprise interface-housing 615. In some embodiments, interface-housing 615 may be located on and/or in lid 111.

Figure 13A:
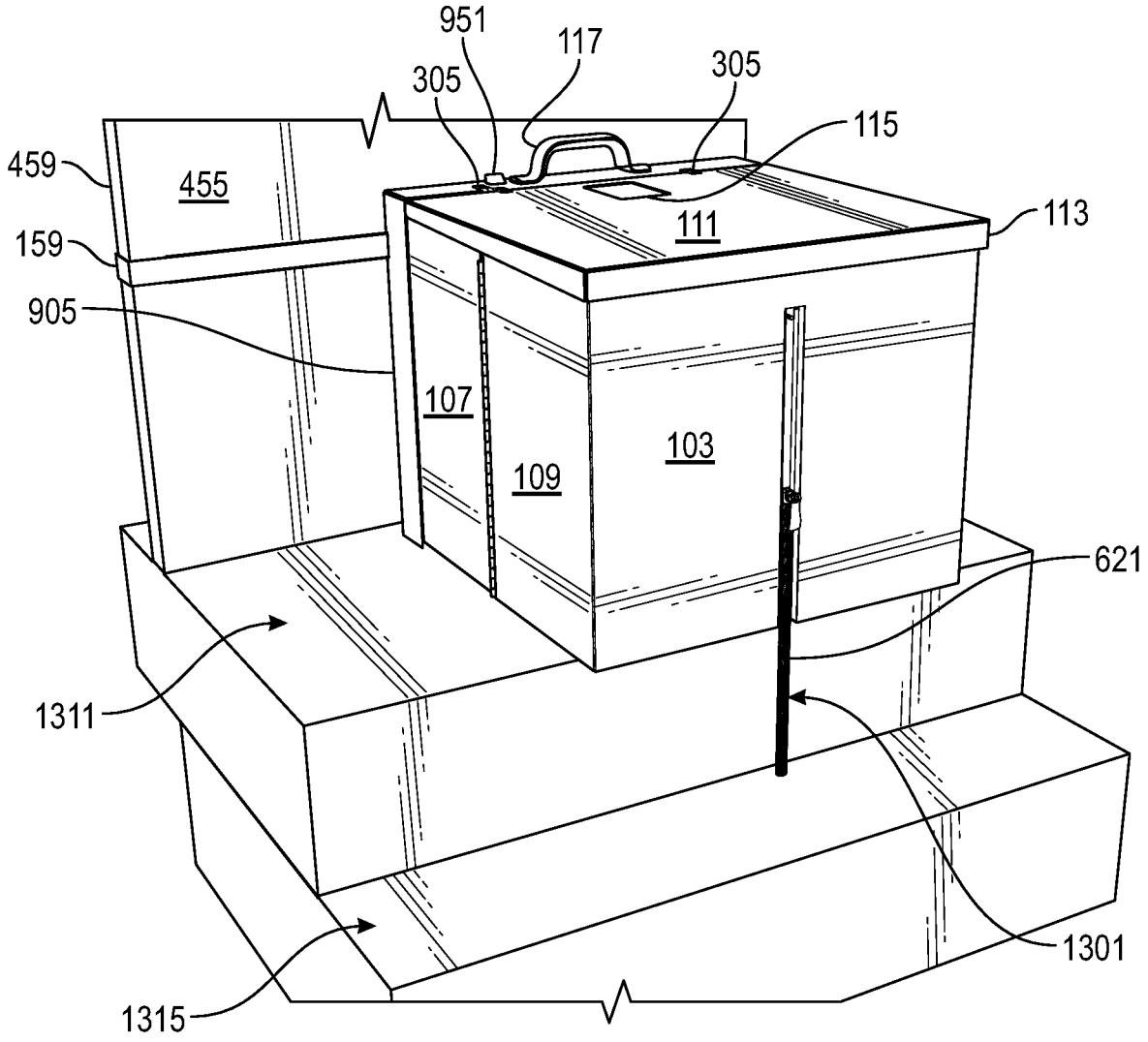
FIG. 13A may depict a front, left, perspective view of a kickstand-assembly (of the package-receiving-locker) in use in scenario with a relatively short landing and/or a landing that may slope away from the door and/or a step-top that may be relatively close to the door.
Figure 13B:
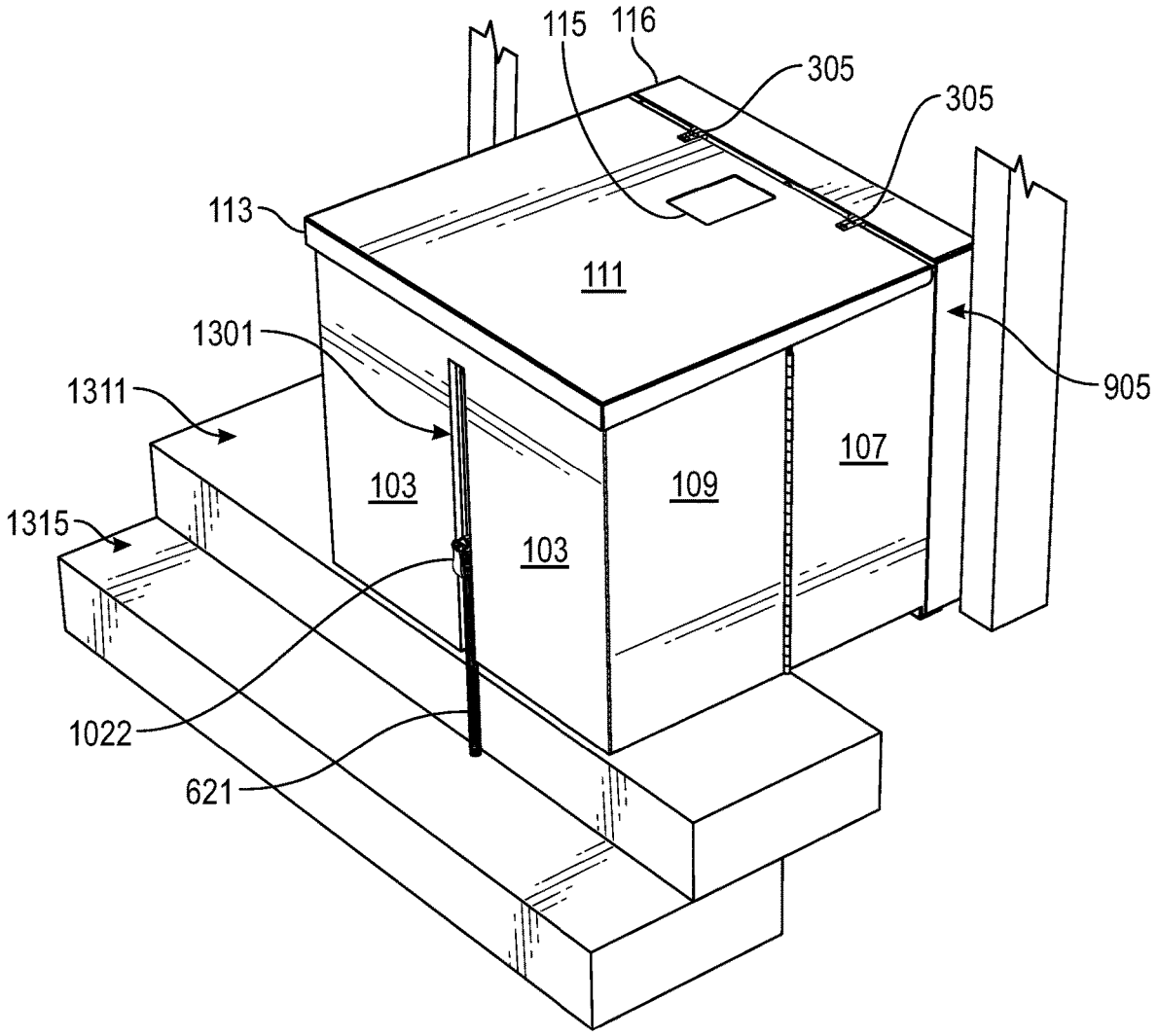
FIG. 13B may depict a front, right, perspective view of the kickstand-assembly in use in scenario with a relatively short landing and/or a landing that may slope away from the door and/or the step-top may be relatively close to the door.

Continuing discussing FIG. 6B, in some embodiments, collapsible-locker 101 may comprise a kickstand subassembly. In some embodiments, the kickstand subassembly may comprise a kickstand 621, a kickstand-housing 623, a kickstand-housing-receiver 625, a spring 627, and a pin 629. FIG. 13A and FIG. 13B may show use of kickstand-subassembly 1301. In some embodiments, use of this kickstand subassembly may allow package-receiving-locker 100 to be stored/used, substantially in the deployed configuration, in a manner that may be substantially level with a floor/ground, in situations where door 451 may have a high threshold with respect to a landing of that door 451 and/or a step may be close in proximity to door 451. That is, this kickstand subassembly may be leveling a device/tool for collapsible-locker 101. Continuing discussing FIG. 6B, in some embodiments, kickstand 621 may be an elongate member that may be substantially rigid to semi-rigid. In some embodiments, kickstand 621 may be extended as needed from kickstand-housing 623. In some embodiments, kickstand 621 may be housed in kickstand-housing 623. In some embodiments, kickstand 621 may be retracted into kickstand-housing 623. In some embodiments, kickstand-housing-receiver 625 may be a location on collapsible-locker 101 for retaining and/or receiving kickstand-housing 623. In some embodiments, kickstand-housing-receiver 625 may be a location on front-wall 103 for retaining and/or receiving kickstand-housing 623. In some embodiments, kickstand-housing-receiver 625 may be an indenture location on collapsible-locker 101 for retaining and/or receiving kickstand-housing 623. In some embodiments, kickstand-housing-receiver 625 may be an indenture location on front-wall 103 for retaining and/or receiving kickstand-housing 623. In some embodiments, kickstand-housing 623 may house spring 627. In some embodiments, spring 627 may be operatively connected to both kickstand 621 and kickstand-housing 623. In some embodiments, spring 627 may be a torsion-spring. In some embodiments, spring 627 may facilitate retraction of deployed kickstand 621 back into kickstand-housing 623. In some embodiments, kickstand-housing 623 may house pin 629. In some embodiments, pin 629 may be operatively connected to both kickstand 621 and kickstand-housing 623. In some embodiments, pin 629 may facilitate pivoting motion of kickstand 621. Note, in some embodiments, 101 may have no such kickstand subassembly.

Figure 7:
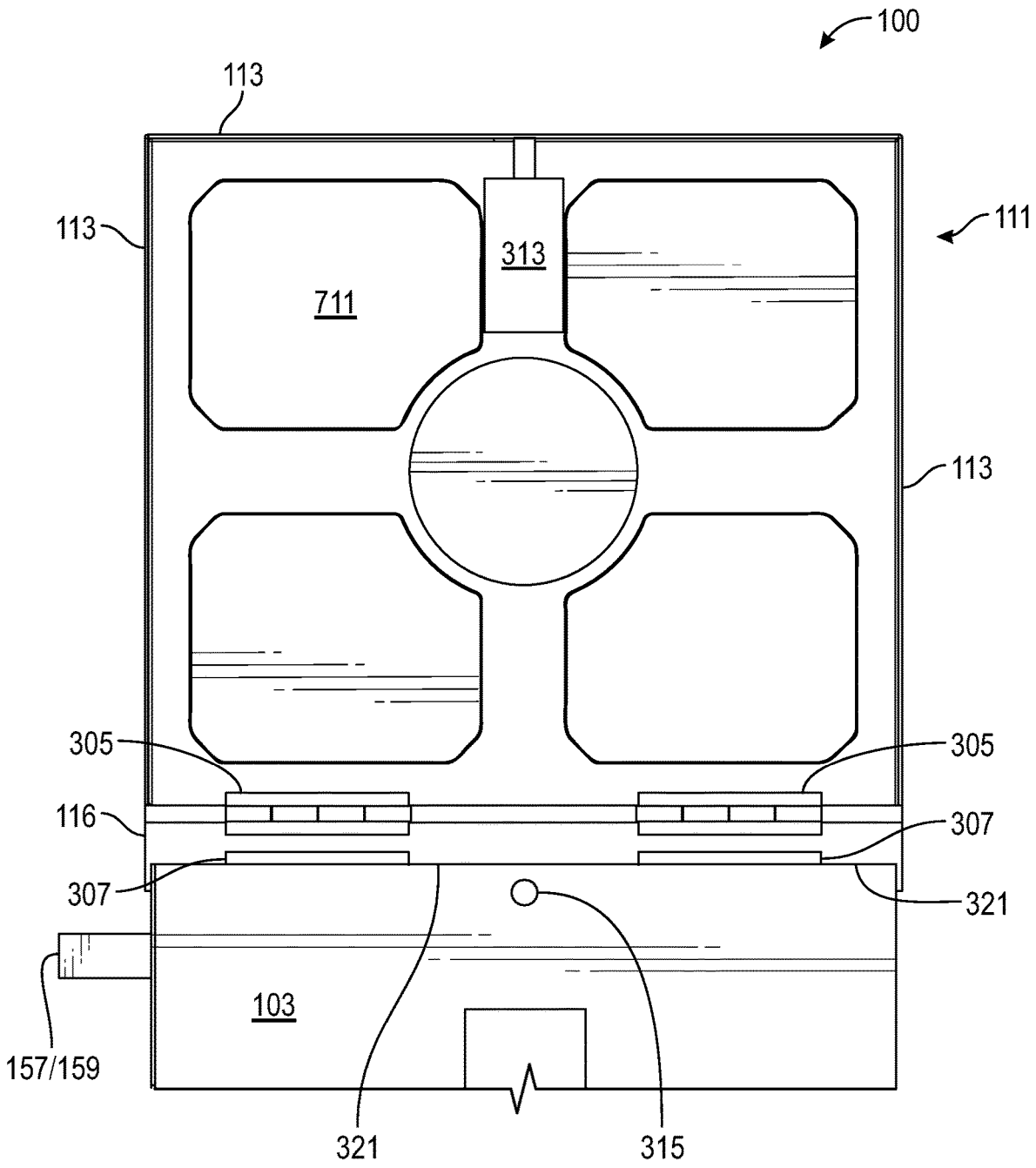
FIG. 7 may depict an underside view of the lid of the package-receiving-locker (with the lid open) along with a partial front view of the front-wall (of the package-receiving-locker).

FIG. 7 may be partial front view of package-receiving-locker 100, with lid 111 open. FIG. 7 may depict an underside view of lid 111 of package-receiving-locker 100. FIG. 7 may depict lid-interior 711. In some embodiments, lid-interior 711 may be an interior facing surface of lid 111. In some embodiments, housing 313 may be attached to lid-interior 711.

Figure 8:
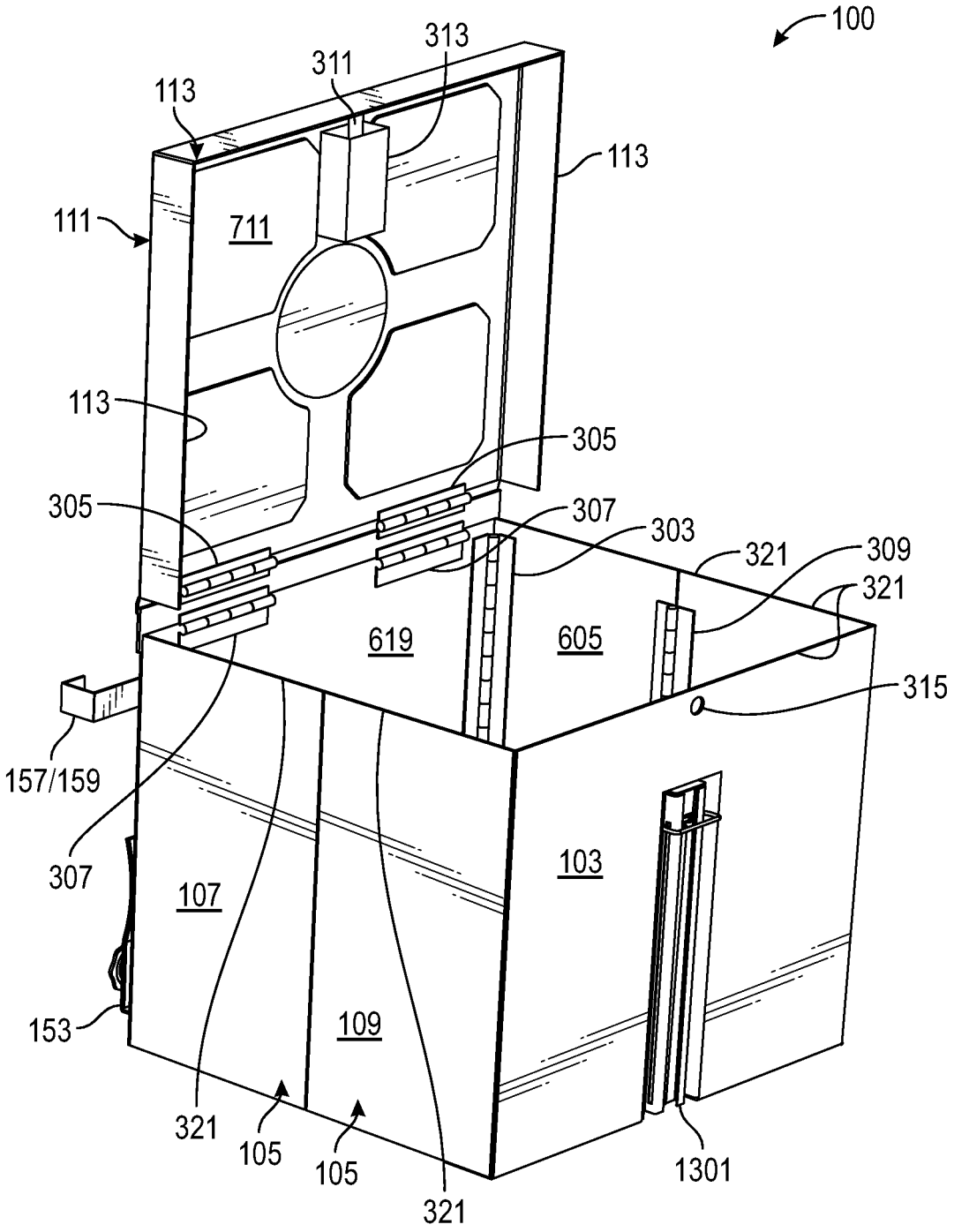
FIG. 8 may depict a perspective view of the package-receiving-locker with the lid open.

FIG. 8 may depict a perspective view of the package-receiving-locker 100 with lid 111 open. Some interior facing surfaces of collapsible-locker 101 may be partially shown in FIG. 8, such as side-wall-interior 605, rear-wall-interior 619, and lid-interior 711.

Figure 9A:
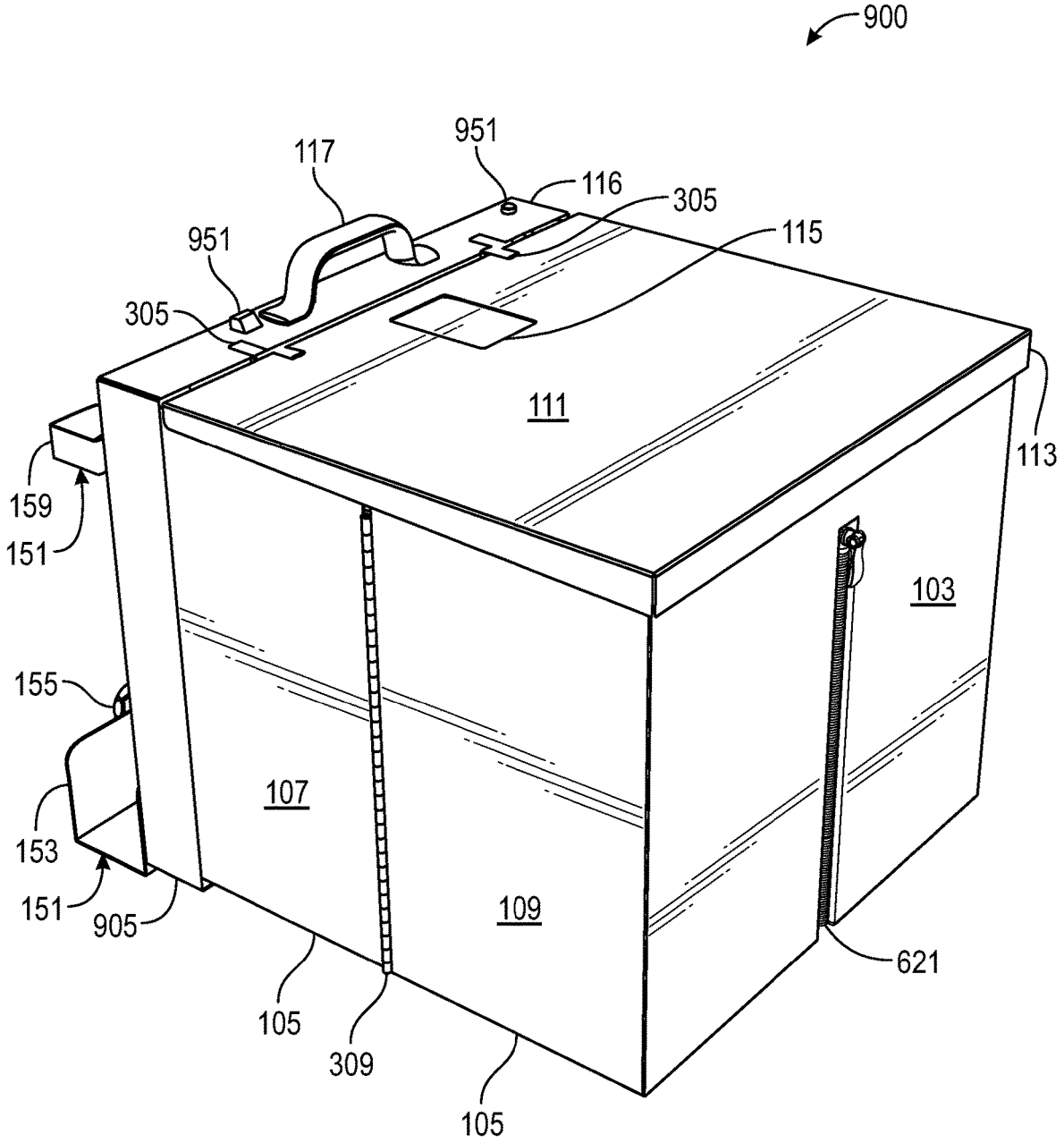
FIG. 9A may depict a front, left, top, perspective (isometric) view of a fully (substantially) deployed package-receiving-locker. Note, the package-receiving-locker shown in FIG. 9A may be a different embodiment than the package-receiving-locker noted in the above drawing figures.
Figure 9B:
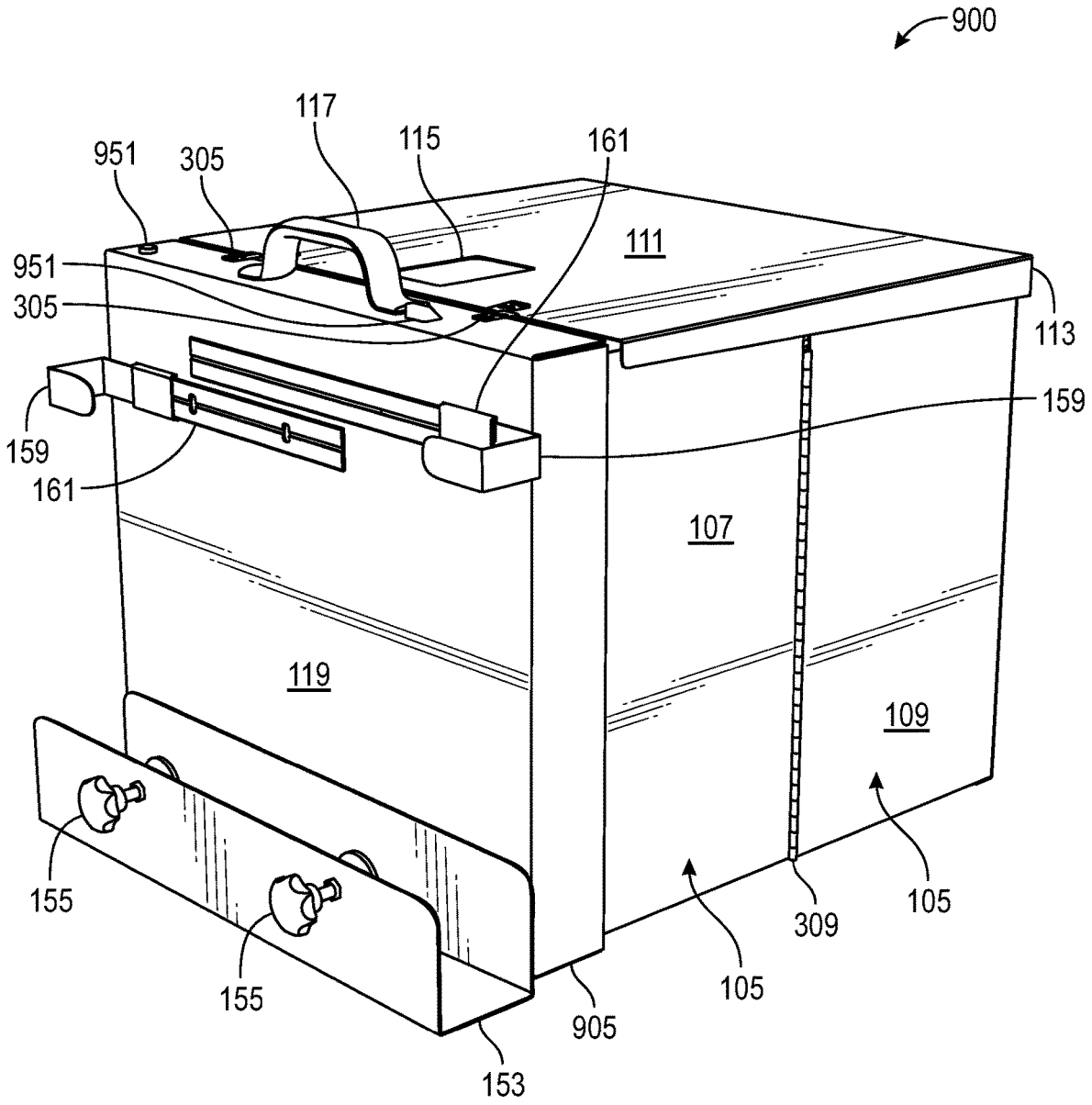
FIG. 9B may depict a rear, left, top, perspective view of the deployed package-receiving-locker from FIG. 9A.
Figure 9C:
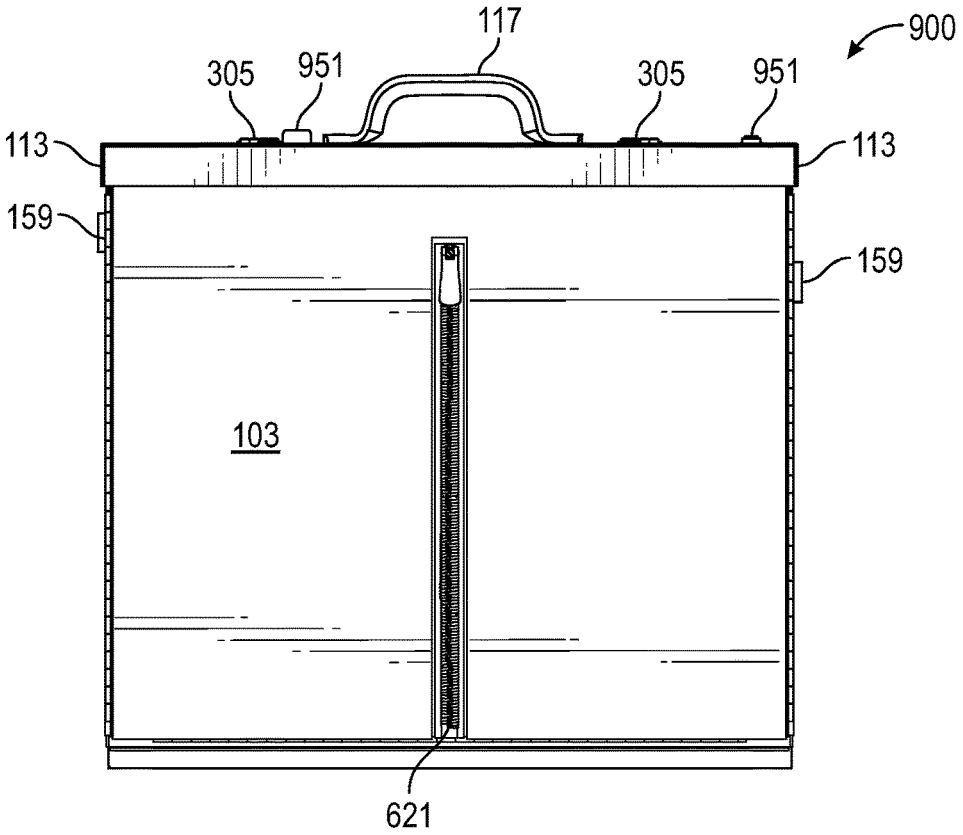
FIG. 9C may depict a front view of the deployed package-receiving-locker from FIG. 9A.
Figure 9D:
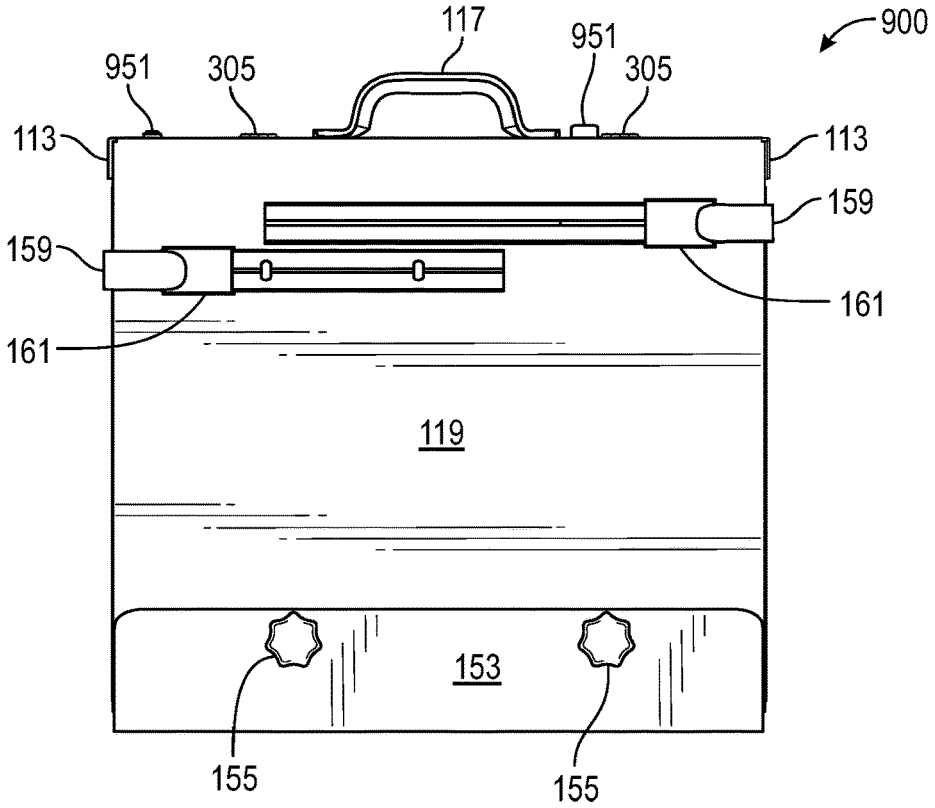
FIG. 9D may depict a rear view of the deployed package-receiving-locker from FIG. 9A.
Figure 9E:
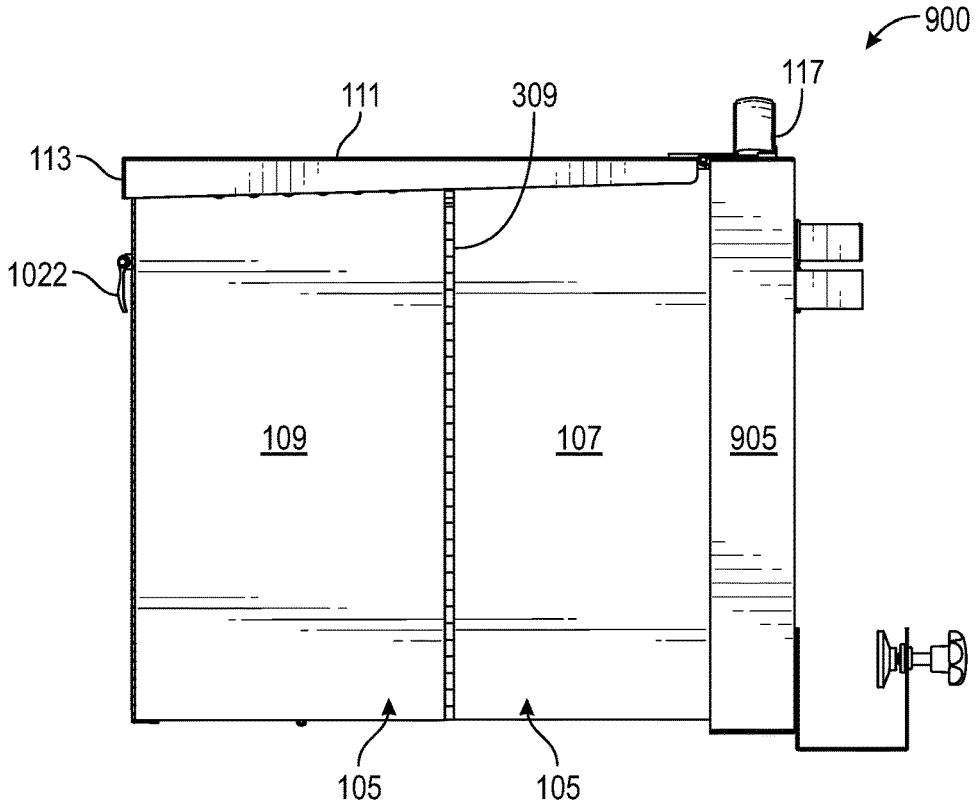
FIG. 9E may depict a right-side view of the deployed package-receiving-locker from FIG. 9A.
Figure 9F:
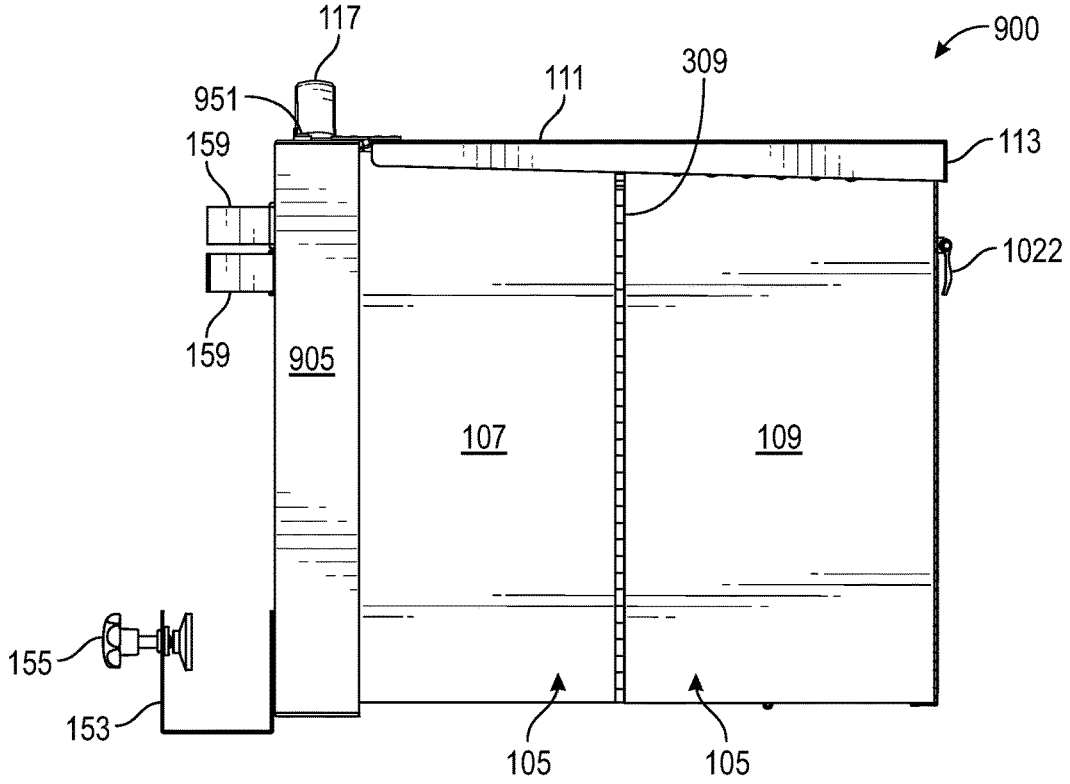
FIG. 9F may depict a left-side view of the deployed package-receiving-locker from FIG. 9A.
Figure 9G:
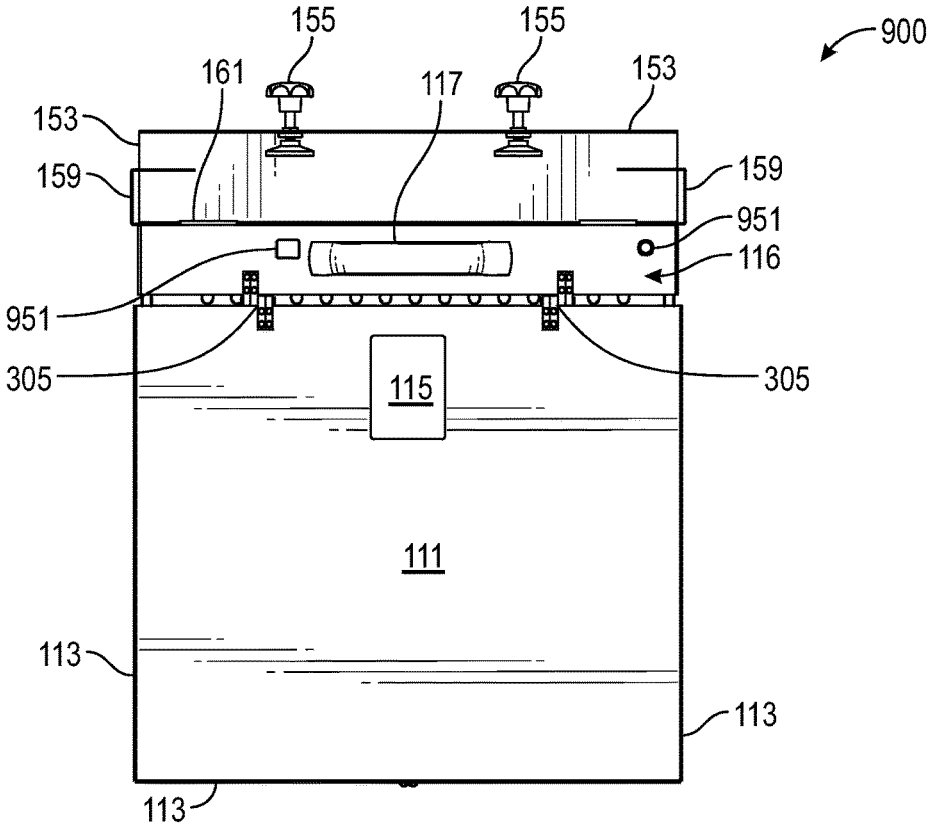
FIG. 9G may depict a top view of the deployed package-receiving-locker from FIG. 9A.
Figure 9H:
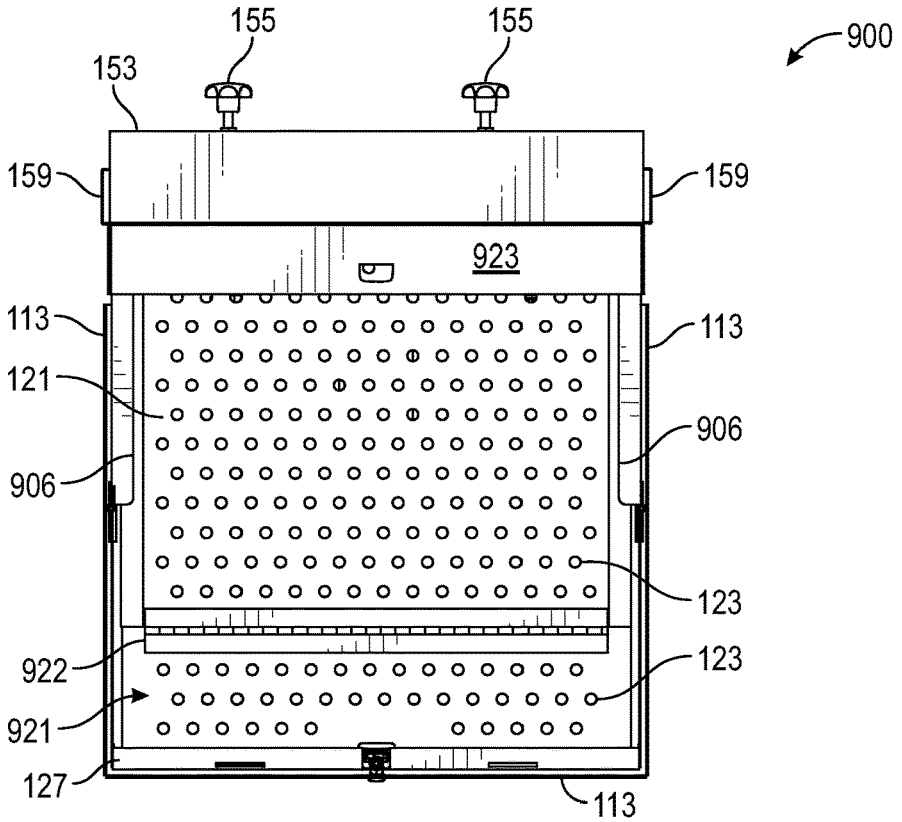
FIG. 9H may depict a bottom view of the deployed package-receiving-locker from FIG. 9A.
Figure 9I:
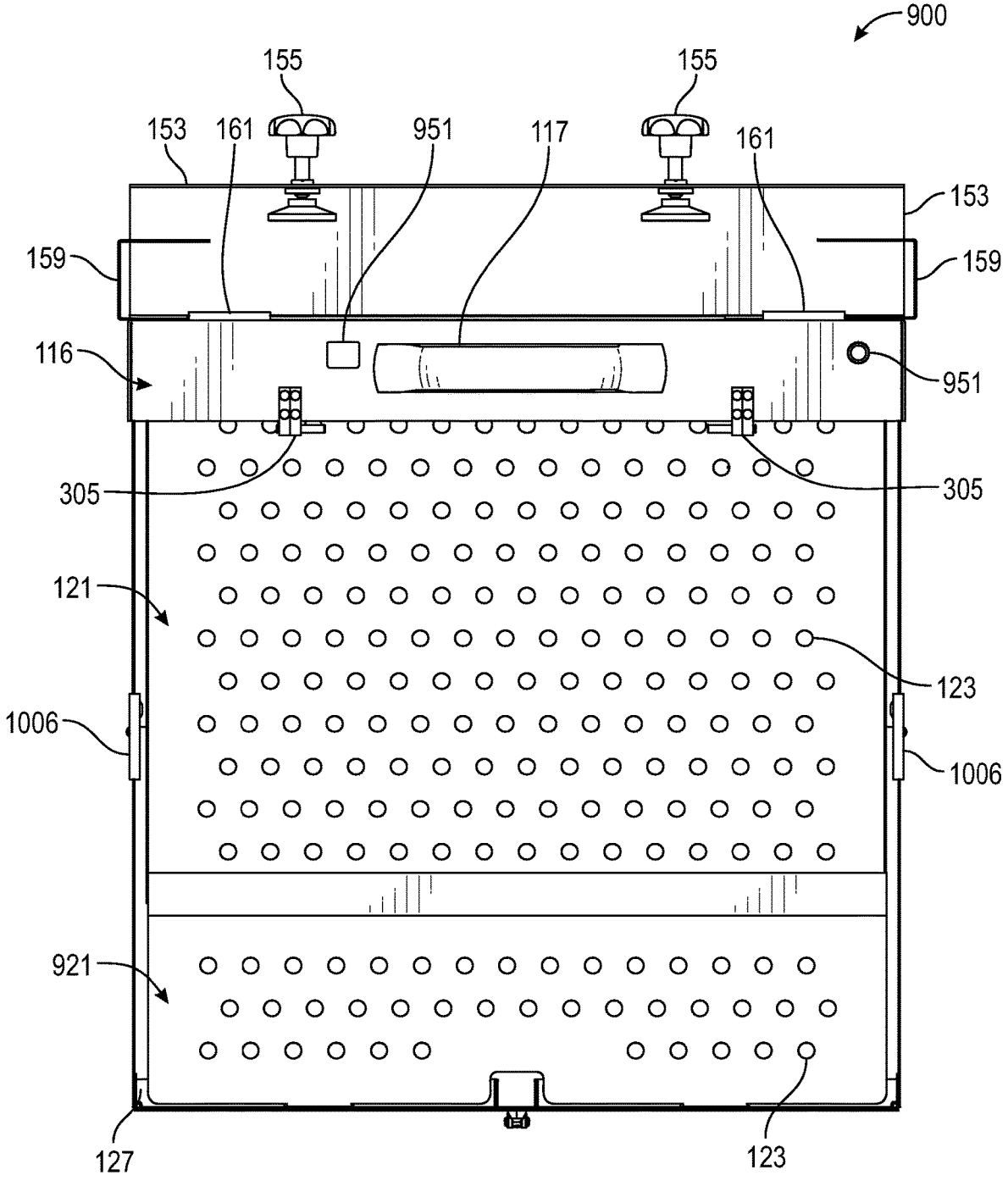
FIG. 9I may depict a top view of the deployed package-receiving-locker from FIG. 9A but shown with a lid (of the package-receiving-locker) removed so at least a portion of an interior of a collapsible-locker (of the package-receiving-locker) may be seen.

FIG. 9A through FIG. 9I may show a package-receiving-locker 900 in a substantially deployed configuration from various views. FIG. 9A may depict a front, left, top, perspective (isometric) view of a deployed package-receiving-locker 900. FIG. 9B may depict a rear, left, top, perspective view of the deployed package-receiving-locker 900 from FIG. 9A. FIG. 9C may depict a front view of the deployed package-receiving-locker 900 from FIG. 9A. FIG. 9D may depict a rear view of the deployed package-receiving-locker 900 from FIG. 9A. FIG. 9E may depict a right-side view of the deployed package-receiving-locker 900 from FIG. 9A. FIG. 9F may depict a left-side view of the deployed package-receiving-locker 900 from FIG. 9A. FIG. 9G may depict a top view of the deployed package-receiving-locker 900 from FIG. 9A. FIG. 9H may depict a bottom view of the deployed package-receiving-locker 900 from FIG. 9A. FIG. 9I may depict a top view of the deployed package-receiving-locker 900 from FIG. 9A but shown with lid 111 removed so at least a portion of the interior of collapsible-locker 101 may be seen.

Package-receiving-locker 900 may be an additional embodiment or alternative embodiment to package-receiving-locker 100. In some embodiments, package-receiving-locker 900 may have substantially the same purposes of package-receiving-locker 100. In some embodiments, package-receiving-locker 900 may solve substantially the same problems of package-receiving-locker 100. In some embodiments, package-receiving-locker 900 may perform substantially similar to package-receiving-locker 100. In some embodiments, package-receiving-locker 900 may function substantially similar to package-receiving-locker 100. In some embodiments, package-receiving-locker 900 may be substantially similar to package-receiving-locker 100 in terms of at least one of features, parts, components, geometries, structures, mechanics, operation, combinations thereof, and/or the like. Thus, FIG. 9A through FIG. 9I, may show the same reference numerals as used with package-receiving-locker 100, to reference similar or the same features, parts, components, geometries, structures, mechanics, and/or operation. For example, and without limiting the scope of the present invention, in some embodiments, package-receiving-locker 900 may comprise collapsible-locker 101 and door-attachment-structure 151. In some embodiments, collapsible-locker 101 may comprise lid 111, two opposing side-walls 105, front-wall 103, rear-wall 119, floor 121, and computing-device 1500. In some embodiments, door-attachment-structure 151 may comprise bottom-door-bracket 153 and two opposing sliding J-hooks 159. These components may be substantially as described above for package-receiving-locker 100.

However, there may be some differences between package-receiving-locker 100 and package-receiving-locker 900, some of which may be discussed below. In some embodiments, collapsible-locker 101 may further comprise a substantially hollow rectangular prism structure proximate and/or attached to rear-wall 119 for housing the collapsible walls/panels when package-receiving-locker 900 may be in the substantially collapsed configuration. This rectangular prism structure may be bound on the top by top-panel 116, on the sides by two opposing side-panels 905, on the bottom by bottom-panel 923 (shown in FIG. 11B), and at a back by rear-wall 119, and open on its front for entry and exit of the collapsible walls/panels. See e.g., FIG. 9A, FIG. 9B, and FIG. 11B. In some embodiments, top-panel 116, side-panels 905, and bottom-panel 923 may be located towards a rear of package-receiving-locker 900. In some embodiments, side-panels 905 may be opposing each other separated by top-panel 116 and/or bottom-panel 923. In some embodiments, top-panel 116 may be opposing bottom-panel 923 and separated by side-panels 905. In some embodiments, side-panels 905 may be substantially parallel. In some embodiments, top-panel 116 and bottom-panel 923 may be substantially parallel. In some embodiments, top-panel 116 may be substantially perpendicular to side-panels 905. In some embodiments, bottom-panel 923 may be substantially perpendicular to side-panels 905. In some embodiments, side-wall-panel-closer-to-rear-wall 107 may attach to side-panels 905 via a hinge (e.g., rear-side-hinge 303). In some embodiments, side-panels 905 may extend perpendicularly away from sides of rear-wall 119. In some embodiments, bottom-panel 923 may extend perpendicularly away from a bottom of rear-wall 119. In some embodiments, top-panel 116, side-panels 905, and bottom-panel 923 may be fixed structures.

In some embodiments, collapsible-locker 101 may comprise one or more input(s) 951. In some embodiments, input(s) 951 may be located on an exterior and/or on an interior of collapsible-locker 101. In some embodiments, input(s) 951 may be located on top-panel 116, lid 111, front-wall 103, side-wall 105, rear-wall 119, lid-interior 711, front-wall-interior 603, side-wall-interior 605, and/or rear-wall-interior 619. In some embodiments, input(s) 951 may be one or more of: an electrical power receiving port, a data communications port, a button, a switch, a camera, a microphone, an antenna, a RFID tag, a NFC tag, combinations thereof, and/or the like. See e.g., FIG. 9A.

In some embodiments, the two opposing sliding J-hooks 159 may be located at two different heights on rear-wall 119. (In some embodiments, one or more of the sliding J-hooks 159 may be replaced with pivoting J-hooks 157.) In some embodiments, bottom-door-bracket 153 may extend substantially along a width of rear-wall 119. In some embodiments, bottom-door-bracket 153 may be a single bracket. (In some embodiments, bottom-door-bracket 153 may be two or more brackets.) See e.g., FIG. 9B.

In some embodiments, exterior-interface 115 may be substantially flush with a top exterior of lid 111. See e.g., FIG. 9A and FIG. 9B. In some embodiments, exterior-interface 115 may extend (protrude) away the top exterior of lid 111. See e.g., FIG. 1A.

In some embodiments, floor 121 may be divided into two portions, a main portion (still designated floor 121) and a distal portion, designated distal-floor 921. In some embodiments, distal-floor 921 may be located away from where floor 121 may be attached to rear-wall 119 (via a hinge) or attached to bottom-panel 923 (via a hinge). In some embodiments, where floor 121 ends away from rear-wall 119, floor 121 may be in communication with distal-floor 921 via joiner 922. In some embodiments, joiner 922 may be one or more hinges. In some embodiments, floor 121 and/or distal-floor 921 may comprise one or more floor-holes 123. In some embodiments, floor-holes 123 may be arranged in a predetermined pattern. In some embodiments, each floor-hole 123 may have a predetermined shape. See e.g., FIG. 9H and FIG. 9I.

FIG. 9H may also show two opposing ledges 906, which may extend inwards toward each other from opposing bottoms of two opposing side-wall-panel-closer-to-rear-wall 107. In some embodiments, ledges 906 may be fixed. In some embodiments, ledges 906 may support and catch opposing portions of floor 121 when collapsible-locker 101 may be in the fully deployed configuration.

In some embodiments, the features, parts, components, geometries, structures, mechanics, and/or operation of package-receiving-locker 900 may be interchanged and/or mixed with the features, parts, components, geometries, structures, mechanics, and/or operation of package-receiving-locker 100.

Figure 10:
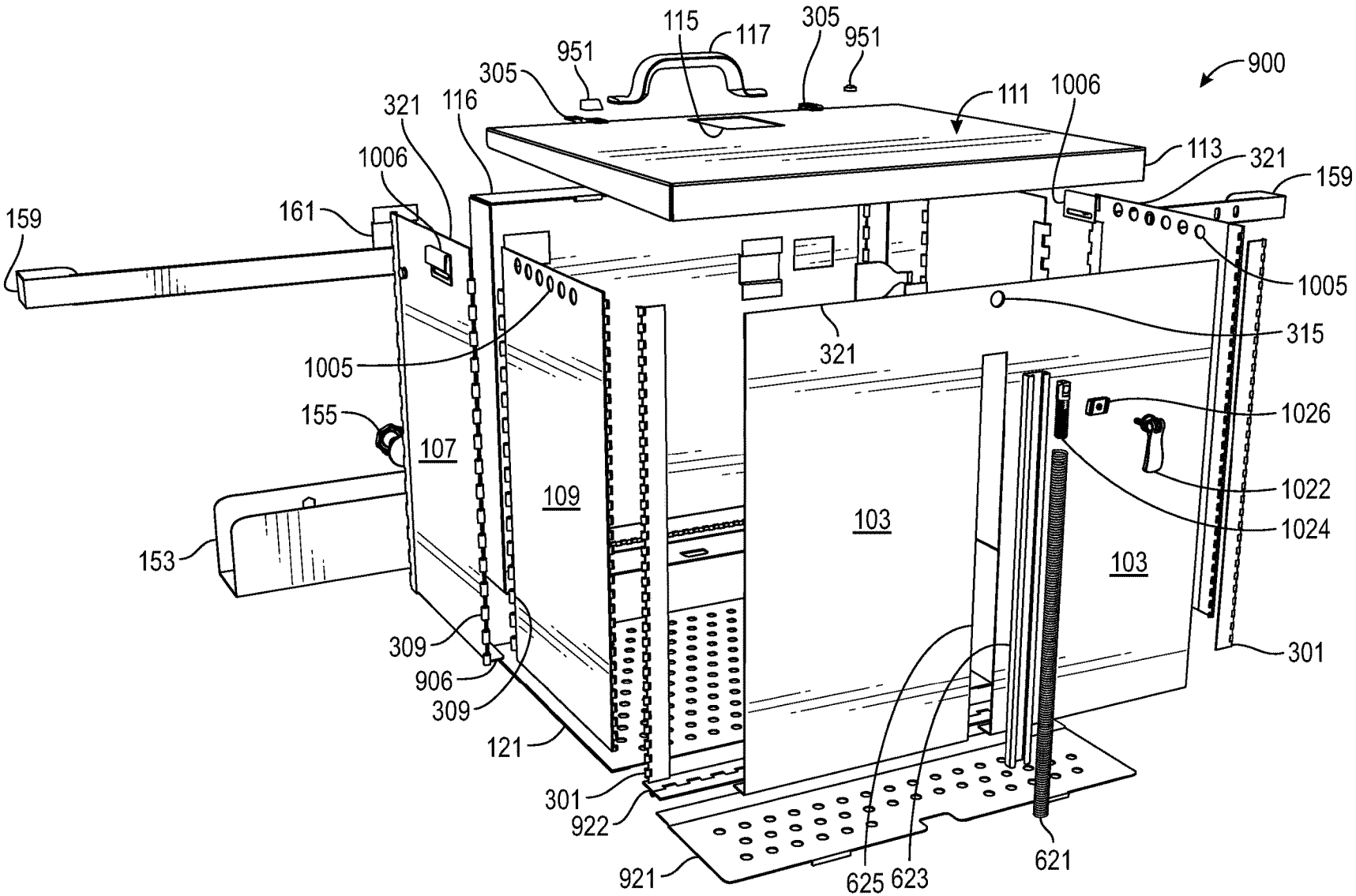
FIG. 10 may depict a front perspective exploded view of the package-receiving-locker from FIG. 9A.

FIG. 10 may depict a front perspective exploded view of the package-receiving-locker 900. In some embodiments, each (or any) side-panel 105 may comprise one or more holes, designated side-panel-holes 1005. In some embodiments, the one or more side-panel-holes 1005 may be located towards a top of the given side-panel 105 and may provide ventilation of the interior of collapsible-locker 101. In some embodiments, the one or more side-panel-holes 1005 may be located towards a top of the given side-panel 105 and may provide structures for a user to grip collapsible-locker 101, i.e., such side-panel-holes 1005 may function as handles.

Continuing discussing FIG. 10, in some embodiments, each (or any) side-panel 105 may comprise a lock 1006. In some embodiments, lock 1006 may lock side-panels 105 at side-hinges 309 into place, in the fully deployed configuration, preventing side-walls 105 from collapsing inwards at side-hinge 309. In some embodiments, lock 1006 may be a sliding member that may slide along a top of side-panels 105. In some embodiments, lock 1006 may be substantially rigid to semi-rigid.

Continuing discussing FIG. 10, in some embodiments, collapsible-locker 101 may comprise a kickstand-subassembly 1301. In some embodiments, kickstand-subassembly 1301 may comprise a kickstand 621, a kickstand-housing 623, a kickstand-housing-receiver 625, a pull 1022, anchor 1024, and a bracket 1026. FIG. 13A and FIG. 13B may show use of kickstand-subassembly 1301. In some embodiments, use of this kickstand-subassembly 1301 may allow package-receiving-locker 900 to be stored/used, substantially in the deployed configuration, in a manner that may be substantially level with a floor/ground, in situations where door 451 may have a high threshold with respect to a landing of that door 451 and/or a step may be close in proximity to door 451. That is, this kickstand subassembly may be a leveling device/tool for collapsible-locker 101. Continuing discussing FIG. 10, in some embodiments, kickstand 621 may be an elongate member that may be substantially rigid to semi-rigid. In some embodiments, kickstand 621 may be an elongate member that may be a tightly coiled and substantially stiff spring. In some embodiments, a terminal end of kickstand 621 may be for physically contacting the floor/ground; while its opposing end may be captured (attached) to anchor 1024. In some embodiments, anchor 1024 may slide up and down within kickstand-housing 623. In some embodiments, attached to anchor 1024 may be bracket 1026 and pull 1022. In some embodiments, pull 1022 may have a handle and may be configured to be pulled up or down to deploy or retract, respectively, kickstand 621.

Figure 11A:
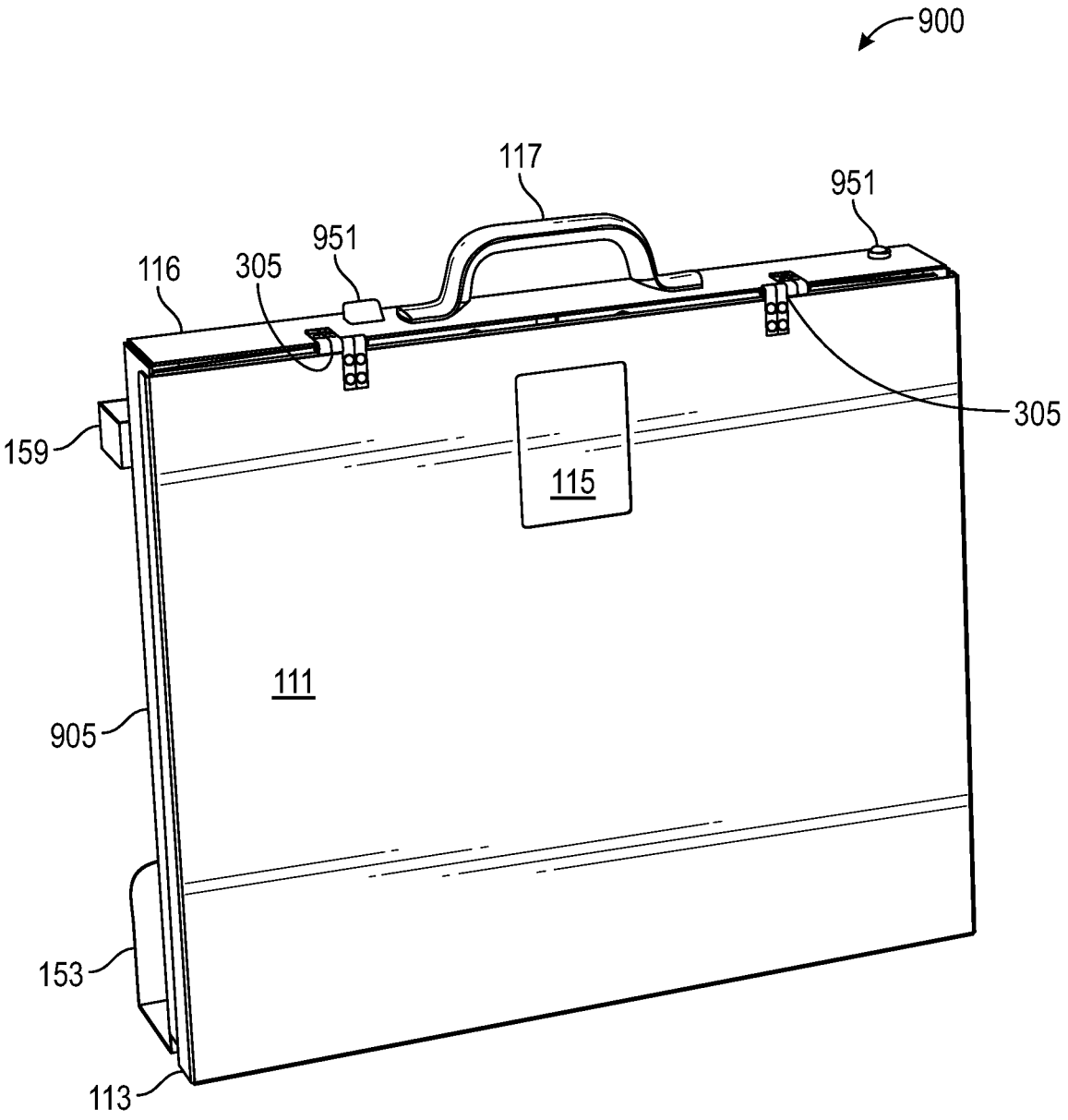
FIG. 11A may depict a front, left, top, perspective view of the substantially (or fully) collapsed package-receiving-locker from FIG. 9A.
Figure 11B:
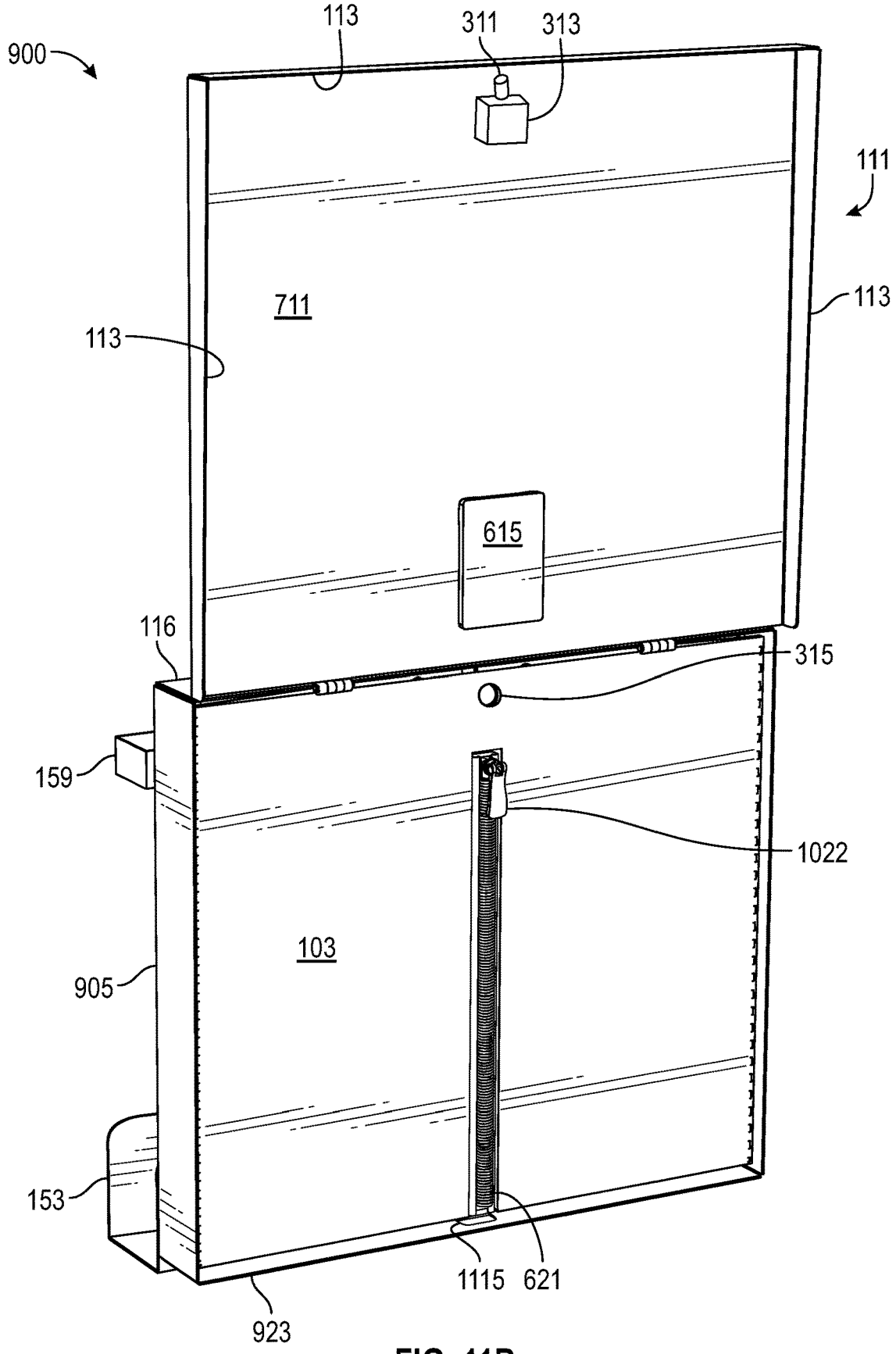
FIG. 11B may depict the lid of the package-receiving-locker from FIG. 9A (or from FIG. 11A) raised to permit deployment of a front-wall, two-opposing side-walls, and a floor of the package-receiving-locker from FIG. 9A.
Figure 11C:
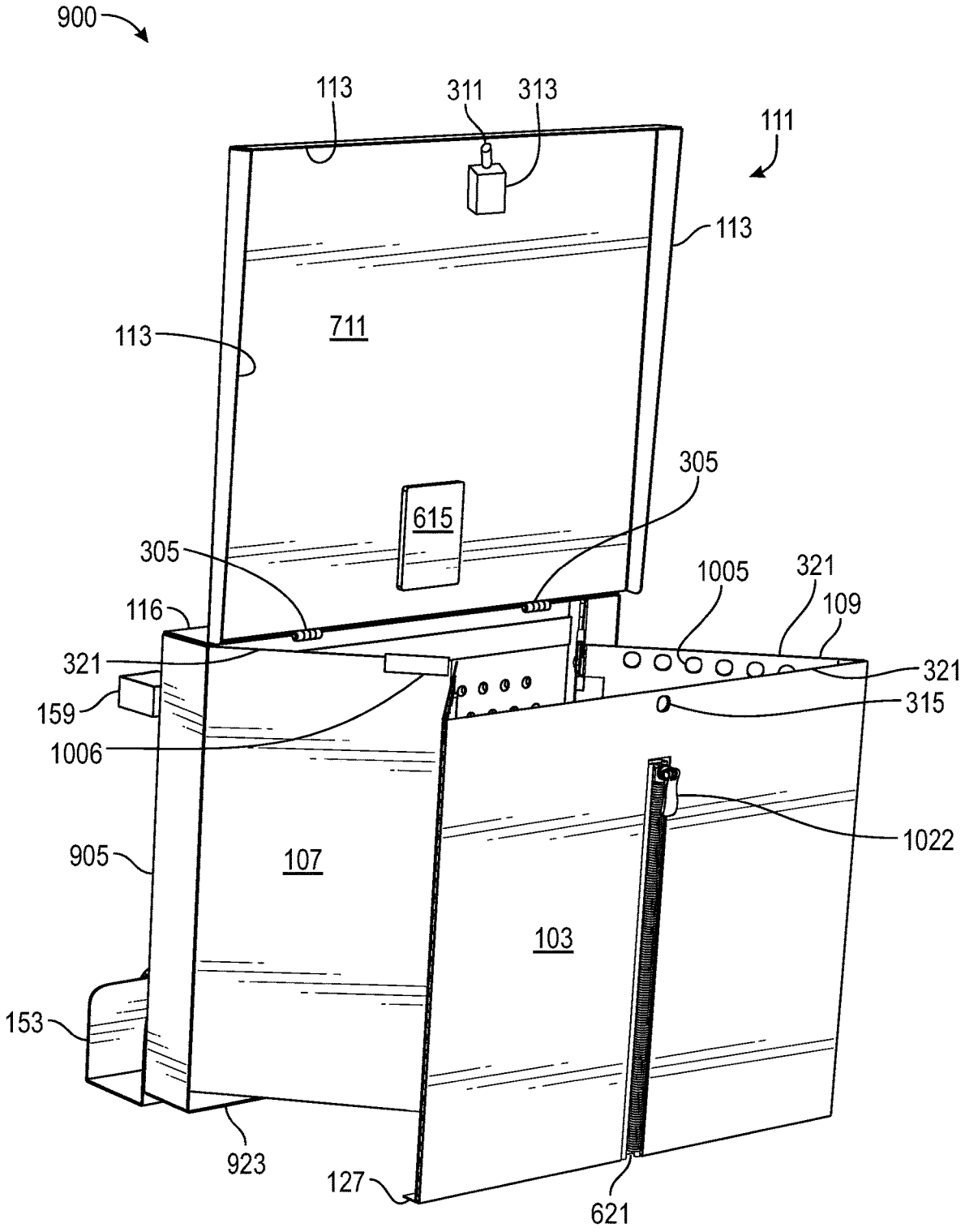
FIG. 11C may show the front-wall and the two opposing side-walls (of the package-receiving-locker from FIG. 9A) being pulled out away from a rear-wall (of the package-receiving-locker from FIG. 9A) in a process of forming the substantially (or fully) deployed configuration.

FIG. 11A through FIG. 11C may show the package-receiving-locker 900 in a process of being deployed from the substantially collapsed configuration to the substantially deployed configuration.

FIG. 11A may depict a front, left, top, perspective view of the substantially collapsed package-receiving-locker 900. In some embodiments, in the substantially collapsed configuration, front-wall 103, side-panels 105 and floor 121 may be removably stored within the rectangular prism formed from rear-wall 119, side-panels 905, top-panel 116, and bottom-panel 923. In some embodiments, in the substantially collapsed configuration, lid 111 may be visible and lid 111 may cover over front-wall 103, side-panels 105 and floor 121.

FIG. 11B may depict lid 111 of the package-receiving-locker 900 raised to permit deployment of the front-wall 103, two-opposing side-walls 105, and the floor 121. FIG. 11B may show bolt-receiver 1115 located in bottom-panel 923. In some embodiments, bolt-receiver 1115 may receive a distal portion bolt 311 when package-receiving-locker 900 may be in the substantially closed configuration, such that lid 111 may be locked to bottom-panel 923. In some embodiments, bolt-receiver 1115 may be a hole in bottom-panel 923 configured to removably receive a distal portion of bolt 311 for locking.

In some embodiments, when the collapsible-locker 101 may be in the substantially collapsed configuration, the at least one lid 111 may be lockable to prevent unintended deployment of the collapsible-locker 101 into the substantially (fully) expanded (deployed) configuration.

FIG. 11C may show the front-wall 103 and two opposing side-walls 105 being pulled out away from a rear-wall 119 from collapsible-locker 101 in a process of forming the substantially deployed configuration. Once front-wall 103 may be completely pulled out away from rear-wall 119, then side-walls 105 may be fully in place, and may be further locked by sliding locks 1006 over side-hinges 309, to prevent side-walls 105 from collapsing inwards. Once front-wall 103 may be completely pulled out, away from rear-wall 119, then floor 121 may be pivot (e.g., via hinge(s)) downwards catching on ledges 906 and/or floor-support 127.

Figure 12A:
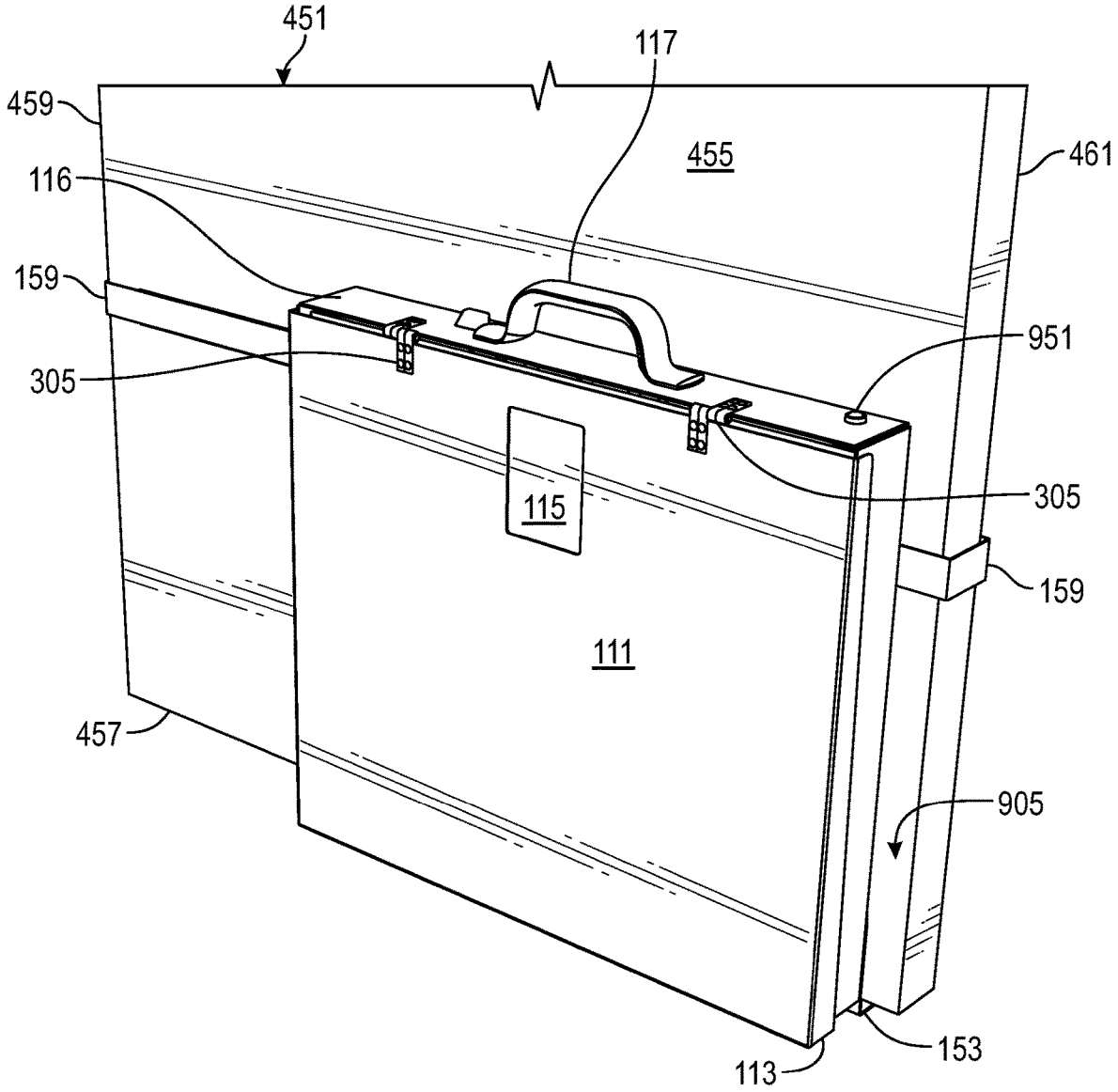
FIG. 12A may depict a front, right, perspective view of the substantially collapsed package-receiving-locker from FIG. 9A removably attached to a door, shown from a door-outside.
Figure 12B:
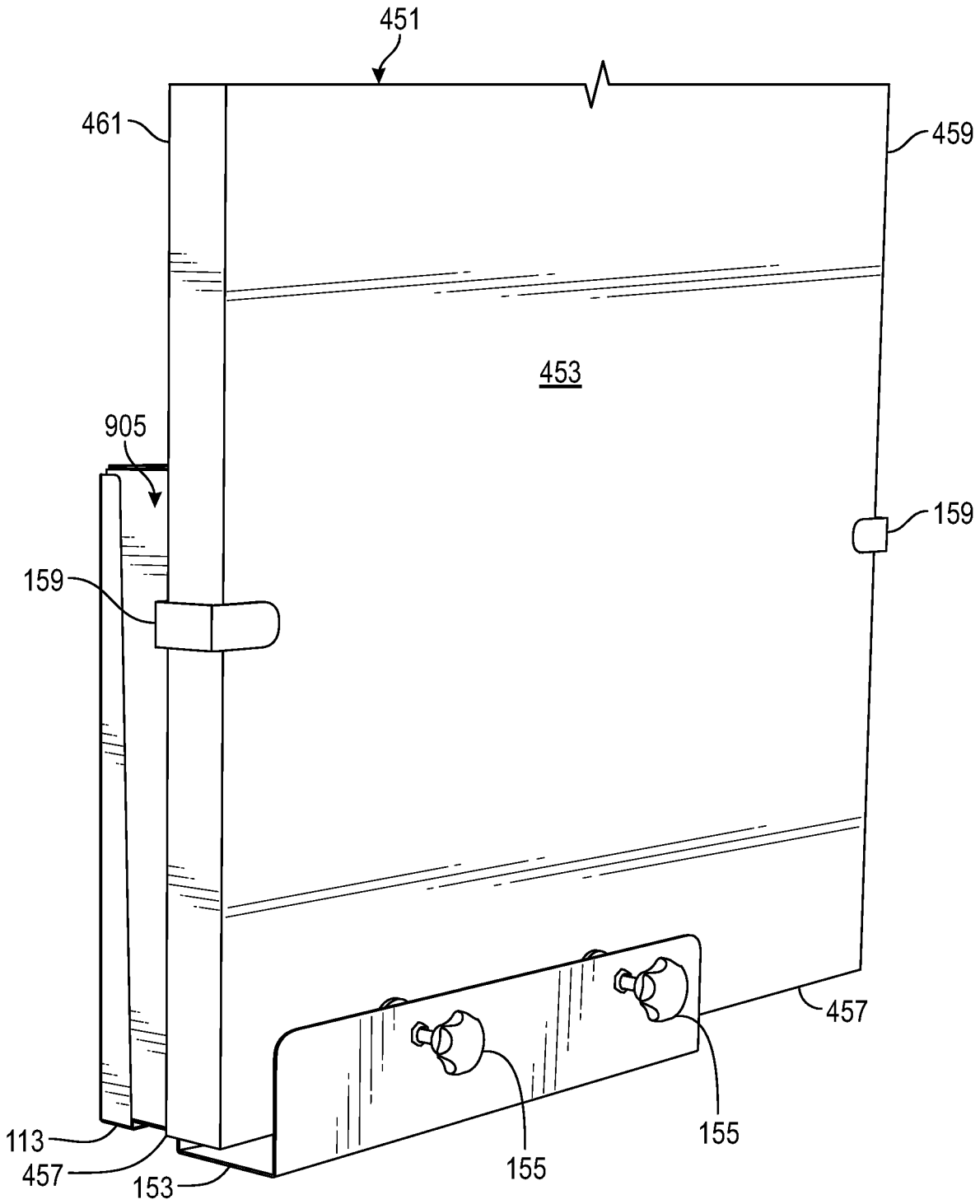
FIG. 12B may depict a rear, right, perspective view of the substantially collapsed package-receiving-locker from FIG. 9A removably attached to the door, shown from a door-inside.
Figure 12C:
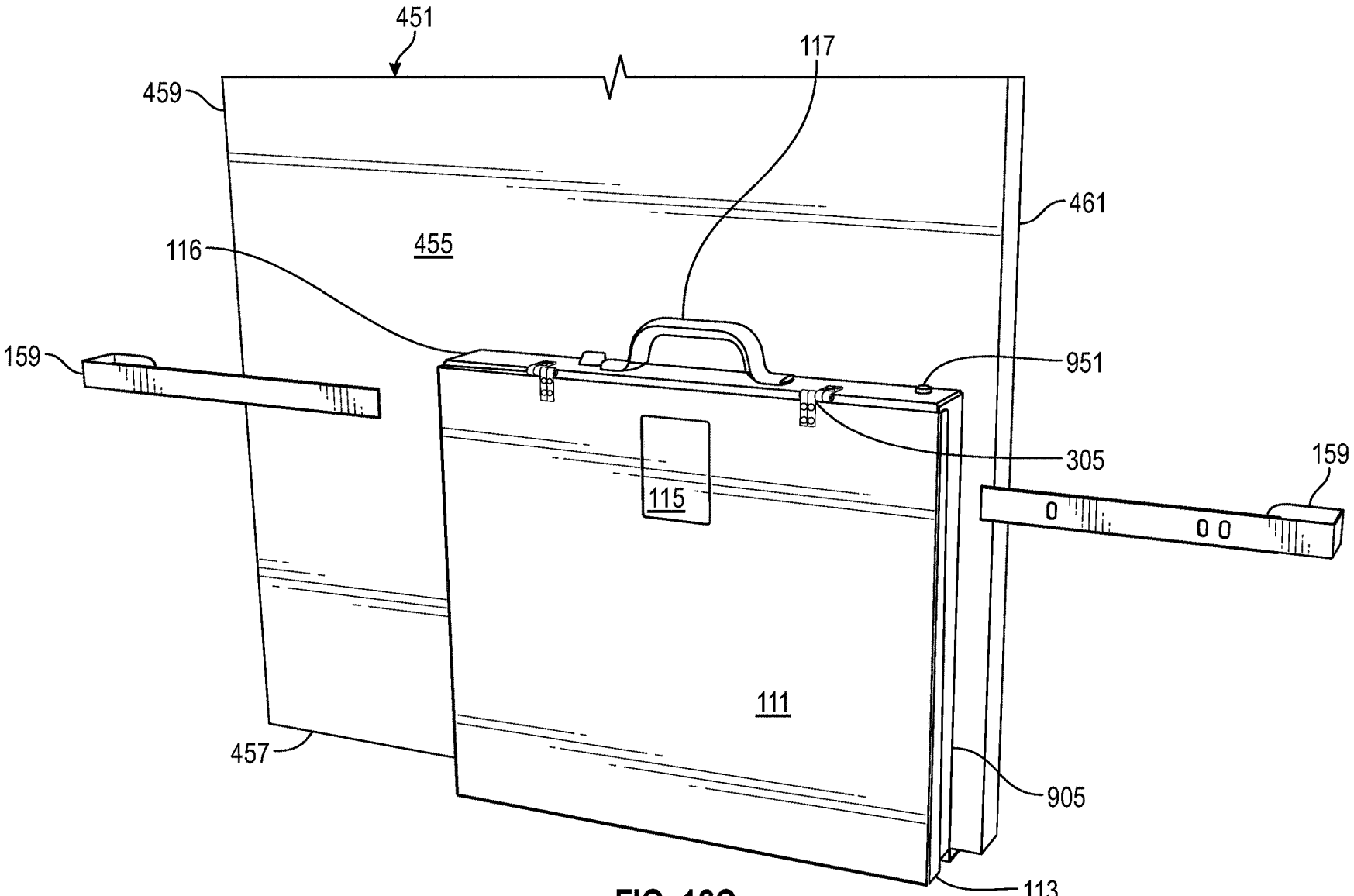
FIG. 12C may depict a front, right, perspective view of the substantially collapsed package-receiving-locker from FIG. 9A with the two opposing J-hooks in a process of being removably secured to the two opposing edges/sides (e.g., the hinge-side and the opposing non-hinge-side) of the door, shown from the door-outside.

FIG. 12A through FIG. 12C may show package-receiving-locker 900 removably attached to door 451 via two opposing J-hooks 159 that may removably capture the opposing sides 459/461 of the door 451; and may show a portion of 153 around a portion of door-bottom 457 of door 451. In FIG. 12A through FIG. 12C, package-receiving-locker 900 may be in its substantially collapsed configuration; however, package-receiving-locker 900 could be in its fully deployed configuration and still be removably attached to door 451 as shown in FIG. 12A through FIG. 12C.

FIG. 12A may depict a front, right, perspective view of the substantially collapsed package-receiving-locker 900 removably attached to door 451. In some embodiments, when collapsible-locker 101 may be removably attached to door 451, intended for deployment, then collapsible-locker 101 may be located on door-outside 455, as opposed to door-inside 453. Door-outside 455 may be shown in FIG. 12A. However, if package-receiving-locker 900 was intended to be stored in its substantially collapsed configuration, then collapsible-locker 101 may be mounted to door 451, such that collapsible-locker 101 may be located on door-inside 453.

FIG. 12B may depict a rear, right, perspective view of the substantially collapsed package-receiving-locker 900 removably attached to door 451. This view in FIG. 12B may be from door-inside 453. FIG. 12B may show package-receiving-locker 900 removably attached to door 451, with the two opposing J-hooks 159 removably capturing (engaging) the opposing sides (edges) 459/461 of door 451. FIG. 12B may show package-receiving-locker 900 removably attached to door 451, with a portion of door-bottom 457 resting upon bottom-door-bracket 153 and secured in place via adjustment-screws 155.

FIG. 12C may depict a front, right, perspective view of the substantially collapsed package-receiving-locker 900 with the two opposing J-hooks 159 in a process of being removably secured to the two opposing edges 459/461 of door 451. Or FIG. 12C may show the two opposing J-hooks 159 in a process of being removably detached from the two opposing edges 459/461 of door 451. In some embodiments, J-hooks 159 may be sliding housed via J-hook-receiver 161 located on a back of rear-wall 119.

Note, in some embodiments, when package-receiving-locker 900 may be properly attached to door 451, package-receiving-locker 900 may be located closer to hinge-side 461 than to non-hinge-side 459. See e.g., FIG. 12A, FIG. 12B, and FIG. 12C.

FIG. 13A and FIG. 13B may show use of kickstand-assembly 1301. FIG. 13A may depict a front, left, perspective view of kickstand-assembly 1301 in use in scenario with a relatively short landing 1311 and/or landing 1311 that may slope away from door 451 and/or step-top 1315 may be relatively close to door 451. FIG. 13B may depict a front, right, perspective view of kickstand-assembly 1301 in use in scenario with a relatively short landing 1311 and/or landing 1311 that may slope away from door 451 and/or step-top 1315 may be relatively close to door 451.

In scenarios where landing 1311 may have a relatively narrow (short) width, landing 1311 may not be level (e.g., may slope away from door 451), and/or door 451 may be relatively close to step-top 1315, then use of kickstand-assembly 1301 may permit collapsible-locker 101 to be leveled and/or for kickstand 621 to bear some of a load of collapsible-locker 101. In such scenarios, kickstand 621 may be extended (deployed) so its terminal end rests upon a top of landing 1311 or upon step-top 1315; kickstand 621 may be extended (deployed) sufficiently that collapsible-locker 101 may be maintained substantially level. See e.g., FIG. 13A and FIG. 13B. In some embodiments, when package-receiving-locker 900 may be removably attached to door 451, and kickstand 621 may be deployed onto landing 1311 or step-top 1315, when door 451 may be opened inwards (away from landing 1311 and step-top 1315), then kickstand 621 may bend and/or pivot so as not to prevent this door's 451 inward opening motion; further, in some embodiments, this door's 451 inward opening motion may also cause retraction of kickstand 621 back into its kickstand-housing 623.

In some embodiments, when package-receiving-locker 100/900/2200/3600 may be in its fully (or substantially) deployed configuration and removably attached to door 451, package-receiving-locker 100/900/2200/3600 may be closer to the ground/floor than to a middle of door 451, with respect to a vertical direction of door 451. This may keep lid 111 and access to package-receiving-locker 100/900/2200/3600 relatively close to the ground/floor, which may be desirable for when User 2 (or User 1) may be short and/or weak. This may also help to reduce visibility of package-receiving-locker 100/900/2200/3600 from the street/curb, which in turn may help to avoid notice of thieves/porch pirates. See e.g., FIG. 13A, FIG. 13B, FIG. 4G, FIG. 4H, FIG. 5E, and FIG. 5F.

FIG. 14A through FIG. 14E may show top views of typical hinged doorway mechanics.

Figure 14A:
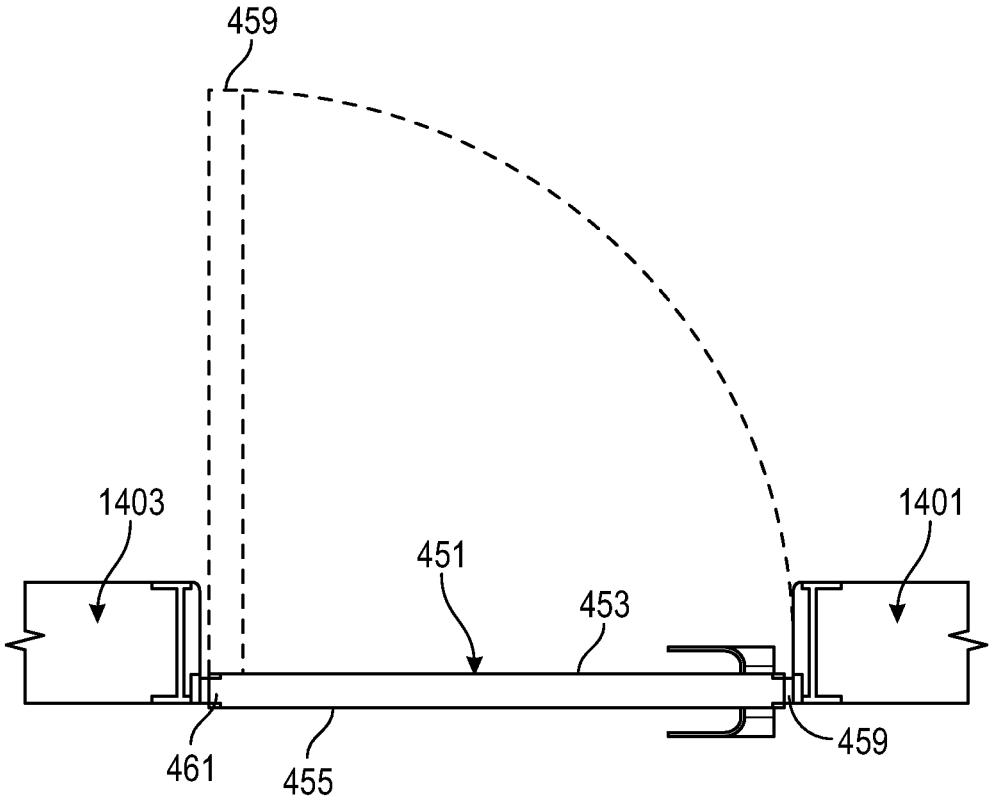
FIG. 14A may show a top diagram view of typical hinged doorway and its associated door swing mechanics.

FIG. 14A may show a top diagram view of typical hinged doorway and its associated mechanics. In some embodiments, door 451 may be side mounted, via hinges, to a door jamb proximate to hinge-side-wall 1403. In some embodiments, disposed opposite of hinge-side-wall 1403, by at least a width of door 451, may be non-hinge-side-wall 1401. In some embodiments, disposed between non-hinge-side-wall 1401 and hinge-side-wall 1403 may be the typical hinged doorway. In some embodiments, when door 451 may be closed, non-hinge-side 459 may be closer to non-hinge-side-wall 1401 than to hinge-side-wall 1403; and hinge-side 461 may be closer to hinge-side-wall 1403 than to non-hinge-side-wall 1401. In some embodiments, when door 451 may be closed, door-inside 453 may face an interior of the given structure (e.g., the given structure may be a home, a residence, a business, an office, etc.). In some embodiments, when door 451 may be closed, door-outside 455 may face an exterior of the given structure.

Figure 14B:
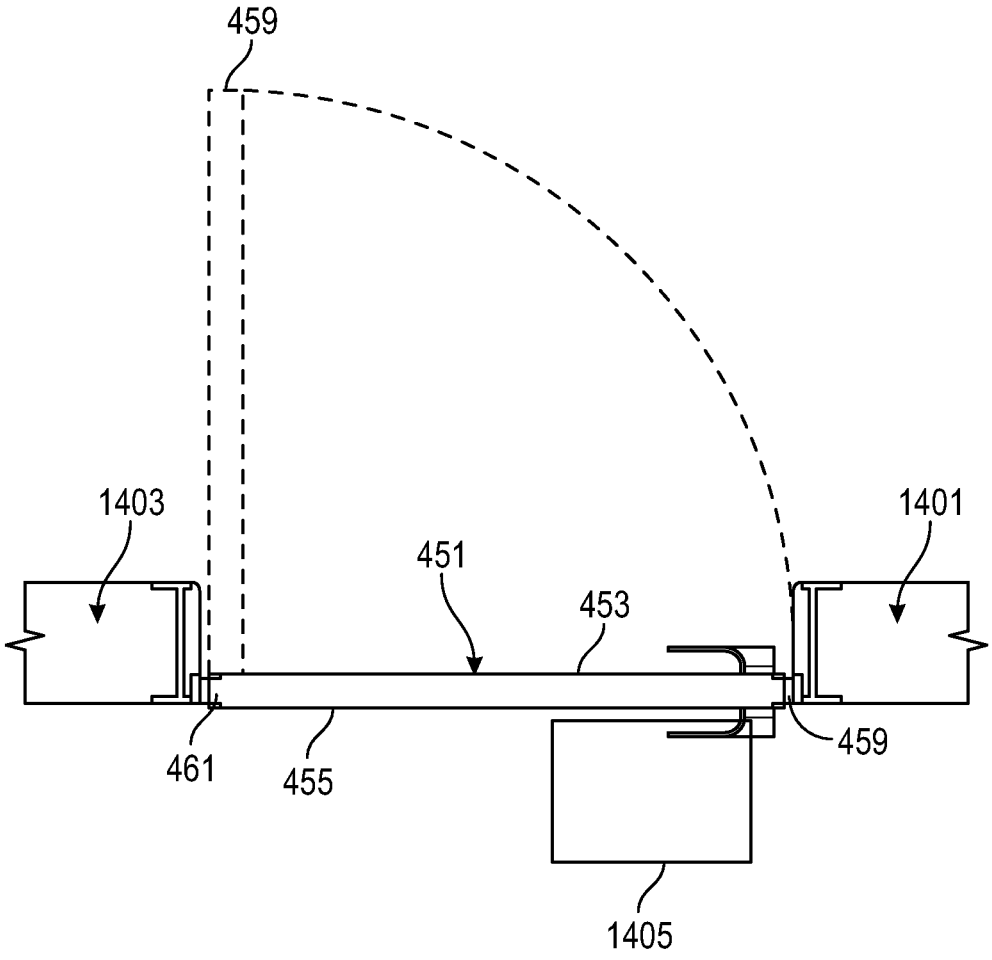
FIG. 14B may show a top diagram view of typical hinged doorway and its associated door swing mechanics in conjunction with a too-close-locker that may be problematic for opening of the door when the too-close-locker may be attached to the door too close to the door's non-hinge-side.

FIG. 14B may show a top diagram view of typical hinged doorway and its associated mechanics in conjunction with a too-close-locker 1405 that may be problematic for opening door 451 when too-close-locker 1405 may be attached to door 451 too close to non-hinge-side 459. Thus, even when a given locker may be relatively small, if that locker is attached too closely to non-hinge-side 459 when that locker may be attached to door 451, then when door 451 may be attempted to be opened, a portion of too-close-locker 1405 may hit non-hinge-side-wall 1401 and prevent door 451 from opening properly. This may be an annoyance and/or a safety problem. In some embodiments, when proper door 451 opening functionality may be desired or required, then the given locker should be attached to door 451 closer to hinge-side 461 than to non-hinge-side 459; and this requirement may in turn place size and shape limitations (as well as placement/location limitations) upon the given locker to be attached to door 451.

Figure 14C:
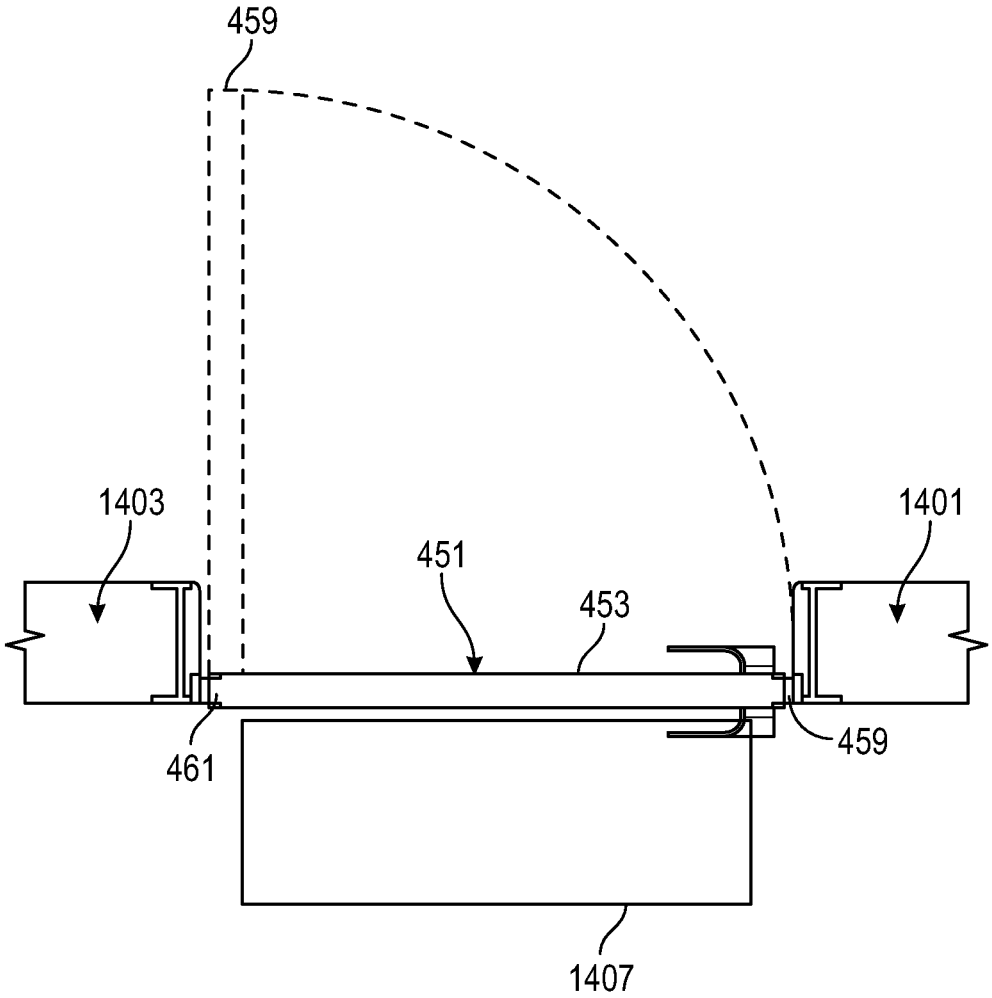
FIG. 14C may show a top diagram view of typical hinged doorway and its associated door swing mechanics in conjunction with a too-wide-locker that may be problematic for opening of the door when the too-wide-locker 1407 may be attached to the door too close to the door's non-hinge-side.

FIG. 14C may show a top diagram view of typical hinged doorway and its associated mechanics in conjunction with a too-wide-locker 1407 that may be problematic for opening door 451 when too-wide-locker 1407 may be attached to door 451 too close to non-hinge-side 459. If too-wide-locker 1407 is too wide, its attachment to door 451 may place too-wide-locker 1407 too close to non-hinge-side 459, such that then when door 451 may be attempted to be opened, a portion of too-wide-locker 1407 may hit non-hinge-side-wall 1401 and prevent door 451 from opening properly. This may be an annoyance and/or a safety problem. In some embodiments, when proper door 451 opening functionality may be desired or required, then the given locker should be attached to door 451 closer to hinge-side 461 than to non-hinge-side 459; and this requirement may in turn place size and shape limitations (as well as placement/location limitations) upon the given locker to be attached to door 451.

Figure 14D:
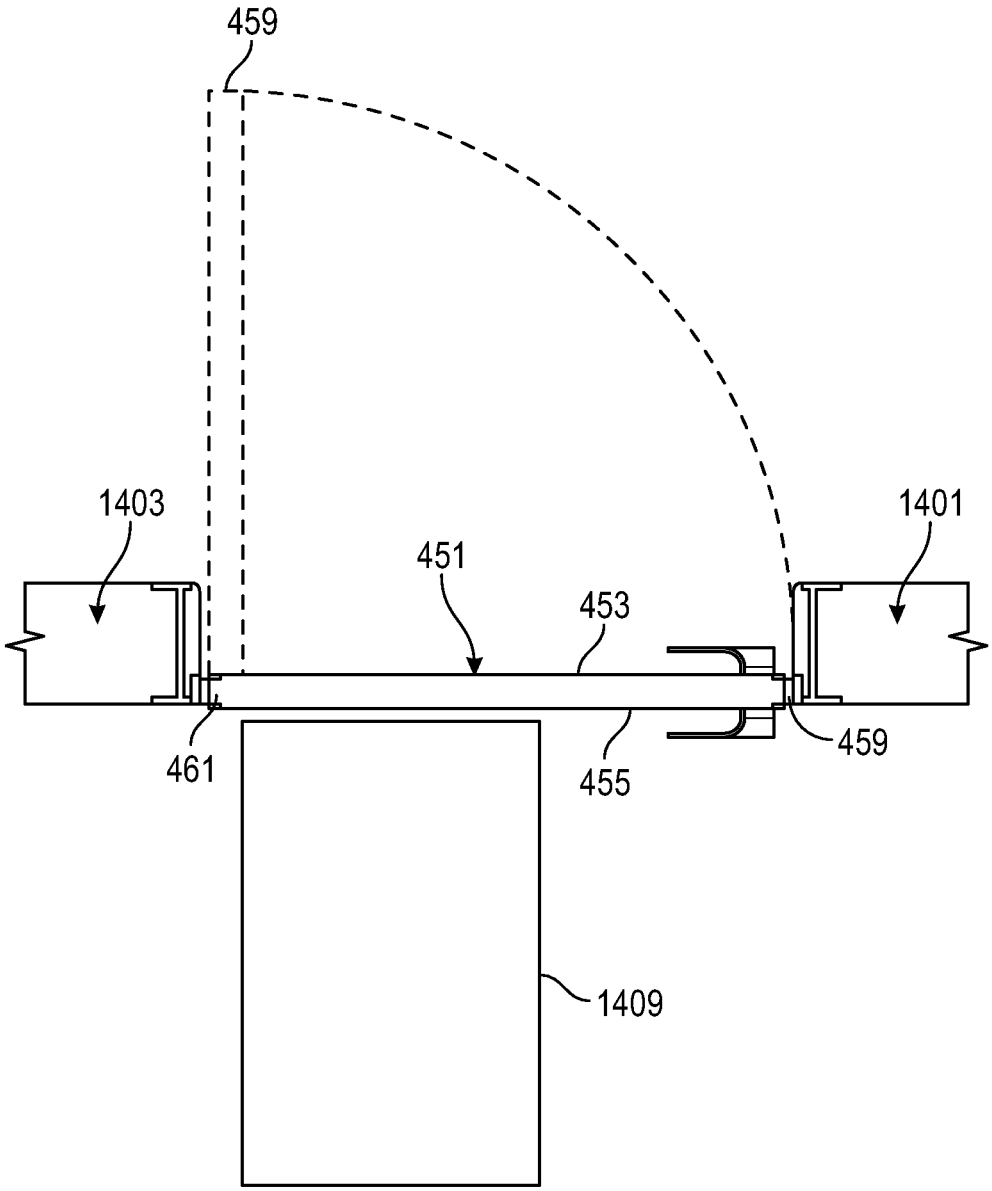
FIG. 14D may show a top diagram view of typical hinged doorway and its associated door swing mechanics in conjunction with a too-deep-locker that may be problematic for opening of the door when the too-deep-locker may be attached to the door too close to the door's non-hinge-side.

FIG. 14D may show a top diagram view of typical hinged doorway and its associated mechanics in conjunction with a too-deep-locker 1409 that may be problematic for opening door 451 when too-deep-locker 1409 may be attached to door 451 too close to non-hinge-side 459. If too-deep-locker 1409 is too deep, its attachment to door 451 may place too-deep-locker 1409 too close to non-hinge-side 459, such that then when door 451 may be attempted to be opened, a portion of too-deep-locker 1409 may hit non-hinge-side-wall 1401 and prevent door 451 from opening properly. This may be an annoyance and/or a safety problem. In some embodiments, when proper door 451 opening functionality may be desired or required, then the given locker should be attached to door 451 closer to hinge-side 461 than to non-hinge-side 459; and this requirement may in turn place size and shape limitations (as well as placement/location limitations) upon the given locker to be attached to door 451.

Figure 14E:
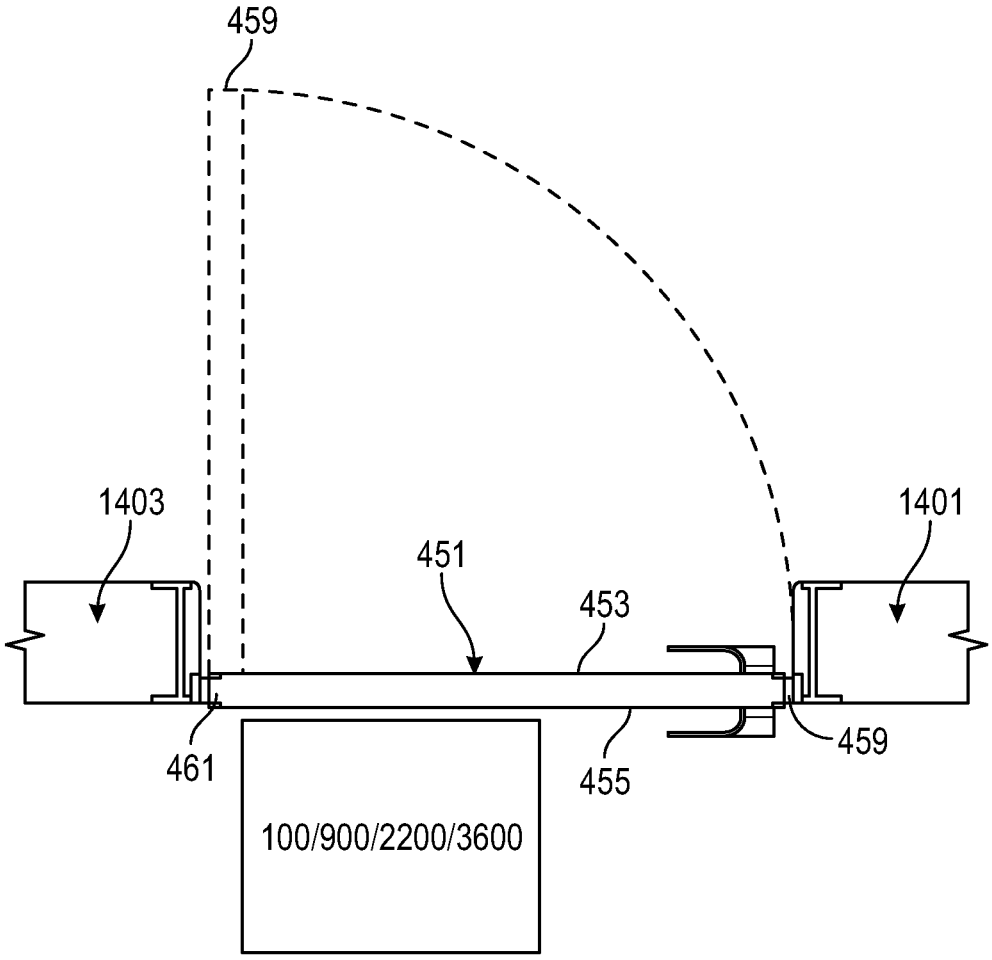
FIG. 14E may show a top diagram view of typical hinged doorway and its associated door swing mechanics in conjunction with a package-receiving-locker which may be sized, shaped, and/or placed in an optimal manner to maximize a volume of the package-receiving-locker, but to still allow proper opening mechanics for the door.

FIG. 14E may show a top diagram view of typical hinged doorway and its associated mechanics in conjunction with package-receiving-locker 100/900/2200/3600 which may be sized, shaped, and placed in an optimal manner to maximize a volume of package-receiving-locker 100/900/2200/3600, but to still allow proper opening mechanics for door 451. The wider the given doorway, a greater in size package-receiving-locker 100/900/2200/3600 may be utilized and still allow for proper opening mechanics of door 451. In some embodiments, when proper door 451 opening functionality may be desired or required, then package-receiving-locker 100/900/2200/3600 should be attached to door 451 closer to hinge-side 461 than to non-hinge-side 459.

Figure 15:
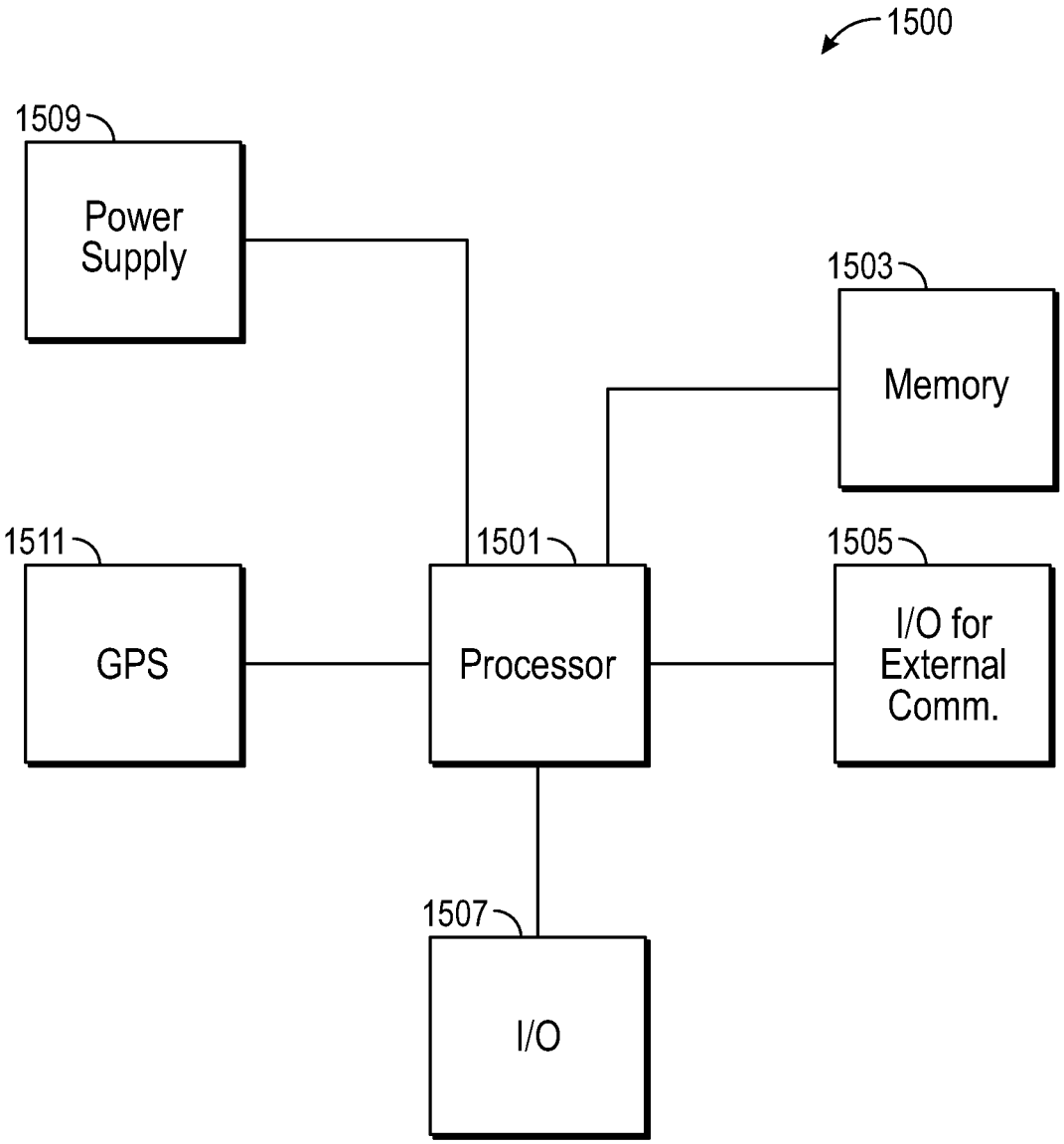
FIG. 15 may show a block diagram of hardware (electronic) components of a given package-receiving-locker.

FIG. 15 may show a block diagram of hardware (electronic) components of a given package-receiving-locker 100/900/2200/3600. FIG. 15 may depict a block diagram showing some main sub-hardware elements for computing-device 1500. In some embodiments, package-receiving-locker 100/900/2200/3600 may comprise computing-device 1500. In some embodiments, at least some aspects of computing-device 1500 may be located under lid 115. In some embodiments, at least some aspects of computing-device 1500 may be located on any internal facing surface of panels and/or walls of collapsible-locker 101, such as, but not limited to, lid 115 (e.g., lid-interior 711). In some embodiments, at least some aspects of computing-device 1500 may be on or at least partially within any internal facing surface of panels and/or walls of collapsible-locker 101, such as, but not limited to, lid 115 (e.g., lid-interior 711). In some embodiments, at least some aspects of computing-device 1500 may be on or at least partially within any external facing surface of panels and/or walls of collapsible-locker 101, such as, but not limited to, lid 115 (e.g., lid-interior 711). In some embodiments, at least some components of computing-device 1500 may be located under exterior-interface 115. In some embodiments, at least some components of computing-device 1500 may be located in bolt-receiver 313. In some embodiments, at least some components of computing-device 1500 may be located in interface-housing 615.

In some embodiments, computing-device 1500 may be a computer. In some embodiments, computing-device 1500 may be selected from one or more of: a computer, a smartphone, a tablet computing device, a laptop computer, a desktop computer, a tower computer, a server computer (server), a workstation computer (workstation), and/or the like. For example, and without limiting the scope of the present invention, in some embodiments, first-user-computing-device 1601 (see FIG. 16) may be a computing-device 1500. For example, and without limiting the scope of the present invention, in some embodiments, second-user-computing-device 1603 (see FIG. 16) may be a computing-device 1500. For example, and without limiting the scope of the present invention, in some embodiments, Server 1605 (see FIG. 16) may be a computing-device 1500. For example, and without limiting the scope of the present invention, in some embodiments, Admin-Device 1607 (see FIG. 16) may be a computing-device 1500.

Continuing discussing FIG. 15, in some embodiments, computing-device 1500 may be one or more circuits. In some embodiments, computing-device 1500 may be a printed circuit board (PCB) or may comprise one or more such PCBs. In some embodiments, computing-device 1500 may comprise one or more of the following sub-hardware elements (components): Processors 1501, one or more Memory 1503, one or more I/O for External Communications 1505, I/O Means 1507, and power-supply 1509. "I/O" herein may refer to "inputs/outputs" as is commonly known in the computing and electronics industries. In some embodiments, the one or more Processors 1501 may be electrically and/or optically coupled (e.g., via wiring, cabling, bus, and/or the like) with the one or more Memory 1503, one or more I/O for External Communications 1505, I/O Means 1507, and power-supply 1509. In some embodiments, at least some of Processors 1501, one or more Memory 1503, one or more I/O for External Communications 1505, I/O Means 1507, and/or power-supply 1509 may be operationally linked with one another, such as via electrical wired connections.

In FIG. 15, Processor 1501 may be one or more processors, including one or more central processors and/or one or more processors for graphics. In some embodiments, Processor 1501 may be in communication with Memory 1503. In some embodiments, Processor 1501 may be in communication with I/O for External Communications 1505. In some embodiments, Processor 1501 may be in communication with I/O Means 1507. In some embodiments, Processor 1501 may be in communication with power-supply 1509. In some embodiments, such communications may be facilitated via wired connections for electrical (and/or optical) communications. In some embodiments, Processor 1501 may receive electrical power necessary for operations from power-supply 1509.

In some embodiments, the inputs of I/O Means 1507 of a given computing-device 1500 may be one or more inputs selected from: inputs from exterior-interface 115; inputs from fingerprint-scanner on exterior-interface 115; inputs from a keypad on exterior-interface 115; lid 111 open/closed sensors (e.g., micro-switch); external motion sensor(s); internal movement sensor (e.g., accelerometer, GPS-module 1511, or the like); a touchscreen of computing-device 1500 (e.g., exterior-interface 115); buttons of computing-device 1500; switches of computing-device 1500; keyboard of computing-device 1500; stylus of computing-device 1500; mouse of computing-device 1500; trackball of computing-device 1500; touchpad of computing-device 1500; lever of computing-device 1500; slide of computing-device 1500; dials of computing-device 1500; camera(s) (external and/or internal) of computing-device 1500; proximity detectors of computing-device 1500 (e.g., RFID/NFC reader/receiver/scanner); motion detector of computing-device 1500; hardwired electrical power ports (e.g., a USB port or the like) of computing-device 1500; hardwired data ports (e.g., a USB port or the like) of computing-device 1500; incoming communications received via I/O for External Communications 1505 of computing-device 1500; microphones of computing-device 1500; and/or the like. In some embodiments, I/O Means 1507 may comprise a GPS chip set (e.g., GPS-module 1511) and/or the like for determining the position of computing-device 1500.

In some embodiments, the inputs of I/O Means 1507 of a given computing-device 1500 of a given package-receiving-locker may comprise at least one camera configured to capture internal/interior images, stills, video, and/or audio from within collapsible-locker 101. In some embodiments, the inputs of I/O Means 1507 of a given computing-device 1500 of a given package-receiving-locker may comprise at least one camera configured to capture external/exterior images, stills, video, and/or audio from outside of collapsible-locker 101. In some embodiments, such camera(s) may emit light (e.g., a flash or constant lighting to aid in image capture). In some embodiments, such camera(s) may be digital. In some embodiments, such data generated and/or captured from such camera(s) may be non-transitorily store in Memory 1503. In some embodiments, such camera(s) may have infrared capability and/or low visible light operating image capturing capability.

In some embodiments, the outputs of I/O Means 1507 may be one or more outputs selected from: state of a lock for lid 111 (e.g., locked or unlocked) (wherein this lock may comprise be one or more bolt(s) 311, servo motor actuator(s) in some embodiments, solenoid actuator(s) in some embodiments, and/or magnetic locks in other embodiments); collapsible-locker 101 internal facing light(s); collapsible-locker 101 external facing light(s); back lighting; information displayed on a monitor, screen (including a touchscreen), or display of computing-device 1500; readouts of computing-device 1500; speakers of computing-device 1500; buzzers of computing-device 1500; bells of computing-device 1500; whistles of computing-device 1500; lights (LEDs) of computing-device 1500; alarms of computing-device 1500; scanners of and/or in communication with computing-device 1500; printers of and/or in communication with computing-device 1500; outgoing information transmitted via the hardwired port (e.g., a USB port or the like) of computing-device 1500; outgoing information transmitted via I/O for External Communications 1505, and/or the like.

Continuing discussing FIG. 15, in some embodiments, Processor 1501 may execute a computer program known as an operating system (e.g., a Microsoft Windows operating system, a Linux operation system, an Apple and/or Macintosh operating system, a mobile computing device operating system, any other suitable operating system, and/or combinations thereof) which may control the execution of other computer programs (e.g., application programs, including in some embodiments a computer program styled as "PRL/SBL Software"); and may provide for scheduling, input/output (I/O) and other device control, accounting, compilation, storage assignment, data management, memory management, communication; and/or dataflow control. Collectively, Processor 1501 and its operating system may define a computer platform for which the application programs and other computer program languages may be written in. In some embodiments, Processor 1501 may also execute one or more computer programs to implement various functions and/or methods of the present invention, such as the PRL/SBL Software that may be one main aspect of the present invention. These computer programs may be written in any type of computer program language, including, but not limited to, a procedural programming language, object-oriented programming language, macro language, and/or combinations thereof.

These computer programs, including the operating system and/or the PRL/SBL Software, may be stored (e.g., non-transitorily stored) in Memory 1503. Memory 1503 may store (hold) information on a volatile or non-volatile medium, and may be fixed and/or removable. Memory 1503 may include a tangible computer readable and computer writable non-volatile recording medium, on which signals are stored that define a computer program or information to be used by the computer program. The recording medium may, for example, be disk memory, flash memory, and/or any other article(s) of manufacture usable to record and store information (in a non-transitory fashion). In some embodiments, in operation, Processor 1501 may cause(s) data (such as, but not limited to, user account data, user profile data, user preference data, delivery verification logs, usage logs, access logs, keystroke logs, camera captures [e.g., photos and/or video], microphone captures [e.g., audio captures], GPS/positional information, movement/translation information, fingerprint scans, fingerprint reference files, usernames, passwords, passcodes, environmental data logs, etc.) to be read from the nonvolatile recording medium into a volatile memory (e.g., a random access memory, or RAM) that may allow for more efficient (i.e., faster) access to the information by the Processor 1501 as compared against the nonvolatile recording medium. Such RAM memory may be located in/on the Memory 1503 and/or in/on Processor 1501. See e.g., FIG. 15. The Processor 1501 may manipulate(s) the data within integrated circuit memory and may then copy the data to the nonvolatile recording medium after processing may be completed. A variety of mechanisms are known for managing data movement between the nonvolatile recording medium and the integrated circuit memory element, and the invention is not limited to any mechanism, whether now known or later developed. The invention is also not limited to a particular processing unit (e.g., Processor 1501) or storage unit (e.g., Memory 1503).

Note, each and every method and/or step discussed herein and as depicted in the figures may be implemented as non-transitory computer-readable medium including codes executable by a processor, such as Processor 1501. That is, such non-transitory computer-readable medium may be the one or more Memory 1503 storage units. That is, such a processor may be Processor 1501; or alternatively, Processor 1501 may comprise such a processor.

The PRL/SBL Software may be non-transitorily stored in Memory 1503. In some embodiments, the PRL/SBL Software may be distributed across several and different Memory 1503*s* of a single computing-device 1500. In some embodiments, the PRL/SBL Software may be distributed across several and different Memory 1503*s* of several and different computing-devices 1500. In some embodiments, some portions of the PRL/SBL Software (e.g., a user GUI or user cookie, user's data or portion thereof) may be non-transitorily stored in Memory 1503 of computing-device(s) 1500 such as first-user-computing-device 1601 and/or second-user-computing-device 1603; wherein other portions of the PRL/SBL Software (e.g., user account data, user profile data, user preference data, delivery verification logs, usage logs, access logs, keystroke logs, camera captures [e.g., photos and/or video], microphone captures [e.g., audio captures], GPS/positional information, movement/translation information, fingerprint scans, fingerprint reference files, usernames, passwords, passcodes, environmental data logs, etc.) may be non-transitorily stored in Memory 1503 of a computing-device 1500 that is a Server 1605. Wherein yet further other portions the PRL/SBL Software (e.g., admin's GUI or admin's cookie) may be non-transitorily stored in Memory 1503 of a computing-device 1500 that is an Admin-Device 1607.

New and/or updates to code, program, software applications, operating system, firmware, and/or the PRL/SBL Software may be saved non-transitorily onto Memory 1503 from I/O Means 1507 and/or via I/O for External Communications 1505.

Continuing discussing FIG. 15, in some embodiments, Processor 1501 may also be in communication with I/O for External Communications 1505. Processor 1501 may control I/O for External Communications 1505, depending upon the instructions that Processor 1501 may be processing/executing. I/O for External Communications 1505 may permit communication between first-user-computing-device 1601 and/or second-user-computing-device 1603 (see e.g., FIG. 16). I/O for External Communications 1505 may permit communication between a given computing-device 1500 (e.g., first-user-computing-device 1601 and/or second-user-computing-device 1603) and other computing-devices (e.g., servers 1605 and/or admin-devices 1607) that are or are not part of the given computing-device 1500, and/or that may not be under the control of a given computing-device 1500. I/O for External Communications 1505 may permit communication between a given computing-device 1500 and another computing-device 1500. I/O for External Communications 1505 may permit communication between a given computing-device 1500 and server(s) 1605. I/O for External Communications 1505 may permit communication between a given computing-device 1500 and admin-device 1607.

In some embodiments, I/O for External Communications 1505 may comprise one or more radios and/or antennas to facilitate wireless communications, such as WiFi (Wi-Fi), Bluetooth, ZigBee, cellular, RFID, NFC, a predetermined wireless communication protocol, combinations thereof, and/or the like. In some embodiments, I/O for External Communications 1505 may comprise at least one Bluetooth chipset and/or the like. In some embodiments, I/O for External Communications 1505 may comprise a network card and/or a network adapter. In some embodiments, I/O for External Communications 1505 may be a network card and/or a network adapter. In some embodiments, I/O for External Communications 1505 may be in wired and/or wireless communications with the Internet, WAN (wide area network), LAN (local area network) (see e.g., internet/network/WAN/LAN 1609 in FIG. 16). Communications between a given computing-device 1500 that may rely upon I/O for External Communications 1505 and one or more of: another computing-device 1500, first-user-computing-device 1601, second-user-computing-device 1603, server 1605, and/or admin-device 1607—may be routed through such a network (see e.g., internet/network/WAN/LAN 1609 in FIG. 16). In some embodiments, I/O for External Communications 1505 may comprise one or more radios and/or antennas to facilitate reading, interrogating, and/or scanning of RFID tags (and/or NFC tags); wherein "RFID" may refer to radio frequency identification and "NFC" may refer to near field communication.

In some embodiments, power-supply 1509 may provide electrical power to the main sub-hardware elements and/or electronics of computing-device 1500. In some embodiments, power-supply 1509 may be one or more batteries. In some embodiments, power-supply 1509 may be one or more rechargeable batteries. In some embodiments, power-supply 1509 may be one or more backup batteries. In some embodiments, batteries of power-supply 1509 may comprise graphene, lithium, combinations thereof, and/or the like. In some embodiments, power-supply 1509 may be one or more AC/DC adapters or electrical power conditioners allowing computing-device 1500 to received standardized AC electrical power from wired power source. In some embodiments, power-supply 1509 may comprise one or more solar panels for generating electrical power, wherein such one or more solar panels may be located on an external surface of package-receiving-locker 100/900/2200/3600 (such as, but not limited to lid 111).

The main sub-hardware elements of a given computing-device 1500, including their workings and configurations, are well known in the relevant computing and electronics industries and such information is incorporated herein by reference.

Figure 16:
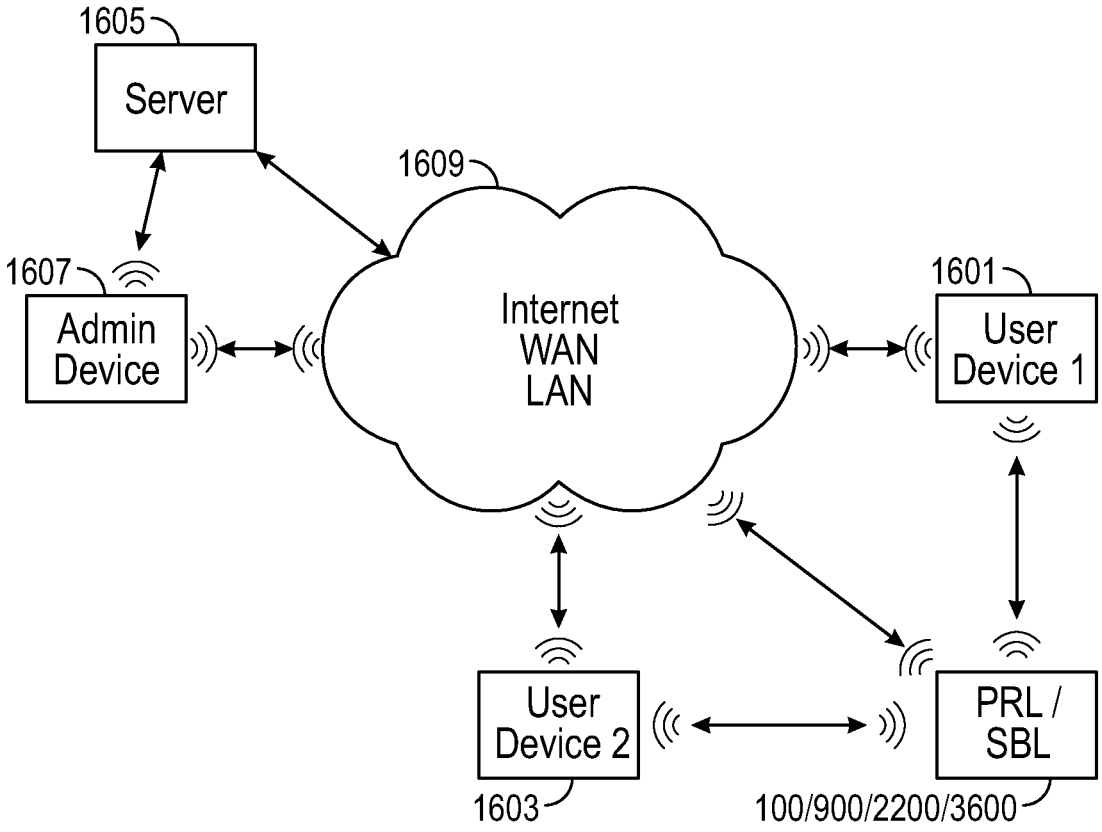
FIG. 16 may depict a block diagram showing the package-receiving-locker in wireless (or wired) communication with other computing-devices.

FIG. 16 may show a block diagram of communications for a given package-receiving-locker 100/900/2200/3600. FIG. 16 may depict a block diagram showing package-receiving-locker 100/900/2200/3600 in wireless (or wired) communication with other computing-devices. FIG. 16 may depict a block diagram showing how aspects of the PRL/SBL Software communicate with itself and with other devices (such as other computing devices). In some embodiments, first-user-computing-device 1601 may be a type of computing-device 1500. In some embodiments, first-user-computing-device 1601 may be associated with User 1. In some embodiments, User 1 may be delivery person (and/or delivery robot) who may be delivering one or more goods to a given package-receiving-locker 100/900/2200/3600. In some embodiments, there may be one or more first-user-computing-device(s) 1601. In some embodiments, second-user-computing-device 1603 may be a type of computing-device 1500. In some embodiments, second-user-computing-device(s) 1603 may be associated with User 2. In some embodiments, User 2 may be an intended recipient (e.g., a consumer, a business, an organization, or the like) of the one or more goods delivered and received into a given package-receiving-locker 100/900/2200/3600. In some embodiments, User 2 may be an owner of package-receiving-locker 100/900/2200/3600. In some embodiments, User 2 may be a lessee (renter) of package-receiving-locker 100/900/2200/3600. In some embodiments, User 2 may have substantial control and/or possession of package-receiving-locker 100/900/2200/3600.

In some embodiments, there may be one or more second-user-computing-device(s) 1603. In some embodiments, first-user-computing-device 1601 and second-user-computing-device 1603 may be different computing-devices, but could be of a same type of computing-device (such as, but not limited to, a smartphone, a laptop, a tablet computing device, and/or the like). In some embodiments, Server 1605 may be a type of computing-device 1500. In some embodiments, there may be one or more Server(s) 1605. In some embodiments, one or more Server(s) 1605 may be associated with back-end operations of the PRL/SBL Software and/or with databases maintained on such Servers 1605. In some embodiments, Admin-Device 1607 may be a type of computing-device 1500. In some embodiments, Internet/WAN/LAN 1609 may comprise various network switches, routers, hubs, gateways, modems, hotspots, signal expanders, and/or the like facilitating data flow. In some embodiments, these network switches, routers, hubs, gateways, modems, hotspots, and signal expanders, and/or the like may be types of computing-devices 1500. In some embodiments, WAN may refer to a wide area network. In some embodiments, LAN may refer to a local area network.

Continuing discussing FIG. 16, in some embodiments, first-user-computing-device 1601 may be in communication with Internet/WAN/LAN 1609. In some embodiments, first-user-computing-device 1601 may be in wireless and/or wired communication with Internet/WAN/LAN 1609.

Continuing discussing FIG. 16, in some embodiments, first-user-computing-device 1601 may be in communication with the computing-device 1500 of package-receiving-locker 100/900/2200/3600. In some embodiments, communications between first-user-computing-device 1601 and package-receiving-locker 100/900/2200/3600 may be via (e.g., through and/or across) Internet/WAN/LAN 1609. In some embodiments, communications between first-user-computing-device 1601 and package-receiving-locker 100/900/2200/3600 may be routed through Internet/WAN/LAN 1609. In some embodiments, first-user-computing-device 1601 may communicate directly with package-receiving-locker 100/900/2200/3600. In some embodiments, such direct communications may be wireless. In some embodiments, User 1, via first-user-computing-device 1601, may receive delivery confirmations and/or delivery verification information. In some embodiments, such received delivery confirmations and/or delivery verification information may be via one or more of: text message (alert or notification); sms message (alert or notification); email; phone call; voicemail; popup message (alert or notification); popup notification; a message (alert or notification) within PRL/SBL Software running on first-user-computing-device 1601; and/or the like. In some embodiments, alert, notification, and/or message may be used interchangeably herein. In some embodiments, first-user-computing-device 1601 may have RFID and/or NFC tags and/or readers for using RFID and/or NFC to open, lock, unlock, and/or close lid 111 of package-receiving-locker 100/900/2200/3600.

Continuing discussing FIG. 16, in some embodiments, first-user-computing-device 1601 may be in communication with one or more Server(s) 1605. In some embodiments, communications between first-user-computing-device 1601 and one or more Server(s) 1605 may be via (e.g., through and/or across) Internet/WAN/LAN 1609. In some embodiments, communications between first-user-computing-device 1601 and one or more Server(s) 1605 may be routed through Internet/WAN/LAN 1609.

Continuing discussing FIG. 16, in some embodiments, second-user-computing-device 1603 may be in communication with Internet/WAN/LAN 1609. In some embodiments, second-user-computing-device 1603 may be in wireless and/or wired communication with Internet/WAN/LAN 1609.

Continuing discussing FIG. 16, in some embodiments, second-user-computing-device 1603 may be in communication with the computing-device 1500 of package-receiving-locker 100/900/2200/3600. In some embodiments, communications between second-user-computing-device 1603 and package-receiving-locker 100/900/2200/3600 may be via (e.g., through and/or across) Internet/WAN/LAN 1609. In some embodiments, communications between second-user-computing-device 1603 and package-receiving-locker 100/900/2200/3600 may be routed through Internet/WAN/LAN 1609. In some embodiments, second-user-computing-device 1603 may communicate directly with package-receiving-locker 100/900/2200/3600. In some embodiments, such direct communications may be wireless. In some embodiments, User 2, via second-user-computing-device 1603, may receive delivery confirmations and/or delivery verification information. In some embodiments, such received delivery confirmations and/or delivery verification information may be via one or more of: text message (alert or notification); sms message (alert or notification); email; phone call; voicemail; popup message (alert or notification); popup notification; a message (alert or notification) within PRL/SBL Software running on second-user-computing-device 1603; and/or the like. In some embodiments, alert, notification, and/or message may be used interchangeably herein. In some embodiments, second-user-computing-device 1603 may have RFID and/or NFC tags and/or readers for using RFID and/or NFC to open, lock, unlock, and/or close lid 111 of package-receiving-locker 100/900/2200/3600.

In some embodiments, User 1 and/or User 2 may use exterior-interface 115 to access (e.g., unlock, and/or open) lid 111 of collapsible-locker 101 of package-receiving-locker 100/900/2200/3600.

In some embodiments, User 1 and/or User 2 may use exterior-interface 115 to lock lid 111 of collapsible-locker 101 of package-receiving-locker 100/900/2200/3600.

Continuing discussing FIG. 16, in some embodiments, second-user-computing-device 1603 may be in communication with one or more Server(s) 1605. In some embodiments, communications between second-user-computing-device 1603 and one or more Server(s) 1605 may be via (e.g., through and/or across) Internet/WAN/LAN 1609. In some embodiments, communications between second-user-computing-device 1603 and one or more Server(s) 1605 may be routed through Internet/WAN/LAN 1609.

Continuing discussing FIG. 16, in some embodiments, Admin-Device 1607 may be in communication with Internet/WAN/LAN 1609. In some embodiments, Admin-Device 1607 may be in wireless and/or wired communication with Internet/WAN/LAN 1609.

Continuing discussing FIG. 16, in some embodiments, Admin-Device 1607 may be in communication with the computing-device 1500 of package-receiving-locker 100/900/2200/3600. In some embodiments, communications between Admin-Device 1607 and package-receiving-locker 100/900/2200/3600 may be via (e.g., through and/or across) Internet/WAN/LAN 1609. In some embodiments, communications between Admin-Device 1607 and package-receiving-locker 100/900/2200/3600 may be routed through Internet/WAN/LAN 1609. In some embodiments, Admin-Device 1607 may communicate directly with package-receiving-locker 100/900/2200/3600. In some embodiments, such direct communications may be wireless. In some embodiments, Admin-Device 1607 may have RFID and/or NFC tags and/or readers for using RFID and/or NFC to open, lock, unlock, and/or close lid 111 of package-receiving-locker 100/900/2200/3600.

Continuing discussing FIG. 16, in some embodiments, Admin-Device 1607 may be in communication with one or more Server(s) 1605. In some embodiments, Admin-Device 1607 may be in direct communication with one or more Server(s) 1605. In some embodiments, communications between Admin-Device 1607 and one or more Server(s) 1605 may be via (e.g., through and/or across) Internet/WAN/LAN 1609. In some embodiments, communications between Admin-Device 1607 and one or more Server(s) 1605 may be routed through Internet/WAN/LAN 1609.

In some embodiments, at least some portion of the PRL/SBL Software may be running and/or non-transitorily stored on computing-device 1500 of package-receiving-locker 100/900/2200/3600, first-user-computing-device 1601, second-user-computing-device 1603, and/or the one or more Server(s) 1605.

In some embodiments, at least some portion of the PRL/SBL Software that may be running on the one or more Server(s) 1605 may direct (cause) an update of the PRL/SBL Software to be loaded onto the Memory 1503 of: computing-device 1500 of package-receiving-locker 100/900/2200/3600, first-user-computing-device(s) 1601, and/or second-user-computing-device(s) 1603.

Continuing discussing FIG. 16, in some embodiments, first-user-computing-device 1601 may be in communication with one or more Admin-Device(s) 1607. In some embodiments, first-user-computing-device 1601 may be in wireless and/or wired communication with one or more admin-device(s) 1607. In some embodiments, communications between first-user-computing-device 1601 and the one or more Admin-Device(s) 1607 may be routed through Internet/WAN/LAN 1609.

Continuing discussing FIG. 16, in some embodiments, second-user-computing-device 1603 may be in communication with one or more Admin-Device(s) 1607. In some embodiments, second-user-computing-device 1603 may be in wireless and/or wired communication with one or more Admin-Device(s) 1607. In some embodiments, communications between second-user-computing-device 1603 and the one or more Admin-Device(s) 1607 may be routed through Internet/WAN/LAN 1609.

Continuing discussing FIG. 16, in some embodiments, computing-device 1500 of package-receiving-locker 100/900/2200/3600 may be in communication with one or more Admin-Device(s) 1607. In some embodiments, computing-device 1500 of package-receiving-locker 100/900/2200/3600 may be in wireless and/or wired communication with one or more Admin-Device(s) 1607. In some embodiments, communications between computing-device 1500 of package-receiving-locker 100/900/2200/3600 and the one or more Admin-Device(s) 1607 may be routed through Internet/WAN/LAN 1609.

Continuing discussing FIG. 16, in some embodiments, the one or more Server(s) 1605 may be in communication with the one or more Admin-Device(s) 1607. In some embodiments, the one or more Server(s) 1605 may be in wireless and/or wired communication with the one or more Admin-Device(s) 1607. In some embodiments, communications between the one or more Server(s) 1605 and the one or more Admin-Device(s) 1607 may be routed through Internet/WAN/LAN 1609. In some embodiments, at least some portion of the PRL/SBL Software may be running on the one or more Admin-Device(s) 1607. In some embodiments, at least some portion of the PRL/SBL Software that may be running on the one or more Admin-Device(s) 1607, and with proper logged in credentials, may access, edit, control, and/or override portions of the PRL/SBL Software and/or data located in Memory 1503 of the one or more Server(s) 1605. In some embodiments, at least some portion of the PRL/SBL Software that may be running on the one or more Admin-Device(s) 1607, and with proper logged in credentials, may access, edit, control, and/or override portions of the PRL/SBL Software and/or data located in Memory 1503 of the first-user-computing-device 1601.

In some embodiments, at least some portion of the PRL/SBL Software that may be running on the one or more Admin-Device(s) 1607, and with proper logged in credentials, may access, edit, control, and/or override portions of the Software and/or data located in Memory 1503 of the second-user-computing-device 1603.

In some embodiments, at least some portion of the PRL/SBL Software that may be running on the one or more Admin-Device(s) 1607, and with proper logged in credentials, may access, edit, control, and/or override portions of the PRL/SBL Software and/or data located in Memory 1503 of computing-device 1500 of package-receiving-locker 100/900/2200/3600.

In some embodiments, computing-device 1500, first-user-computing-device 1601, and/or second-user-computing-device 1603, may be a network capable standalone digital camera with a lens field of view pointed at (oriented) at a given package-receiving-locker 100/900/2200/3600, such that images, video, and/or audio of the given package-receiving-locker 100/900/2200/3600 may be captured.

Figure 17:
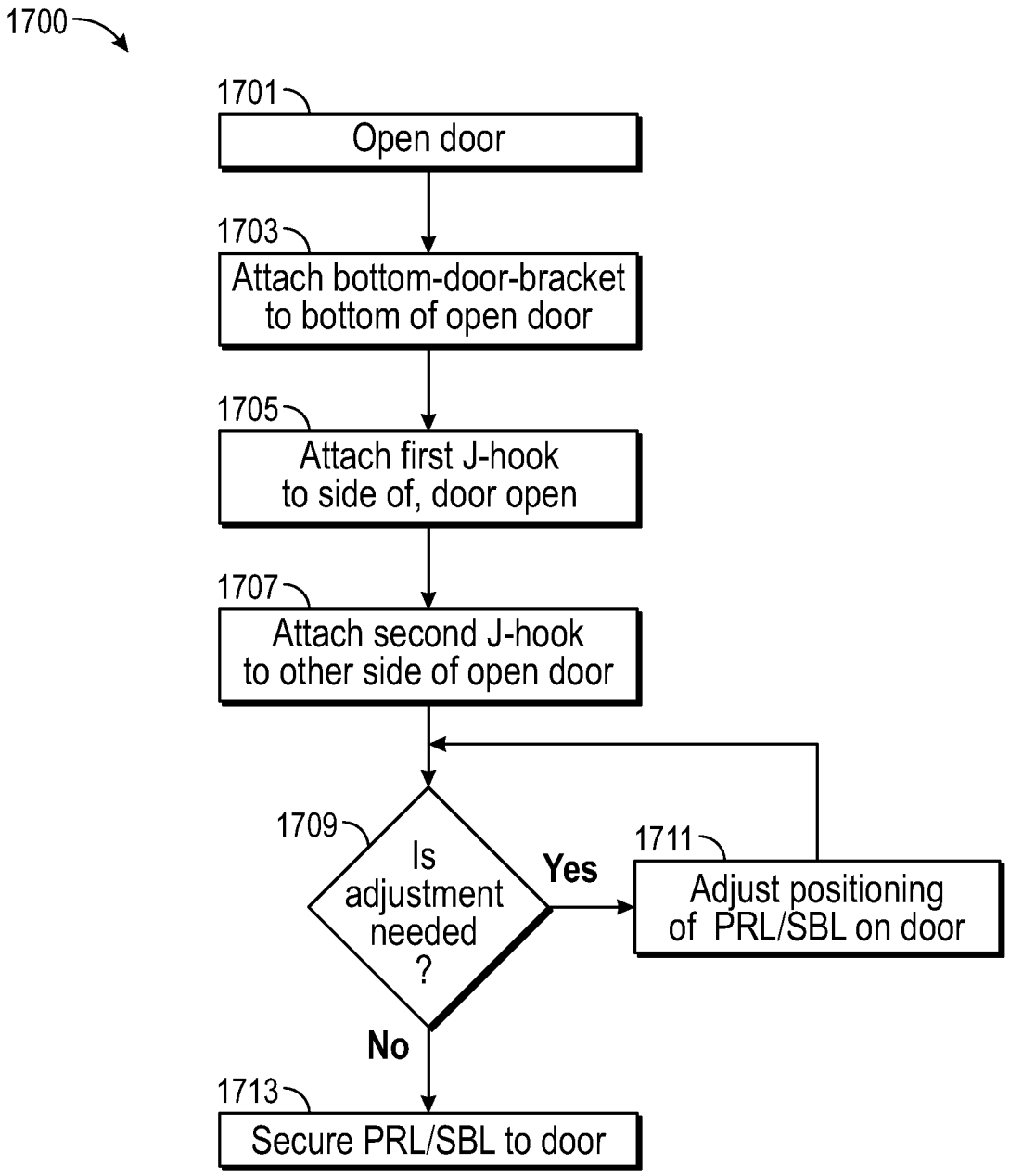
FIG. 17 may be a flow diagram showing at least some steps of how a given package-receiving-locker may be removably attached to a given door.

FIG. 17 may be a flow diagram showing steps of how a given package-receiving-locker 100/900 may be removably attached to a given door 451. In some embodiments, FIG. 17 may depict at least some steps of method 1700. In some embodiments, method 1700 may be a method of attaching the given package-receiving-locker 100/900 to the given door 451. In some embodiments, such attachment may of the given package-receiving-locker 100/900 to the given door 451 may be removable attachment. In some embodiments, method 1700 may also be supported by FIG. 5A through FIG. 5F and/or FIG. 12A through FIG. 12C. In some embodiments, method 1700 may comprise steps of: 1701, 1703, 1705, 1707, 1709, 1711, and 1713. In some embodiments, at least one of these steps may be optional.

Continuing discussing FIG. 17, in some embodiments, step 1701 may be a step of opening door 451. In some embodiments, removable attachment of package-receiving-locker 100/900 to door 451, may require door 451 to be at least partially open. In some embodiments, door 451 may need to be at least 30 degrees open from being closed to permit removable attachment of package-receiving-locker 100/900 to door 451. In some embodiments, door 451 may need to be at least 45 degrees open from being closed to permit removable attachment of package-receiving-locker 100/900 to door 451. In some embodiments, door 451 may need to be at least 60 degrees open from being closed to permit removable attachment of package-receiving-locker 100/900 to door 451. In some embodiments, door 451 may need to be at least 70 degrees open from being closed to permit removable attachment of package-receiving-locker 100/900 to door 451. In some embodiments, step 1701 may progress into step 1703.

Continuing discussing FIG. 17, in some embodiments, step 1703 may be a step of removably attaching bottom-door-bracket 153 to door-bottom 457 of open door 451. In some embodiments, step 1703 may be accomplished by sliding bottom-door-bracket 153 onto door-bottom 457 of open door 451. If locating collapsible-locker 101 on door-outside 455 may be desired, then executing step 1703 should be done so that door-outside 455 may be facing collapsible-locker 101 and that door-inside 453 may be facing adjustment-screw 155. In other words, if locating collapsible-locker 101 exteriorly of door 451, then step 1703 should be executed such that collapsible-locker 101 is located exteriorly to door 451 and that adjustment-screw 155 is located interiorly of door 451. Note, it may be necessary to loosen adjustment-screw 155 in order to facilitate execution of step 1703. In some embodiments, step 1703 may progress into step 1705.

Continuing discussing FIG. 17, in some embodiments, step 1705 may be a step of attaching a first J-hook to a side of open door 451. In some embodiments, the first J-hook may be pivoting J-hook 157 or sliding J-hook 159. In some embodiments, the side of open door 451 may be non-hinge-side 459 or hinge-side 461. In some embodiments, the first J-hook may be pivoting J-hook 157 and the side of open door 451 may be non-hinge-side 459. In some embodiments, pivoting J-hook 157 may have a fixed and predetermined length for a given width of door 451, such that removably attaching pivoting J-hook 157 to non-hinge-side 459, may put package-receiving-locker 100/900 into a proper location/position with respect to door 451 (e.g., located closer to hinge-side 461 than to non-hinge-side 459). In such embodiments, step 1709 may not be needed. In some embodiments, the first J-hook may be sliding J-hook 159 and the side of open door 451 may be hinge-side 461. In some embodiments, step 1705 may progress into step 1707.

Continuing discussing FIG. 17, in some embodiments, step 1707 may be a step of attaching a second J-hook to the opposite side of open door 451. In some embodiments, the second J-hook may be other of the two J-hooks, i.e., the remaining J-hook not used in step 1705. Thus, if the first J-hook may be pivoting J-hook 157, then the second J-hook may be sliding J-hook 159; or if the first J-hook may be sliding J-hook 159, then the second J-hook may be pivoting J-hook 157. Similarly, if non-hinge-side 459 was the side used in step 1705, then the opposite side in step 1707 may be hinge-side 461; or if hinge-side 461 was the side used in step 1705, then the opposite side in step 1707 may be non-hinge-side 459. In some embodiments, step 1707 may progress into step 1709.

Continuing discussing FIG. 17, in some embodiments, step 1709 may be a step of determining is positional adjustment of package-receiving-locker 100/900 on door 451 may be needed or desired. In some embodiments, a correct position/location of package-receiving-locker 100/900 on door 451 may be shown in FIG. 14E, with package-receiving-locker 100/900 located closer to hinge-side 461 than to non-hinge-side 459. If no adjustment of position/location of package-receiving-locker 100/900 on door 451 may be needed or desired, then step 1709 may progress into step 1713. If adjustment of position/location of package-receiving-locker 100/900 on door 451 may be needed or desired, then step 1709 may progress into step 1711.

Continuing discussing FIG. 17, in some embodiments, step 1713 may be a step of removably securing (e.g., tightening) the correctly positioned package-receiving-locker 100/900 onto door 451. In some embodiments, step 1713 may involve tightening adjustment-screw 155 against door 451, such that bottom-door-bracket 153 may be fixedly (but removably) attached to door 451 by friction (clamping).

Continuing discussing FIG. 17, in some embodiments, step 1711 may be a step of adjusting package-receiving-locker 100/900 on door 451 to a desired position/location. In some embodiments, adjustment step 1711 may involve sliding bottom-door-bracket 153 on door-bottom 457 of door 451, which may require loosening of adjustment-screw 155 and/or loosening of the first or the second J-hooks. In some embodiments, step 1711 may progress back into step 1709.

In some embodiments, method 1700 may be carried out with collapsible-locker 101 deployed or collapsed.

Figure 18:
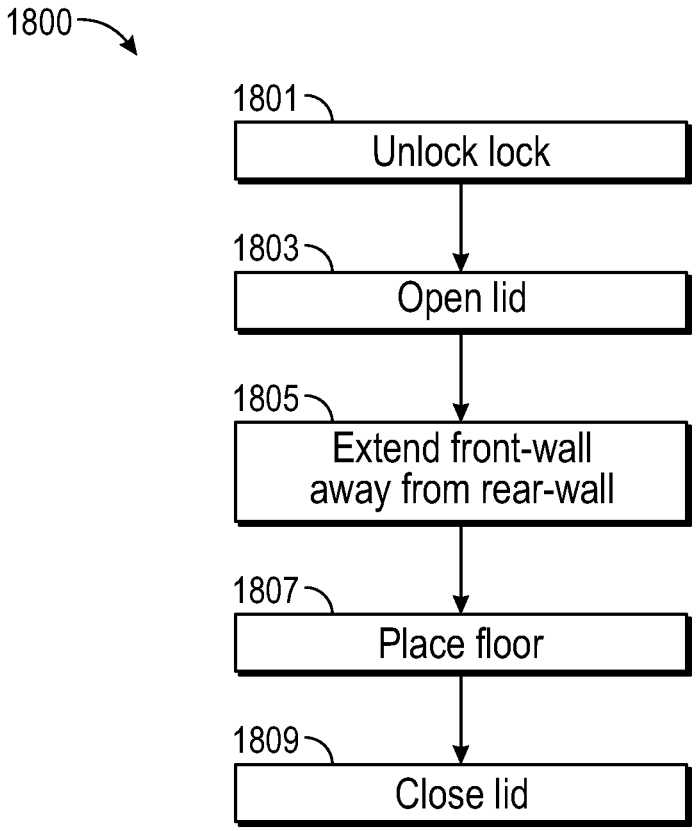
FIG. 18 may be a flow diagram showing at least some steps of how a given package-receiving-locker may be removably deployed from its substantially (or fully) collapsed configuration into its substantially (or fully) deployed configuration.

FIG. 18 may be a flow diagram showing steps of how a given package-receiving-locker 100/900/2200/3600 may be removably deployed from its substantially collapsed configuration into its substantially deployed configuration. In some embodiments, FIG. 18 may depict at least some steps of method 1800. In some embodiments, method 1800 may be a method of deploying the given package-receiving-locker 100/900/2200/3600 from its substantially collapsed configuration into its substantially deployed configuration. In some embodiments, method 1800 may also be supported by FIG. 3A through FIG. 3F and/or by FIG. 11A through FIG. 11C. In some embodiments, method 1800 may comprise steps of: 1801, 1803, 1805, 1807, and 1809. In some embodiments, at least one of these steps may be omitted, optional, and/or not performed in method 1800, e.g., step 1809.

Continuing discussing FIG. 18, in some embodiments, step 1801 may be a step of unlocking the lock of the given package-receiving-locker 100/900/2200/3600. Unlocking the given package-receiving-locker 100/900/2200/3600 may involve retracting bolt 311 from its bolt-receiver (e.g., bolt-receiver 1115). In some embodiments, when package-receiving-locker 900 may be in the substantially collapsed configuration, lid 111 may be locked to bottom-panel 923, by a distal portion of bolt 311 passing through bolt-receiver 1115. In some embodiments, the unlocking of the given package-receiving-locker 100/900/2200/3600 may be addressed by step 2005 and/or step 2017 shown in FIG. 20. In some embodiments, step 1801 may progress into step 1803.

Continuing discussing FIG. 18, in some embodiments, step 1803 may be a step of opening lid 111. In some embodiments, lid 111 may be need to be opened sufficiently so as not to interfere with steps 1805 and 1807. In some embodiments, step 1803 may require lid 111 to be opened at least 90 degrees from lid 111 position when collapsible-locker 101 may be substantially collapsed. In some embodiments, step 1803 may require lid 111 to be opened more than 90 degrees from lid 111 position when collapsible-locker 101 may be substantially collapsed. In some embodiments, step 1803 may progress into step 1805.

Continuing discussing FIG. 18, in some embodiments, step 1805 may be a step of extending front-wall 103 away from rear-wall 119, such that the two opposing side-walls 105 become substantially parallel with each other. In some embodiments, step 1805 may be accomplished by pulling front-wall 103 away from rear-wall 119. In some embodiments, step 1805 may be accomplished by tilting collapsible-locker 101 such that front-wall 103 may be pulled from rear-wall 119 by gravity, which in turn may mean package-receiving-locker 100/900/2200/3600 may not yet be removably attached to door 451. In some embodiments, step 1805 may progress into step 1807.

Continuing discussing FIG. 18, in some embodiments, step 1807 may be a step of placing floor 121 such that floor 121 may be substantially perpendicular with front-wall 103, side-walls 105, and rear-wall 119. In some embodiments, step 1807 may be facilitated by pushing floor 121 away from rear-wall 119. In some embodiments, step 1807 may be facilitated by gravity encouraging floor 121 to pivot (e.g., via hinge(s)) downwards away from rear-wall 119. In some embodiments, step 1807 may progress into step 1809. In some embodiments, completion of step 1807 may complete method 1800, i.e., in such embodiments step 1809 may be optional or omitted.

Continuing discussing FIG. 18, in some embodiments, step 1809 may be a step of closing lid 111, such that bolt 311 may removably engage bolt-receiver 315. In some embodiments, a default state of package-receiving-locker 100/900/2200/3600 may be locked, i.e., when lid 111 may be closed, the distal portion of bolt 311 may be removably captured within bolt-receiver 315. In some embodiments, a servo motor, solenoid, energized magnet, and/or the like that is operationally linked to bolt 311 or to bolt-receiver 315 may facilitate such locking (and unlocking) of lid 111. In some embodiments, step 1809 may be omitted or optional.

In some embodiments, method 1800 may be carried out whether or not package-receiving-locker 100/900/2200/3600 may be removably attached to door 451.

Figure 19:
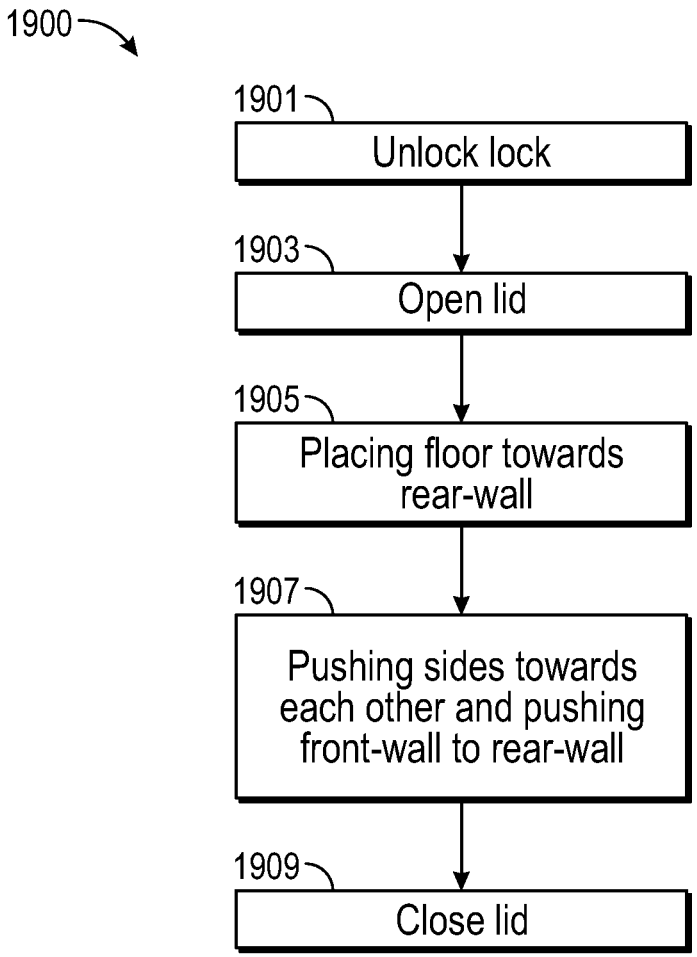
FIG. 19 may be a flow diagram showing at least some steps of how a given package-receiving-locker may be removably collapsed from its substantially (or fully) deployed configuration into its substantially (or fully) collapsed configuration.

FIG. 19 may be a flow diagram showing steps of how a given package-receiving-locker 100/900/2200/3600 may be removably collapsed from its substantially deployed configuration into its substantially collapsed configuration. In some embodiments, FIG. 19 may depict at least some steps of method 1900. In some embodiments, method 1900 may be a method of collapsing the given package-receiving-locker 100/900/2200/3600 from its substantially deployed configuration into its substantially collapsed configuration. In some embodiments, method 1900 may also be supported by FIG. 3A through FIG. 3F and/or by FIG. 11A through FIG. 11C. In some embodiments, method 1900 may comprise steps of: 1901, 1903, 1905, 1907, and 1909. In some embodiments, at least one of these steps may be omitted, optional, and/or not performed in method 1900.

Continuing discussing FIG. 19, step 1901 may be a step of unlocking the lock of the given package-receiving-locker 100/900/2200/3600. Unlocking the given package-receiving-locker 100/900/2200/3600 may involve retracting bolt 311 from its bolt-receiver (e.g., bolt-receiver 315). In some embodiments, when package-receiving-locker 900 may be in the substantially deployed configuration, lid 111 may be locked to front-wall 103 (and/or to side-panels 105), by a distal portion of bolt 311 passing through bolt-receiver 315. In some embodiments, the unlocking of the given package-receiving-locker 100/900/2200/3600 may be addressed by step 2005 and/or by step 2017 shown in FIG. 20. In some embodiments, step 1901 may progress into step 1903.

Continuing discussing FIG. 19, step 1903 may be a step of opening lid 111. In some embodiments, step 1903 may be a step of opening lid 111 to reveal opening-to-interior 321. In some embodiments, step 1903 may progress into step 1905. In some embodiments, in order for step 1905 and step 1907 to be carried out, lid 111 must be opened sufficiently. In some embodiments, 20 degrees or more (but less than 270 degrees) of opening of lid 111 may be sufficient.

Continuing discussing FIG. 19, step 1905 may be a step of placing floor 121 towards rear-wall 119. In some embodiments, step 1905 may be a step of pivoting (e.g., via hinge(s)) floor 121 upwards from its deployed configuration when floor 121 may be acting as a floor in collapsible-locker 101, to an upright vertical wall orientation that may end up with floor 121 being substantially parallel with rear-wall 119. In some embodiments, step 1905 may progress into step 1907.

Continuing discussing FIG. 19, step 1907 may be a step of pushing sides (e.g., the two opposing side-walls 105) towards each other and pushing front-wall 103 towards rear-wall 119. In some embodiments, the more the two opposing side-walls 105 are pushed towards each other, the more front-wall 103 will be drawn inwards towards rear-wall 119. In some embodiments, in order to push the two opposing side-walls 105 towards each other, may require sliding locks 1006 along opening-to-interior 321 of the top of the two opposing side-walls 105 to an unlocked configuration, i.e., such that locks 1006 are not preventing pivoting of side-hinge 309. In some embodiments, step 1907 may progress into step 1909.

Continuing discussing FIG. 19, step 1909 may be a step of closing lid 1909. In some embodiments, when collapsible-locker 101 may be in its substantially collapsed configuration, lid 111 may entirely cover over front-wall 103, as well as entirely covering the two opposing side-walls 105 (which may be behind front-wall 103); and as well as entirely covering over floor 121 (which may be behind the two opposing side-walls 105). In some embodiments, when collapsible-locker 101 may be in its substantially collapsed configuration, lid 111 may be locked to bottom-panel 923 (e.g., with a distal portion of bolt 311 inserted into bolt-receiver 1115). In some embodiments, locking lid 111 to bottom-panel 923 as a part of step 1909 may be omitted or optional in method 1900.

In some embodiments, method 1900 may be carried out whether or not package-receiving-locker 100/900/2200/3600 may be removably attached to door 451.

Figure 20:
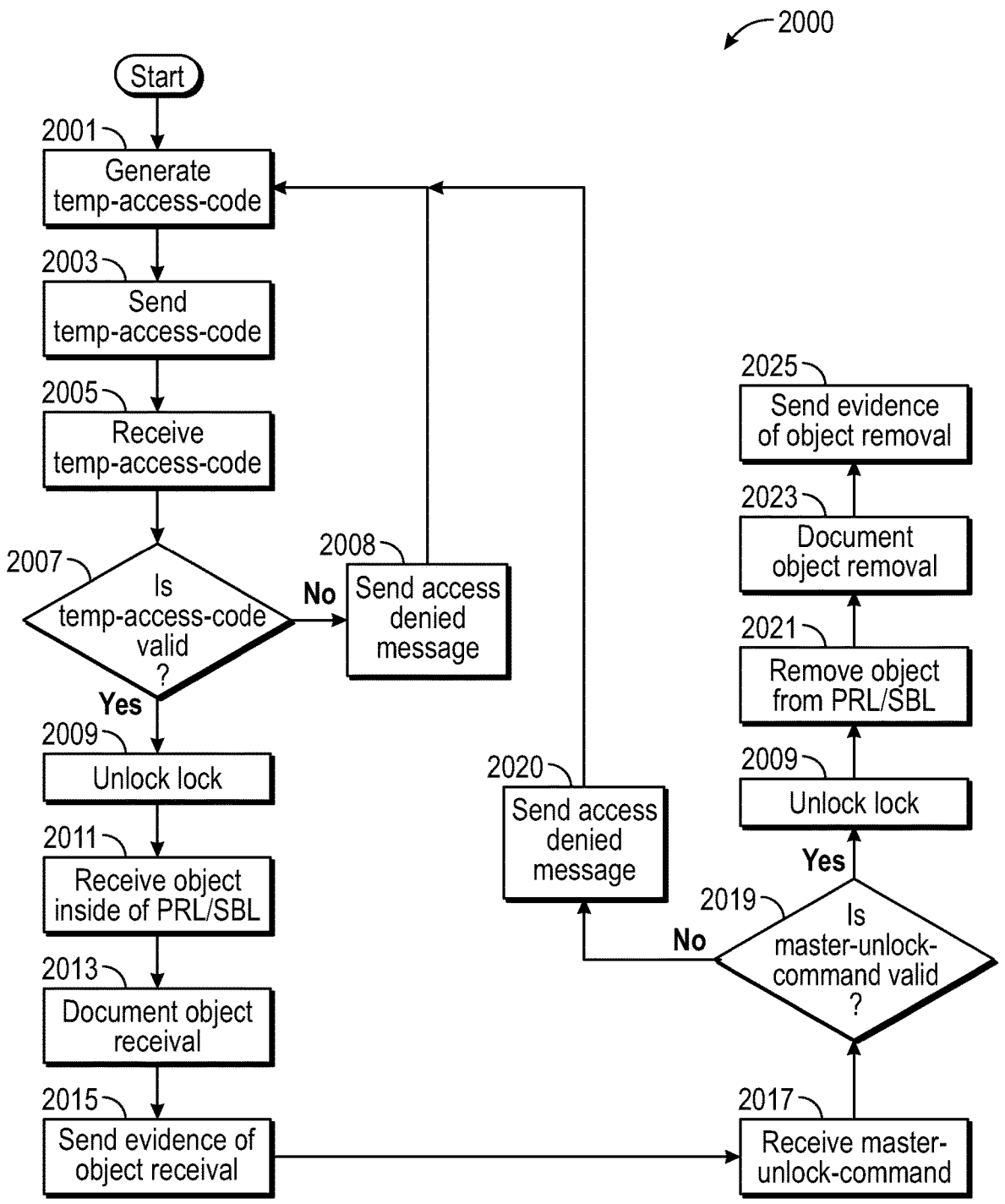
FIG. 20 may be a flow diagram showing at least some steps of how at least one object (e.g., a package) may be received into the given package-receiving-locker (e.g., the package-receiving-locker may be a secure package drop-off location).

FIG. 20 may be a flow diagram showing steps of how the at least one object may be received into the given package-receiving-locker 100/900/2200/3600. In some embodiments, FIG. 20 may depict at least some steps of method 2000. In some embodiments, method 2000 may be a method of receiving an object (at least one object) into the given package-receiving-locker 100/900/2200/3600 for temporary storage. In some embodiments, method 2000 may comprise at least some of the following steps of: 2001, 2003, 2005, 2007, 2008, 2009, 2011, 2013, 2015, 2017, 2019, 2020, 2009, 2021, 2023, and 2025. In some embodiments, at least one of these steps may be omitted, optional, and/or not performed in method 2000. In some embodiments, method 2000 may comprise at least some steps of how the delivered object that was received into the given package-receiving-locker 100/900/2200/3600 may then be subsequently retrieved from the given package-receiving-locker 100/900/2200/3600. In some embodiments, execution of steps of method 2000 may require that collapsible-locker 101 be in its fully and/or substantially deployed configuration such as may be shown in FIG. 1A and/or in FIG. 9A.

For example and without limiting the scope of the present invention, method 2000 may be executed when a delivery person (or robot) may be delivering the at least one object to be temporarily stored within the given collapsible-locker 101, when the given collapsible-locker 101 may be in its fully or substantially deployed configuration. This delivery person (or robot) may be User 1. And User 2, the intended recipient of the delivered at least one object, may be the one who then retrieves the delivered at least one object from the fully or substantially deployed collapsible-locker 101. In this scenario, delivery (via User 1) may occur when the fully or substantially deployed collapsible-locker 101 may be removably attached to the exterior of door 451, i.e., removably attached to door-outside 455. However, in some embodiments, retrieval (by User 2) of the delivered at least one object from the fully or substantially deployed collapsible-locker 101 may occur where the fully or substantially deployed collapsible-locker 101 may be inside or outside of the given structure that door 451 provides access to. For example, and without limiting the scope of the present invention, such retrieval (by User 2) may occur when the fully or substantially deployed collapsible-locker 101 may be still removably attached to door 451, but with door 451 opened inwards. And recall, this at least one object may be one or more of: a package, a parcel, mail, a box, a container, an article, documents, a bag, a sack, a pouch, a consumer good, an electronic device, an appliance, clothing, food, a beverage, combinations thereof, and/or the like. Also note, User 2, the intended recipient may have others perform tasks associated with User 2.

Continuing discussing FIG. 20, in some embodiments, step 2001 may be a step of generating a temp-access-code. In some embodiments, the temp-access-code may be a code (such as a password) (or a command) for unlocking a locked collapsible-locker 101. That is, once a given temp-access-code may be provided to the given locked collapsible-locker 101, that collapsible-locker 101 may unlock if the provided temp-access-code was valid. In some embodiments, the temp-access-code may be a temporary access code, i.e., a one time use access code, that upon using will no longer work to provide unlocking to collapsible-locker 101. In some embodiments, the temp-access-code may be numeric, alphanumeric (case sensitive in some embodiments and/or utilizing special characters in some embodiments), incorporated into a RFID tag, incorporated into a NFC tag, and/or the like. In some embodiments, the temp-access-code may be a pin number. In some embodiments, the temp-access-code may be from three to twelve characters in length. In some embodiments, it may be the PRL/SBL Software that may generate one or more temp-access-codes. For example, and without limiting the scope of the present invention, User 2, via interaction with User 2's second-user-computing-device 1603 (which could be a smartphone for example) may input (command) to the PRL/SBL Software to generate one or more temp-access-codes. In some embodiments, at least some portion of the PRL/SBL Software may be running as a mobile app on second-user-computing-device 1603. In some embodiments, at least some portion of the PRL/SBL Software may be running on a remote server (e.g., Server 1605) and accessed via web-browser running on second-user-computing-device 1603. In some embodiments, User 2 through engagement with PRL/SBL Software, via second-user-computing-device 1603, may generate the one or more temp-access-codes; and may associate each given generated temp-access-code with a particular purpose, such as, but not limited to, a specific purchase for delivery. In some embodiments, step 2001 may progress into step 2003.

Continuing discussing FIG. 20, in some embodiments, step 2003 may be a step of sending the generated temp-access-code. In some embodiments, step 2003 may be a step of sending the generated temp-access-code from second-user-computing-device 1603 to collapsible-locker 101 for non-transitory storage of this temp-access-code in Memory 1503 of computing-device 1500 of that collapsible-locker 101, so that should User 1 (the delivery person or delivery robot) then provide this temp-access-code to collapsible-locker 101, that collapsible-locker 101 can verify the provided temp-access-code from User 1 to then unlock collapsible-locker 101. Communications between second-user-computing-device 1603 and computing-device 1500 of collapsible-locker 101 may be wireless communications with each other, either directly or indirectly using at least a portion of internet/network/WAN/LAN 1609. In some embodiments, step 2003 may be a step of sending (or providing) the generated temp-access-code to User 1. For example, and without limiting the scope of the present invention, during a purchase transaction that User 2 may be engaged in (whether online or in person), User 2 may generate a temp-access-code for that purchase and may then provide (send) that generated temp-access-code to the seller, so that seller may then provide that generated temp-access-code to User 1. For example, and without limiting the scope of the present invention, the seller may provide the generated temp-access-code by having this generated temp-access-code provided on a shipping label of the purchased item or incorporated into a RFID tag or NFC tag used by User 1. In some embodiments, step 2003 may progress into step 2005.

Continuing discussing FIG. 20, in some embodiments, step 2005 may be a step of receiving temp-access-code. In some embodiments, step 2005 may be a step of receiving the generated temp-access-code from second-user-computing-device 1603 into Memory 1503 of computing-device 1500 of collapsible-locker 101, so that should User 1 (the delivery person or delivery robot) then provide this temp-access-code to collapsible-locker 101, that collapsible-locker 101 can verify the provided temp-access-code from User 1 to then unlock collapsible-locker 101. In some embodiments, step 2005 may be a step of receiving the generated temp-access-code from User 1 or from first-user-computing-device 1601 for unlocking purposes. For example, and without limiting the scope of the present invention, User 1 may see the temp-access-code printed on a shipping label and enter this temp-access-code at exterior-interface 115 (which may be keypad or touchscreen with keypad functionality) of computing-device 1500 of collapsible-locker 101. For example, and without limiting the scope of the present invention, User 1 may bring first-user-computing-device 1601 into sufficient proximity of computing-device 1500 of collapsible-locker 101 to enable RFID/NFC wireless communications, such that the temp-access-code may be transmitted from first-user-computing-device 1601 and received at computing-device 1500 of collapsible-locker 101 via RFID/NFC. For example, and without limiting the scope of the present invention, User 1 may bring first-user-computing-device 1601 into sufficient proximity of computing-device 1500 of collapsible-locker 101 or into sufficient proximity with internet/network/WAN/LAN 1609 to enable wireless communications, such that the temp-access-code may be transmitted from first-user-computing-device 1601 and received at computing-device 1500 of collapsible-locker 101 via such wireless communications. In some embodiments, step 2005 may progress into step 2007.

Continuing discussing FIG. 20, in some embodiments, step 2007 may be a step of determining if the temp-access-code received from User 1 or received from first-user-computing-device 1601 at collapsible-locker 101 may be valid. In some embodiments, if the temp-access-code received from User 1 or received from first-user-computing-device 1601 matches the temp-access-code provided from second-user-computing-device 1603 (provided in step 2003 to collapsible-locker 101), then the temp-access-code received from User 1 or received from first-user-computing-device 1601 may be valid. In some embodiments, if the temp-access-code received from User 1 or received from first-user-computing-device 1601 does not match (or has expired) the temp-access-code provided from second-user-computing-device 1603 (provide in step 2003), then the temp-access-code received from User 1 or received from first-user-computing-device 1601 may not be valid. In some embodiments, step 2007 may progress into step 2008 if the temp-access-code was not validated. In some embodiments, step 2007 may progress into step 2009 if the temp-access-code was validated.

Continuing discussing FIG. 20, in some embodiments, step 2008 may be a step of sending an access denied message. In some embodiments, a no outcome of step 2007 may result in step 2008. In some embodiments, step 2008 may be a step of sending an access denied message to User 2 from collapsible-locker 101. In some embodiments, step 2008 may be a step of sending an access denied message from collapsible-locker 101 to the PRL/SBL Software (and viewable from the GUI of the PRL/SBL Software). In some embodiments, this sent access denial message may be accessed by User 2 on second-user-computing-device 1603. In some embodiments, step 2008 may be a step of sending an access denied message to User 1 from collapsible-locker 101. In some embodiments, this sent access denial message may be accessed by User 1 on first-user-computing-device 1601. In some embodiments, such sent access denial messages may be one or more of: text message (alert or notification); sms message (alert or notification); email; phone call; voicemail; popup message (alert or notification); popup notification; a message (alert or notification); and/or the like. In some embodiments, step 2008 may be a step of sending an access denied message from I/O Means 1507 of collapsible-locker 101 to notify anyone in proximity to collapsible-locker 101, such as, User 1. In some embodiments, this access denial message may be communicated from I/O Means 1507 as one or more of: an auditory message from a speaker of collapsible-locker 101; a buzzer sounding from collapsible-locker 101; a predetermined light pattern (e.g., a red light or flashing red light) from a light source of collapsible-locker 101; and/or the like. In some embodiments, step 2008 may progress into step 2001.

Continuing discussing FIG. 20, in some embodiments, step 2009 may be a step of unlocking lock(s) of collapsible-locker 101. In some embodiments, execution of step 2009 may require a yes outcome from step 2007; i.e., a successful validation of the temp-access-code received from User 1 at collapsible-locker 101. In some embodiments, in step 2009 lid 111 may be unlocked from front-wall 103 and/or unlocked from side-walls 105. In some embodiments, in step 2009 the distal portion of bolt 311 may be retracted from bolt-receiver 315. In some embodiments, retraction of bolt 311 may be accomplished by a servo-motor and/or a solenoid, and/or the like. In some embodiments, execution of this unlocking step 2009 may be accomplished by energizing unlocking magnets or deenergizing locking magnets. In some embodiments, step 2009 may progress into step 2011.

Continuing discussing FIG. 20, in some embodiments, step 2011 may be a step of receiving the at least one object inside of the interior of the given collapsible-locker 101. For example, and without limiting the scope of the present invention, once step 2009 may be executed and collapsible-locker 101 may be unlocked, then User 1 may open lid 111 and place the at least one object into (inside of) collapsible-locker 101. In some embodiments, opening of lid 111 may trigger (activate) one or more lights to provide light into the interior of collapsible-locker 101; wherein such lights may be part of the I/O Means 1507. In some embodiments, then User 1 may close lid 111, and collapsible-locker 101 may then automatically lock. In some embodiments, then lid 111 may self-close, and collapsible-locker 101 may then automatically lock. In some embodiments, step 2011 may progress into step 2013. In some embodiments, I/O Means 1507 may comprise one or more sensors for ascertaining if lid 111 may be open or closed. When such a sensor determines lid 111 to be closed, that sensor input may prompt an output of locking collapsible-locker 101.

Continuing discussing FIG. 20, in some embodiments, step 2013 may be a step of documenting receival of the at least one object into collapsible-locker 101. In some embodiments, I/O Means 1507 may comprise one or more sensors for verifying that the at least one object has been received into collapsible-locker 101. In some embodiments, I/O Means 1507 may comprise one or more sensors located inside of collapsible-locker 101 for verifying that the at least one object has been received into collapsible-locker 101. In some embodiments, such sensors may be one or more: internally located image cameras; internally located video cameras; internally located radar/sonar; internally located range finder; scale for measuring weight of collapsible-locker 101 or of floor 121; pressure sensor(s) on floor 121. In some embodiments, such sensors may document and/or verify if the at least one object has been placed into collapsible-locker 101. In some embodiments, I/O Means 1507 may comprise one or more sensors located exteriorly of collapsible-locker 101 for verifying that the at least one object has been received into collapsible-locker 101. In some embodiments, such exteriorly located sensors may be located on an exterior surface of collapsible-locker 101, such as one or more cameras, which may be part of I/O Means 1507; wherein these one or more cameras may be oriented to capture images, video, and/or audio of people/objects approaching or leaving collapsible-locker 101 within a predetermined proximity. In some embodiments, such exteriorly located sensors may be located separated from (not attached to) collapsible-locker 101, such as one or more cameras, which may be part of I/O Means 1507; wherein these one or more cameras may be oriented to capture images, video, and/or audio of people/objects approaching or leaving collapsible-locker 101 within a predetermined proximity. In some embodiments, these cameras may be activated by proximity sensors (which may be parts of I/O Means 1507) of collapsible-locker 101; activated by lid 111 opening; and/or activated by lid 111 closing. In some embodiments, step 2013 may progress into step 2015.

Continuing discussing FIG. 20, in some embodiments, step 2015 may be a step of sending the evidence of object receival collected/generated from step 2013 (or sending a conclusion from the collected evidence). In some embodiments, this sending step 2015 may be directed to User 2 from collapsible-locker 101. In some embodiments, this sending step 2015 may be directed from collapsible-locker 101 to the PRL/SBL Software, and accessible (viewable) from the GUI (graphical user interface) of the PRL/SBL Software. In some embodiments, this sending step 2015 may be directed from collapsible-locker 101 to second-user-computing-device 1603. In some embodiments, this sending step 2015 may be directed to User 1 from collapsible-locker 101. In some embodiments, this sending step 2015 may be directed from collapsible-locker 101 to first-user-computing-device 1601. In some embodiments, this send step 2015 may function as a delivery confirmation for User 2 and a delivery verification for User 1. In some embodiments, execution of step 2015 may conclude method 2000 as pertaining to the method of receiving the at least one object into the given collapsible-locker 101. In some embodiments, remaining steps in FIG. 20, such as steps 2017 through 2025 may address User 2 retrieving the at least one object from the inside of the given collapsible-locker 101. In some embodiments, step 2015 may progress into step 2017.

Continuing discussing FIG. 20, in some embodiments, step 2017 may be a step of receiving a master-unlock-command for unlocking the given locked collapsible-locker 101. In some embodiments, the master-unlock-command may be a code (such as a password) (or a command) for unlocking a locked collapsible-locker 101. In some embodiments, this master-unlock-command may come from User 2. In some embodiments, unlike the temp-access-code, the master-unlock-command may not expire after one use. In some embodiments, the master-unlock-command may be numeric, alphanumeric (case sensitive in some embodiments and/or utilizing special characters in some embodiments), incorporated into a RFID tag, incorporated into a NFC tag, and/or the like. In some embodiments, the master-unlock-command may be a pin number. In some embodiments, the master-unlock-command may be from three to twelve characters in length. In some embodiments, the master-unlock-command may be longer (more characters) and/or more complex (greater diversity of characters) than a temp-access-code. In some embodiments, the master-unlock-command may be received at the given collapsible-locker 101 for unlocking that given collapsible-locker 101. In some embodiments, the master-unlock-command may be received at the given collapsible-locker 101 for unlocking that given collapsible-locker 101 in one of two ways, (1) as a manually input on exterior-interface 115; and/or (2) communicated wirelessly from second-user-computing-device 1603 to collapsible-locker 101, such as a RFID communication, a NFC communication, a WiFi communication, a Bluetooth communication, a ZigBee communication, and/or the like. In some embodiments, User 2 via the GUI of the PRL/SBL Software running on second-user-computing-device 1603 may engage an unlock button (on the GUI), which in turn may cause the master-unlock-command to be transmitted from second-user-computing-device 1603 to collapsible-locker 101, via wireless communications. In some embodiments, step 2017 may progress into step 2019.

In some embodiments, the PRL/SBL Software have one or more user profiles associated with the PRL/SBL Software; e.g., there may be multiple Users 2. In some embodiments, each User 2 profile on the given the PRL/SBL Software license/seat, may have its own associated master-unlock-command.

In some embodiments, an employee or agent that operates and/or maintains Server 1605, the PRL/SBL Software, and/or package-receiving-lockers 100/900/2200/3600, may have their own master-unlock-commands, usable via Admin-Device 1607 to override and unlock a given collapsible-locker 101.

Continuing discussing FIG. 20, in some embodiments, step 2019 may be a step of determining if the master-unlock-command received in step 2017 may be valid. In some embodiments, for master-unlock-command validation/verification purposes of step 2019, various master-unlock-commands may be non-transitorily stored in one or more registers of Memory 1503 of collapsible-locker 101 that may be paired with a given second-user-computing-device 1603 operating/running the PRL/SBL Software. In some embodiments, when a master-unlock-command may be received at collapsible-locker 101 for unlocking purposes, the master-unlock-commands that may already be non-transitorily stored in the one or more registers of Memory 1503 of collapsible-locker 101 may then be compared for validation/verification. If a match, then step 2019 may progress into step 2009. If no match, then step 2019 may progress into step 2020.

Continuing discussing FIG. 20, in some embodiments, step 2020 may be a step of sending an access denied message. In some embodiments, a no outcome of step 2019 may result in step 2020. In some embodiments, step 2020 may be a step of sending an access denied message to User 2 from collapsible-locker 101. In some embodiments, step 2020 may be a step of sending an access denied message from collapsible-locker 101 to the PRL/SBL Software (and viewable from the GUI of the PRL/SBL Software). In some embodiments, this sent access denial message may be accessed by User 2 on second-user-computing-device 1603. In some embodiments, such sent access denial messages may be one or more of: text message (alert or notification); sms message (alert or notification); email; phone call; voicemail; popup message (alert or notification); popup notification; a message (alert or notification); and/or the like. In some embodiments, step 2020 may be a step of sending an access denied message from I/O Means 1507 of collapsible-locker 101 to notify anyone in proximity to collapsible-locker 101, such as, User 2. In some embodiments, this access denial message may be communicated from I/O Means 1507 as one or more of: an auditory message from a speaker of collapsible-locker 101; a buzzer sounding from collapsible-locker 101; a predetermined light pattern (e.g., a red light or flashing red light) from a light source of collapsible-locker 101; and/or the like. In some embodiments, step 2020 may progress into step 2001.

Continuing discussing FIG. 20, in some embodiments, step 2009 may be the step of lid 111 being unlocked from front-wall 103 and/or unlocked from side-walls 105. In some embodiments, step 2009 may follow a successful validation/verification in step 2019. In some embodiments, step 2009 may progress to step 2021.

Continuing discussing FIG. 20, in some embodiments, step 2021 may be a step of removing the at least one object from inside of the given collapsible-locker 101. That is, with collapsible-locker 101 unlocked, User 2 may open lid 111 and remove the at least one object from collapsible-locker 101. In some embodiments, after User 2 may have removed the at least one object from collapsible-locker 101, User 2 may close lid 111. In some embodiments, after User 2 may have removed the at least one object from collapsible-locker 101, lid 111 may self-close. At this point, User 2 may now be in physical possession of the at least one object. In some embodiments, step 2021 may progress into step 2023.

Continuing discussing FIG. 20, in some embodiments, step 2023 may be a step of documenting removal of the at least one object from collapsible-locker 101. In some embodiments, I/O Means 1507 may comprise one or more sensors for verifying that the at least one object has been removed from collapsible-locker 101. In some embodiments, I/O Means 1507 may comprise one or more sensors located inside of collapsible-locker 101 for verifying that the at least one object has been removed from collapsible-locker 101. In some embodiments, such sensors may be one or more: internally located image cameras; internally located video cameras; internally located radar/sonar; internally located range finder; scale for measuring weight of collapsible-locker 101 or of floor 121; pressure sensor(s) on floor 121. In some embodiments, such sensors may document and/or verify if the at least one object has been removed from collapsible-locker 101. In some embodiments, I/O Means 1507 may comprise one or more sensors located exteriorly of collapsible-locker 101 for verifying that the at least one object has been removed from collapsible-locker 101. In some embodiments, such exteriorly located sensors may be located on an exterior surface of collapsible-locker 101, such as one or more cameras, which may be part of I/O Means 1507; wherein these one or more cameras may be oriented to capture images, video, and/or audio of people/objects approaching or leaving collapsible-locker 101 within a predetermined proximity to collapsible-locker 101. In some embodiments, such exteriorly located sensors may be located separated from (not attached to) collapsible-locker 101, such as one or more cameras, which may be part of I/O Means 1507; wherein these one or more cameras may be oriented to capture images, video, and/or audio of people/objects approaching or leaving collapsible-locker 101 within a predetermined proximity to collapsible-locker 101. In some embodiments, these cameras may be activated by proximity sensors (which may be parts of I/O Means 1507) of collapsible-locker 101; activated by lid 111 opening; and/or activated by lid 111 closing. In some embodiments, step 2023 may progress into step 2025.

Continuing discussing FIG. 20, in some embodiments, step 2025 may be a step of sending evidence of the at least one object removal from collapsible-locker 101 collected/generated in step 2023 (or sending a conclusion from such collected/generated evidence). In some embodiments, this sending step 2025 may be directed to User 2 from collapsible-locker 101. In some embodiments, this sending step 2025 may be directed from collapsible-locker 101 to the PRL/SBL Software, and accessible (viewable) from the GUI (graphical user interface) of the PRL/SBL Software. In some embodiments, this sending step 2025 may be directed from collapsible-locker 101 to second-user-computing-device 1603. In some embodiments, this sending step 2025 may be directed to User 1 from collapsible-locker 101. In some embodiments, this sending step 2025 may be directed from collapsible-locker 101 to first-user-computing-device 1601. In some embodiments, this send step 2025 may function as a confirmation that User 2 may be physical possession of the at least one object. In some embodiments, execution of step 2025 may conclude method 2000.

In some embodiments, I/O Means 1507 may comprise one or more proximity sensors and/or motion detectors, located internally of collapsible-locker 101 and/or located exteriorly of collapsible-locker 101. Upon triggering (activation) of such proximity sensors and/or motion detectors, then other components of I/O Means 1507 may be triggered (activated) such as one or more of: internally located image cameras; internally located video cameras; internally located radar/sonar; internally located range finder; scale for measuring weight of collapsible-locker 101 or of floor 121; pressure sensor(s) on floor 121; exteriorly located cameras, microphones, lights, and/or the like.

In some embodiments, I/O Means 1507 may comprise one or more GPS-module 1511 and/or accelerometers, located internally of collapsible-locker 101 and/or located exteriorly of collapsible-locker 101 or combinations thereof. Upon triggering of such GPS-module 1511 and/or accelerometer beyond a predetermined motion threshold, then other components of I/O Means 1507 may be triggered (activated) such as one or more of: internally located image cameras (e.g., interior-camera(s) 2905); internally located video cameras (e.g., interior-camera(s) 2905); internally located radar/sonar; internally located range finder; scale for measuring weight of collapsible-locker 101 or for measuring a load upon floor 121; pressure sensor(s) on floor 121; exteriorly located cameras (e.g., camera(s) 2903), microphones, lights, and/or the like.

In some embodiments, the invention may be a system for receiving packages, wherein the system may comprise at least one package-receiving-locker 100/900/2200/3600 and the PRL/SBL Software.

Figure 21:
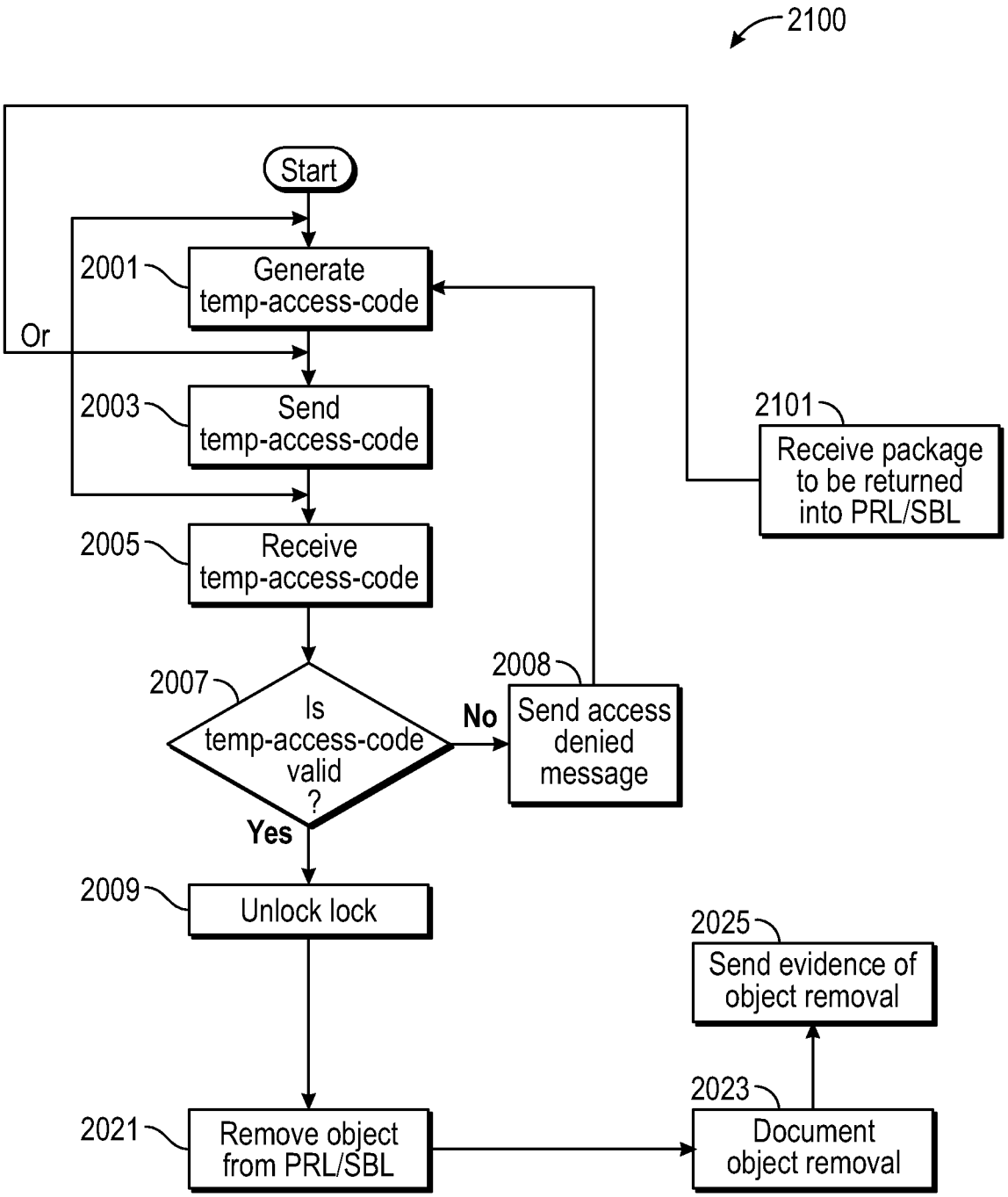
FIG. 21 may be a flow diagram showing steps of how a given package-receiving-locker may be used to return a package to a seller/vendor (e.g., the package-receiving-locker may be a secure package pickup location).

FIG. 21 may be a flow diagram showing steps of how a given package-receiving-locker 100/900/2200/3600 may be used to return a package to a seller/vendor. In some embodiments, FIG. 21 may depict at least some steps of method 2100. In some embodiments, method 2100 may be a method of returning package 2100. In some embodiments, method 2100 may comprise at least some of the following steps of: 2101, 2001, 2003, 2005, 2007, 2008, 2009, 2021, 2023, and 2025. In some embodiments, at least one of these steps may be omitted, optional, and/or not performed in method 2100. In some embodiments, execution of steps of method 2100 may require that collapsible-locker 101 be in its fully and/or substantially deployed configuration such as may be shown in FIG. 1A and/or in FIG. 9A.

Continuing discussing FIG. 21, in some embodiments, steps of method 2100, such as steps 2001, 2003, 2005, 2007, 2008, 2009, 2021, 2023, and 2025, may be as substantially described for method 2000; except in step 2021 in method 2100 it may be User 1 (the shipper) who removes the package from collapsible-locker 101 so that User 1 may then deliver this package to the seller/vendor for the return. In some embodiments, prior to step 2005 in method 2100 being executed, step 2101 must be executed. In some embodiments, step 2101 may proceed step 2001, step 2003, or step 2005 in method 2100. In some embodiments, step 2101 may a step of receiving the package to be returned into the given collapsible-locker 101. In some embodiments, it may be User 2 who places the package to be returned into the given collapsible-locker 101 in step 2101. In order to accomplish step 2101, User 2 (or an agent of User 2) may execute step 2017, which may lead to step 2019, and step 2009, i.e., once User 2 causes step 2009 to occur, User 2 may place the package to returned into collapsible-locker 101.

In some embodiments, prior to step 2003 or concurrently with step 2003 in method 2100, User 2 may contact the seller/vendor to obtain a return authorization (RMA). When User 2 may be in contact/communication with the seller/vendor, the temp-access-code (from step 2001) for User 1 may be provided to the seller/vendor as at least a part of step 2003, and then the seller/vendor may communicate this temp-access-code to User 1 so that User 1 may initiate step 2005.

Figure 22B:
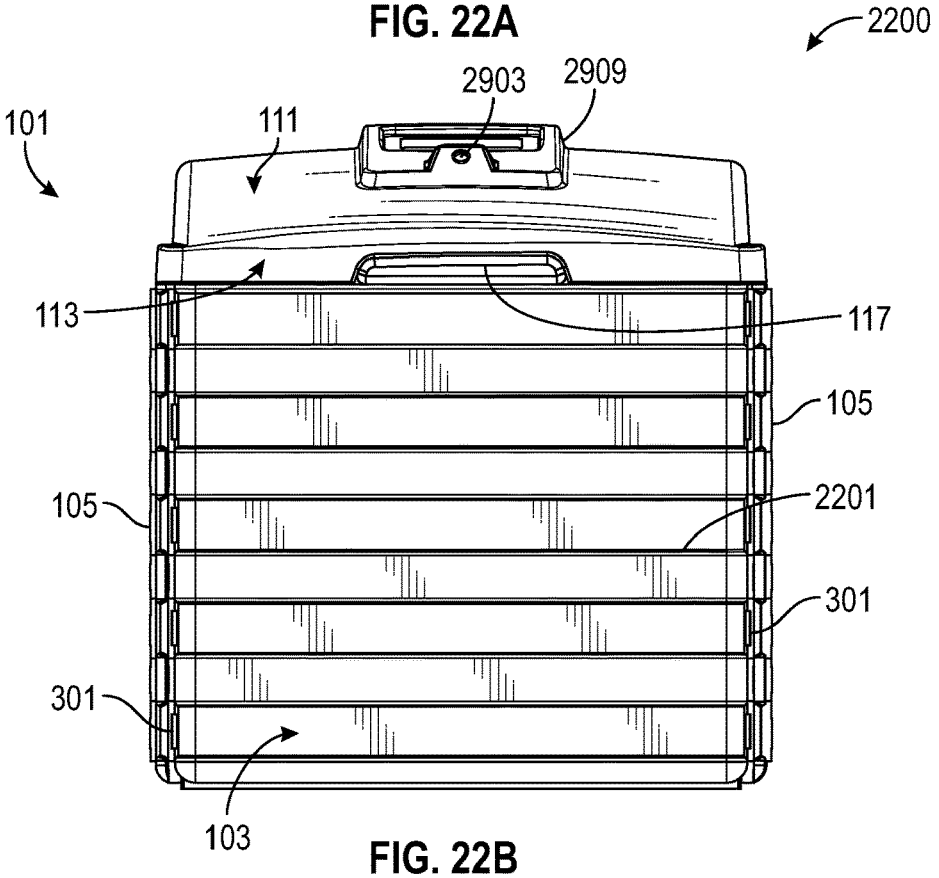
FIG. 22B may depict a front view of the package-receiving-locker of FIG. 22A.
Figure 22C:
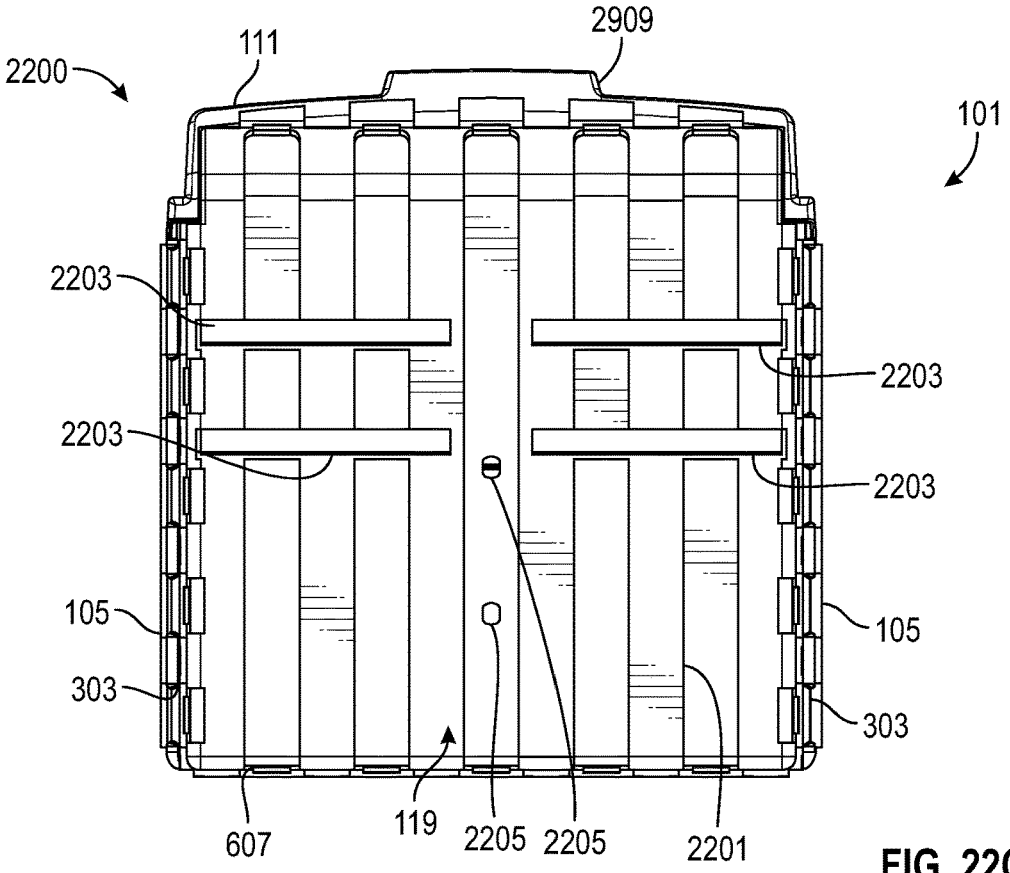
FIG. 22C may depict a back (rear) view of the package-receiving-locker of FIG. 22A.
Figure 22D:
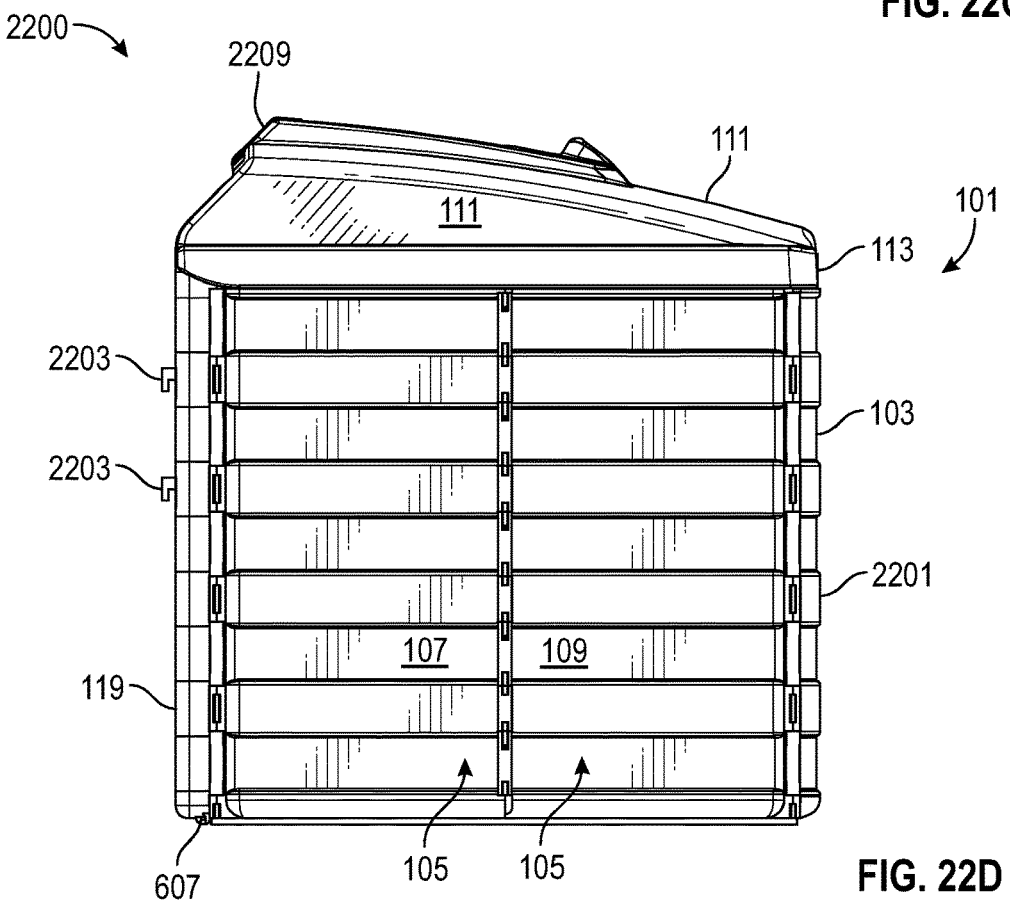
FIG. 22D may depict a side view (left or right) of the package-receiving-locker of FIG. 22A. (Side views may be substantially similar or identical.)
Figure 22E:
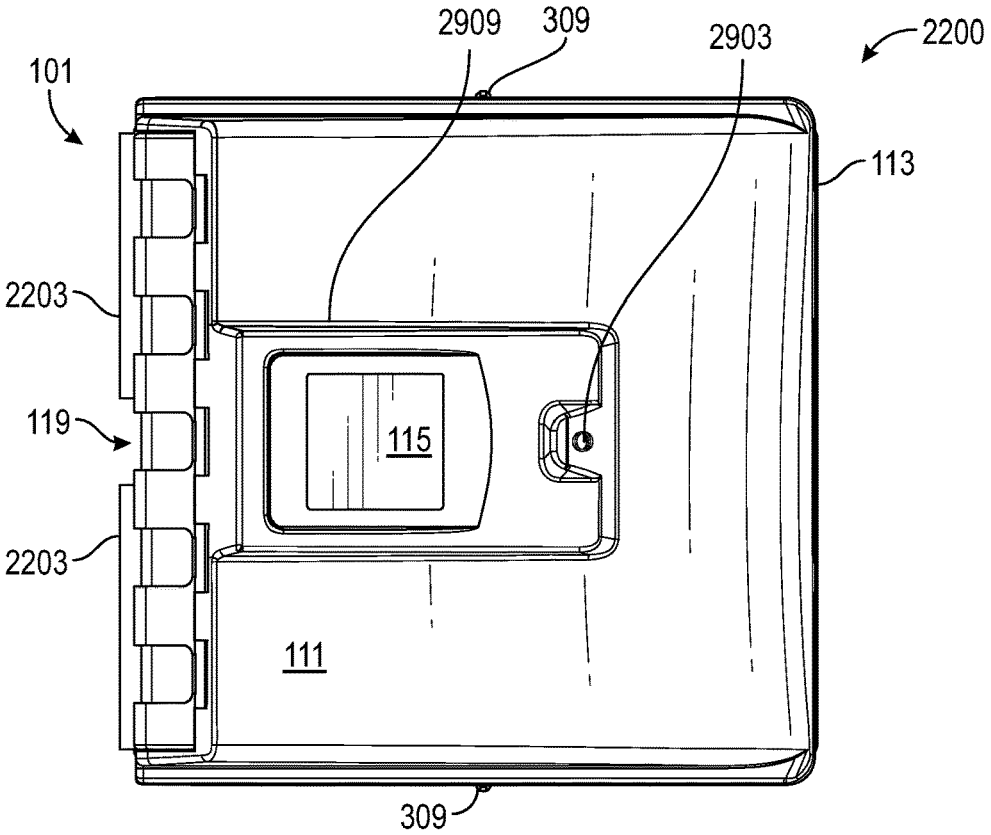
FIG. 22E may depict a top view of the package-receiving-locker of FIG. 22A.
Figure 22F:
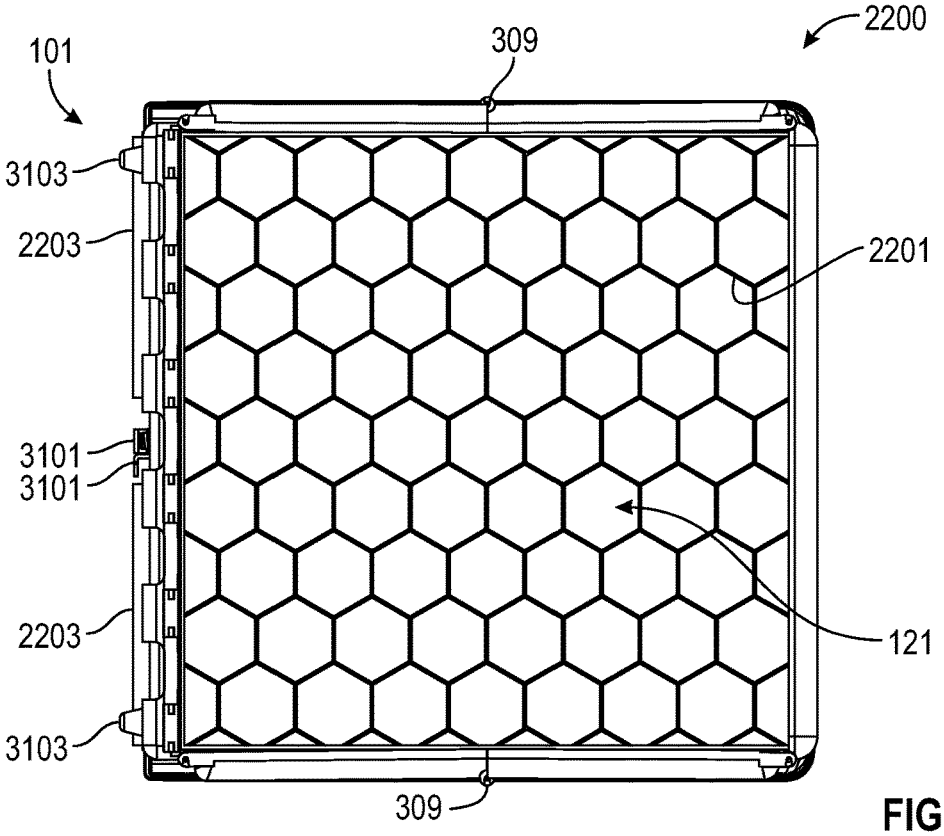
FIG. 22F may depict a bottom view of the package-receiving-locker of FIG. 22A.

FIG. 22A through FIG. 22F may depict a package-receiving-locker 2200, wherein this package-receiving-locker 2200 may be shown with its lid 111 closed and in the substantially (or fully) deployed (expanded) configuration. FIG. 22A may depict a front, left, top, perspective (isometric) view of package-receiving-locker 2200. FIG. 22B may depict a front view of package-receiving-locker 2200. FIG. 22C may depict a back (rear) view of package-receiving-locker 2200. (Note, FIG. 22C and FIG. 22B may be opposing views.) FIG. 22D may depict a side view (left or right) of package-receiving-locker 2200. (Side views of package-receiving-locker 2200 may be substantially similar or identical.) FIG. 22E may depict a top view of package-receiving-locker 2200. FIG. 22F may depict a bottom view of package-receiving-locker 2200. (Note, FIG. 22F and FIG. 22E may be opposing views.)

Package-receiving-locker 2200 may be an additional embodiment or alternative embodiment to package-receiving-locker 100 (and/or with respect to package-receiving-locker 900). In some embodiments, package-receiving-locker 2200 may have substantially the same purposes of package-receiving-locker 100/900. In some embodiments, package-receiving-locker 2200 may solve substantially the same problems of package-receiving-locker 100/900. In some embodiments, package-receiving-locker 2200 may perform substantially similar to package-receiving-locker 100/900. In some embodiments, package-receiving-locker 2200 may function substantially similar to package-receiving-locker 100/900. In some embodiments, package-receiving-locker 2200 may be substantially similar to package-receiving-locker 100/900 in terms of at least one of features, parts, components, geometries, structures, mechanics, operation, combinations thereof, and/or the like. Thus, figures showing package-receiving-locker 2200 (e.g., FIG. 22A through FIG. 25B) may show the same reference numerals as used with package-receiving-locker 100, to reference similar or the same features, parts, components, geometries, structures, mechanics, and/or operation. For example, and without limiting the scope of the present invention, in some embodiments, package-receiving-locker 2200 may comprise collapsible-locker 101. In some embodiments, collapsible-locker 101 may comprise lid 111, two opposing side-walls 105, front-wall 103, rear-wall 119, floor 121, and computing-device 1500. These components may be substantially as described above for package-receiving-locker 100.

However, there may be some differences between package-receiving-locker 100 and package-receiving-locker 2200, some of which may be noted and discussed below. For example, and without limiting the scope of the present invention, in some embodiments, package-receiving-locker 2200 may comprise: at least one exterior-rib 2201, at least one rail 2203, at least one hole 2205, at least one interior-rib 2301, at least one cam-lock 3101, at least one back-support 3103, and/or at least one door-attachment-structure 3000.

In some embodiments, lid 111, side-wall(s) 105, front-wall 103, rear-wall 119, and/or floor 121 may comprise one or more exterior-rib(s) 2201 for providing structural strength. In some embodiments, exterior-rib(s) 2201 may run substantially horizontally, vertically, diagonally, and/or the like. For example, and without limiting the scope of the present invention, FIG. 22A may show exterior-ribs 2201 that may be substantially horizontal. For example, and without limiting the scope of the present invention, FIG. 22C may show exterior-ribs 2201 that may be substantially vertical. In some embodiments, exterior-rib(s) 2201 may be substantially honeycomb shaped and/or the like. For example, and without limiting the scope of the present invention, FIG. 22F may show exterior-ribs 2201 that may be substantially honeycomb shaped.

In some embodiments, on the exterior of rear-wall 119 may be one or more rail(s) 2203. In some embodiments, these rail(s) 2203 may be attached to the exterior of rear-wall 119. In some embodiments, these rail(s) 2203 may be integral to the exterior of rear-wall 119. In some embodiments, these rail(s) 2203 may be molded into the exterior of rear-wall 119. In some embodiments, rail(s) 2203 may be the same material(s) as rear-wall 119. In some embodiments, rail(s) 2203 may have the same rigidity as rear-wall 119. In some embodiments, rail(s) 2203 may support a weight of package-receiving-locker 2200. In some embodiments, rail(s) 2203 may support a weight of package-receiving-locker 2200 and objects within package-receiving-locker 2200. In some embodiments, rail(s) 2203 may support a weight with a range of 40 pounds to up to 200 pounds. In some embodiments, rail(s) 2203 may support a weight up to 60 pounds. In some embodiments, rail(s) 2203 may run substantially horizontally across the exterior of rear-wall 119. In some embodiments, there may be one or more rows of rail(s) 2203 that may run substantially horizontally across the exterior of rear-wall 119. In some embodiments, a given row of rail 2203 may have one or more gaps (breaks) in that row of rail 2203. In some embodiments, a cross-section a given rail 2203 may show that the given rail 2203 may have a "L" bracket shape. In some embodiments, openings to rail(s) 2203 may be face upwards, downwards, or both upwards and downwards. In some embodiments, a given rail 2203 may engage a given rail of door-attachment-structure 3000, wherein the given rail of door-attachment-structure 3000 may be denoted as PRL-engagement-rail 3013. That is, a given rail 2203 may be complimentary attached to a given PRL-engagement-rail 3013. In some embodiments, a nature of this engagement/complimentary attachment may be a sliding engagement/attachment; i.e., a given PRL-engagement-rail 3013 may be slid onto a given rail 2203. In some embodiments, a given PRL-engagement-rail 3013 may removably and slidingly attach to a given rail 2203. In some embodiments, removable attachment between PRL-engagement-rail(s) 3013 and rail(s) 2203 may be further facilitated by use of one or more magnets. See e.g., FIG. 22C, FIG. 22D, FIG. 25B, FIG. 27D, FIG. 31B, and FIG. 35B.

In some embodiments, lid 111, side-wall(s) 105, front-wall 103, rear-wall 119, and/or floor 121 may comprise one or more hole(s) 2205. In some embodiments, such hole(s) 2205 may be through hole(s). In some embodiments, such hole(s) 2205 may be for ventilation, drainage, weight minimization, inspection, access, pass-through, cable pass-through, and/or the like. In some embodiments, rear-wall 119 may comprise at least one hole 2205 so that at least one cam-lock 3101 may extend outwardly from this at least one hole 2205. In some embodiments, a given cam-lock 3101 may be for preventing sliding between rail(s) 2203 and PRL-engagement-rail(s) 3013; i.e., for securing rear-wall 119 to door-attachment-structure 3000. See e.g., FIG. 22C, FIG. 23A, and FIG. 31B.

When lid 111 may be closed, exterior-camera 2903 may be used to monitor an exterior environment of package-receiving-locker 2200; such as, people approaching or leaving package-receiving-locker 2200. When lid 111 may be closed, exterior-camera 2903 may be positioned and oriented to monitor a predetermined zone that is external of the given collapsible-locker 101. In some embodiments, package-receiving-locker 2200 may comprise at least one exterior-camera 2903. In some embodiments, exterior-camera 2903 may be mounted to and/or attached to an exterior of lid 111. In some embodiments, exterior-camera 2903 may be mounted to and/or attached to exterior-electronics-cover 2909. In some embodiments, exterior-camera 2903 may be mounted to and/or attached to an exterior of lid 111, front-wall 103, side-wall(s) 105, and/or rear-wall 119. In some embodiments, exterior-camera 2903 may be located on an exterior surface of collapsible-locker 101. In some embodiments, exterior-camera 2903 may be controlled and/or powered by computing-device 1500 of package-receiving-locker 2200. In some embodiments, exterior-camera 2903 may be motion activated. In some embodiments, exterior-camera 2903 may be an input of I/O Means 1507. In some embodiments, exterior-camera 2903 may capture images, stills, video, and/or audio. In some embodiments, exterior-camera 2903 may emit light to aid in image capture. In some embodiments, exterior-camera 2903 may operate in low light conditions. In some embodiments, exterior-camera 2903 may be an infrared camera. In some embodiments, exterior-camera 2903 may be a digital camera. See e.g., FIG. 22A and FIG. 22B.

Figure 22G:
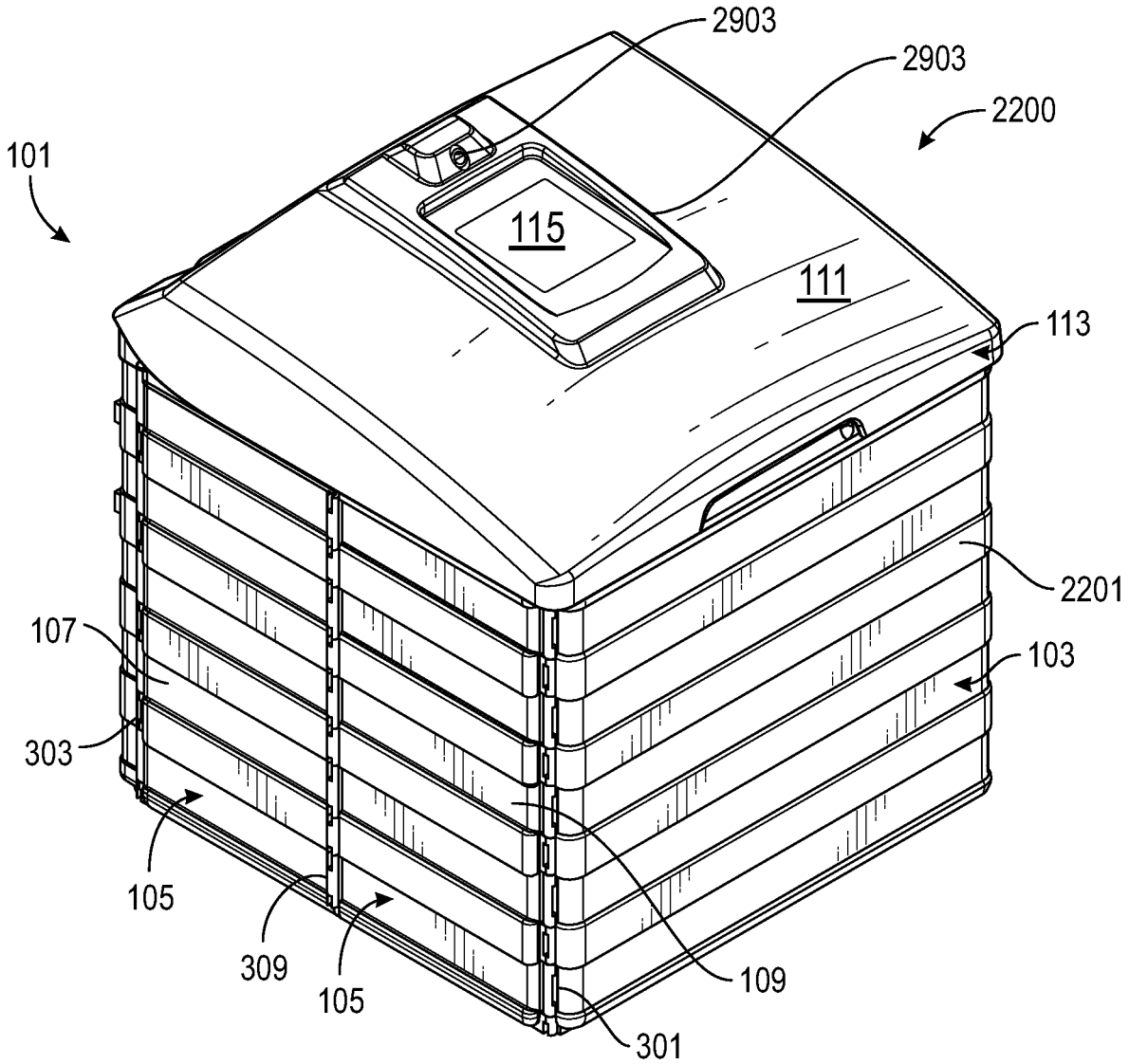
FIG. 22G may depict a perspective view of the package-receiving-locker of FIG. 22A, wherein an exterior-camera may be located closer to a rear of the package-receiving-locker.

FIG. 22G may depict a perspective view of package-receiving-locker 2200, wherein exterior-camera 2903 may be located closer to a rear of package-receiving-locker 2200 as compared against FIG. 22A.

Figure 23A:
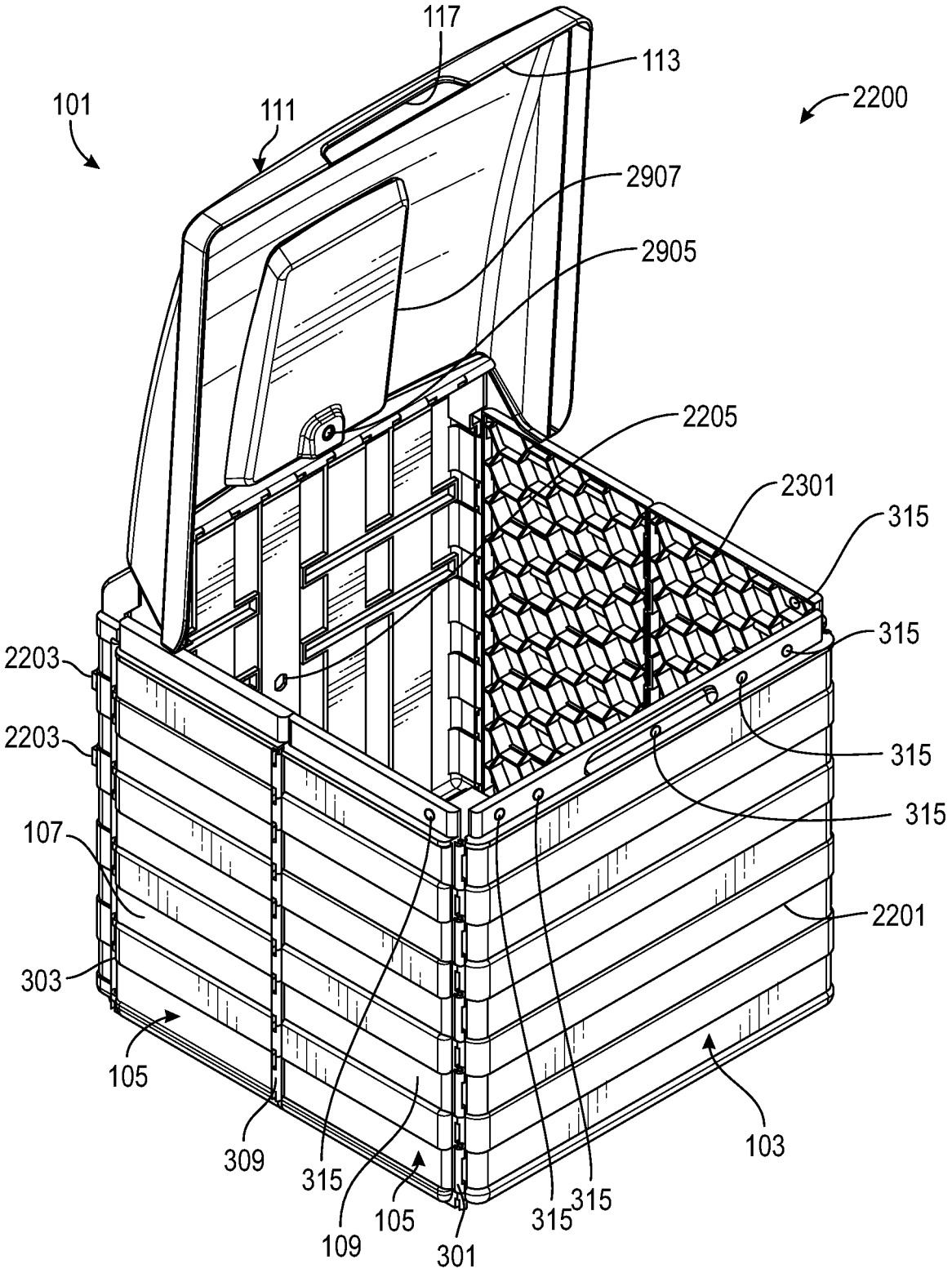
FIG. 23A may depict a front, left, top, perspective (isometric) view of the package-receiving-locker of FIG. 22A, but with a lid of the package-receiving-locker at least partially open.
Figure 23B:
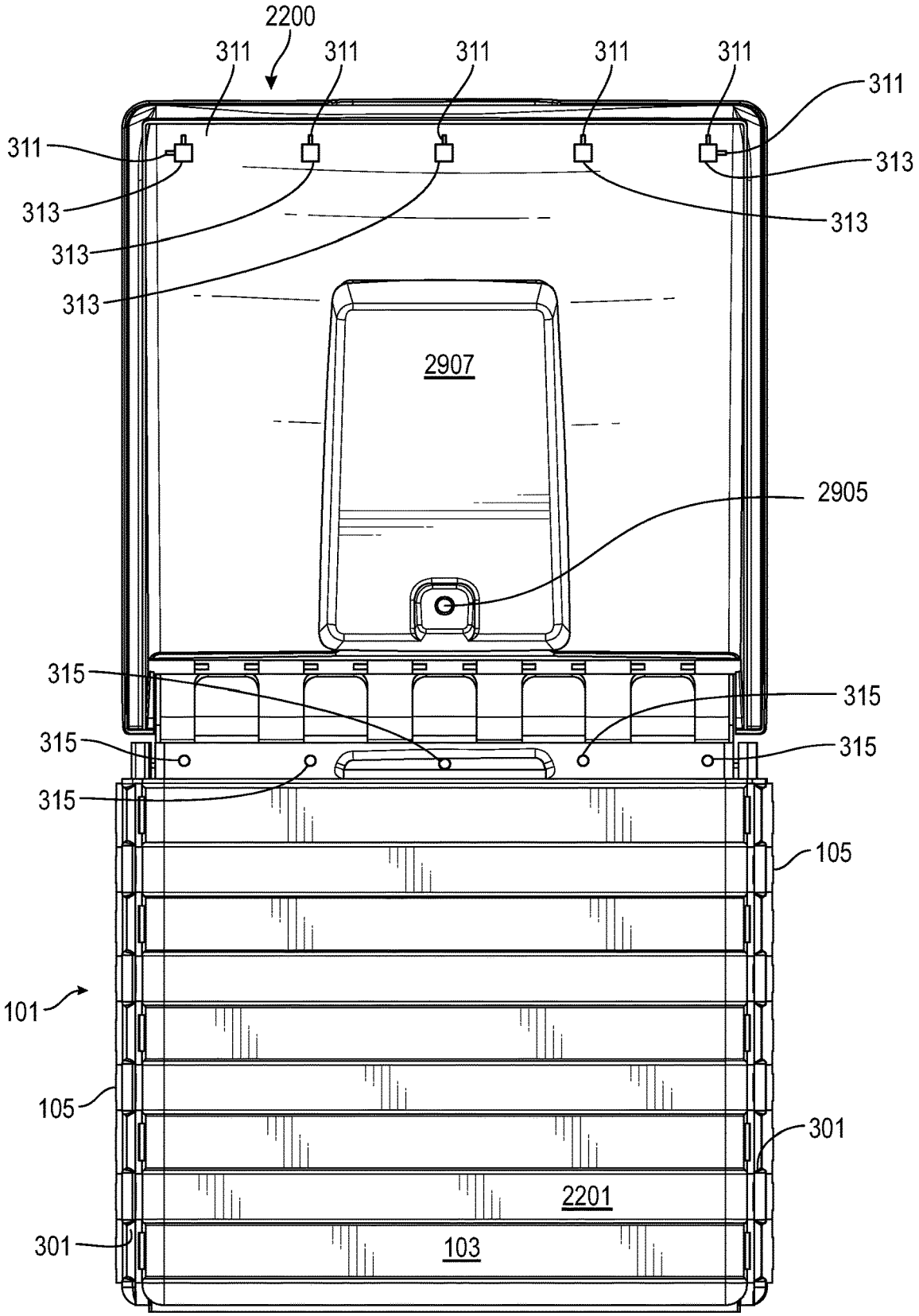
FIG. 23B may depict a front view of the package-receiving-locker of FIG. 23A.
Figure 23D:
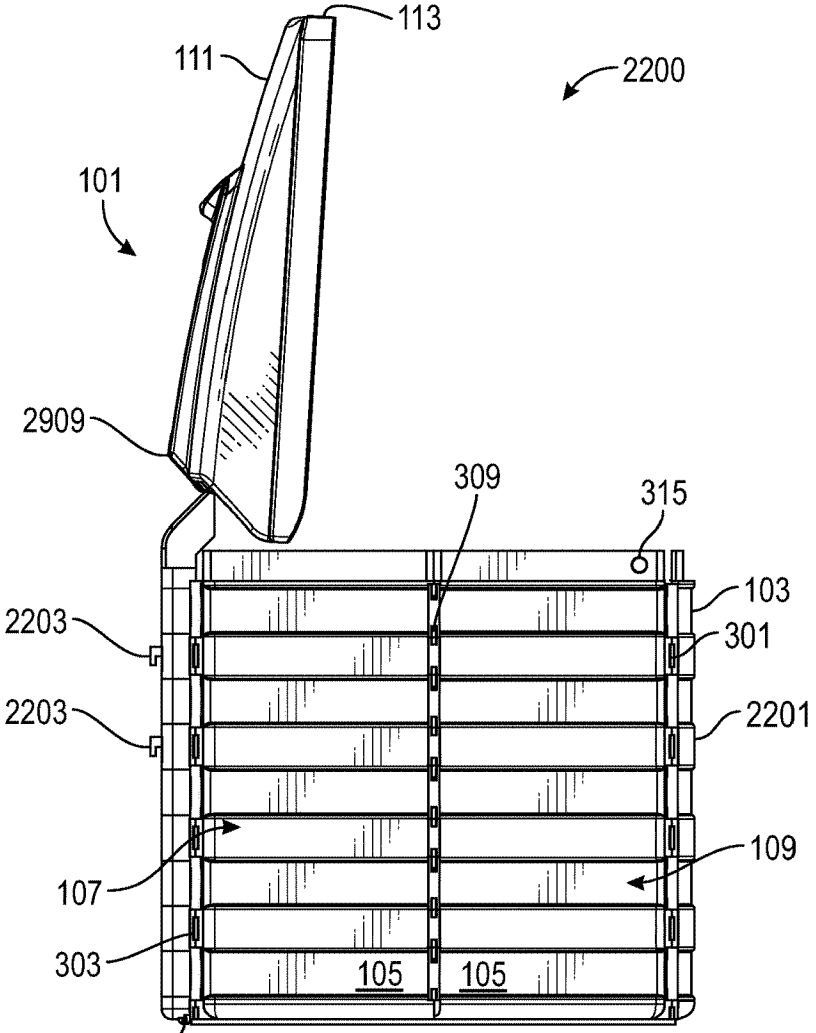
FIG. 23D may depict a side view (left or right) of the package-receiving-locker of FIG. 23A. (Side views may be substantially similar or identical.)
Figure 23C:
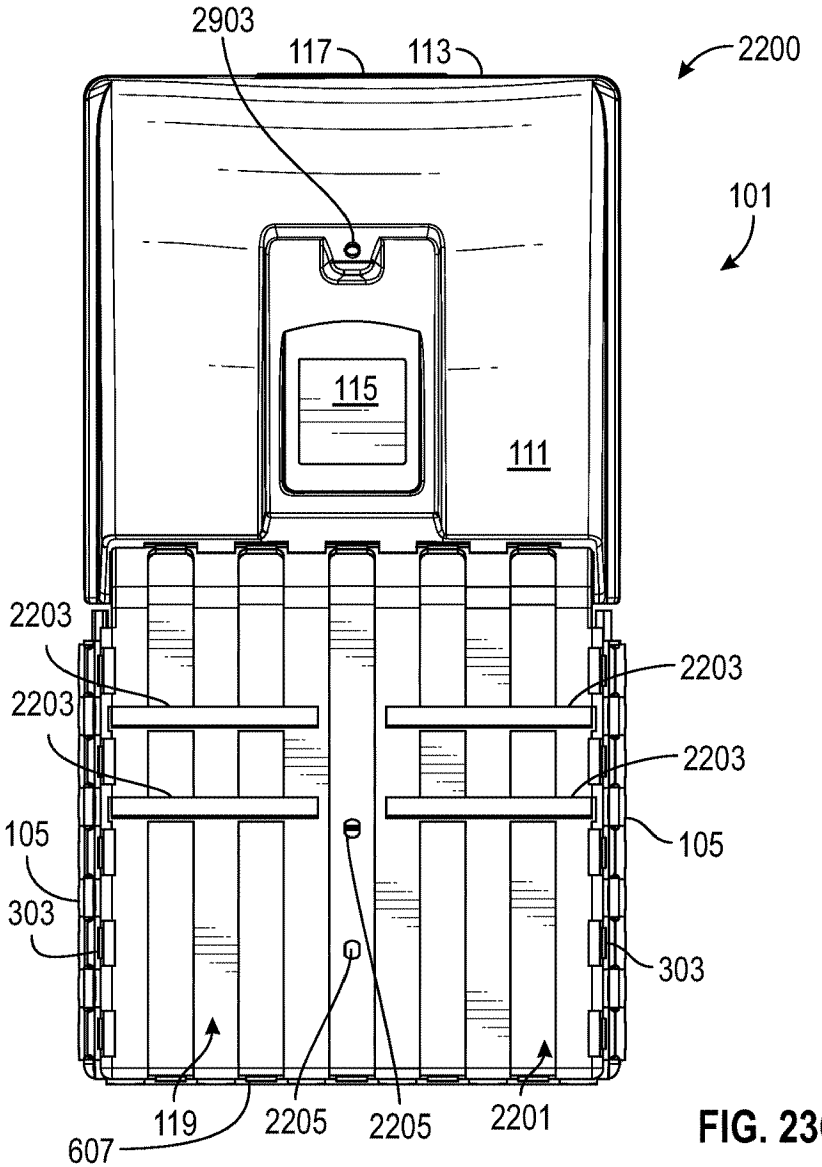
FIG. 23C may depict a back (rear) view of the package-receiving-locker of FIG. 23A.
Figure 23E:
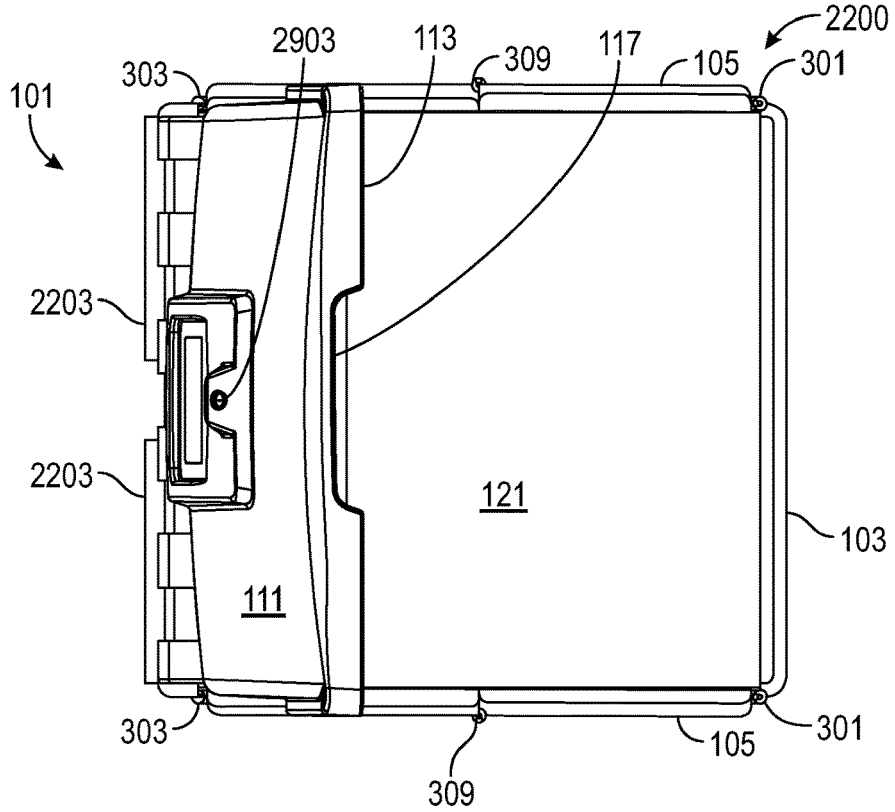
FIG. 23E may depict a top view of the package-receiving-locker of FIG. 23A.
Figure 24A:
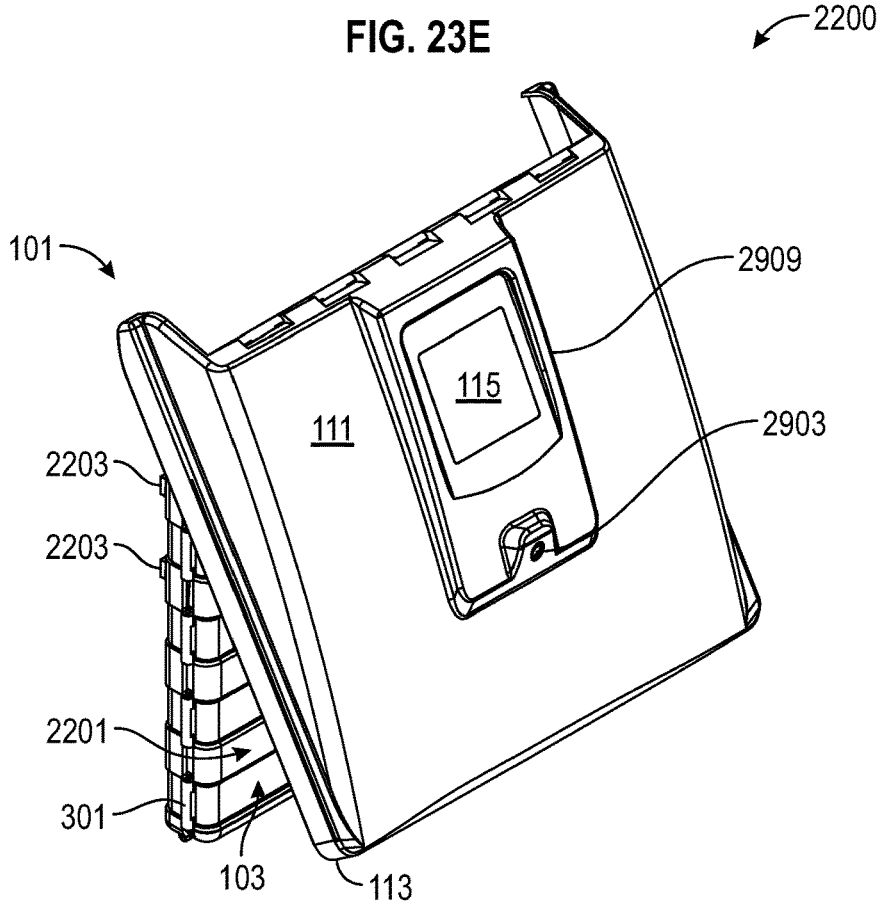
FIG. 24A may depict a front, left, top, perspective (isometric) view of the package-receiving-locker of FIG. 22A, but shown in a partially deployed (partially collapsed) configuration.
Figure 24B:
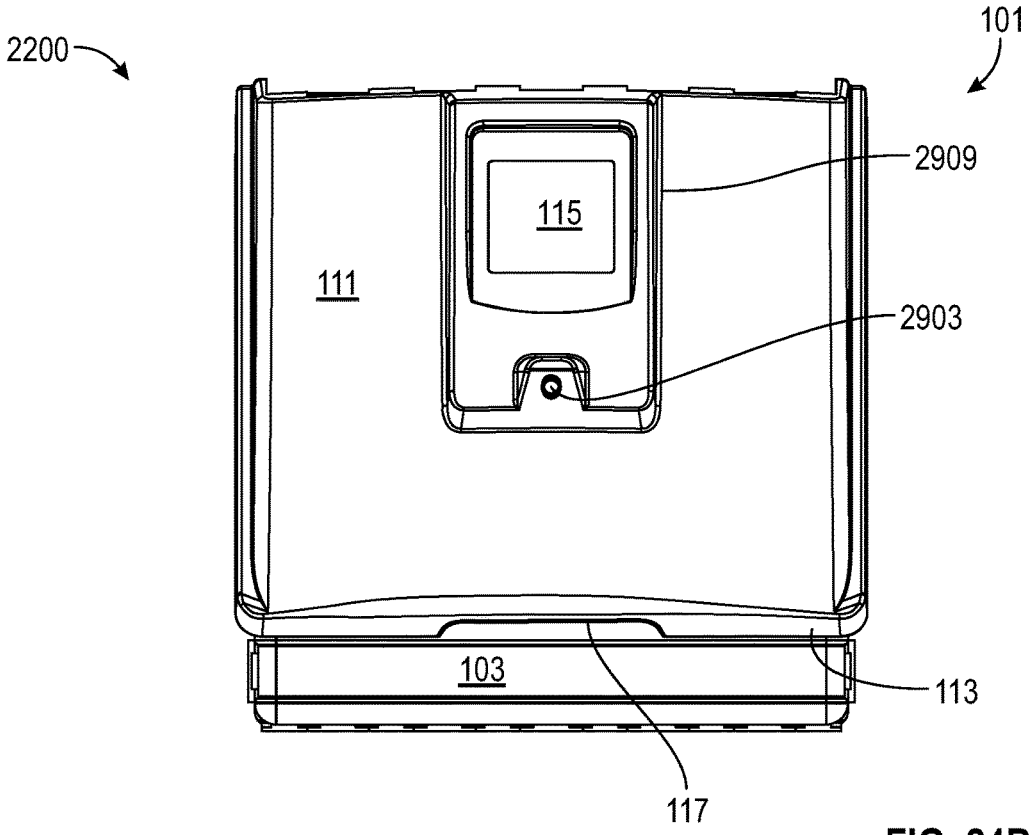
FIG. 24B may depict a front view of the package-receiving-locker of FIG. 24A.
Figure 24C:
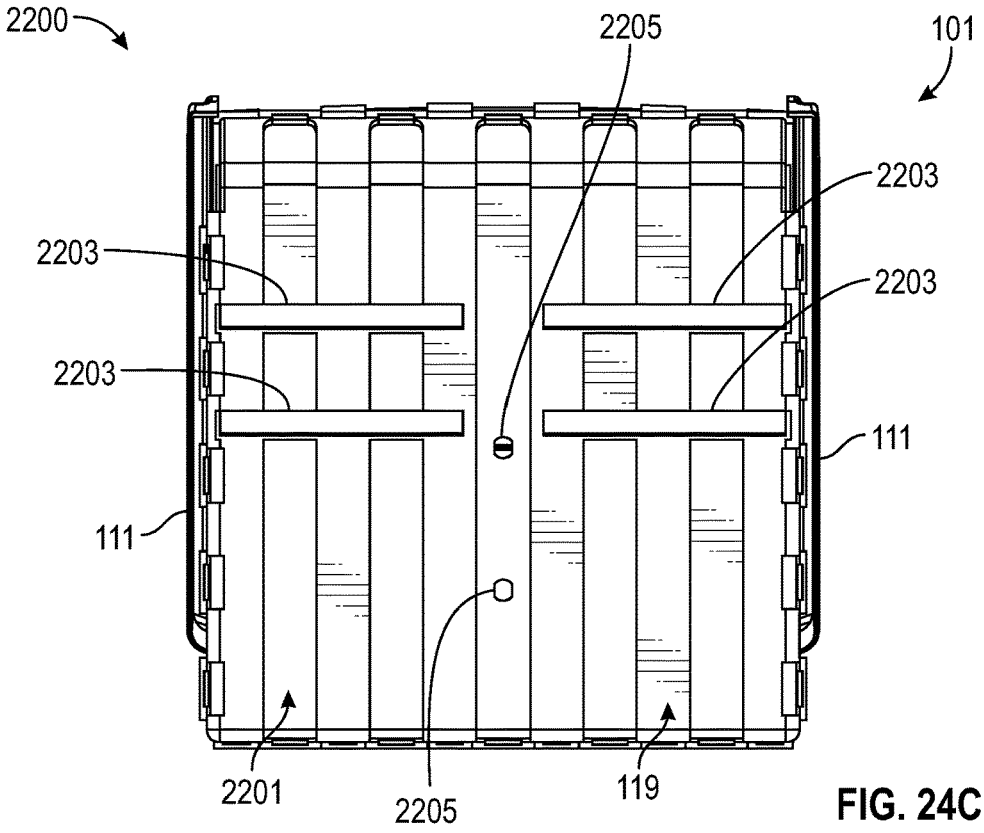
FIG. 24C may depict a back (rear) view of the package-receiving-locker of FIG. 24A.
Figure 24D:
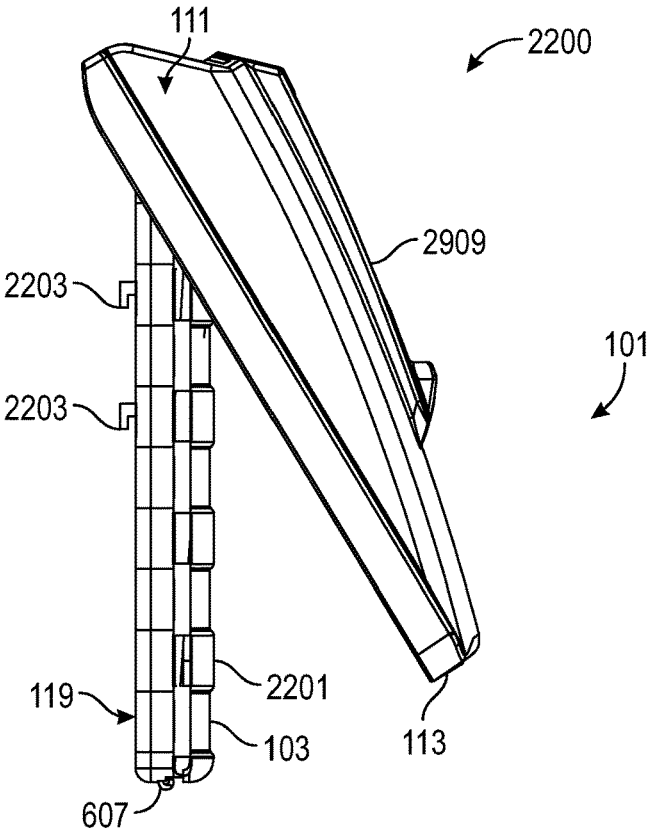
FIG. 24D may depict a side view (left or right) of the package-receiving-locker of FIG. 24A. (Side views may be substantially similar or identical.)
Figure 24E:
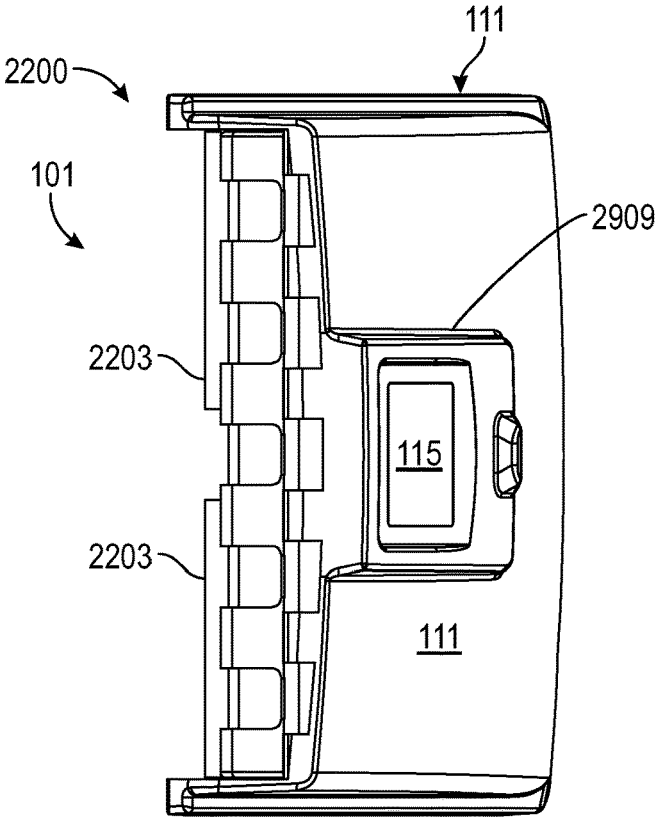
FIG. 24E may depict a top view of the package-receiving-locker of FIG. 24A.

FIG. 23A through FIG. 23E may depict package-receiving-locker 2200, wherein this package-receiving-locker 2200 may be shown with its lid 111 open (at least partially open) and in the substantially (or fully) deployed (expanded) configuration. FIG. 23A may depict a front, left, top, perspective (isometric) view of package-receiving-locker 2200. FIG. 23B may depict a front view of package-receiving-locker 2200. FIG. 23C may depict a back (rear) view of package-receiving-locker 2200. (Note, FIG. 23C and FIG. 23B may be opposing views.) FIG. 23D may depict a side view (left or right) of package-receiving-locker 2200. FIG. 23E may depict a top view of package-receiving-locker 2200.

With lid 111 at least partially open, interior-rib(s) 2301 of package-receiving-locker 2200 may be seen. In some embodiments, lid 111, side-wall(s) 105, front-wall 103, rear-wall 119, and/or floor 121 may comprise one or more interior-rib(s) 2301 for providing structural strength. In some embodiments, interior-rib(s) 2301 may run substantially horizontally, vertically, diagonally, and/or the like. In some embodiments, interior-rib(s) 2301 may be substantially honeycomb shaped and/or the like. For example, and without limiting the scope of the present invention, FIG. 23A may show interior-ribs 2301 that may be substantially honeycomb shaped.

With lid 111 at least partially open, at least some possible bolt-receiver(s) 315 of package-receiving-locker 2200 may be seen. In some embodiments, a given bolt-receiver 315 may receive a given bolt 311 for locking package-receiving-locker 2200. In some embodiments, a given bolt-receiver 315 may be a hole or a cavity/pocket for receiving a terminal end of bolt 311. In some embodiments, a given bolt-receiver 315 may be located in the top/upper portions of front-wall 103 and/or side-walls 105. In some embodiments, a given bolt 311 may be driven from/by its respective housing 313. In some embodiments, bolt(s) 311 and its respective housing(s) 313 may be located on an underside of lid 111. In some embodiments, bolt 311 may be driven closed or open via a solenoid, a servo motor, worm drive, a linear motor, magnets, and/or the like; and the driver may be controlled by computing-device 1500 of the given package-receiving-locker 2200. See e.g., FIG. 23A and FIG. 23B.

With lid 111 at least partially open, at least one interior-camera 2905 of package-receiving-locker 2200 may be seen. When lid 111 may be closed, interior-camera 2905 may be used to monitor the interior of package-receiving-locker 2200. When lid 111 may be closed, interior-camera 2905 may be positioned and oriented to monitor the main interior volume of a given collapsible-locker 101. When lid 111 may be open, interior-camera 2905 may be used to monitor the exterior of package-receiving-locker 2200; such as, insertion and/or removal of object(s) into and out of package-receiving-locker 2200. In some embodiments, package-receiving-locker 2200 may comprise at least one interior-camera 2905. In some embodiments, interior-camera 2905 may be mounted to and/or attached to an underside of lid 111. In some embodiments, interior-camera 2905 may be mounted to and/or attached to an underside of electronics cover 2907. In some embodiments, interior-camera 2905 may be mounted to and/or attached to an interior/inside of lid 111, front-wall 103, side-wall(s) 105, rear-wall 119 (rear-wall-interior 619), and/or floor 121. In some embodiments, interior-camera 2905 may be located on an inside/interior surface of collapsible-locker 101. In some embodiments, interior-camera 2905 may be controlled and/or powered by computing-device 1500 of package-receiving-locker 2200. In some embodiments, interior-camera 2905 may be motion activated. In some embodiments, interior-camera 2905 may be an input of I/O Means 1507. In some embodiments, interior-camera 2905 may capture images, stills, video, and/or audio. In some embodiments, interior-camera 2905 may emit light to aid in image capture. In some embodiments, interior-camera 2905 may operate in low light conditions. In some embodiments, interior-camera 2905 may be an infrared camera. In some embodiments, interior-camera 2905 may be a digital camera. See e.g., FIG. 23A and FIG. 23B.

FIG. 24A through FIG. 24E may depict package-receiving-locker 2200, wherein this package-receiving-locker 2200 may be shown in a state of partial collapse or partial expansion. That is, FIG. 24A through FIG. 24E may depict package-receiving-locker 2200 being deployed (expanded) or being collapsed. In FIG. 24A through FIG. 24E package-receiving-locker 2200 may have its lid 111 partially open and unlocked. For example, and without limiting the scope of the present invention, to deploy (expand) package-receiving-locker 2200, lid 111 may need to be unlocked and a front of lid 111 (e.g., lid-overhand 113) pivoted away from a bottom of front-wall 103, so that front-wall 103 may be pulled out and away from rear-wall 119, allowing the two opposing side-walls 105 to unfold and deploy; and then for floor 121 to pivot downwards from a substantially vertical position to a substantially horizontal position. For example, and without limiting the scope of the present invention, to collapse package-receiving-locker 2200, lid 111 may need to be unlocked and a front of lid 111 (e.g., lid-overhand 113) pivoted away from a top of front-wall 103, floor 121 to be lifted upwards pivoting from the substantially horizontal position back to the substantially vertical position (so is next to rear-wall 119), so that front-wall 103 may then be pushed in and towards from rear-wall 119, allowing the two opposing side-walls 105 to refold inwards.

Figure 25A:
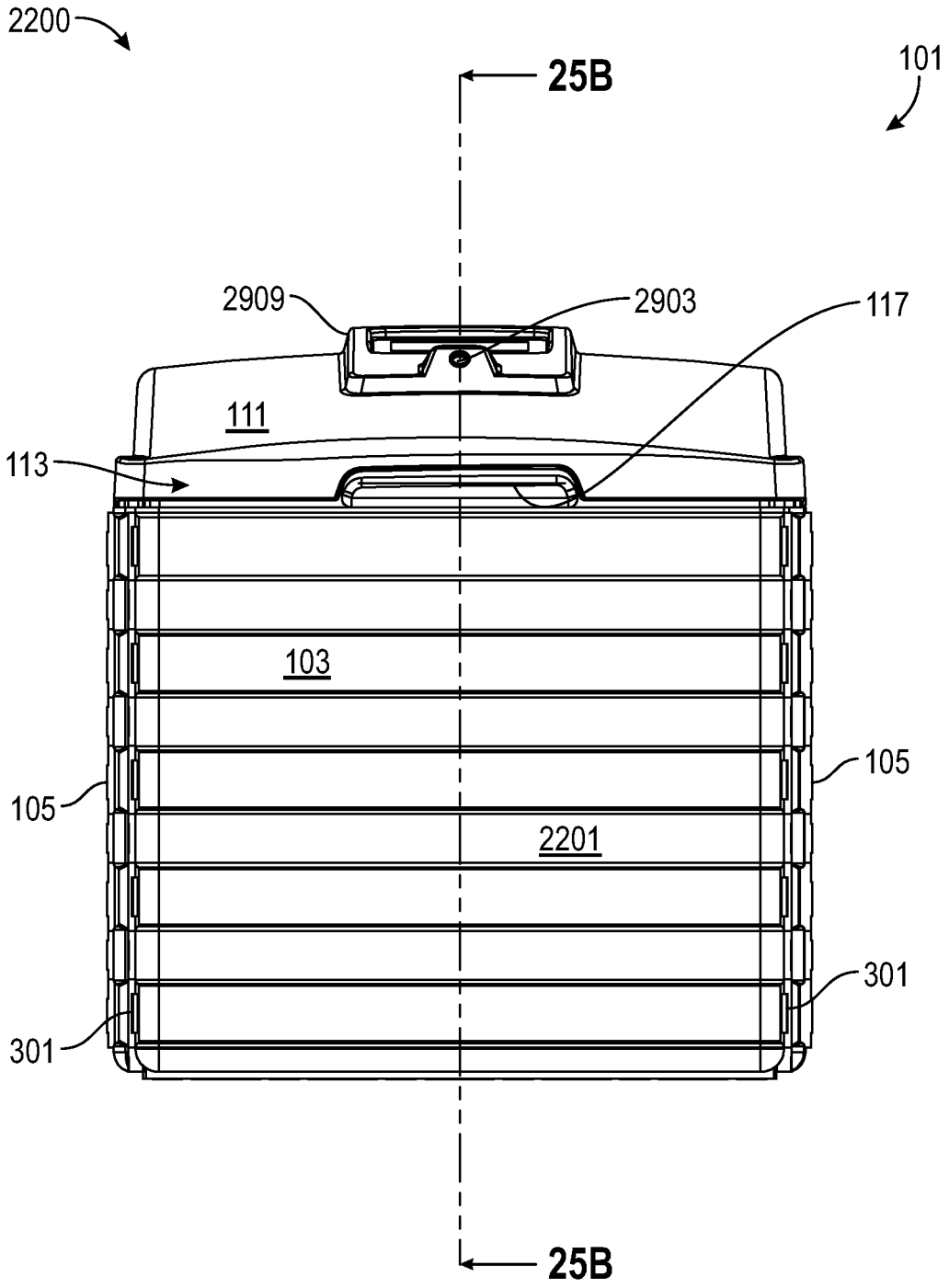
FIG. 25A may depict a front view of the package-receiving-locker of FIG. 22A (i.e., FIG. 25A may be similar to FIG. 22B) and also shown in FIG. 25A may be sectional line 25B-25B. Sectional line 25B-25B may pass through a middle/center of the package-receiving-locker, from front to back.
Figure 25B:
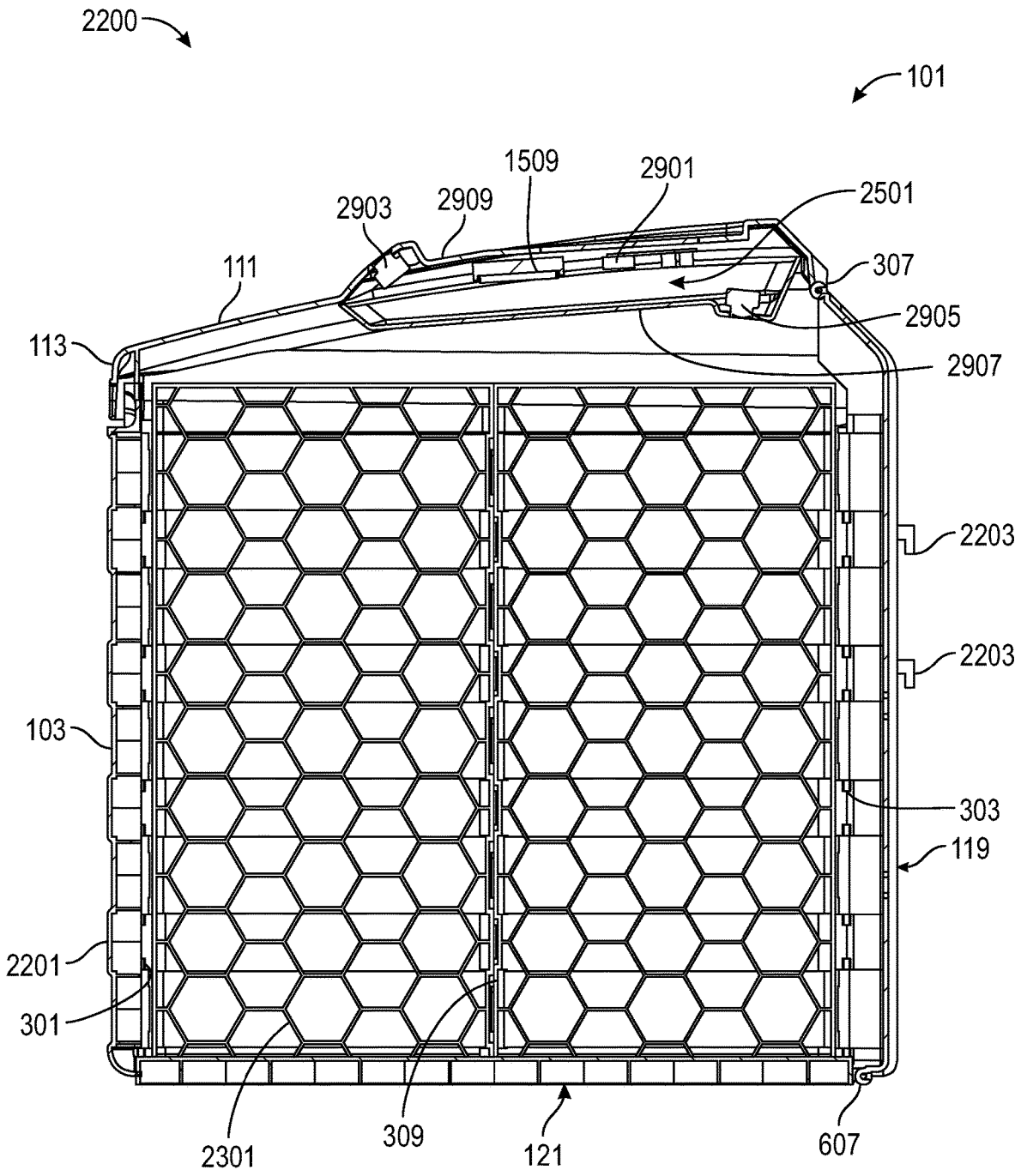
FIG. 25B may be a cross-sectional view of the package-receiving-locker of FIG. 22A through sectional line 25B-25B.
Figure 26A:
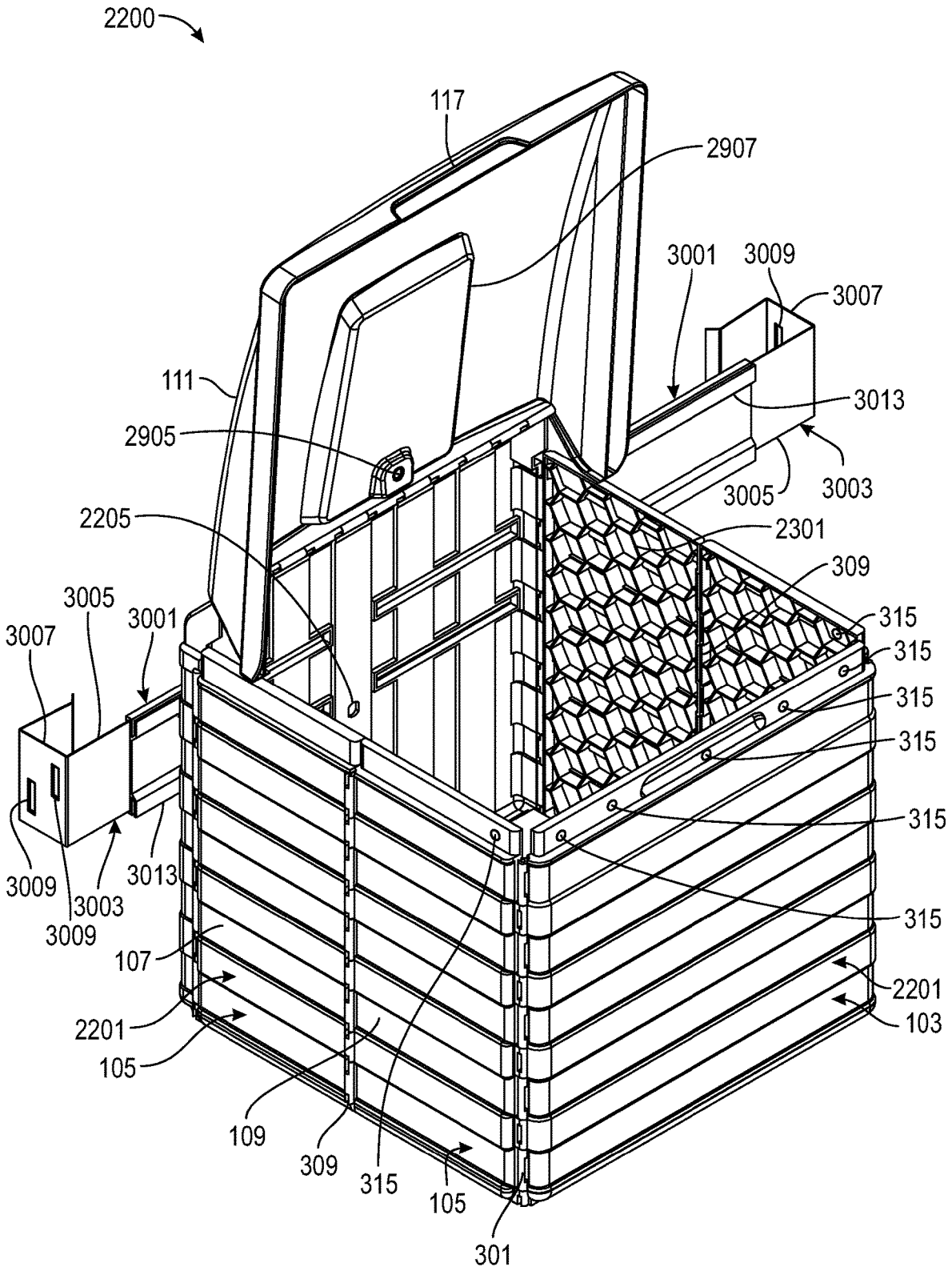
FIG. 26A may depict a front, left, top, perspective (isometric) view of the package-receiving-locker of FIG. 22A, but shown with the lid at least partially open and shown wherein the package-receiving-locker of FIG. 22A may be attached to a door-attachment-structure.
Figure 26B:
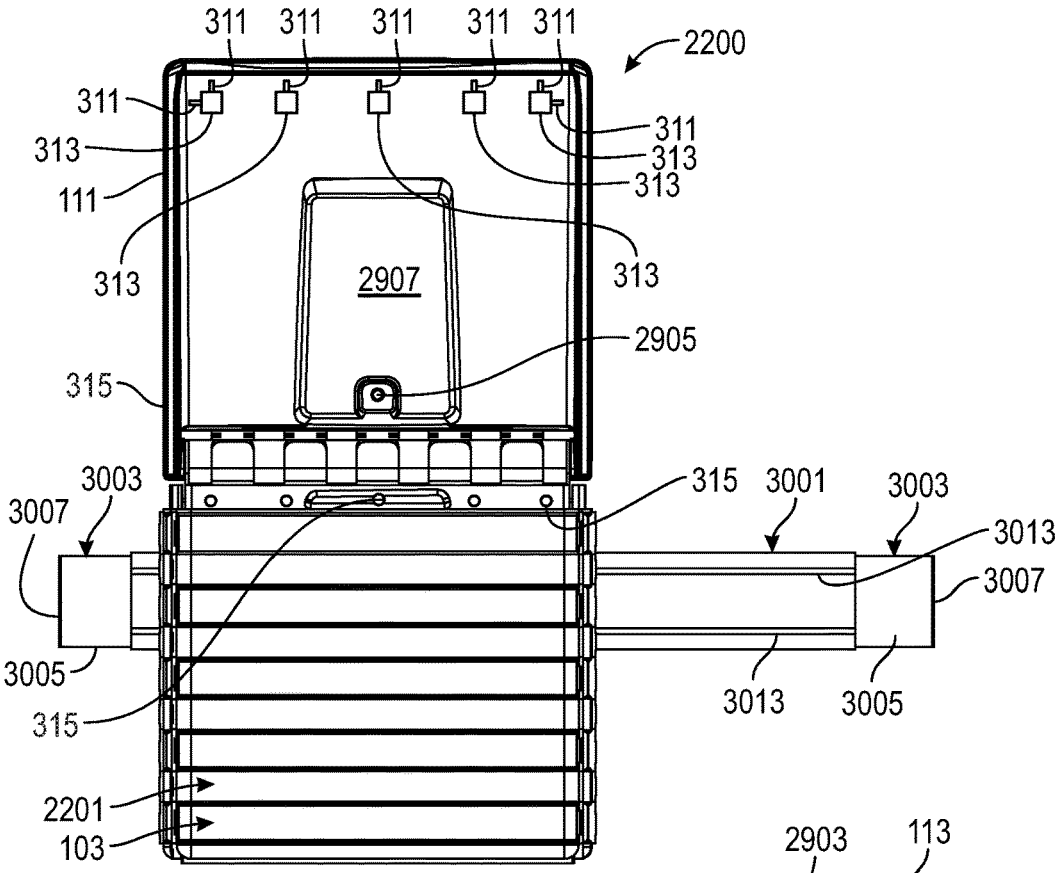
FIG. 26B may depict a front view of the package-receiving-locker of FIG. 26A.
Figure 26C:
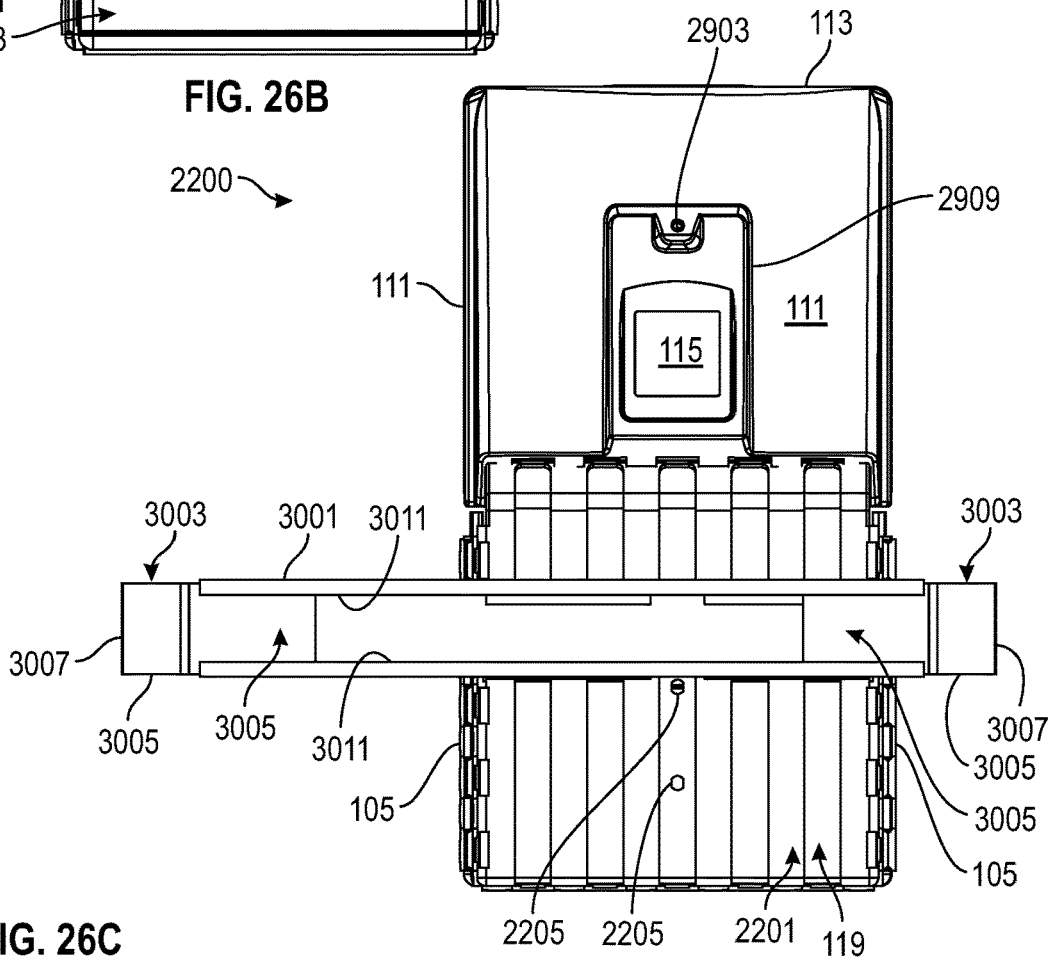
FIG. 26C may depict a back (rear) view of the package-receiving-locker of FIG. 26A.
Figure 26D:
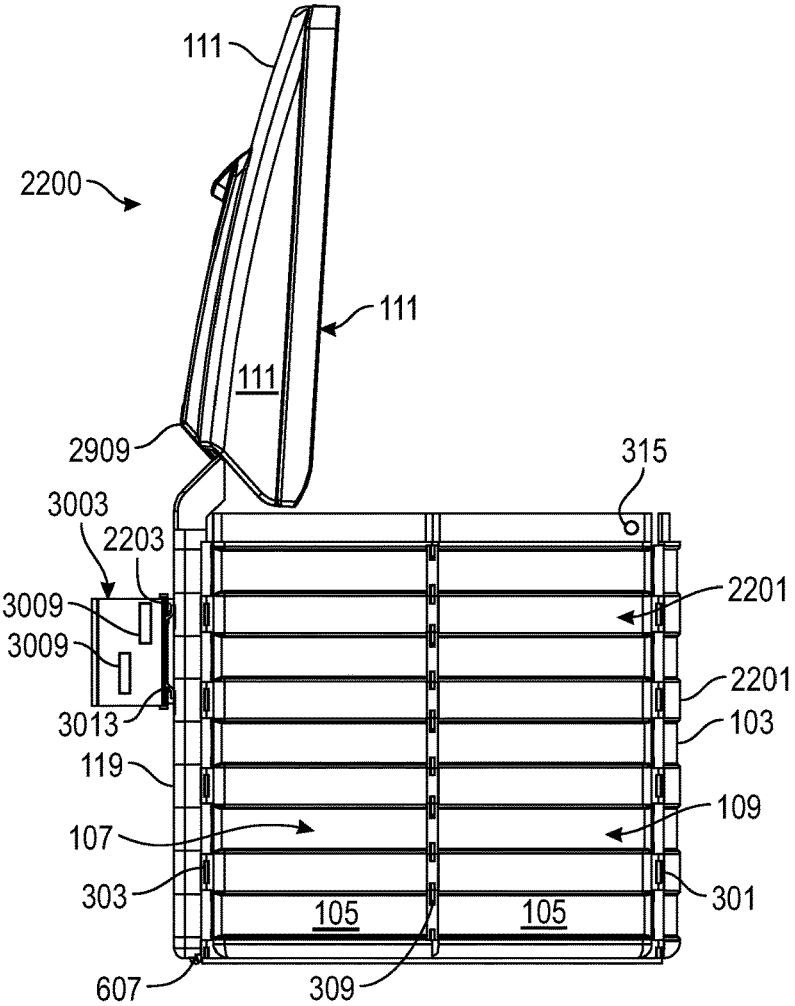
FIG. 26D may depict a side view (left or right) of the package-receiving-locker of FIG. 26A. (Side views may be substantially similar or identical.)
Figure 26E:
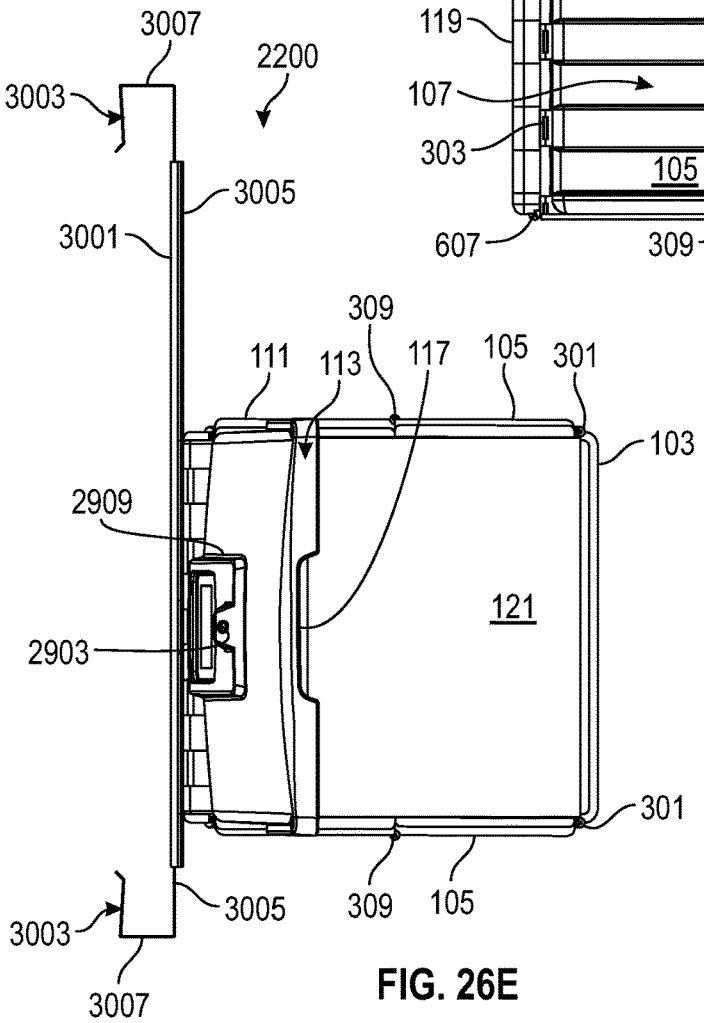
FIG. 26E may depict a top view of the package-receiving-locker of FIG. 26A.
Figure 27A:
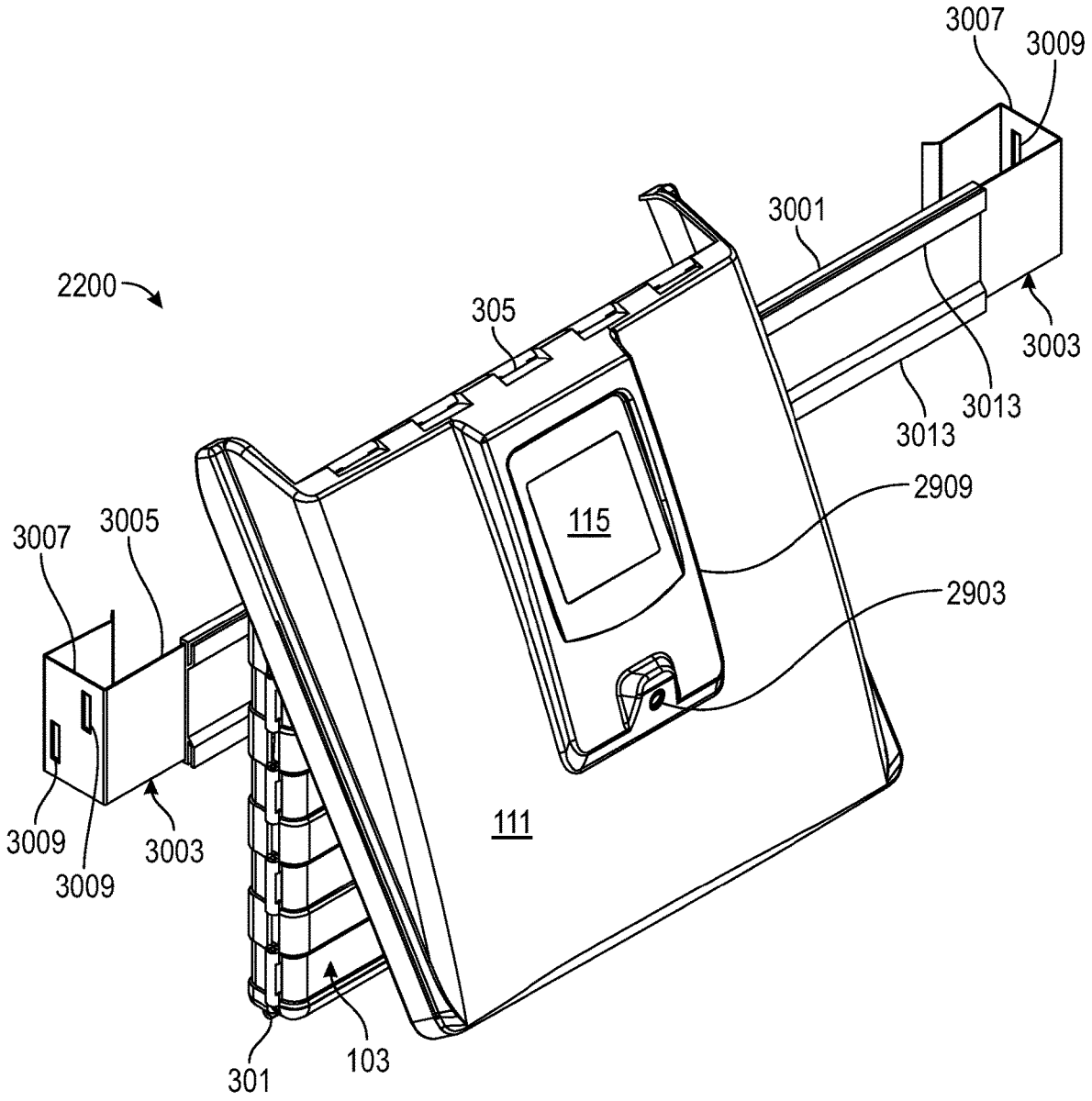
FIG. 27A may depict a front, left, top, perspective (isometric) view of the package-receiving-locker of FIG. 22A, but shown in a partially deployed (partially collapsed) configuration and shown wherein the package-receiving-locker of FIG. 22A may be attached to the door-attachment-structure.
Figure 27B:
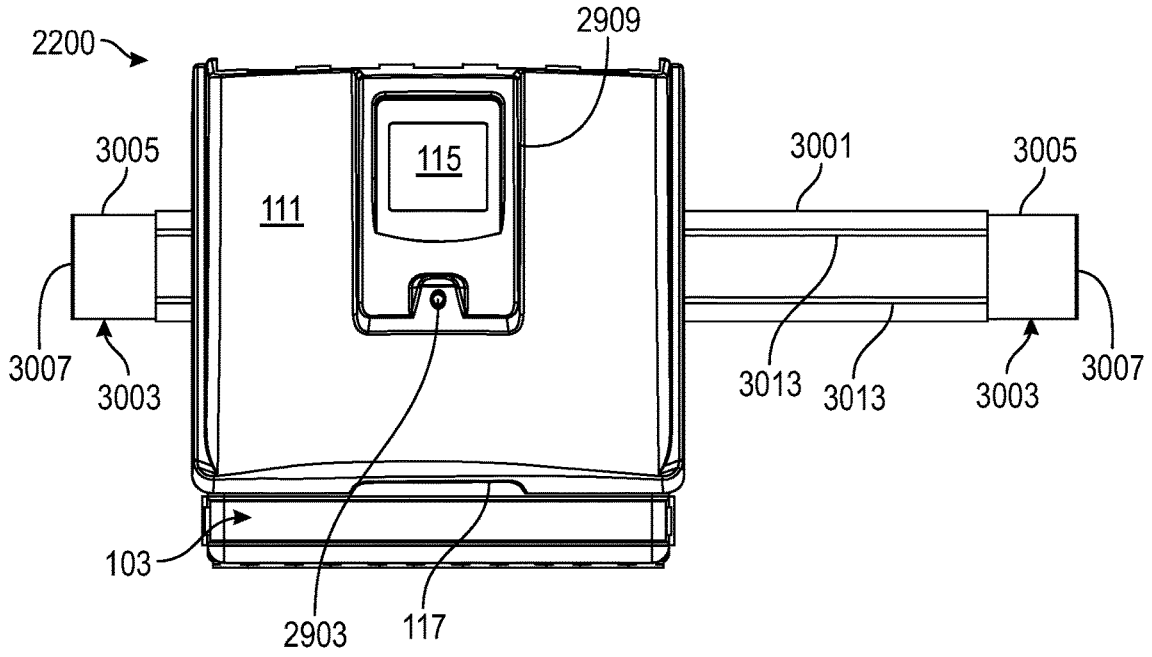
FIG. 27B may depict a front view of the package-receiving-locker of FIG. 27A.
Figure 27C:
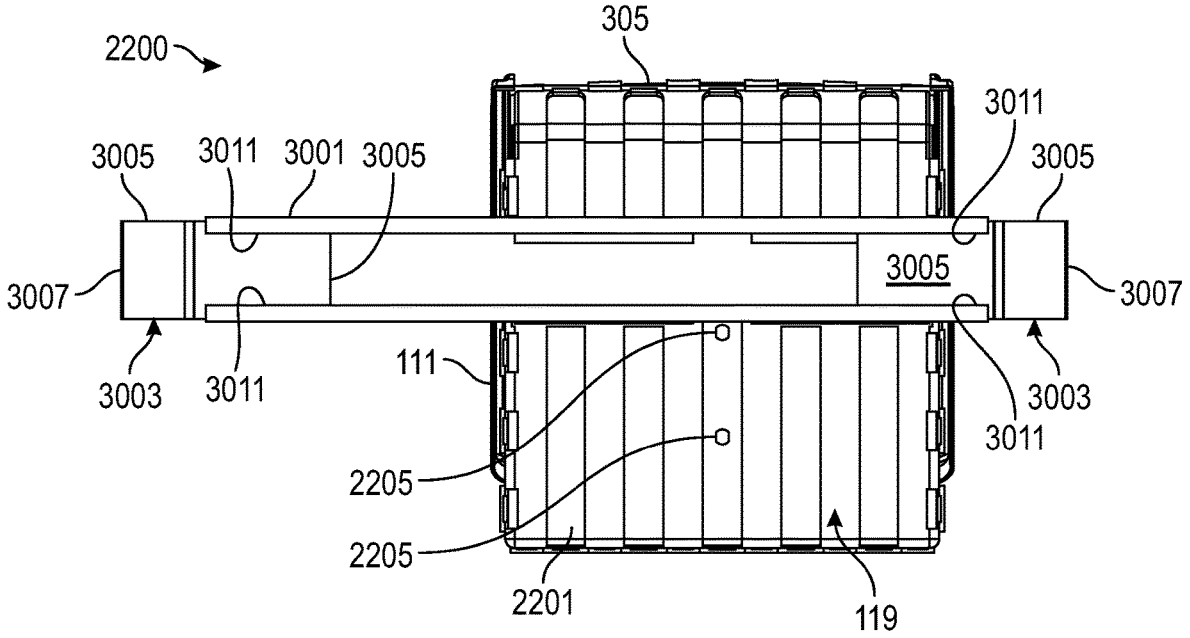
FIG. 27C may depict a back (rear) view of the package-receiving-locker of FIG. 27A.
Figure 27D:
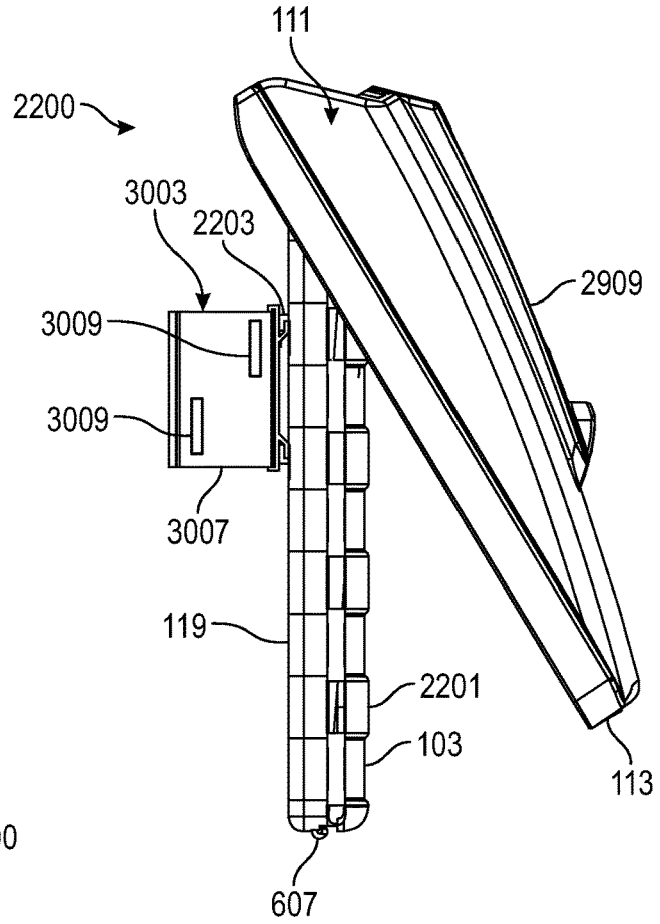
FIG. 27D may depict a side view (left or right) of the package-receiving-locker of FIG. 27A. (Side views may be substantially similar or identical.)
Figure 27E:
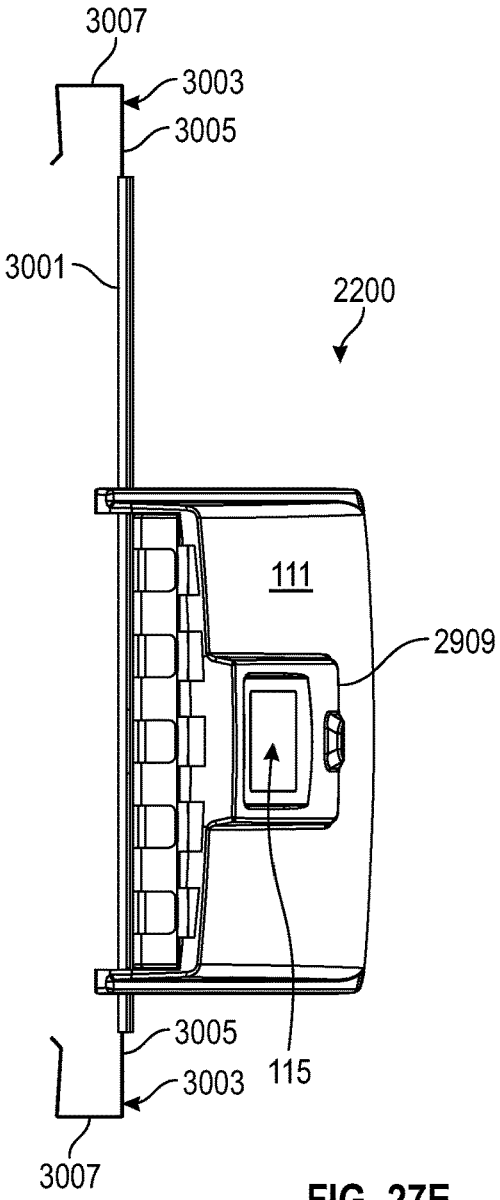
FIG. 27E may depict a top view of the package-receiving-locker of FIG. 27A.

FIG. 25A may depict a front view of package-receiving-locker 2200 (i.e., FIG. 25A may be similar to FIG. 22B) and also shown in FIG. 25A may be sectional line 25B-25B. Sectional line 25B-25B may pass through a middle/center of package-receiving-locker 2200, from front to back. FIG. 25B may be a cross-sectional view of package-receiving-locker 2200 through sectional line 25B-25B. Honeycombed shaped interior-rib(s) 2301 of side-walls 105 may be shown in FIG. 25B. A cross-section through rail(s) 2203 may be shown in FIG. 25B, showing a "L" bracket shape.

FIG. 25B may also show cross-sections through some of the electronics and electronics housing components of a given package-receiving-locker 2200. Cross-sections through exterior-electronics-cover 2909 and electronic cover 2907 may be seen in FIG. 25B. In some embodiments, exterior-electronics-cover 2909 may be located on a top of lid 111. In some embodiments, exterior-electronics-cover 2909 may be attached on a top of lid 111. In some embodiments, electronic cover 2907 may be located on an underside of lid 111. In some embodiments, electronic cover 2907 may be attached to an underside of lid 111. In some embodiments, exterior-electronics-cover 2909 may be disposed above electronic cover 2907, such that a pocket 2501 is formed in between. Various electronics components, circuits, and/or hardware of computing-device 1500 may be housed within this pocket 2501 between exterior-electronics-cover 2909 and electronic cover 2907. For example, and without limiting the scope of the present invention, PCB 2901 (printed circuit board 2901) may be housed within this pocket 2501 between exterior-electronics-cover 2909 and electronic cover 2907. In some embodiments, PCB 2901 may comprise computing-device 1500 or a portion thereof. In some embodiments, PCB 2901 may comprise one or more Processors 1501, one or more Memory 1503, I/O for External Communications 1505, some portions of I/O Means 1507 (such as, but not limited to, sensors), power-supply 1509, and/or GPS-module 1511. In some embodiments, exterior-electronics-cover 2909 may house exterior-interface 115. In some embodiments, exterior-electronics-cover 2909 may house exterior-camera 2903. In some embodiments, electronic cover 2907 may house interior-camera 2905. In some embodiments, electronic cover 2907 may comprise one or more internally/interiorly oriented/directed lights, sensors, and/or interface means (e.g., port/jack)—i.e., components of I/O Means 1507. In some embodiments, exterior-electronics-cover 2909 may comprise one or more externally/exteriorly oriented/directed lights, sensors, and/or interface means (e.g., port/jack)—i.e., components of I/O Means 1507.

FIG. 26A through FIG. 26E may depict package-receiving-locker 2200 and may depict door-attachment-structure 3000. FIG. 26A through FIG. 26E may be similar to FIG. 23A through FIG. 23E, i.e., both sets of figures may show package-receiving-locker 2200 deployed/expanded and with lid 111 at least partially open; however, door-attachment-structure 3000 may also be shown in FIG. 26A through FIG. 26E.

FIG. 27A through FIG. 27E may depict package-receiving-locker 2200 and may depict door-attachment-structure 3000. FIG. 27A through FIG. 27E may be similar to FIG. 24A through FIG. 24E, i.e., both sets of figures may show package-receiving-locker 2200 in a partially deployed/collapsed configuration and with lid 111 at least partially open; however, door-attachment-structure 3000 may also be shown in FIG. 27A through FIG. 27E.

FIG. 28A through FIG. 28E may depict package-receiving-locker 2200 and may depict door-attachment-structure 3000. FIG. 28A through FIG. 28E may be similar to FIG. 22A through FIG. 22E, i.e., both sets of figures may show package-receiving-locker 2200 substantially (fully) deployed/expanded and with lid 111 closed; however, door-attachment-structure 3000 may also be shown in FIG. 28A through FIG. 28E.

Figure 28A:
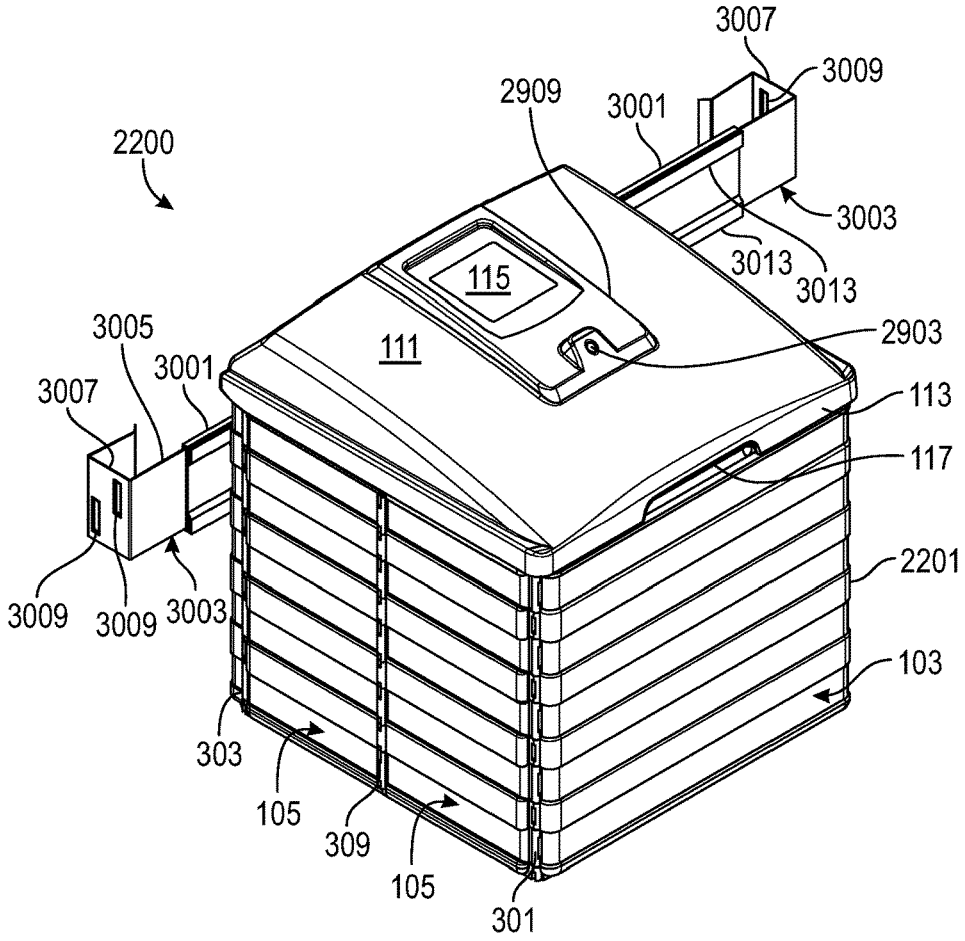
FIG. 28A may depict a front, left, top, perspective (isometric) view of the package-receiving-locker of FIG. 22A, but shown with the lid closed and shown wherein the package-receiving-locker of FIG. 22A may be attached to the door-attachment-structure.
Figure 28B:
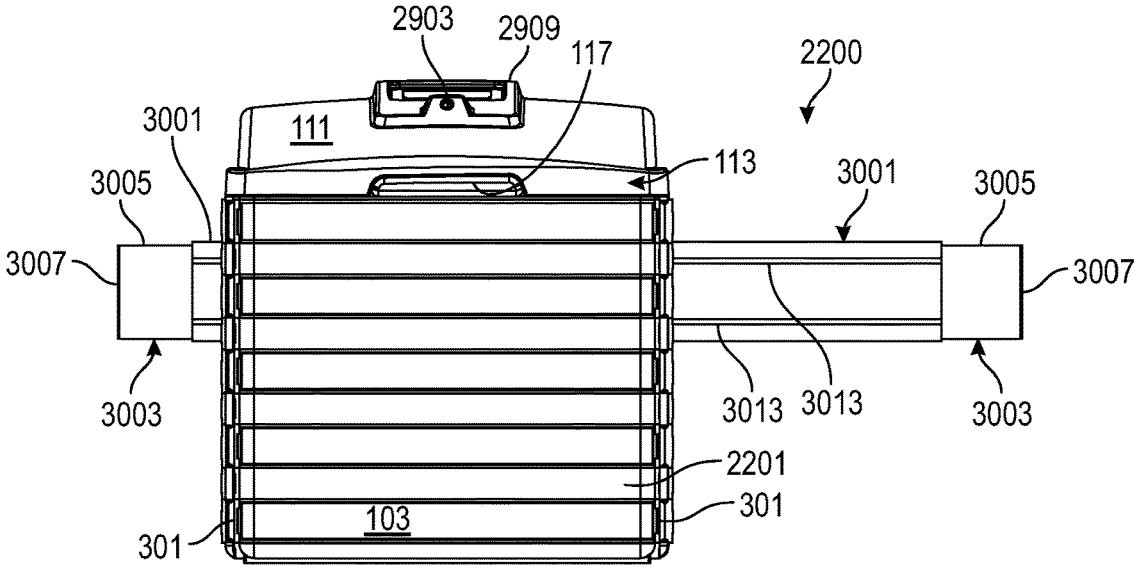
FIG. 28B may depict a front view of the package-receiving-locker of FIG. 28A.
Figure 28C:
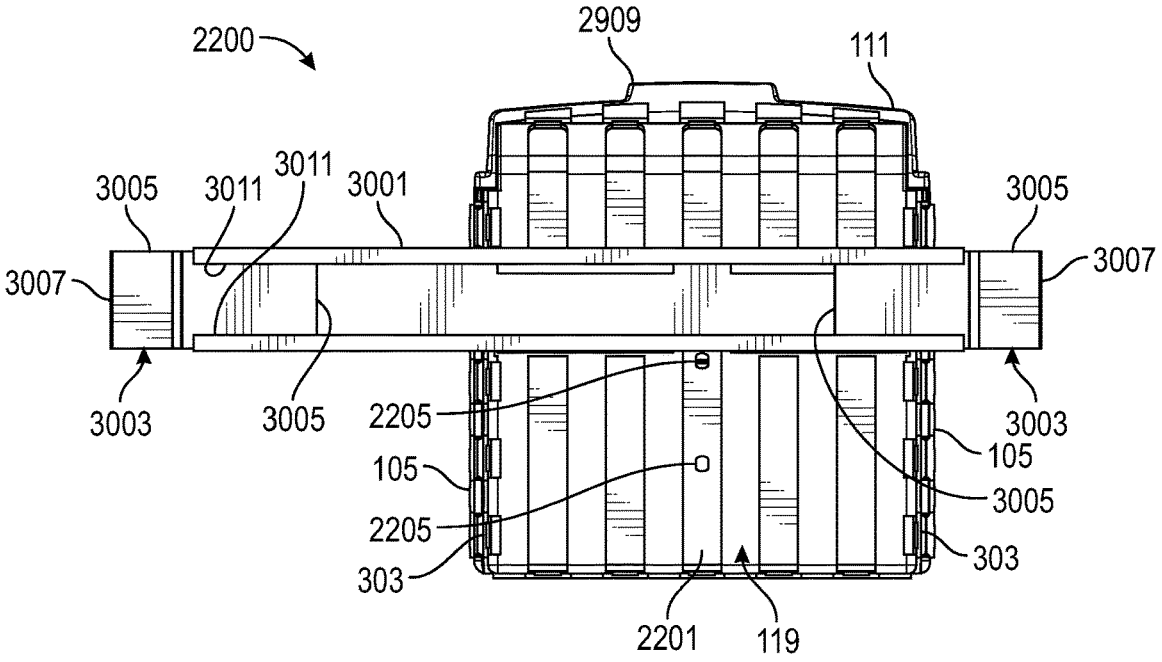
FIG. 28C may depict a back (rear) view of the package-receiving-locker of FIG. 28A.
Figure 28D:
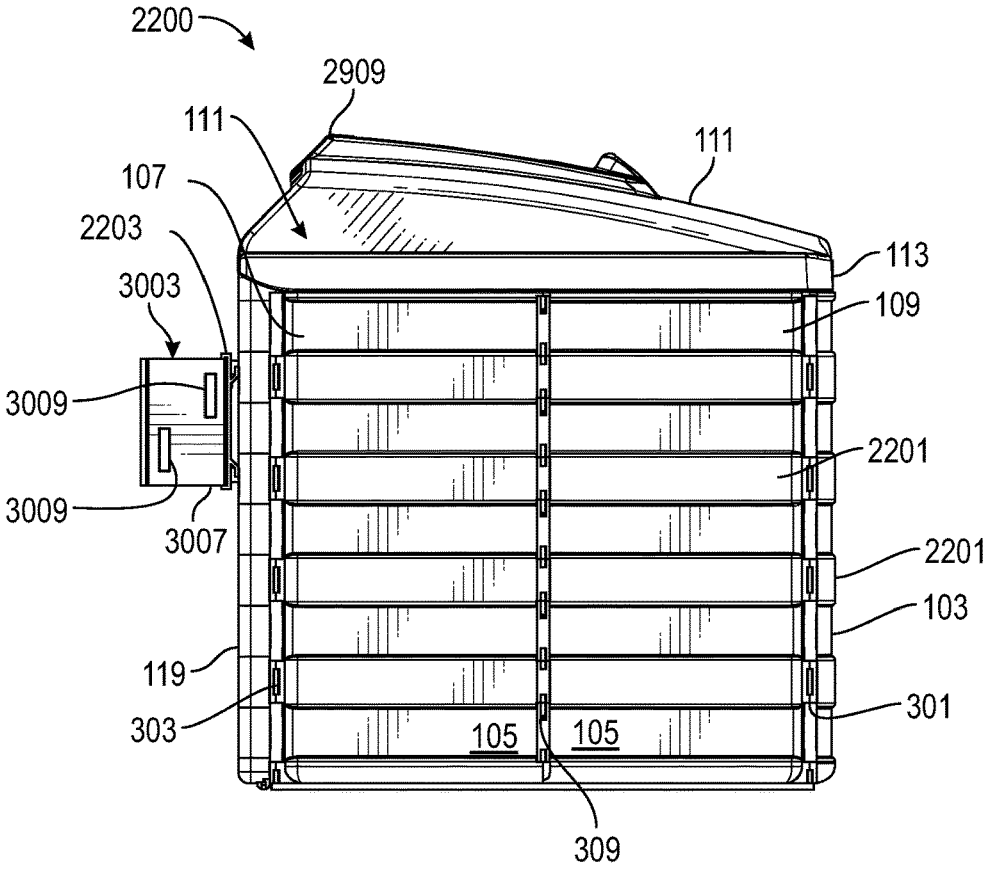
FIG. 28D may depict a side view (left or right) of the package-receiving-locker of FIG. 28A. (Side views may be substantially similar or identical.)
Figure 28E:
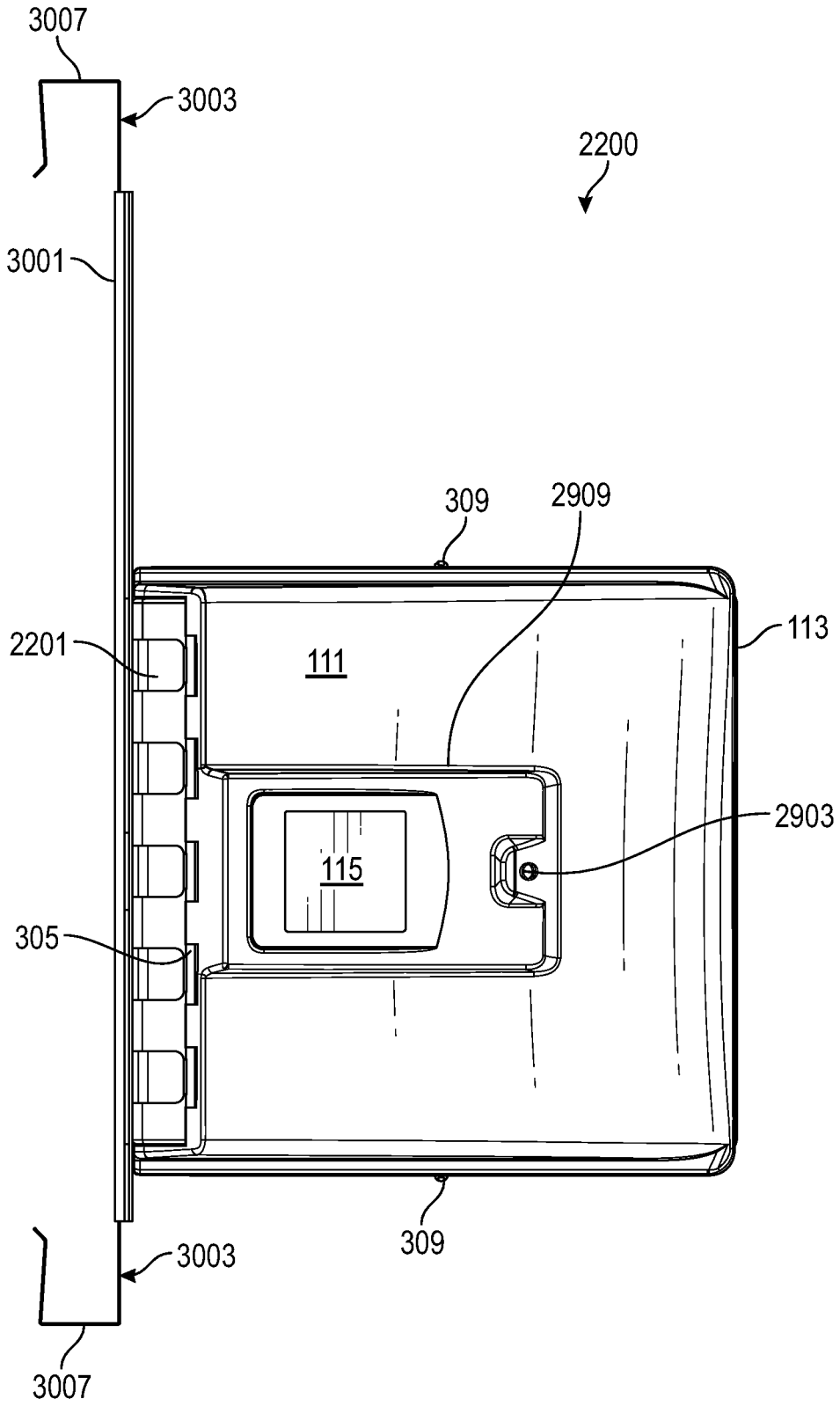
FIG. 28E may depict a top view of the package-receiving-locker of FIG. 28A.

In FIG. 226A through FIG. 28E, door-attachment-structure 3000 may be attached to rear-wall 119 of package-receiving-locker 2200. In FIG. 226A through FIG. 28E, door-attachment-structure 3000 may be attached to rear-wall 119 of collapsible-locker 101 of package-receiving-locker 2200. In some embodiments, door-attachment-structure 3000 may be removably attached to rear-wall 119. In some embodiments, door-attachment-structure 3000 may be removably and slidingly to rear-wall 119. In some embodiments, door-attachment-structure 3000 may comprise central-rail 3001 and two opposing end-brackets 3003. In some embodiments, PRL-engagement-rail(s) 3013 may be on and/or attached to central-rail 3001. In some embodiments, central-rail 3001 may comprise one or more PRL-engagement-rail(s) 3013. In some embodiments, PRL-engagement-rail(s) 3013 may removably and slidingly engage to rail(s) 2203 of rear-wall 119. See e.g., FIG. 26C, FIG. 26D, FIG. 27C, FIG. 27D, FIG. 28C, FIG. 28D, FIG. 33D, FIG. 34C, FIG. 35A, and FIG. 35B.

Figure 30A:
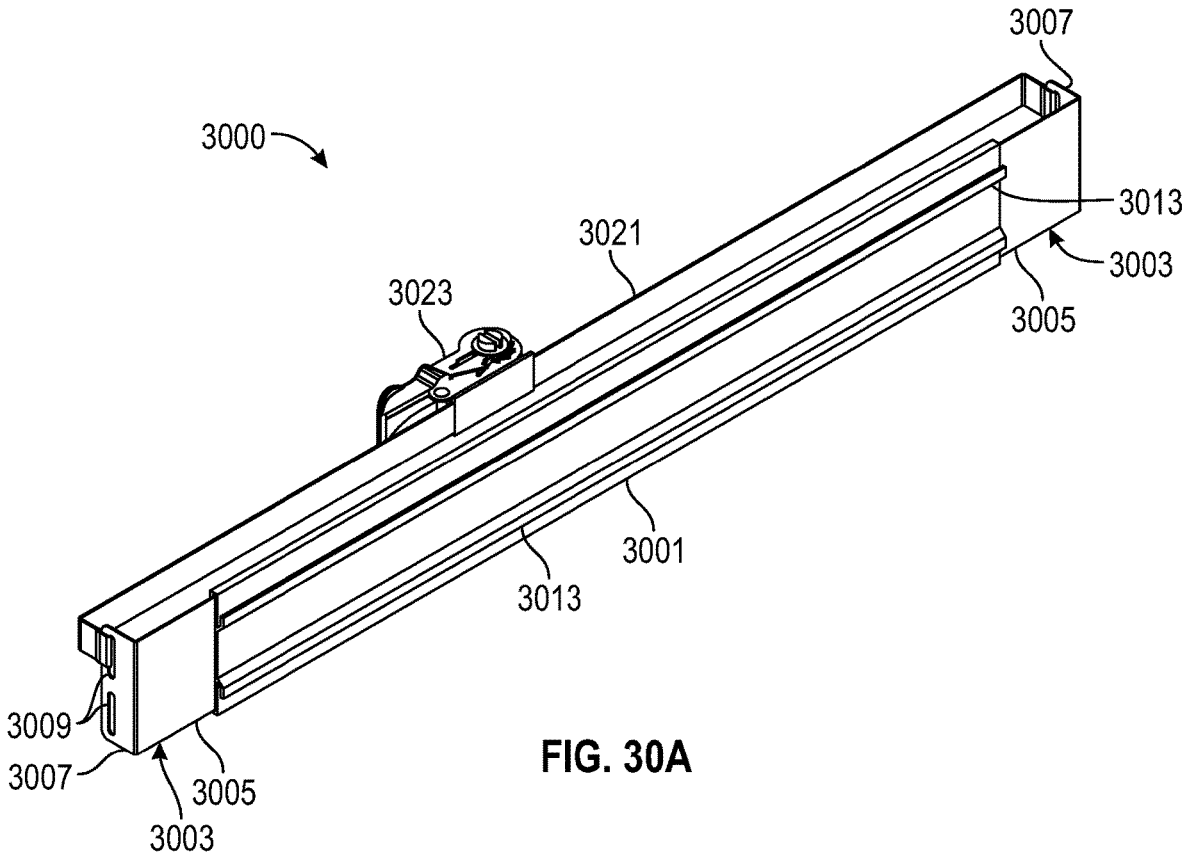
FIG. 30A may depict perspective (isometric) view of a door-attachment-structure.
Figure 30B:
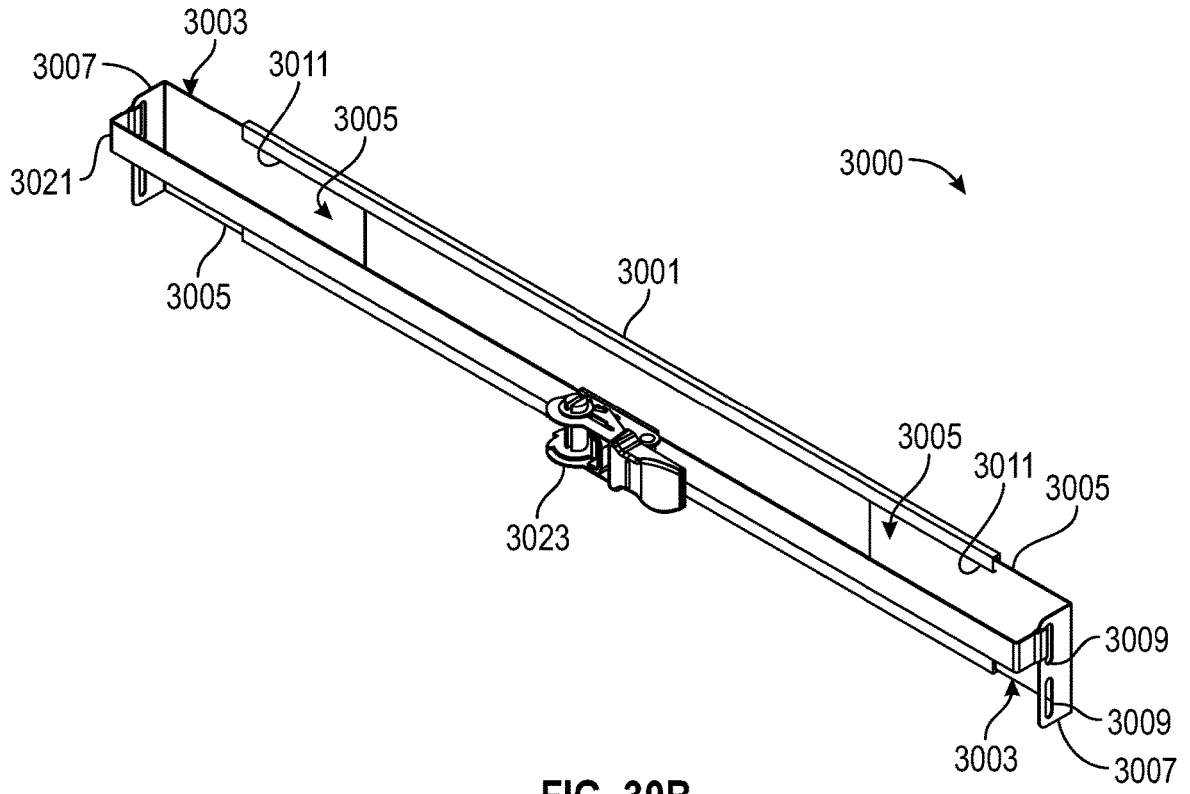
FIG. 30B may depict another perspective (isometric) view of the door-attachment-structure of FIG. 30A.
Figure 30C:
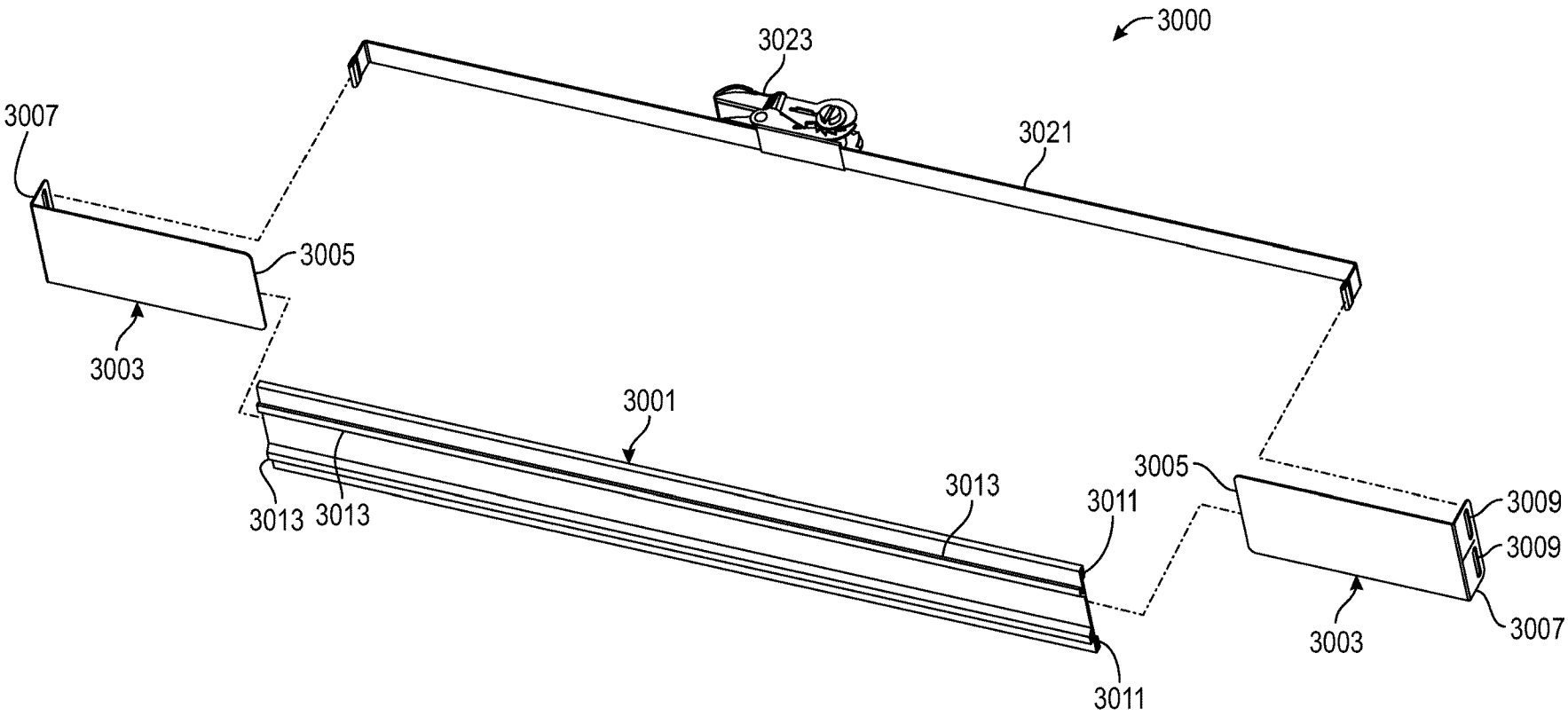
FIG. 30C may depict an exploded perspective (isometric) view of the door-attachment-structure of FIG. 30A.

FIG. 30A through FIG. 30C may show just door-attachment-structure 3000 (without showing the collapsible-container 101 of package-receiving-locker 2200). FIG. 30A may depict perspective (isometric) view of door-attachment-structure 3000. FIG. 30B may depict another perspective (isometric) view of door-attachment-structure 3000. FIG. 30C may depict an exploded perspective (isometric) view of door-attachment-structure 3000.

In some embodiments, door-attachment-structure 3000 may comprise central-rail 3001 and two opposing end-brackets 3003. In some embodiments, central-rail 3001 may be an elongate and mostly planar member with PRL-engagement-rail(s) 3013 on one side and end-bracket-receiving-slots 3011 on its opposite side. In some embodiments, PRL-engagement-rail(s) 3013 may be rail(s) for removable and sliding engagement with rail(s) 2203 of rear-wall 119. In some embodiments, PRL-engagement-rail(s) 3013 may run an entire length of central-rail 3001. In some embodiments, openings to PRL-engagement-rail(s) 3013 may face upwards, downwards, or both upwards and downwards. In some embodiments, removable attachment between PRL-engagement-rail(s) 3013 and rail(s) 2203 may be further facilitated by use of one or more magnets. In some embodiments, end-bracket-receiving-slots 3011 may be slot(s) at the ends of central-rail 3001 for receiving an insertable-portion 3005 of a given end-bracket 3003. In some embodiments, at least one end of central-rail 3001 may have an end-bracket-receiving-slot 3011. In some embodiments, both opposing ends of central-rail 3001, with respect to a length of central-rail 3001 may have an end-bracket-receiving-slot 3011. In some embodiments, end-bracket-receiving-slots 3011 may run an entire length of central-rail 3001. In some embodiments, central-rail 3001 may be a structural member and/or load bearing member. In some embodiments, central-rail 3001 may be rigid. In some embodiments, central-rail 3001 may be substantially rigid or rigid, fixed, and/or firm (not elastic, not flexible). In some embodiments, central-rail 3001 may be made from metal, plastic, plastic with fillers, composites, laminates, wood, combinations thereof, and/or the like. In some embodiments, central-rail 3001 may be extruded, molded, machined, 3D printed, combinations thereof, and/or the like. In some embodiments, central-rail 3001 may have a fixed and predetermined length. In some embodiments, a length of central-rail 3001 may be shorter than a width of door 451. See e.g., FIG. 30A, FIG. 30B, and FIG. 30C.

In some embodiments, central-rail 3001 may be integral with rear-wall 119. In some embodiments, central-rail 3001 may be permanently attached to rear-wall 119, such that central-rail 3001 and rear-wall 119 always translate together.

Either or both terminal and opposing ends of central-rail 3001, with respect to a length of central-rail 3001, may have an end-bracket 3003. In some embodiments, a purpose and/or function for end-brackets 3003 may be to grip, grab, squeeze, engage, and/or attach to opposing ends/edges/thicknesses of door 451, with respect to a width of door 451. In some embodiments, end-brackets 3003 may be attached to the opposing terminal ends of central-rail 3001, with respect to a length of central-rail 3001. In some embodiments, end-brackets 3003 may be substantially rigid or rigid, fixed, and/or firm (not elastic, not flexible). In some embodiments, end-brackets 3003 may be removably attached to the opposing terminal ends of central-rail 3001, with respect to a length of central-rail 3001. In some embodiments, end-brackets 3003 may be attached to central-rail 3001 magnetically, via one or more magnets. In some embodiments, end-brackets 3003 may be permanently attached to the opposing terminal ends of central-rail 3001, with respect to a length of central-rail 3001. In some embodiments, end-brackets 3003 may be integral to the opposing terminal ends of central-rail 3001, with respect to a length of central-rail 3001. In some embodiments, a given end-bracket 3003 may be a substantially flat and a planar member, with one or two bends; wherein with one bend the given end-bracket 3003 may be substantially "L" shaped; and wherein with two bends the given end-bracket 3003 may be substantially "U" shaped. In the "L" shaped configuration, the shorter portion (and terminal end portion) may be denoted as door-thickness-engagement-portion 3007. In the "U" shaped configuration, the bowl (pocket) portion of the "U" may be denoted as door-thickness-engagement-portion 3007. Door-thickness-engagement-portion 3007 may be in physical contact with the opposing thicknesses of door 451, with respect to a width of door 451. In some embodiments, within door-thickness-engagement-portion 3007 may be one or more apertures 3009. In some embodiments, a given aperture 3009 may be a hole and/or a slot through its respective door-thickness-engagement-portion 3007. In some embodiments, a given aperture 3009 may facilitate screwing, nailing, bolting, and/or mechanically fastening the given door-thickness-engagement-portion 3007 to the given door 451 thickness. In some embodiments, a given aperture 3009 may provide an anchor attachment location for strap 3021. In some embodiments wherein a given end-bracket 3003 may be removable from central-rail 3001, the given end-bracket may comprise insertable-portion 3005. In the "L" shaped configuration of end-bracket 3003, the longer portion may be insertable-portion 3005. In the "U" shaped configuration of end-bracket 3003, at least one of the stem portions of the "U" may be insertable-portion 3005. At least a portion (end portion) of insertable-portion 3005 may be slidingly inserted into end-bracket-receiving-slot 3011 of central-rail 3001. In some embodiments, by varying how much of insertable-portions 3005 may be inserted into end-bracket-receiving-slots 3011, a given door-attachment-structure 3000 (with a central-rail 3001 of fixed and predetermined length) may be used with different doors 451 of different widths. See e.g., FIG. 30A, FIG. 30B, and FIG. 30C.

Note, in some embodiments, the two opposing end-brackets 3003 may be denoted as at least two opposing panels that may extend beyond opposing sides of the collapsible-locker 101, wherein the at least two opposing panels (end-brackets 3003) may be configured for engaging opposing sides, by width, of the side-hinged door 451 (e.g., hinged-side 461 and non-hinged-side 459). In some embodiments, the at least two opposing panels (end-brackets 3003) might only extend beyond one of the sides of collapsible-locker 101.

In some embodiments, the inside portion of door-thickness-engagement-portion 3007 that may physically touch the sides/edges/thickness of a given door 451, may have cleats and/or other means to increase friction between door-thickness-engagement-portion 3007 and the sides/edges/thickness of the given door 451.

In some embodiments, an ability of opposing end-brackets 3003 to grip, grab, squeeze, engage, and/or attach to opposing ends/edges/thicknesses of door 451, with respect to a width of door 451 may be accomplished in several ways. In some embodiments, strap 3021 may run from both opposing end-brackets 3003, wherein the two opposing end-brackets 3003 may be physically touching the two opposing ends/edges/thicknesses of door 451, with respect to a width of door 451, providing a squeezing force exerted on door 451 between the two opposing end-brackets 3003. In some embodiments, the two opposing end-brackets 3003 may be nailed, screwed, bolted, and/or mechanically fastened to the two opposing ends/edges/thicknesses of door 451, with respect to a width of door 451. In some embodiments, insertion of the insertable-portion 3005 into its respective end-bracket-receiving-slot 3011 may be further reinforced by use of magnets to facilitate attachment of insertable-portion 3005 to end-bracket-receiving-slot 3011. In some embodiments, insertion of the insertable-portion 3005 into its respective end-bracket-receiving-slot 3011 may include a ratchet mechanical action functioning similar to a ratchet vice, such that further insertion increases the squeezing force exerted between the two opposing end-brackets 3003 on the two opposing ends/edges/thicknesses of door 451, with respect to a width of door 451. In such manners, door-attachment-structure 3000 may be attached (removably so in some embodiments) to door 451. See e.g., FIG. 32A through FIG. 34C.

As noted, in some embodiments, strap 3021 may be used to removably attach door-attachment-structure 3000 to a given door 451. In some embodiments, the fabric and/or textile components of strap 3021 may be referred to as webbing, tubular webbing, hoopie, or hoopi. In some embodiments, the fabric and/or textile components of strap 3021 may be made substantially from synthetic materials, natural materials, or combinations thereof. In some embodiments, the fabric and/or textile components of strap 3021 may be made substantially from one or more of: nylon, polypropylene, polyester, Kevlar, Dyneema, combinations thereof, and/or the like. In some embodiments, strap 3021 may be a tie-down strap, a ratchet strap, a cam-strap, and/or the like. In some embodiments, strap 3021 may be fitted with a cam-ratchet 3023 (or the like) in order to tighten opposing ends of strap 3021. See e.g., FIG. 30A, FIG. 30B, and FIG. 30C.

In some embodiments, strap 3021 may be an elastic member, such as, but not limited to, bungie cord; and may not require a cam-ratchet 3023. In some embodiments, strap 3021 may run between and be attached to opposing insertable-portions 3005, so at to pull each respective insertable-portion 3005 towards the other insertable-portion 3005.

Figure 29:
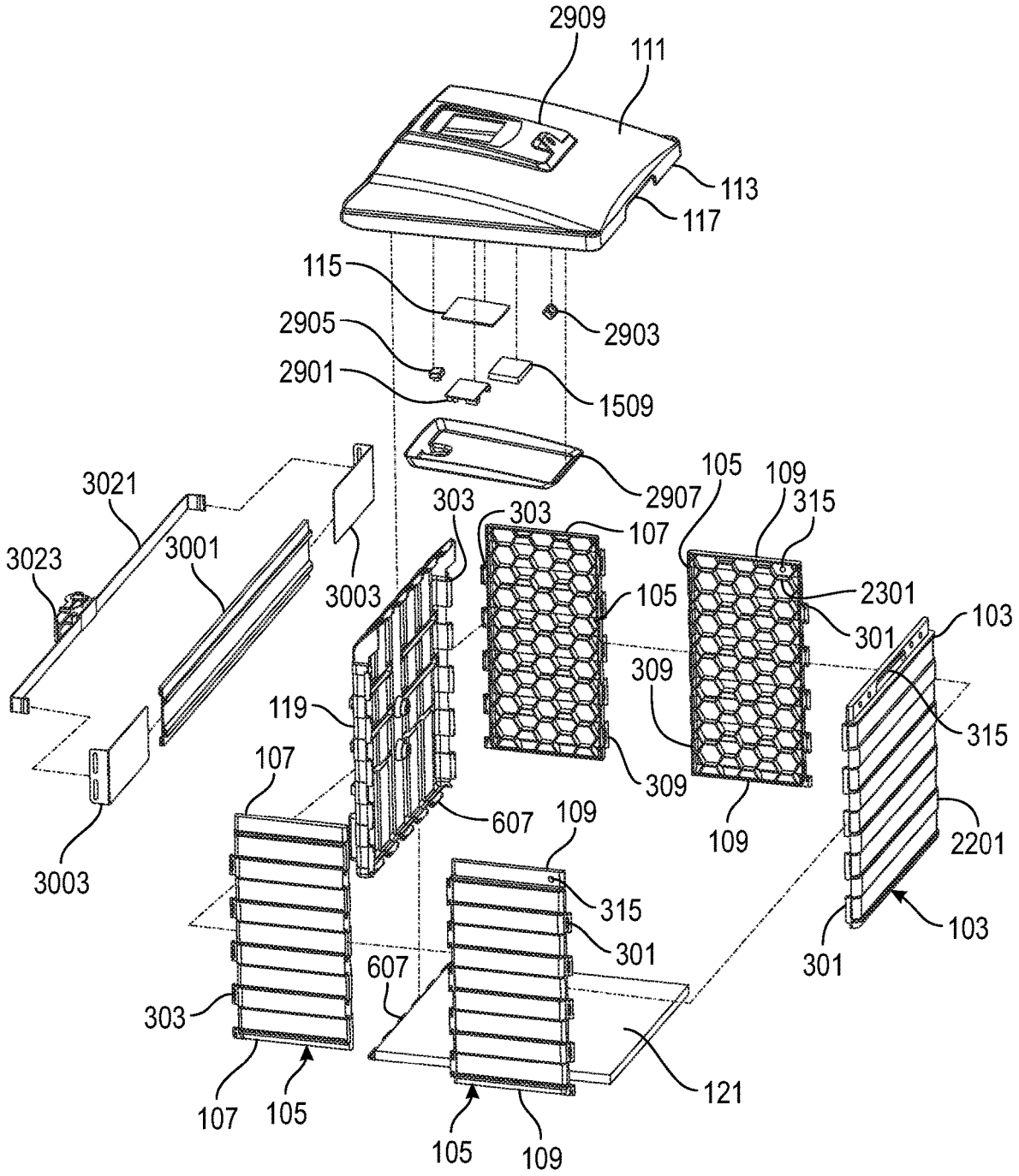
FIG. 29 may depict a front, left, top, perspective (isometric) view of the package-receiving-locker of FIG. 22A, but wherein the package-receiving-locker of FIG. 22A may be shown exploded.

FIG. 29 may depict a front, left, top, perspective (isometric) view of package-receiving-locker 2200, but wherein at least some of the components of package-receiving-locker 2200 may be shown exploded. For example, and without limiting the scope of the present invention, the main structural components of collapsible-locker 101 of front-wall 103, rear-wall 119, side-walls 105, lid 111, and floor 121 may be shown exploded from each other. For example, and without limiting the scope of the present invention, (bottom) electronics cover 2907 may be shown exploded from a bottom of lid 111; and exterior-interface 115, power-source 1509, PCB 2901, exterior-camera 2903, and interior-camera 2905 may also be shown exploded from lid 111. For example, and without limiting the scope of the present invention, the main structural components of door-attachment-structure 3000 of central-rail 3001, end-brackets 3003, and strap 3021 may be shown exploded from each other; and door-attachment-structure 3000 may be shown exploded away from rear-wall 119.

Figure 31A:
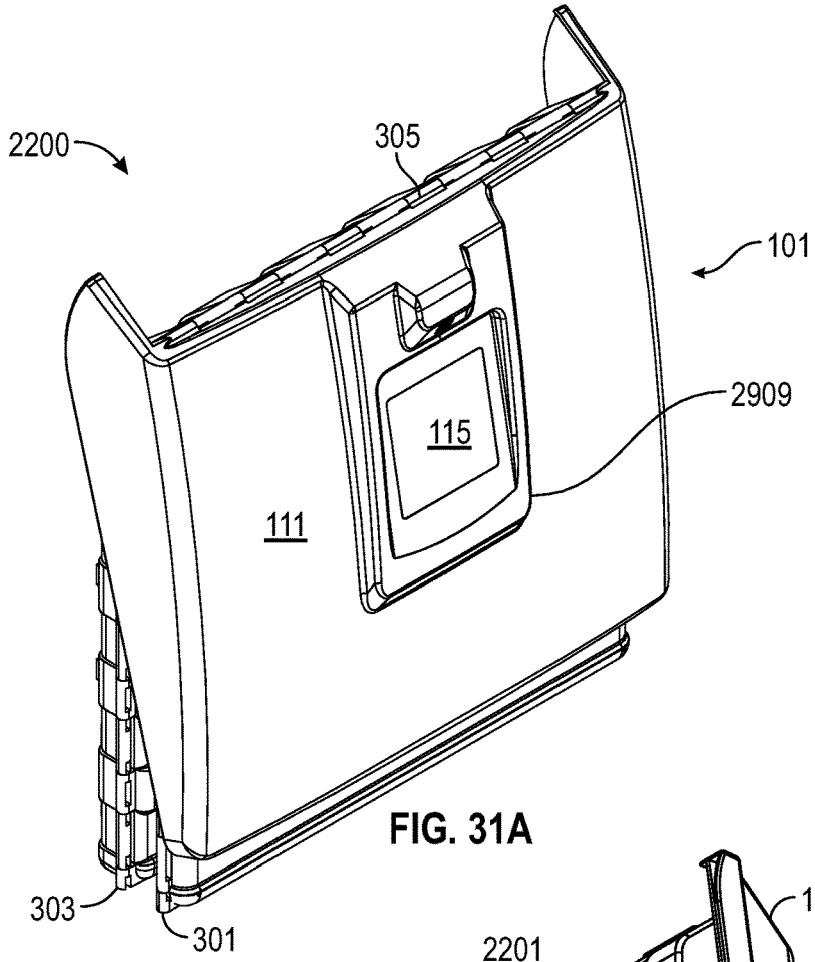
FIG. 31A may depict a front, left, top, perspective (isometric) view of the package-receiving-locker of FIG. 22A, but shown in the fully collapsed configuration.
Figure 31B:
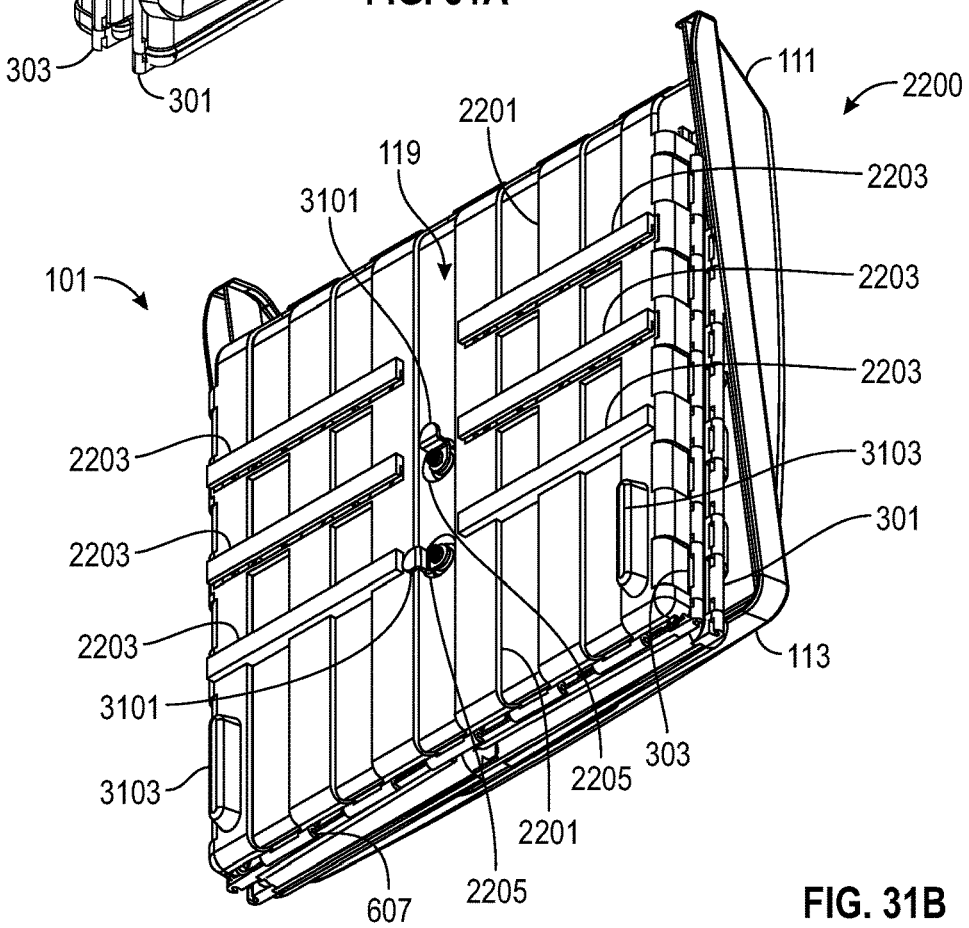
FIG. 31B may a rear, left, bottom, perspective (isometric) view of the package-receiving-locker of FIG. 31A.
Figure 31C:
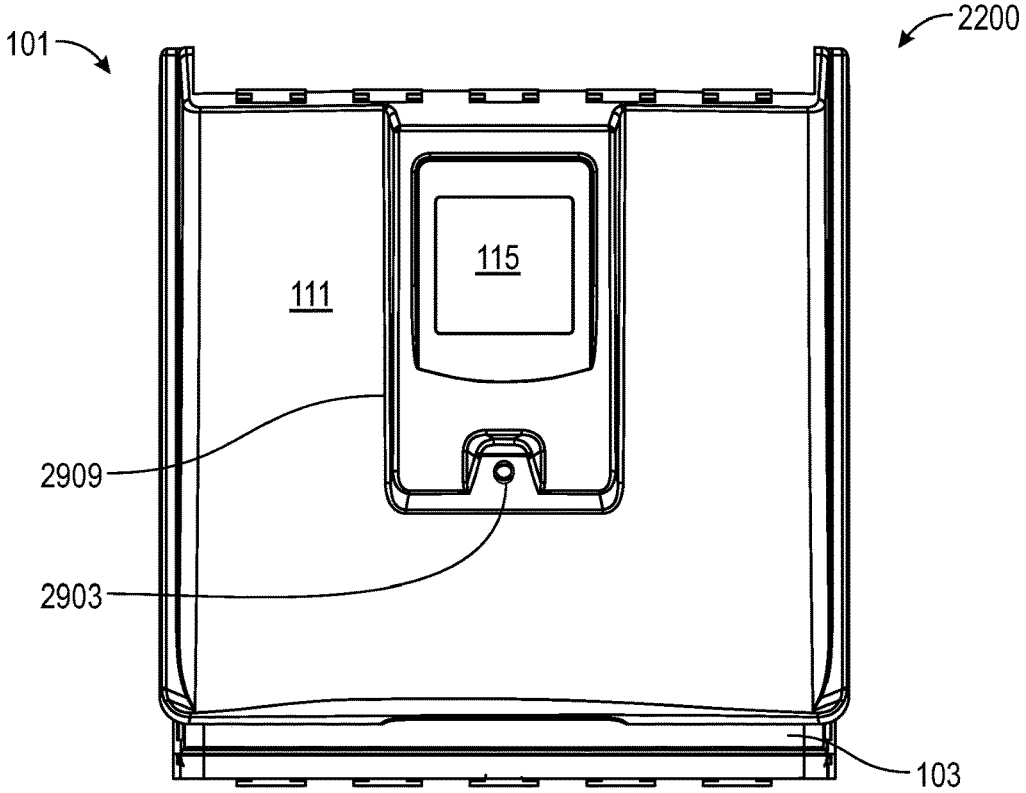
FIG. 31C may depict a front view of the package-receiving-locker of FIG. 31A.
Figure 31D:
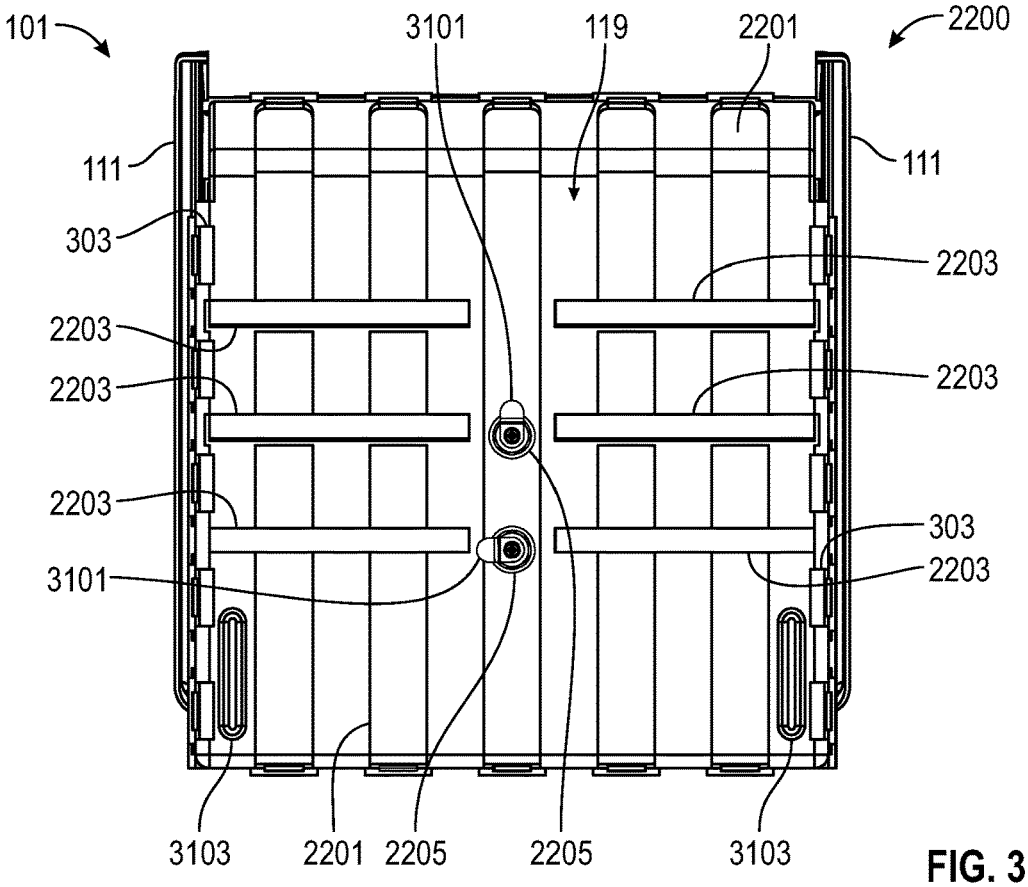
FIG. 31D may depict a rear (back) view of the package-receiving-locker of FIG. 31A.
Figure 31E:
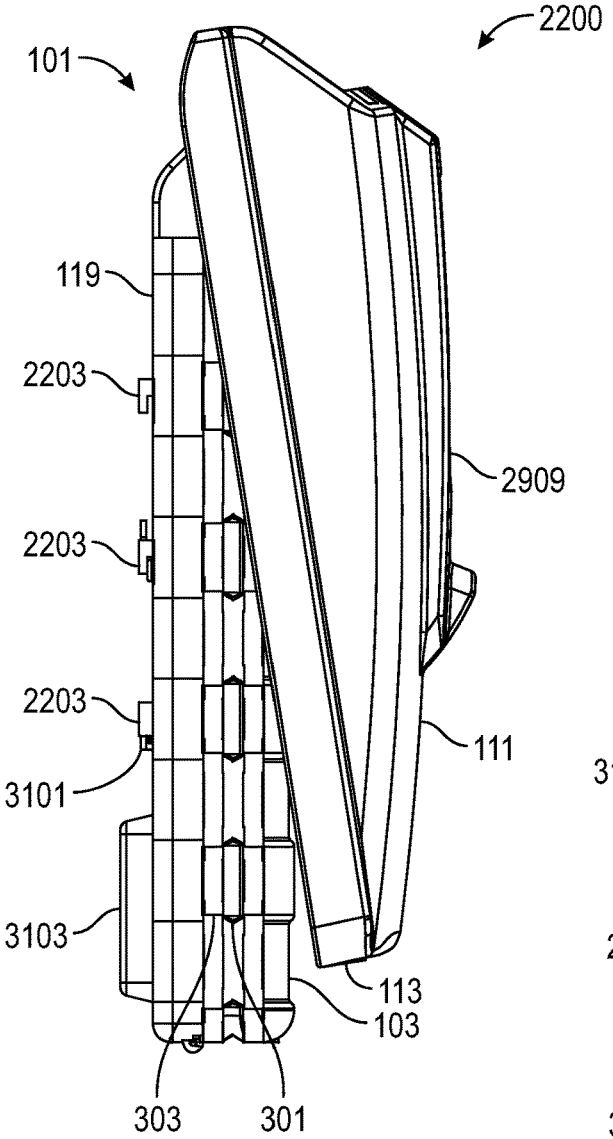
FIG. 31E may depict a side view (left or right) of the package-receiving-locker of FIG. 31A. (Side views may be substantially similar or identical.)
Figure 31F:
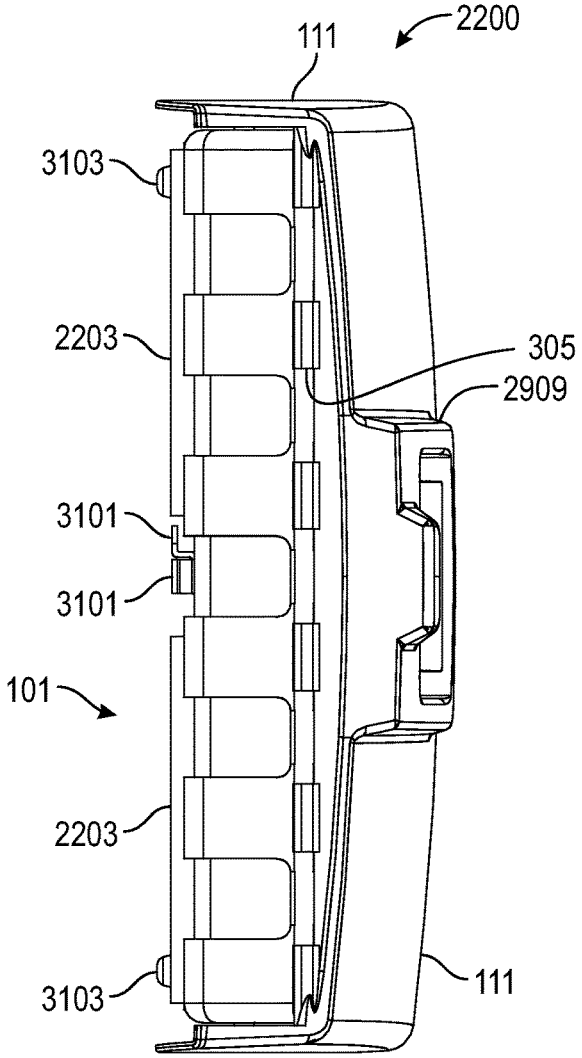
FIG. 31F may depict a top view of the package-receiving-locker of FIG. 31A.
Figure 31G:
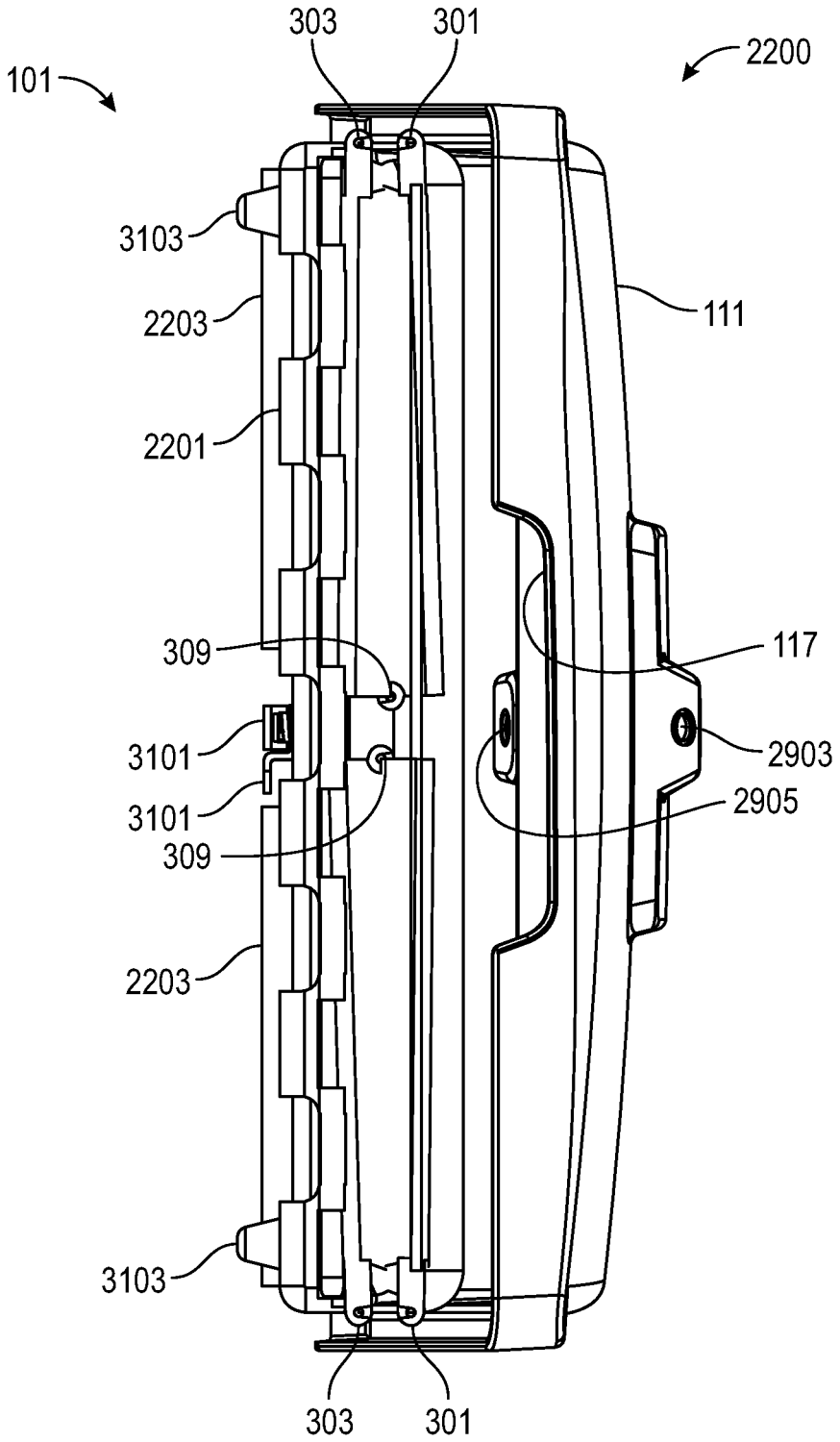
FIG. 31G may depict a bottom view of the package-receiving-locker of FIG. 31A.

FIG. 31A through FIG. 31G may show package-receiving-locker 2200 in its fully collapsed configuration from various viewing angles. FIG. 31A may depict a front, left, top, perspective (isometric) view of package-receiving-locker 2200. FIG. 31B may a rear, left, bottom, perspective (isometric) view of package-receiving-locker 2200. FIG. 31C may depict a front view of package-receiving-locker 2200. FIG. 31D may depict a rear (back) view of package-receiving-locker 2200. (FIG. 31D and FIG. 31C) may be opposing views.) FIG. 31E may depict a side view (left or right) of package-receiving-locker 2200. (Side views may be substantially similar or identical.) FIG. 31F may depict a top view of package-receiving-locker 2200. FIG. 31G may depict a bottom view of package-receiving-locker 2200. Portions of lid-hinge 305 may be visible in FIG. 31A and FIG. 31F, wherein lid-hinge 305 may permit hinged movement between rear-wall 119 and lid 111. In some embodiments, via lid-hinge 305, lid 111 may be hingedly (pivotally) attached to rear-wall 119. In some embodiments, lid-hinge 305 may be how lid 111 may be attached to collapsible-locker 101.

Cam-locks 3101 and back-supports 3103 may be seen in FIG. 31B, FIG. 31D, FIG. 31E, FIG. 31F, and FIG. 31G. One or more cam-locks 3101 may protrude from rear-wall 119 from holes 2205. Two cam-locks 3101 may protrude from rear-wall 119 at different heights on rear-wall 119. At least one cam-lock 3101 may be used at a time to (removably) secure rear-wall 119 to a PRL-engagement-rail 3013 of central-rail 3001, to prevent sliding (back-and-forth) translation between rail(s) 2203 and PRL-engagement-rail(s) 3013. When the cam-lock 3101 is tighten, tension and/or friction is exerted between the cam-lock 3101 and a PRL-engagement-rail 3013. In some embodiments, tightening or loosening cam-lock 3101 may be done by a user handling a back-side (rear) of the cam-lock 3101 from inside the collapsible-locker 101, when lid 111 may open. See also FIG. 35B showing how a given cam-lock 3101 may removably engage against a given PRL-engagement-rail 3013 of central-rail 3001.

In some embodiments, one or more back-supports 3103 may protrude from an exterior of rear-wall 119. In some embodiments, rear-wall 119 may have two back-supports 3103 that protrude outwards from an exterior surface of rear-wall 119. In some embodiments, the two back-supports 3103 may be disposed away from each other each being closer to a rear-side-hinge, wherein these two rear-side-hinges are opposing each other on different sides of the package-receiving-locker 2200. When collapsible-locker 101 may be (removably) attached to a given door 451, one or more back-supports 3103 may press against an exterior of door 451, such as door-outside 455. In some embodiments, exterior surfaces of back-supports 3103 may have non-slip properties and/or cushioning properties. See e.g., FIG. 31B, FIG. 31D, FIG. 31E, FIG. 31F, and FIG. 31G.

Note, FIG. 32A through FIG. 35B may all show at least some portion of door 451 and at least some portion of package-receiving-locker 2200 in relation to that door 451.

Figure 32A:
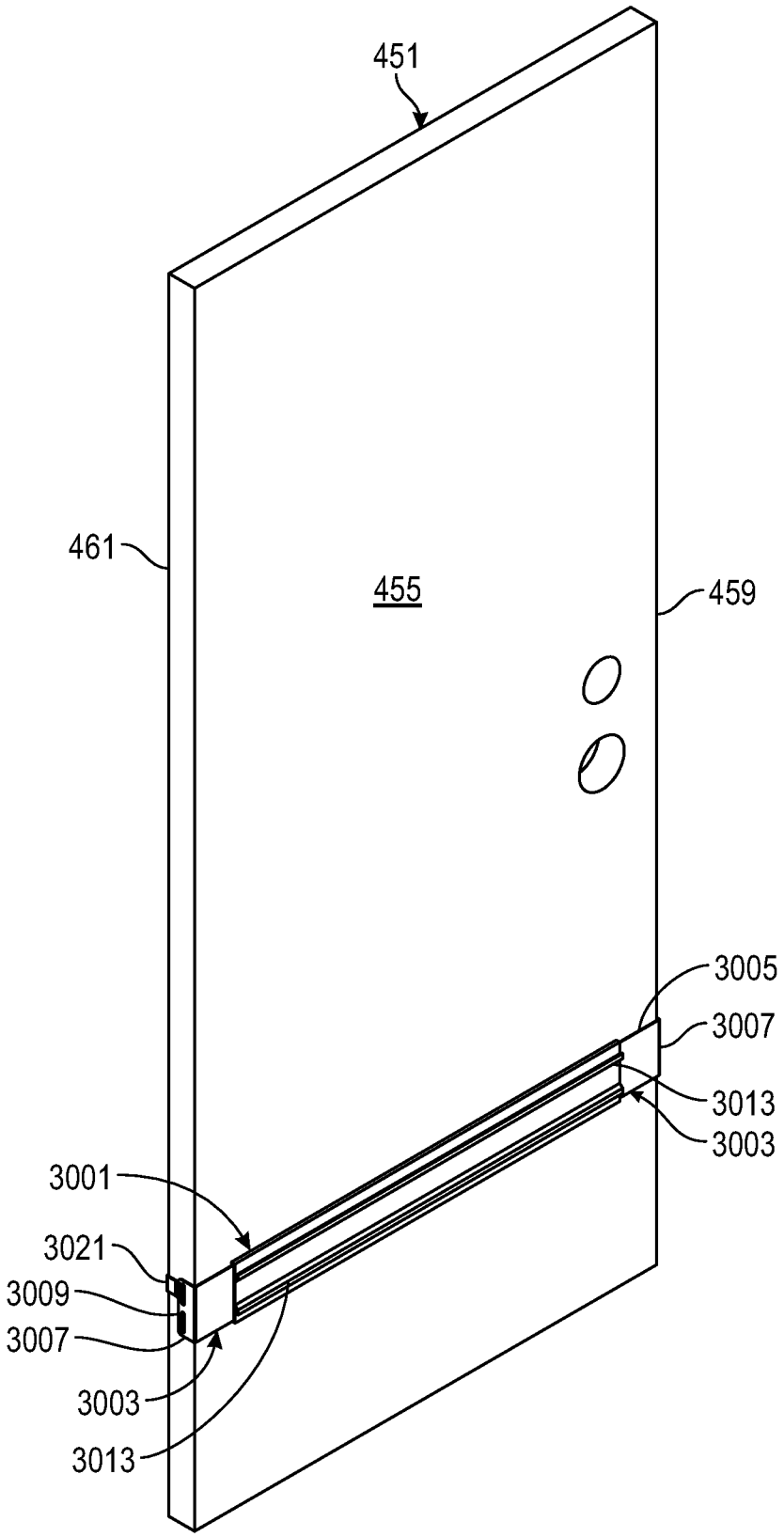
FIG. 32A may depict the door-attachment-structure attached to a door, shown from a perspective view.
Figure 32B:
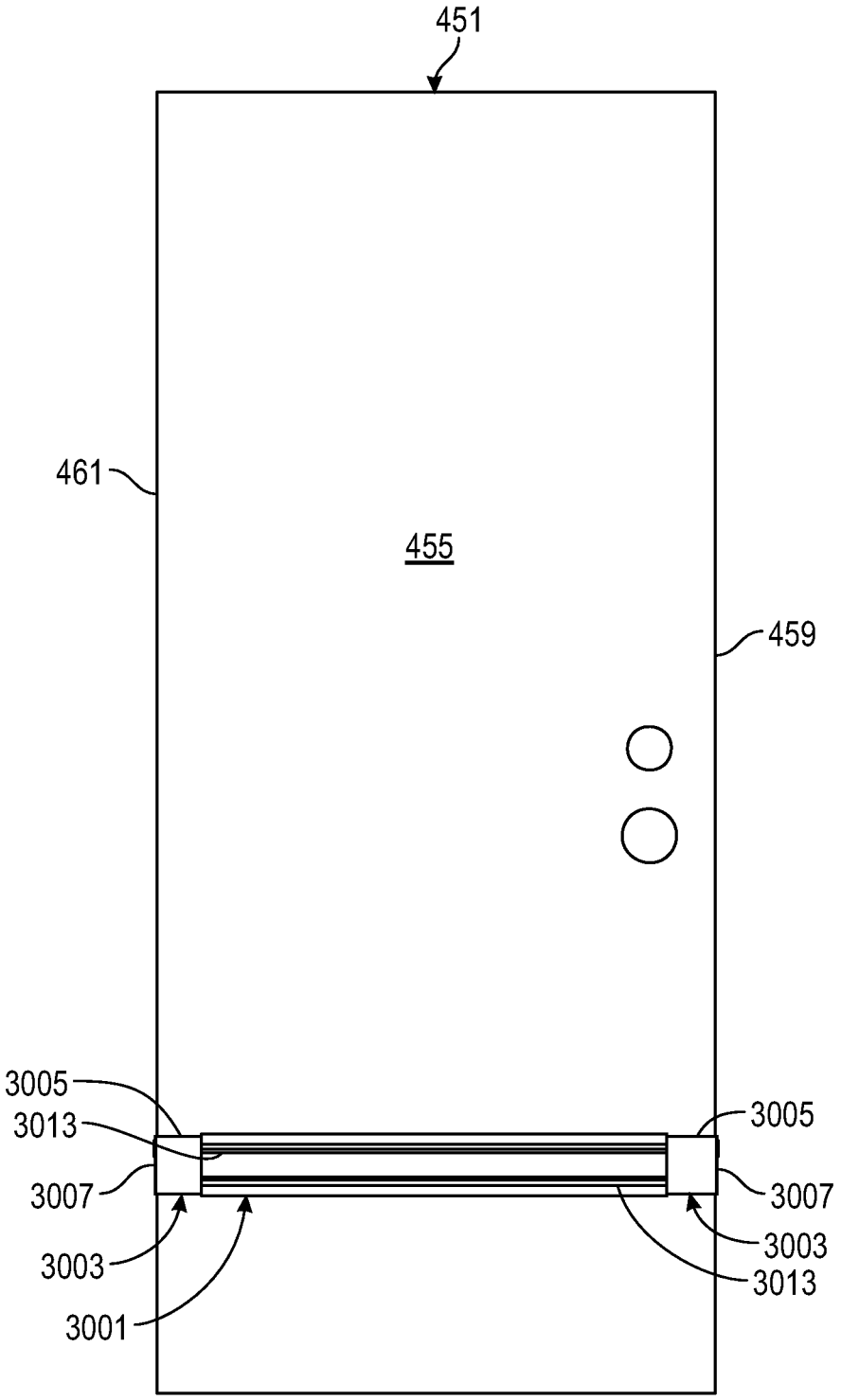
FIG. 32B may depict the door-attachment-structure attached to the door (e.g., showing a front/outside of the door), shown from a front view.
Figure 32C:
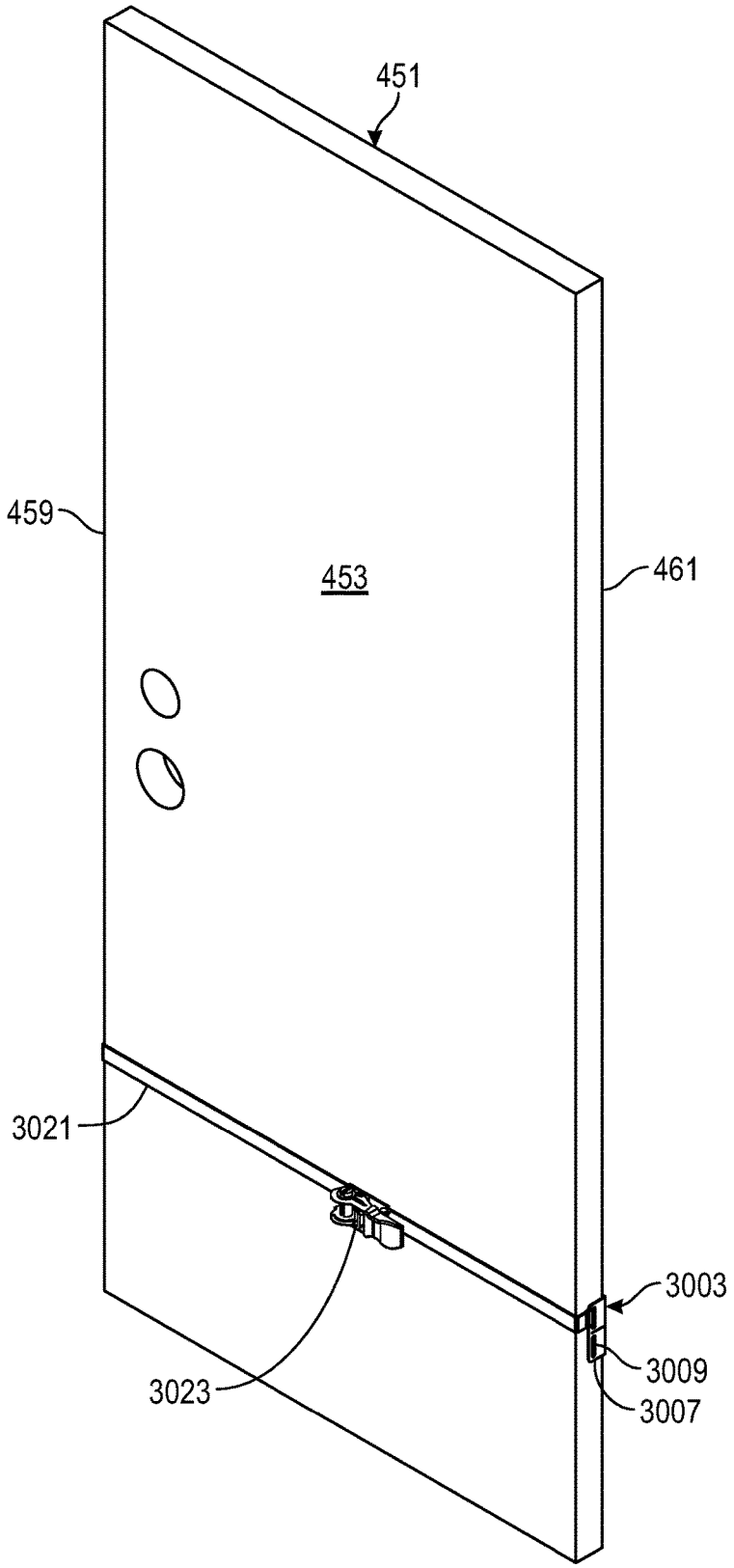
FIG. 32C may depict the door-attachment-structure attached to the door (e.g., showing the rear/inside of the door), shown from another perspective view.
Figure 32D:
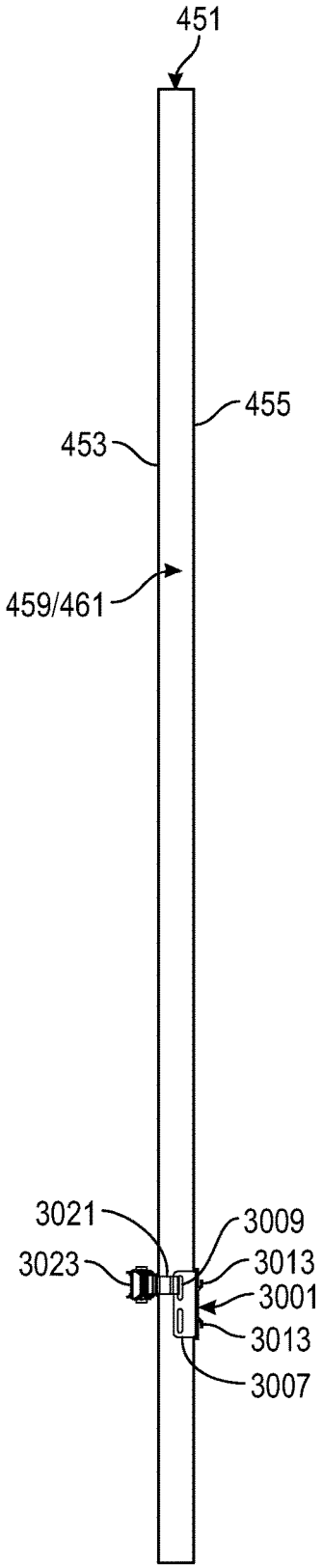
FIG. 32D may depict the door-attachment-structure attached to the door (e.g., showing a front/outside of the door), shown from a side view.

FIG. 32A through FIG. 32D may show just door-attachment-structure 3000 that is removably attached to door 451 from various viewing angles. Collapsible-locker 101 portion of package-receiving-locker 2200 may not be shown in these figures. FIG. 32A may show this from a perspective view and of door-outside 455. FIG. 32B may show this from a front view and of door-outside 455. FIG. 32C may show this from a rear/back perspective view and of door-inside 453. And FIG. 32D may show this from a side view of door 451. In FIG. 32A through FIG. 32D door-attachment-structure 3000 may be removably attached to door 451. In some embodiments, door-attachment-structure 3000 may be removably attached to door 451 tight enough to prevent or minimize 3000 slipping downwards on door 451. Each of the two opposing end-brackets 3003 may be physically touching an opposing side/edge/thickness of door 451; strap 3021, whose ends may be removably attached to each of the two end-brackets 3003, may be tightened via cam-ratchet 3023 such that each of the two end-brackets 3003 squeezes tightly against each of its respective side/edge/thickness of door 451; and in this way door-attachment-structure 3000 may be removably attached to door 451; and in a manner that prevents 3000 from sliding downwards on door 451. In some embodiments, when door-attachment-structure 3000 may be attached to door 451, the back side of central-rail 3000 (side opposite of PRL-engagement-rails 3013) may be substantially flush and flat up against door-outside 455.

In some embodiments, door-attachment-structure 3000 may be attached to door 451 by the two opposing end-brackets 3003 being nailed, screwed, bolted, and/or mechanically attached to its respective side/edge/thickness of door 451. In some embodiments, door-attachment-structure 3000 may be attached to door 451 by the two opposing end-brackets 3003 being glued to its respective side/edge/thickness of door 451.

In some embodiments, door-attachment-structure 3000 may be attached to door 451 by the two opposing end-brackets 3003 being ratchet slidingly attached to end-bracket-receiving-slots 3011 of central-rail 3001, such that the door-thickness-engagement-portions 3007 of end-brackets 3003 are squeezed against respective sides/edges/thicknesses of door 451. That is, insertable-portion 3005 and end-bracket-receiving-slots 3011 may engage with each other in a ratchet fashion.

FIG. 33A through FIG. 35B may all show collapsible-locker 101 portion of package-receiving-locker 2200 removably attached to central-rail 3001 (e.g., via rail(s) 2203 engagement with PRL-engagement-rail(s) 3013); and may show door-attachment-structure 3000 attached to door 451. In FIG. 33A through FIG. 33D collapsible-locker 101 may be in fully (substantially) collapsed configuration. In FIG. 34A through FIG. 34C collapsible-locker 101 may be in fully (substantially) expanded/deployed configuration. FIG. 35A may show a cross-sectional side view of collapsible-locker 101 attached to door 451 via door-attachment-structure 3000. FIG. 35A may include a detail region denoted as 35B. FIG. 35B may be a closeup view of detail region 35B.

FIG. 33B and FIG. 34B, both front views of door-outside 455, show how the collapsible-locker 101 portion of package-receiving-locker 2200 is asymmetrically (i.e., not centered) attached to door 451 (e.g., via door-attachment-structure 3000), with respect to sides of door 451. That is, for some proper uses, collapsible-locker 101 portion of package-receiving-locker 2200 should not be centered on door 451, with respect to the sides of door 451. In some embodiments, collapsible-locker 101 portion of package-receiving-locker 2200 should be attached to door 451 (e.g., via door-attachment-structure 3000) such that collapsible-locker 101 portion of package-receiving-locker 2200 is closer to hinge-side 461 and further away from non-hinge-side 459. See e.g., FIG. 14A through FIG. 14E and their respective discussion above, as why this positioning of collapsible-locker 101 may be important (e.g., allowing door 451 to open and close normally (i.e., door 451 be fully openable) even when a collapsible-locker 101 may be attached to the door 451).

In some embodiments, for doors 451 of widths from 28 inches to 36 inches, a ratio of "distance from SBL to hinge-side 3401" to "distance from SBL to non-hinge-side 3403" may be in a range of 0.0 to 0.8 (including endpoints), wherein in this range of ratios, door 451 may open normally even with the given package-receiving-locker 100/900/2200/3600 attached to door 451. See e.g., FIG. 34B. In some embodiments, this range of ratios may be with respect to a collapsible-locker 101 of package-receiving-locker 100/900/2200/3600 that may have a width and/or depth of 18 inches. In some embodiments, "distance from SBL to non-hinge-side 3403" may need to be ten inches or more for door 451 to open normally (i.e., door 451 be fully openable) even with the given package-receiving-locker 100/900/2200/3600 attached to door 451.

In some embodiments, in addition to collapsible-locker 101 positioning on door-outside 455 being asymmetrical, this positioning may also be fixed and secured, such that collapsible-locker 101 may not translate back and forth on door-outside 455. This may be accomplished by tightening between door-attachment-structures 151/3000 and rear-wall 119 (e.g., tightening a cam-lock 3101 against a PRL-engagement-rail 3013).

In some embodiments, when collapsible-locker 101 portion of package-receiving-locker 2200 may be attached to door 451, all portions of package-receiving-locker 2200 may be raised off of the ground/floor. In some embodiments, when collapsible-locker 101 portion of package-receiving-locker 2200 may be attached to door 451, no portion of package-receiving-locker 2200 may be touching the ground/floor. This may be important and may facilitate natural door 451 opening and closing, even when a given collapsible-locker 101 may be attached to that door 451. This may facilitate compliance with fire codes requiring unimpeded opening of access/entry doors. See e.g., FIG. 33A through FIG. 35A.

In some embodiments, when collapsible-locker 101 portion of package-receiving-locker 2200 may be attached to door 451, collapsible-locker 101 may be in its fully (substantially) collapsed configuration. See e.g., FIG. 33A through FIG. 33D.

In some embodiments, when collapsible-locker 101 portion of package-receiving-locker 2200 may be attached to door 451, collapsible-locker 101 may located on a bottom half of door 451. In some embodiments, when collapsible-locker 101 portion of package-receiving-locker 2200 may be attached to door 451, collapsible-locker 101 may not be touching the ground (aside from any wheels of collapsible-locker 101). In some embodiments, when collapsible-locker 101 portion of package-receiving-locker 2200 may be attached to door 451, walls of collapsible-locker 101 may not be touching the ground. In some embodiments, when collapsible-locker 101 portion of package-receiving-locker 2200 may be attached to door 451, there may be portions of door 451 above, below, and to either side of collapsible-locker 101 that are not covered by collapsible-locker 101.

In some embodiments, when collapsible-locker 101 portion of package-receiving-locker 2200 may be attached to door 451, lid 111 may be opened and/closed. In some embodiments, when collapsible-locker 101 portion of package-receiving-locker 2200 may be attached to door 451, objects may be inserted into or removed from collapsible-locker 101 through the single main access opening that lid 111 may control access to. See e.g., FIG. 34A through FIG. 34C.

FIG. 36A through FIG. 36G may depict a package-receiving-locker 3600, wherein this package-receiving-locker 3600 may be shown with its lid 111 closed and in the substantially (or fully) deployed (expanded) configuration. FIG. 36A may depict a front, right, top, perspective (isometric) view of package-receiving-locker 3600. FIG. 36B may depict a back (rear), left, top, perspective (isometric) view of package-receiving-locker 3600. FIG. 36C may depict a front view of package-receiving-locker 3600. FIG. 36D may depict a back (rear) view of package-receiving-locker 2200. (Note, FIG. 36D and FIG. 36C may be opposing views.) FIG. 36E may depict a top view of package-receiving-locker 3600. FIG. 36F may depict a bottom view of package-receiving-locker 3600. (Note, FIG. 36F and FIG. 36E may be opposing views.) FIG. 36G may depict a side view (left or right) of package-receiving-locker 3600. (Side views of package-receiving-locker 3600 may be substantially similar or identical.)

Package-receiving-locker 3600 may be an additional embodiment or alternative embodiment to package-receiving-locker 100 (and/or with respect to package-receiving-locker 900 and/or with respect to package-receiving-locker 2200). In some embodiments, package-receiving-locker 3600 may have substantially the same purposes of package-receiving-locker 100/900/2200. In some embodiments, package-receiving-locker 3600 may solve substantially the same problems of package-receiving-locker 100/900/2200. In some embodiments, package-receiving-locker 3600 may perform substantially similar to package-receiving-locker 100/900/2200. In some embodiments, package-receiving-locker 3600 may function substantially similar to package-receiving-locker 100/900/2200. In some embodiments, package-receiving-locker 3600 may be substantially similar to package-receiving-locker 100/900/2200 in terms of at least one of features, parts, components, geometries, structures, mechanics, operation, combinations thereof, and/or the like. Thus, figures showing package-receiving-locker 3600 (e.g., FIG. 36A through FIG. 36G) may show the same reference numerals as used with package-receiving-locker 100, to reference similar or the same features, parts, components, geometries, structures, mechanics, and/or operation. For example, and without limiting the scope of the present invention, in some embodiments, package-receiving-locker 3600 may comprise collapsible-locker 101. In some embodiments, collapsible-locker 101 may comprise lid 111, two opposing side-walls 105, front-wall 103, rear-wall 119, floor 121, and computing-device 1500. These components may be substantially as described above for package-receiving-locker 100.

However, there may be some differences between package-receiving-locker 100 and package-receiving-locker 3600, some of which may be noted and discussed below. For example, and without limiting the scope of the present invention, in some embodiments, package-receiving-locker 3600 may comprise: at least one rail 2203, at least one handle-pocket 3601, and/or at least one door-attachment-structure 3000.

In some embodiments, exterior portions of rear-wall 119 may comprise one or more rail(s) 2203 (see e.g., the above discussions of rail(s) 2203). See e.g., FIG. 36B and FIG. 36D. In some embodiments, rail(s) 2203 may be used to removably and slidingly engage with complimentary PRL-engagement-rail(s) 3013 of central-rail 3001.

In some embodiments, handle-pocket 3601 may be a pocket, cavity, and/or opening in an exterior of collapsible-locker 101 wherein handle 117 may be removably housed. In some embodiments, handle-pocket 3601 may be located on an upper portion of collapsible-locker 101. In some embodiments, handle-pocket 3601 may be located on a rear portion of collapsible-locker 101. In some embodiments, handle-pocket 3601 may be located on an upper rear portion of collapsible-locker 101. See e.g., FIG. 36B, FIG. 36D, and FIG. 36E. Note, some embodiments of package-receiving-locker 3600 may not utilize a handle-pocket 3601.

FIG. 37 may be a flow diagram showing steps of how a given package-receiving-locker 2200/3600 may be removably attached to a given door 451. In some embodiments, FIG. 37 may depict at least some steps of method 3700. In some embodiments, method 3700 may be a method of attaching the given package-receiving-locker 2200/3600 to the given door 451. In some embodiments, such attachment may of the given package-receiving-locker 2200/3600 to the given door 451 may be removable attachment. In some embodiments, method 3700 may also be supported by FIG. 26A through FIG. 30C and/or FIG. 32A through FIG. 35B. In some embodiments, method 3700 may comprise steps of: 1701, 3703, 3705, 1709, 1711, and 1713. In some embodiments, at least one of these steps may be optional.

Continuing discussing FIG. 37, in some embodiments, step 1701 may be a step of opening door 451. In some embodiments, removable attachment of package-receiving-locker 2200/3600 to door 451, may require door 451 to be at least partially open. In some embodiments, door 451 may need to be at least 30 degrees open from being closed to permit removable attachment of package-receiving-locker 2200/3600 to door 451. In some embodiments, door 451 may need to be at least 45 degrees open from being closed to permit removable attachment of package-receiving-locker 2200/3600 to door 451. In some embodiments, door 451 may need to be at least 60 degrees open from being closed to permit removable attachment of package-receiving-locker 2200/3600 to door 451. In some embodiments, door 451 may need to be at least 70 degrees open from being closed to permit removable attachment of package-receiving-locker 2200/3600 to door 451. In some embodiments, step 1701 may progress into step 3703.

Continuing discussing FIG. 37, in some embodiments, step 3703 may be a step of attaching central-rail 3001 to at least partially open door 451. In some embodiments, this may entail that the insertable-portions 3005 of the two opposing end-brackets 3003 are inserted into a respective end-bracket-receiving-slot 3011 of central-rail 3001. This may further entail placing the two door-thickness-engagement-portions 3007 of each end-bracket 3003 against a respective opposing side/edge/thickness of door 451, for example, as shown in FIG. 32A through FIG. 32D. Lastly, this may entail that the two opposing door-thickness-engagement-portions 3007 of each end-bracket 3003 squeeze against its respective opposing side/edge/thickness of door 451. This may be done by: (1) using strap 3021 to apply pressure to the two opposing door-thickness-engagement-portions 3007; and/or (2) nailing, screwing, bolting, and/or mechanically fastening the two opposing door-thickness-engagement-portions 3007 to their respective opposing side/edge/thickness of door 451; and/or (3) gluing the two opposing door-thickness-engagement-portions 3007 to their respective opposing side/edge/thickness of door 451; and/or (4) using a ratchet engagement between insertable-portions 3005 and end-bracket-receiving-slots 3011. In some embodiments, step 3703 may progress into step 3705.

Continuing discussing FIG. 37, in some embodiments, step 3705 may be a step of attaching collapsible-locker 101 (of package-receiving-locker 2200/3600) to PRL-engagement-rail(s) 3013 of central-rail 3001. In some embodiments, step 3705 may be a step of attaching collapsible-locker 101 to door-attachment-structure 3000. With door 451 at least partially open, this may be accomplished by sliding rail(s) 2203 of collapsible-locker 101 onto PRL-engagement-rail(s) 3013 of central-rail 3001. See e.g., FIG. 33D, FIG. 34C, FIG. 35A, and FIG. 35B. In some embodiments, proper completion of step 3705 may be when at least one rail 2203 may be entirely engaged by at least one PRL-engagement-rail(s) 3013. See e.g., FIG. 33A, FIG. 33B, FIG. 34A, and FIG. 34B. In some embodiments, step 3705 may progress into step 1709.

Continuing discussing FIG. 37, in some embodiments, step 1709 may be a step of determining is positional adjustment of package-receiving-locker 2200/3600 on door 451 may be needed or desired. In some embodiments, a correct position/location of package-receiving-locker 2200/3600 on door 451 may be shown in FIG. 14E, FIG. 33A, FIG. 33B, FIG. 34A, and FIG. 34B, with package-receiving-locker 2200/3600 located closer to hinge-side 461 than to non-hinge-side 459. If no adjustment of position/location of package-receiving-locker 2200/3600 on door 451 may be needed or desired, then step 1709 may progress into step 1713. If adjustment of position/location of package-receiving-locker 2200/3600 on door 451 may be needed or desired, then step 1709 may progress into step 1711.

Continuing discussing FIG. 37, in some embodiments, step 1713 may be a step of removably securing (e.g., tightening) the correctly positioned package-receiving-locker 2200/3600 onto door 451. In some embodiments, step 1713 may involve tightening cam-lock 3101 against at least one PRL-engagement-rail 3013, such rail(s) 2203 may longer freely slide along and against PRL-engagement-rail(s) 3013. In some embodiments, tightening (or loosening) a given cam-lock 3101 may require lid 111 to be at least partially open and to then engage with a rear/inside portion of the given cam-lock 3101.

Continuing discussing FIG. 37, in some embodiments, step 1711 may be a step of adjusting package-receiving-locker 2200/3600 on door 451 to a desired position/location. In some embodiments, adjustment step 1711 may involve sliding rail(s) 2203 along and against PRL-engagement-rail(s) 3013. In some embodiments, step 1711 may require loosening cam-lock 3101 to permit such sliding translation between rail(s) 2203 and PRL-engagement-rail(s) 3013. In some embodiments, step 1711 may progress back into step 1709.

In some embodiments, method 3700 may be carried out with collapsible-locker 101 deployed or collapsed.

In some embodiments, a given package-receiving-locker 100/900/2200/3600 may have two main subassemblies, its respective collapsible-locker 101 and its respective door-attachment-structure 151/3000. The given door-attachment-structure 151/3000 may be attachable (removably so in some embodiments) to the given package-receiving-locker 100/900/2200/3600. The given door-attachment-structure 151/3000 may be attachable (removably so in some embodiments) to the given door 451.

In some embodiments, the given door-attachment-structure 151/3000 may be slidingly adjustable such that an overall length of the given door-attachment-structure 151/3000 may be variable within a predetermined range, wherein the given door-attachment-structure 151/3000 may be configured for attachment to different side-hinged-doors 451 of fixed and predetermined widths. For example, and without limiting the scope of the present invention, when a door 451 may have a width of 36 inches, then the overall length the given door-attachment-structure 151/3000 (e.g., the lengths of central-rail 3001 and end-brackets 3003, when at least partially inserted into central-rail 3001) may greater and able to squeeze both opposing sides of door 451, with respect to the width of door 451.

In some embodiments, portions of door-attachment-structure 151/3000 may be that may be touching door 451, may have padding and/or the like, to protect door 451 from damage, such as, but not limited to, scratches and abrasion.

In some embodiments, the wall(s) of a given collapsible-locker 101, such as, but not limited to, front-wall 103, side-walls 105, rear-wall 119, floor 121, and/or lid 111, may be substantially non-tubular and/or substantially non-cylindrical.

Note, in some embodiments, lid 111 of a given collapsible-locker 101 may not be on the top of the given collapsible-locker 101. That is, in some embodiments, the main access opening to the interior of the given collapsible-locker 101 may be on a side of the given collapsible-locker 101, and in such embodiments, lid 111 may then be on a side of the given collapsible-locker 101.

Note, in some embodiments, lid 111 may be two or more separates lids to the main access opening of the given collapsible-locker 101.

In some embodiments, when a given collapsible-locker 101 may be in the substantially collapsed configuration or when the collapsible-locker 101 may be in the substantially expanded configuration, the at least one lid 111 may still be openable (which may however require the at least one lid 111 to first be unlocked). In some embodiments, when the side-hinged-door 451 may be open or closed, and regardless of collapsible-locker 101 configuration, the at least one lid 111 may be openable (which may however require the at least one lid 111 to first be unlocked).

In some embodiments, when the collapsible-locker 101 of a given package-receiving-locker 100/900/2200/3600 may be attached to door 451 (e.g., via door-attachment-structure 151/3000), no walls (e.g., rear-wall 119) of the collapsible-locker 101 may be physically touching door 451.

In some embodiments, the invention may be a system for a secure object storage location, wherein the system may comprise at least one package-receiving-locker 100/900/2200/3600 and the PRL/SBL Software.

In some embodiments, any of the hinges of a given package-receiving-locker 100/900/2200/3600 may be one or more of: a living hinge and/or an integral hinge; a torque hinge, a friction hinge, and/or a spring hinge.

In some embodiments, at least one of the hinges of a given package-receiving-locker 100/900/2200/3600 may be: a living hinge and/or an integral hinge; a torque hinge, a friction hinge, and/or a spring hinge.

In some embodiments, when package-receiving-locker 100/900/2200/3600 may be in its substantially (fully) deployed (expanded) configuration, no hinges of package-receiving-locker 100/900/2200/3600 may be visible from an exterior of package-receiving-locker 100/900/2200/3600. In some embodiments, when package-receiving-locker 100/900/2200/3600 may be in its substantially (fully) deployed (expanded) configuration, at least some portion of at least one hinge of package-receiving-locker 100/900/2200/3600 may be visible from an exterior of package-receiving-locker 100/900/2200/3600.

In some embodiments, any of the walls and/or panels of package-receiving-locker 100/900/2200/3600 may be substantially planar. In some embodiments, any of the walls and/or panels of package-receiving-locker 100/900/2200/3600 may be substantially flat. In some embodiments, any of the walls and/or panels of package-receiving-locker 100/900/2200/3600 may be substantially textured with one or more predetermined patterns. In some embodiments, any of the walls and/or panels of package-receiving-locker 100/900/2200/3600 may be ribbed for additional structural strength. In some embodiments, any of the walls and/or panels of package-receiving-locker 100/900/2200/3600 may be corrugated and/or undulating for additional structural strength. In some embodiments, any of the walls and/or panels of package-receiving-locker 100/900/2200/3600 may be firm, non-flexible, rigid, or semi-rigid. In some embodiments, any of the walls and/or panels of package-receiving-locker 100/900/2200/3600 may be a structural member. In some embodiments, any of the walls and/or panels of package-receiving-locker 100/900/2200/3600 may be substantially opaque. In some embodiments, any of the walls and/or panels of package-receiving-locker 100/900/2200/3600 may be substantially constructed from one or more of: a metal, a plastic, a wood, a laminate, a composite, a ceramic, combinations thereof, and/or the like. In some embodiments, any of the walls and/or panels of package-receiving-locker 100/900/2200/3600 may be substantially powder coated to partially powder coated. In some embodiments, any of the walls and/or panels of package-receiving-locker 100/900/2200/3600 may be substantially painted to partially painted.

In some embodiments, at least one of the walls and/or panels of package-receiving-locker 100/900/2200/3600 may be substantially planar. In some embodiments, at least one of the walls and/or panels of package-receiving-locker 100/900/2200/3600 may be substantially flat. In some embodiments, at least one of the walls and/or panels of package-receiving-locker 100/900/2200/3600 may be substantially textured with one or more predetermined patterns. In some embodiments, at least one of the walls and/or panels of package-receiving-locker 100/900/2200/3600 may be may be ribbed for additional structural strength. In some embodiments, at least one of the walls and/or panels of package-receiving-locker 100/900/2200/3600 may be firm, non-flexible, rigid to semi-rigid. In some embodiments, at least one of the walls and/or panels of package-receiving-locker 100/900/2200/3600 may be a structural member. In some embodiments, at least one of the walls and/or panels of package-receiving-locker 100/900/2200/3600 may be corrugated and/or undulating for additional structural strength. In some embodiments, at least one of the walls and/or panels of package-receiving-locker 100/900/2200/3600 may be substantially opaque. In some embodiments, at least one of the walls and/or panels of package-receiving-locker 100/900/2200/3600 may be substantially constructed from one or more of: a metal, a plastic, a wood, a laminate, a composite, a ceramic, combinations thereof, and/or the like. In some embodiments, at least one of the walls and/or panels of package-receiving-locker 100/900/2200/3600 may be substantially powder coated to partially powder coated. In some embodiments, at least one of the walls and/or panels of package-receiving-locker 100/900/2200/3600 may be substantially painted to partially painted.

In some embodiments, at least one of a bottom surface of the walls and/or of the panels of package-receiving-locker 100/900/2200/3600 may comprise one or more wheels, rollers, casters, sliding friction reducer, and/or the like.

In some embodiments, a given collapsible-locker 101 of package-receiving-locker 100/900/2200/3600 may have fixed and predetermined dimensions. For example, and without limiting the scope of the present invention, in some embodiments, a given collapsible-locker 101 of package-receiving-locker 100/900/2200/3600, in its substantially (fully) expanded/deployed configuration, may have dimensions of about: a one foot cube, a one and a half foot cube, a two foot cube, a two and a half foot cube, a three foot by 2 two foot rectangular prism, and/or the like, wherein "about" in this context may be plus or minus one inch.

Any plastics used as materials of construction may be one or more thermoplastics suitable for injection molding. For example, and without limiting the scope of the present invention, such plastics may be one or more of: acrylonitrile-butadiene styrene (ABS), polyvinyl chloride (PVC), polycarbonate, nylon, polypropylene, polyethylene (e.g., HDPE), with fillers or without fillers, and/or the like. Fillers may include, but may not be limited to, glass, carbon fiber, combinations thereof, and/or the like.

Note with respect to the materials of construction, it is not desired nor intended to thereby unnecessarily limit the present invention by reason of such disclosure.

In some embodiments, a given collapsible-locker 101 of package-receiving-locker 100/900/2200/3600 may be installed on doors, garage doors, roll-up doors, gates, walls, fences, and/or the like.

In some embodiments, a given collapsible-locker 101 of package-receiving-locker 100/900/2200/3600 may only exist in the fully expanded/deployed configuration, i.e., may not be collapsible.

Package-receiving-lockers (PRLs/SBLs) and their uses have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid and at least one locking-means; wherein the collapsible-container further comprises at least one lid that is hingedly attached to the at least one wall; wherein when the collapsible-container is in the substantially collapsed configuration, the at least one lid is lockable, by use of the at least one locking-means, to prevent unintended deployment of the collapsible-container into the substantially expanded configuration; and a door-attachment-structure; wherein at least a portion of the door-attachment-structure is attached to the at least one wall of the collapsible-container; and other different portions of the door-attachment-structure are attached to the side-hinged-door;

wherein when the collapsible-container is in the substantially expanded configuration the collapsible-container has a main interior volume that is substantially void space for the temporary storage of the object.

2. The package-receiving-locker of claim 1, wherein the collapsible-container has only a single main opening for accessing the main interior volume of the collapsible-container, wherein the object enters and leaves the collapsible-container via the single main opening.

3. The package-receiving-locker of claim 2, wherein access to the single main opening is controlled by the at least one lid, wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

4. The package-receiving-locker of claim 1, wherein when the collapsible-container is in the substantially collapsed configuration or when the collapsible-container is in the substantially expanded configuration, the at least one lid is openable.

5. The package-receiving-locker of claim 1, wherein when the package-receiving-locker is removably attached to the side-hinged-door and wherein when the side-hinged-door is open or closed, the at least one lid is openable.

6. The package-receiving-locker of claim 1, wherein the attachment between the side-hinged-door and the other different portions of the door-attachment-structure are removable attachment.

7. The package-receiving-locker of claim 1, wherein the attachment between the at least the portion of the door-attachment-structure and the at least one wall of the collapsible-container is removable attachment.

8. The package-receiving-locker of claim 1, wherein when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

9. The package-receiving-locker of claim 1, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

10. The package-receiving-locker of claim 1, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

11. The package-receiving-locker of claim 1, wherein the collapsible-container is removably separable from the side-hinged-door such that when the collapsible-container is not attached to the side-hinged-door and the collapsible-container is in the substantially collapsed configuration, the collapsible-container is removably storable behind the side-hinged-door or behind another side-hinged-door.

12. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid; wherein the at least one wall comprises: at least one rear-wall, at least one front-wall, at least two opposing side-walls, at least one floor, and at least one lid; wherein the at least one rear-wall, the at least one front-wall, the at least two opposing side-walls, the at least one floor, and the at least one lid all together substantially bound and enclose a main interior volume of the collapsible-container; wherein the at least one rear-wall is hingedly attached to: the at least one lid, the at least two opposing-side-walls, and the at the least one floor; wherein the at least one front-wall is hingedly attached to the at least two opposing-side-walls; and a door-attachment-structure; wherein at least a portion of the door-attachment-structure is attached to the at least one wall of the collapsible-container; and other different portions of the door-attachment-structure are attached to the side-hinged-door;

wherein when the collapsible-container is in the substantially expanded configuration, the main interior volume is substantially void space for the temporary storage of the object.

13. The package-receiving-locker of claim 12, wherein the collapsible-container has only a single main opening for accessing the main interior volume of the collapsible-container, wherein the object enters and leaves the collapsible-container via the single main opening.

14. The package-receiving-locker of claim 13, wherein the collapsible-container comprises at least one locking-means, wherein access to the single main opening is controlled by the at least one lid; wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

15. The package-receiving-locker of claim 12, wherein when the collapsible-container is in the substantially collapsed configuration or when the collapsible-container is in the substantially expanded configuration, the at least one lid is openable.

16. The package-receiving-locker of claim 12, wherein when the package-receiving-locker is removably attached to the side-hinged-door and wherein when the side-hinged-door is open or closed, the at least one lid is openable.

17. The package-receiving-locker of claim 12, wherein the attachment between the side-hinged-door and the other different portions of the door-attachment-structure are removable attachment.

18. The package-receiving-locker of claim 12, wherein the attachment between the at least the portion of the door-attachment-structure and the at least one wall of the collapsible-container is removable attachment.

19. The package-receiving-locker of claim 12, wherein when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

20. The package-receiving-locker of claim 12, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

21. The package-receiving-locker of claim 12, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

22. The package-receiving-locker of claim 12, wherein the collapsible-container is removably separable from the side-hinged-door such that when the collapsible-container is not attached to the side-hinged-door and the collapsible-container is in the substantially collapsed configuration, the collapsible-container is removably storable behind the side-hinged-door or behind another side-hinged-door.

23. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid; and a door-attachment-structure; wherein at least a portion of the door-attachment-structure is attached to the at least one wall of the collapsible-container; and other different portions of the door-attachment-structure are attached to the side-hinged-door; wherein the other different portions of the door-attachment-structure comprises at least two opposing panels that extend beyond opposing sides of the collapsible-container, wherein the at least two opposing panels are configured for engaging opposing sides, by width, of the side-hinged door;

wherein when the collapsible-container is in the substantially expanded configuration the collapsible-container has a main interior volume that is substantially void space for the temporary storage of the object.

24. The package-receiving-locker of claim 23, wherein the collapsible-container has only a single main opening for accessing the main interior volume of the collapsible-container, wherein the object enters and leaves the collapsible-container via the single main opening.

25. The package-receiving-locker of claim 24, wherein the collapsible-container comprises at least one lid and at least one locking-means; wherein access to the single main opening is controlled by the at least one lid; wherein the at least one lid is hingedly attached to the at least one wall; wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

26. The package-receiving-locker of claim 23, wherein the collapsible-container comprises at least one lid that is hingedly attached to the at least one wall; wherein when the collapsible-container is in the substantially collapsed configuration or when the collapsible-container is in the substantially expanded configuration, the at least one lid is openable.

27. The package-receiving-locker of claim 23, wherein the collapsible-container comprises at least one lid that is hingedly attached to the at least one wall; wherein when the package-receiving-locker is removably attached to the side-hinged-door and wherein when the side-hinged-door is open or closed, the at least one lid is openable.

28. The package-receiving-locker of claim 23, wherein the attachment between the side-hinged-door and the other different portions of the door-attachment-structure are removable attachment.

29. The package-receiving-locker of claim 23, wherein the attachment between the at least the portion of the door-attachment-structure and the at least one wall of the collapsible-container is removable attachment.

30. The package-receiving-locker of claim 23, when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

31. The package-receiving-locker of claim 23, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

32. The package-receiving-locker of claim 23, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

33. The package-receiving-locker of claim 23, wherein the collapsible-container is removably separable from the side-hinged-door such that collapsible-container is not attached to the side-hinged-door; wherein when the when the collapsible-container is in the substantially collapsed configuration, the collapsible-container is removably storable behind the side-hinged-door or behind another side-hinged-door.

34. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid; and a door-attachment-structure; wherein at least a portion of the door-attachment-structure is attached to the at least one wall of the collapsible-container; and other different portions of the door-attachment-structure are attached to the side-hinged-door; wherein the door-attachment-structure is slidingly adjustable such that an overall length of the door-attachment-structure is variable within a predetermined range, wherein the door-attachment-structure is configured for attachment to different side-hinged-doors of fixed and predetermined widths;

wherein when the collapsible-container is in the substantially expanded configuration the collapsible-container has a main interior volume that is substantially void space for the temporary storage of the object.

35. The package-receiving-locker of claim 34, wherein the collapsible-container has only a single main opening for accessing the main interior volume of the collapsible-container, wherein the object enters and leaves the collapsible-container via the single main opening.

36. The package-receiving-locker of claim 35, wherein the collapsible-container comprises at least one lid and at least one locking-means; wherein access to the single main opening is controlled by the at least one lid; wherein the at least one lid is hingedly attached to the at least one wall; wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

37. The package-receiving-locker of claim 34, wherein the collapsible-container comprises at least one lid that is hingedly attached to the at least one wall; wherein when the collapsible-container is in the substantially collapsed configuration or when the collapsible-container is in the substantially expanded configuration, the at least one lid is openable.

38. The package-receiving-locker of claim 34, wherein the collapsible-container comprises at least one lid that is hingedly attached to the at least one wall; wherein when the package-receiving-locker is removably attached to the side-hinged-door and wherein when the side-hinged-door is open or closed, the at least one lid is openable.

39. The package-receiving-locker of claim 34, wherein the attachment between the side-hinged-door and the other different portions of the door-attachment-structure are removable attachment.

40. The package-receiving-locker of claim 34, wherein the attachment between the at least the portion of the door-attachment-structure and the at least one wall of the collapsible-container is removable attachment.

41. The package-receiving-locker of claim 34, wherein when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

42. The package-receiving-locker of claim 34, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

43. The package-receiving-locker of claim 34, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

44. The package-receiving-locker of claim 34, wherein the collapsible-container is removably separable from the side-hinged-door such that when the collapsible-container is not attached to the side-hinged-door and the collapsible-container is in the substantially collapsed configuration, the collapsible-container is removably storable behind the side-hinged-door or behind another side-hinged-door.

45. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid; and a door-attachment-structure; wherein at least a portion of the door-attachment-structure is attached to the at least one wall of the collapsible-container; and other different portions of the door-attachment-structure are attached to the side-hinged-door; wherein the door-attachment-structure engages both opposing sides of the side-hinged-door, with respect to a width of the side-hinged-door; and wherein the door-attachment-structure also engages a bottom of the side-hinged-door;

wherein when the collapsible-container is in the substantially expanded configuration the collapsible-container has a main interior volume that is substantially void space for the temporary storage of the object.

46. The package-receiving-locker of claim 45, wherein the collapsible-container has only a single main opening for accessing the main interior volume of the collapsible-container, wherein the object enters and leaves the collapsible-container via the single main opening.

47. The package-receiving-locker of claim 46, wherein the collapsible-container comprises at least one lid and at least one locking-means; wherein access to the single main opening is controlled by the at least one lid; wherein the at least one lid is hingedly attached to the at least one wall; wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

48. The package-receiving-locker of claim 45, wherein the collapsible-container comprises at least one lid that is hingedly attached to the at least one wall; wherein when the collapsible-container is in the substantially collapsed configuration or when the collapsible-container is in the substantially expanded configuration, the at least one lid is openable.

49. The package-receiving-locker of claim 45, wherein the collapsible-container comprises at least one lid that is hingedly attached to the at least one wall; wherein when the package-receiving-locker is removably attached to the side-hinged-door and wherein when the side-hinged-door is open or closed, the at least one lid is openable.

50. The package-receiving-locker of claim 45, wherein the attachment between the side-hinged-door and the other different portions of the door-attachment-structure are removable attachment.

51. The package-receiving-locker of claim 45, wherein the attachment between the at least the portion of the door-attachment-structure and the at least one wall of the collapsible-container is removable attachment.

52. The package-receiving-locker of claim 45, wherein when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

53. The package-receiving-locker of claim 45, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

54. The package-receiving-locker of claim 45, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

55. The package-receiving-locker of claim 45, wherein the collapsible-container is removably separable from the side-hinged-door such that when the collapsible-container is not attached to the side-hinged-door and the collapsible-container is in the substantially collapsed configuration, the collapsible-container is removably storable behind the side-hinged-door or behind another side-hinged-door.

56. A package-receiving-locker for temporary storage of an object, wherein the package-receiving-locker is attachable to a side-hinged-door; wherein the package-receiving-locker comprises:

a collapsible-container that exists in two operational configurations, a substantially collapsed configuration and a substantially expanded configuration, respectively, wherein the collapsible-container comprises at least one wall that is rigid; and a door-attachment-structure; wherein at least a portion of the door-attachment-structure is attached to the at least one wall of the collapsible-container; and other different portions of the door-attachment-structure are attached to the side-hinged-door; wherein the door-attachment-structure comprises a central-rail and two opposing end-brackets; wherein the two opposing end-brackets are located at opposing ends of the central-rail; wherein the at least the portion of the door-attachment-structure that is attached to the at least one wall is located on the central-rail; and wherein the other different portions of the door-attachment-structure that is attached to the side-hinged-door are located on the two opposing end-brackets;

wherein when the collapsible-container is in the substantially expanded configuration the collapsible-container has a main interior volume that is substantially void space for the temporary storage of the object.

57. The package-receiving-locker of claim 56, wherein the collapsible-container has only a single main opening for accessing the main interior volume of the collapsible-container, wherein the object enters and leaves the collapsible-container via the single main opening.

58. The package-receiving-locker of claim 57, wherein the collapsible-container comprises at least one lid and at least one locking-means; wherein access to the single main opening is controlled by the at least one lid; wherein the at least one lid is hingedly attached to the at least one wall; wherein the at least one lid exists in two operational configurations, a closed configuration and a substantially open configuration, respectively; wherein when the at least one lid is in the closed configuration, the at least one lid is lockable, by use of the at least one locking-means, to prevent unintended access to the single main opening.

59. The package-receiving-locker of claim 56, wherein the collapsible-container comprises at least one lid that is hingedly attached to the at least one wall; wherein when the collapsible-container is in the substantially collapsed configuration or when the collapsible-container is in the substantially expanded configuration, the at least one lid is openable.

60. The package-receiving-locker of claim 56, wherein the collapsible-container comprises at least one lid that is hingedly attached to the at least one wall; wherein when the package-receiving-locker is removably attached to the side-hinged-door and wherein when the side-hinged-door is open or closed, the at least one lid is openable.

61. The package-receiving-locker of claim 56, wherein the attachment between the side-hinged-door and the other different portions of the door-attachment-structure are removable attachment.

62. The package-receiving-locker of claim 56, wherein the attachment between the at least the portion of the door-attachment-structure and the at least one wall of the collapsible-container is removable attachment.

63. The package-receiving-locker of claim 56, wherein when the collapsible-container is attached to the side-hinged-door via the door-attachment-structure, no walls of the collapsible-container, including the at least one wall, physically touch the side-hinged-door; wherein the walls of the collapsible-container substantially enclose and bound the main interior volume.

64. The package-receiving-locker of claim 56, wherein when the collapsible-container is attached to the side-hinged-door via the door-attachment-structure, the attachment is fixed and asymmetrically positioned, such that the collapsible-container is closer to a hinge-side of the side-hinged-door and farther away from an opposing non-hinged-side of the side-hinged-door; wherein the side-hinged-door remains fully openable.

65. The package-receiving-locker of claim 56, wherein the two opposing end-brackets are configured to engage and squeeze opposing sides of the side-hinged-door.

66. The package-receiving-locker of claim 56, wherein the two opposing end-brackets and the central-rail are rigid.

67. The package-receiving-locker of claim 56, wherein the collapsible-container comprises at least two cameras, an exterior camera and an interior camera, respectively; wherein an opening to the exterior camera is located on an exterior surface of the collapsible-container; wherein the exterior camera is positioned and oriented to monitor a predetermined zone that is external of the collapsible-container; wherein an opening to the interior camera is located on an interior surface of the collapsible-container that at least partially bounds the main interior volume when the collapsible-container is in the substantially expanded configuration; and wherein the interior camera is positioned and oriented to monitor the main interior volume of the collapsible-container.

68. The package-receiving-locker of claim 56, wherein the collapsible-container is removably separable from the side-hinged-door such that when the collapsible-container is not attached to the side-hinged-door and the collapsible-container is in the substantially collapsed configuration the collapsible-container is removably storable behind the side-hinged-door or behind another side-hinged-door.

* * * * *